United States Patent [19]

Nishijima et al.

[11] Patent Number: 5,017,464

[45] **Date of Patent: * May 21, 1991**

[54] SILVER HALIDE LIGHT-SENSITIVE PHOTOGRAPHIC MATERIAL HAVING IMPROVED LIGHT FASTNESS

[75] Inventors: Toyoki Nishijima; Kaoru Onodera, both of Odawara, Japan

[73] Assignee: Konica Corporation, Tokyo, Japan

[ * ] Notice: The portion of the term of this patent subsequent to Jun. 23, 2004 has been disclaimed.

[21] Appl. No.: 483,336

[22] Filed: Feb. 20, 1990

Related U.S. Application Data

[63] Continuation of Ser. No. 220,910, Jul. 19, 1988, abandoned, which is a continuation of Ser. No. 9,994, Feb. 2, 1987, abandoned.

[30] Foreign Application Priority Data

Feb. 6, 1986 [JP] Japan ..... 61-24888
Feb. 7, 1986 [JP] Japan ..... 61-25521

[51] Int. Cl.[5] ..... G03C 1/34

[52] U.S. Cl. ..... 430/551; 430/558; 430/607; 430/613

[58] Field of Search ..... 430/551, 558, 372, 386, 430/387, 613, 607

[56] References Cited

U.S. PATENT DOCUMENTS

| | | | |
|---|---|---|---|
| 2,403,721 | 7/1946 | Jelley et al. | 430/523 |
| 4,346,165 | 8/1982 | Sawada et al. | 430/372 |
| 4,588,679 | 5/1986 | Furutachi | 430/551 |
| 4,590,153 | 5/1986 | Kawagishi et al. | 430/551 |
| 4,622,287 | 11/1986 | Umemoto et al. | 430/505 |
| 4,675,275 | 6/1987 | Nishijima et al. | 430/372 |
| 4,906,559 | 3/1990 | Nishijima et al. | 430/551 |

FOREIGN PATENT DOCUMENTS

| | | | |
|---|---|---|---|
| 0203465 | 6/1986 | European Pat. Off. . | |
| 0187521 | 7/1986 | European Pat. Off. . | |
| 0203746 | 12/1986 | European Pat. Off. | 430/386 |

*Primary Examiner*—Charles L. Bowers, Jr.
*Assistant Examiner*—Lee C. Wright
*Attorney, Agent, or Firm*—Jordan B. Bierman; Bierman and Muserlian

[57] ABSTRACT

A light-sensitive silver halide photographic material comprising a support having provided thereon at least one silver halide emulsion layer, wherein the silver halide emulsion layer contains a compound represented by General Formula [I];

[I]

(wherein Z represents a group of non-metallic atoms necessary to complete a nitrogen-containing heterocyclic ring which may have a substituent; X represents a hydrogen atom or a releasing group; and R represents a hydrogen atom or a substituent), the silver halide emulsion layer containing the compound of Formula [I] further containing a metal complex having a quenching rate constant of singled oxygen more than $3\times10^7\ M^{-1}$, $sec^{-1}$, and a compound having the General Formula [a-1] or [a-2];

[a-1]

(wherein $R^1$ and $R^2$ are independently an alkyl group; $R^3$ is an alkyl group; a —NR'R" group, a —SR' group or a —COOR" group, in which R' is a monovalent organic group and R" is a hydrogen atom or a monovalent organic group; and m is 0 to 3); or

[a-2]

pos (wherein $R^4$ is a hydrogen atom, a hydroxyl group, an oxy radical group, —SOR' group, in which R' is a monovalent organic group, or a —$SO_2R$" group, in which R" is a hydrogen atom or a monovalent organic group; $R^5$, $R^6$, $R^{5'}$, $R^{6'}$, and $R^9$ are independently an alkyl group; $R^7$ and $R^8$ are independently a hydrogen atom or a —$OCOR^{10}$ group, in which $R^{10}$ is a monovalent organic group, provided that $R^7$ and $R^8$ may be combined to form a heterocyclic group; and n is 0 to 4).

14 Claims, No Drawings

SILVER HALIDE LIGHT-SENSITIVE PHOTOGRAPHIC MATERIAL HAVING IMPROVED LIGHT FASTNESS

This application is a continuation of application Ser. No. 220,910, filed July 19, 1988, now abandoned, which is a continuation of application Ser. No. 009,994 filed Feb. 2, 1987, now abandoned.

FIELD OF THE INVENTION

The present invention relates to a light-sensitive silver halide photographic material, in particular to a light-sensitive silver halide material for color photography that is provided with improved image stability to light.

BACKGROUND OF THE INVENTION

A conventional method of forming color images using a light-sensitive silver halide photographic material is based on reaction of a photographic coupler with the oxidant of a color developing agent. The typical photographic couplers used for color reproduction include magenta, yellow and cyan. The typical color developing agents used include aromatic primary amines. Dyes such as azomethine dyes are formed through reaction of dye-forming couplers such as magenta- or yellow-dye-forming coupler with an oxidant of aromatic primary amine color developing agent. Dyes such as indoaniline dyes are produced through reaction of the cyan coupler with an oxidant of the aromatic primary amine color developing agent.

Among these dyes 5-pyrazolone, cyanoacetophenone, indazolone, pyrazolobenzimidazole, pyrazolotriazole couplers are used to form magenta dye images.

In the past, the 5-pyrazolone coupler has been practically used mainly as the magenta dye image-forming coupler. The dye images formed from the 5-pyrazolone coupler are highly resistant to light and heat, while its color tone is not sufficient. Further, dyes of this class have an unnecessary spectrum absorption near 430 nm and the absorption spectrum of visible light near 550 nm is broad, which causes color turbidity, resulting in less clear photographic images.

As the couplers providing no such unnecessary absorption, there have been known 1H-pyrazolo [3,2-c]-s-triazole type couplers, 1H-imidazo [1,2-b]-pyrazole type couplers, 1H-b pyrazolo [1,5-b]-pyrazole type couplers, and 1H-b pyrazolo [1,5-d] tetrazole type couplers, which are disclosed in U.S. Pat. No. 3,725,067, Japanese Patent Publication Open to Public Inspection No. 162548/1984, and Japanese Patent Publication Open to Public Inspection No. 171956/1984.

The light stability of the color images formed by these couplers, however, is very low and, therefore, it has been considered in the art that the use of such couplers for light-sensitive material especially for color photographic papers which are subject to direct appreciation, does not meet critical requirements of recording and preserving the original image. This has prevented the couplers from being used practically.

To improve light resistance, use of phenol compounds or phenyl ether compound as anti-oxidants has been proposed, for example, in Japanese Patent Publication Open to Public Inspection (hereinafter referred to as Japanese Patent O.P.I. Publication) No. 125732/1984 This, however, has provided no sufficient effects.

On the other hand, use of a metal complex as the antifading agent has been presented in Japanese Patent O.P.I. Publications No. 99340/1981, 168652/1981 and 51834/1985. Application of the metal complex to dyes from certain class of pyrazolotriazole couplers can improve the light resistance, however, compounds providing relatively high light resistance, are often accompanied by such a disadvantage that non-exposed samples tend to result in increased fog with the lapse of time. Some compounds obtained from a metal complex, which cause less foggind during storage do not provide sufficient resistivity to light.

Thus it has been difficult to improve light resistivity of light-sensitive silver halide photographic materials while keeping resistance against fogging during storage when a pyrazolotriazole system magenta coupler and a metal complex are used in combination.

SUMMARY OF THE INVENTION

A primary object of the present invention is to provide a light-sensitive silver halide photographic material that is excellent in color reproducibility of magenta dye image and in image fastness against light with decreased fogging during storage of raw samples.

The object of the present invention can be achieved by: a light-sensitive silver halide photographic material comprising a support and provided thereon at least one silver halide emulsion layer, wherein at least one layer of said silver halide emulsion layer contains a compound represented by general formula [I],

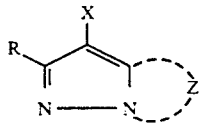

[I]

(wherein Z represents a group of non-metallic atoms necessary to complete a nitrogen-containing heterocyclic ring which may have a substituent; X represents a hydrogen atom or a substituent capable of being split off upon reaction with an oxidation product of a color developing agent; and R represents a hydrogen atom or a substituent), said silver halide emulsion layer containing the compound of formula [I] further containing a metal complex having a quenching rate constant of singlet oxygen more than $3\times10^7$ $M^{-1}$ $sec^{-1}$, and a compound having the general formula [a-1],

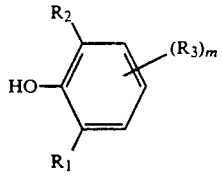

[a-1]

(wherein $R^1$ and $R^2$ are independently selected from an alkyl group; $R^3$ is selected from the group consisting of an alkyl group, a —NR'R" group, a —SR' group and a —COOR" group, in which R' is a mono-valent organic group and R" is a hydrogen atom or a mono-valent organic group; and m is an integer of 0 to 3);

or a compound having the general formula [a-2], [a-2]

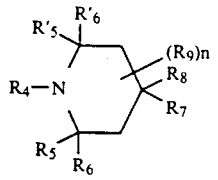

[a-2]

(wherein $R^4$ is selected from the consisting of hydrogen atom, a hydroxyl group, an oxy radical group, —SOR′ group, in which R′ is a mono-valent organic group, a —$SO_2R''$ group, in which R″ is a hydrogen atom or a mono-valent organic group; $R^5$, $R^6$, $R^{5}40$ , $R^{6'}$ and $R^9$ are independently selected from an alkyl group; $R^7$ and $R^8$ are independently selected from the group consisting of a hydrogen atom and a —$OCOR^{10}$ group, in which $R^{10}$ is a mono-valent organic group, provided that $R^7$ and $R^8$ may be combined with each other to form a heterocyclic group; and n is an integer of 0 to 4).

DETAILED DESCRIPTION OF THE INVENTION

The present invention is explained more in detail with reference to preferred embodiments:

In formula [I], the substituent represented by R includes a halogen atom , an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro-compound residual group, a bridged hydrocarbon compound residual group, an alkoxy group, an aryloxy group, a heterocyclic oxy group, a siloxy group, an acyloxy group, a carbomoyloxy group, an amino group, an acylamino group, a sulfonamide group, an imide group, an ureide group, a sulfamoyl amino group, an alkoxy carbonyl amino group, an aryloxy carbonyl amino group, an alkoxy carbonyl group, an aryloxy carbonyl group, an alkyl thio group, an aryl thio group, and a heterocyclic thio group.

The preferable halogen atoms are chlorine and bromine, and chlorine is most preferable.

The alkyl group represented by R is preferably one containing 1 thru 32 carbon atoms; the alkenyl and alkenyl groups are preferably ones containing 2 thru 32 carbon atoms; the cycloalkyl and cycloalkenyl groups are preferably ones containing 3 thru 12 carbon atoms, in particular 5 thru 7 carbon atoms; and the alkyl, alkenyl and alkynyl groups may be of straight-chained or of branched.

The alkyl, alkenyl, alkynyl, cycloalkyl, and/or cycloalkenyl groups may contain substituents e.g., aryl, cyano, halogen atoms, heterocyclic rings, cycloalkyl, cycloalkenyl, spiro-compound residues and bridged hydrocarbon compound residues, as well as substituents substituted via a carbonyl group such as acyl, carboxyl, carbamoyl, alkoxy carbonyl and aryloxy carbonyl, and substituents substituted via hetero atoms {such as substituents substituted via oxygen atoms including hydroxy, alkoxy, aryloxy, hetero ring oxy, siloxy, acyloxy and carbamoyloxy, substituents substituted via nitrogen atoms including nitro, amino (including di-alkyl amino), sulfamoyl amino, alkoxy carbonyl amino, aryloxy carbonyl amino, acyl amino, sulfon amide, imide and ureide, substituents substituted via sulfur atoms including alkyl thio, aryl thio, heterocyclic thio, sulfonyl, sulfinyl and sulfamoyl, and substituents substituted via phosphorus atoms including phosphonyl}].

The groups used practically include a methyl group, an ethyl group, an isopropyl group, a t-butyl group, a pentadecyl group, a heptadecyl group, a 1-hexyl nonyl group, a 1,1′-dipentyl nonyl group, a 2-chlor-t-butyl group, a trifluoromethyl group, a lethoxy tridecyl group, a 1-methoxy isopropyl group, a methane sulfonyl ethyl group, a 2,4-di-t-amyl phenoxy methyl group, an anilino group, a 1-phenyl isopropyl group, a 3-m-group, butane sulfon amini phenoxy propyl group, a 3-4′-{alpha-[4″ (p-hydroxy benzene sulfonyl) phenoxy) dodecanoyl amino} phenyl propyl group, a 3-{4′-[alpha-(2″,4″-di-t-amyl phenoxy) butane amide] phenyl}-propyl group, a 4-[alpha-(ochlor phenoxy) tetra decane amide phenoxy] propyl group, an aryl group, a cyclopentyl group, and a cyclohexyl group.

The aryl group represented by R is preferably a phenyl group, which may contain substituents (e.g., an alkyl group, an alkoxy group, and an acyl amino group).

The aryl group practically used includes a phenyl group, a 4-t-butyl phenyl group, a 2,4-di-t-amyl phenyl group, a 4-tetradecane amide phenyl group, a hexa di-siloxy phenyl group, and a 4′-alpha-(4″-t-butyl phenoxy) tetradecane amide]phenyl group.

The heterocyclic group represented by R should preferably contain 5 thru 7 members that may have been replaced or condensed. The heterocyclic group practically used includes 2-furyl, 2-thienyl, 2-pyrimidinyl, and 2-benzothiazolyl groups.

The acyl group represented by R includes, e.g., an alkyl carbonyl group such as acetyl, phenyl acetyl, dedecanoyl and alpha-2,4-di-t-amylphenoxy butanoyl groups, and an aryl carbonyl group such as benzoyl, 3-pentadecyl oxy benzoyl and p-chlorbenzoyl groups.

The sulfonyl group represented by R includes an alkyl sulfonyl group such as methyl sufonyl and dodecyl sulfonyl groups, and an aryl sufonyl group such as benzen sulfonyl and p-toluene sulfonyl groups.

The sulfinyl group represented by R includes an alkyl sulfinyl group such as ethyl sulfinyl, octyl sulfinyl and 3-phenoxy butyl sulfinyl groups, and an aryl sulfinyl group such as phenyl sulfinyl and m-pentadecyl phenyl sulfinyl groups.

The phosphonyl group represented by R includes an alkyl phosphonyl group such as a butyl octyl phosphonyl group, an alkoxy phosphonyl group such as an octyloxy phosphonyl group, an aryloxy phosphonyl group such as a phenoxy phosphonyl group, and an aryl phosphonyl group such as a phenyl phosphonyl group.

The carbamoyl group represented by R, which may have been replaced by an alkyl group or an aryl group (preferably a phenyl group), includes, e.g., N-methyl carbamoyl, N,N-dibutyl carbamoyl, N-(2-pentadecyl octyl ethyl) carbamoyl, N-ethyl-N-dodecyl carbamoyl, and N-{3-(2,4-di-t-amyl phenoxy) propyl} carbamoyl groups.

The sulfamoyl group represented by R, which may have been replaced by an alkyl group or an aryl group (preferably a phenyl group), includes, e.g., N-propyl sulfamoyl, N,N-diethyl sulfamoyl, N-(2-penta decyl oxy-ethyl) sulfamoyl, N-ethyl-N-dodecyl sulfamoyl, and N-phenyl sulfamoyl groups.

The spiro-compound residue represented by R includes, e.g., spiro [3.3] heptan-1-il.

The bridged hydrocarbon compound residue represented by R includes, e.g., bicyclo[2.2.1]heptane-1-il.

tricyclo [3.3.1.1$^{3,7}$]decane-1-il, and 7,7-dimethyl-bicyclo[2.2.1] heptane-1-il.

The alkoxy group represented by R, which may have replaced substituents for the alkyl group set forth above, includes, e.g., methoxy, propoxy, 2-ethoxy, pentadecyloxy, 2-dodecyloxy ethoxy, and phenethyloxy ethoxy groups.

The aryloxy group represented by R includes, e.g., phenoxy, p-t-butyl phenoxy, and m-pentadecyl phenoxy groups. In that case, the aryl nucleus may have been replaced by substituents or atoms set forth above for the aryl group.

The heterocyclic oxy group represented by R, which should be preferably a one containing a hetero ring having 5 thru 7 members that may have a substituent, includes, e.g., 3,4,5,6-tetra-hydropiranyl-2-oxy and 1-phenyl tetrasol-5-oxy groups.

The siloxy group represented by R, which may have been replaced by an alkyl group, etc., includes trimethyl siloxy, tri-ethyl siloxy and di-methyl butyl siloxy groups.

The acyloxy group represented by R, which may contain substituents, includes, e.g., alkyl carbonyloxy and aryl carbonyloxy groups. Practically, acetyloxy, alpha-chloracetyloxy and benzoyloxy groups can be used.

The carbamoyloxy group represented by R, which may have been replaced by alkyl and/or aryl groups, includes, e.g., N-ethyl carbamoyloxy, N,N-di-ethyl carbamoyloxy, and N-phenyl carbamoyloxy groups.

The amino group represented by R, which may have been replaced by an alkyl group or an aryl group (preferably a phenyl group), includes, e.g., ethyl amino, anilino, m-chloranilino, 3-pentadecyloxy carbonyl anilino, and 2-chlor-5-hexadecane amide anilino groups.

The acyl amino group represented by R, which may have substituents, includes, e.g., alkyl carbonyl amino and aryl carbonyl amino groups (preferably a phenyl carbonyl amino group). Used practically are acetoamide, alpha-ethyl propane amide, N-phenyl acetoamide, dodecane amide, 2,4-di-amyl phenoxy acetoamide, and alpha-3-t-butyl 4-hydroxy phenoxy butane amide groups.

The sulfon amide group represented by R, which may have substituents, includes alkyl sulfonyl amino and aryl sulfonyl amino groups. Used practically are methyl sulfonyl amino, pentadecyl sulfonyl amino, benzene sulfon amide, p-toluene sulfon amide, and 2-methoxy-5-t-amyl benzene sulfon amide groups.

The imide group represented by R, which may be of ah open chain or ring and have substituents, includes, e.g., succinic acid imide, 3-heptadecyl succinic acide imide, phthalimide, and glutaric imide groups.

The ureido group represented by .R, which may have been replaced by an alkyl group and/or an aryl group (preferably a phenyl group), includes, e.g., N-ethyl ureido, N-methyl-N-decyl ureido, N-phenyl ureido, and N-p-tri-ureido groups.

The sulfamoyl amino group represented by R, which may have been replaced by an alkyl group and/or an aryl group (preferably a phenyl group), includes, e.g., N,N-di-butyl sulfamoyl amino, N-methyl sulfamoyl amino, and N-phenyl sulfamoyl amino groups.

The alkoxy carbonyl amino group represented by R, which may have substituents, includes, e.g., methoxy carbonyl amino, methoxy ethoxy carbonyl amino, and octadecyloxy carbonyl amino groups.

The aryloxy carbonyl amino group, which may have substituents, includes, e.g., phenoxy carbonyl amoni and 4-methyl phenoxy carbonyl amino groups.

The alkoxy carbonyl group represented by R, which may have further substituents, includes, e.g., methoxy carbonyl, butyloxy carbonyl, dodecyloxy carbonyl, octadecyloxy carbonyl, ethoxy methoxy carbonyloxy, and benzyloxy carbonyl groups.

The aryloxy carbonyl group represented by R, which may have further substituents, includes, e.g., phenoxy carbohyl, p-chloro-phenoxy carbonyl, and m-penta decyloxy phenoxy carbonyl groups.

The alkylthio group represented by R, which may have further substgituents, includes, e.g., ethylthio, dodecylthio, octa-decylthio, phenethylthio, and 4-phenoxy propylthio groups.

The arylthio group represented by R, which may have further substituents, should be preferably a phenylthio group including p-methoxy phenylthio, 2-t-octyl phenylthio, 3-octadecyl phenylthio, 2-carboxyl phenylthio, and p-acetoamine phenylthio groups The hetero ring thio group represented by R should be preferably a hetero ring thio group that may have further condensed rings and/or substituents, including, e.g., 2-pyridyl thio, 2-benzothiazolyl thio and 2,4-diphenoxy-1,3,5-triazole-6-thio groups.

As the substituents freed through their reaction with the oxidant of coloring developing agent indicated by X, there are, for example, groups substituted via a halogen atom (chlorine atom, bromine atom, fluorine atom, etc.), as well as a carbon atom, an oxygen atom, a sulfur atoms or a nitrogen atom.

The groups substituted via a carbon atom include carboxyl, hydroxy methyl and tri-phenyl methyl groups, as well as groups indicated by the formula:

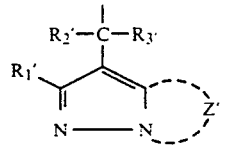

where $R^{1'}$ has the same meaning as R and Z' has the same meaning as Z, and $R^{2'}$ and $R^{3'}$ refer to a hydrogen atom and aryl, alkyl and/or hetero ring groups.

The groups substituted via an oxygen atom include, e.g., alkoxy, aryloxy, hetero ringoxy, acyloxy, sulfonyloxy, alkoxy carbonyloxy, aryloxy carbonyloxy, alkyl oxalyloxy, and alkoxy oxalyloxy groups.

The alkoxy group, which may have further substituents, includes ethoxy, 2-phenoxy ethoxy, 2-cyano ethoxy, phenethyloxy, and p-chloro-benzyloxy groups.

As the aryloxy group, a phenoxy group is preferable, and the aryl group may have further substituents. The aryloxy group includes, e.g., phenoxy, 3-methyl phenoxy, 3-dodecyl phenoxy, 4-methane sulfon amide phenoxy, 4-alpha-(3'-pentadecyl phenoxy) butane amide] phenoxy, hexydecyl carbamoyl methoxy, 4-cyano phenoxy, 4-methane sulfonyl phenoxy, 1-naphthyloxy, and p-methoxy phenoxy groups.

As the heterocyclic oxy group, a heterocyclic oxy group having 5 thru 7 members is desirable, which can be a condensed ring or may have substituents. The heterocyclic oxy group includes, e.g., 1-phenyl tetrazolyloxy and 2-benzothiazolyloxy groups.

The acyloxy group includes, e.g., an alkyl carbonyloxy group such as acetoxy and butanoloxy groups, an alkenyl carbonyloxy group such as a cinnamoyloxy group, and an aryl carbonyloxy group such as a benzoyloxy group.

The sulfonyloxy group includes, e.g., butane sulfonyloxy and methane sulfonyloxy groups.

The alkoxy carbonyloxy group includes, e.g., ethoxy carbonyloxy and benzyloxy carbonyloxy groups.

The aryloxy carbonyl group includes, e.g., a phenoxy carbonyloxy group.

The alkyl oxalyloxy group includes, e.g., a methyl oxalyloxy group.

The alkoxy oxalyloxy group includes, e.g., an ethoxy oxalyloxy group.

As the groups substitued via sulfur atoms, there are, for example, alkyl thio, aryl thio hetero ring thio, and alkyloxy thio carbonyl thio groups.

The alkyl thio group includes butyl thio, 2-cyano ethyl thio, phenethyl thio, and benzyl thio groups.

The aryl thio group includes phenyl thio, 4-methane sulfon amide phenyl thio, 4-dodecyl phenethyl thio, 4-nonafluoropentane amide phenythyl thio, 4-carboxyl phenyl thio, and 2-ethoxy-5-t-butyl phenyl thio groups.

The hetero ring thio group includes, e.g., 1-phenyl-1,2,3,4-tetrazolyl-5-chio and 2-benzothiazolyl groups.

The alkyloxy thio carbonyl group includes, e.g., a dodecyloxy thio carbonyl thio group.

The groups substituted via nitrogen atoms include, e.g., those reprsented by the formula:

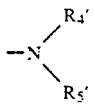

where $R^{4'}$ and $R^{4'}$ refer to a hydrogen atom, an alkyl group, an aryl group, a hetero ring group, a sulfamoyl group, a carbamoyl group, an acyl group, a sulfonyl group, an aryloxy carbonyl group, or an alkoxy carbonyl group; $R^{4'}$ and $R^{5'}$ may be combined, forming a hetero ring, but both of $R^{4'}$ and $R^{5'}$ cannot be a hydrogen atom.

The alkyl group may be a chain or a branch having preferably 1 thru 11 carbons. The alkyl group may contain substituents such as an aryl group, an alkoxy group, an aryloxy group, an alkyl thio group, an aryl thio group, an alkyl amino group, an aryl amino group, an acyl amino group, a sulfon amide group, an imino group, an acyl group, an alkyl sulfonyl group, an aryl sulfonyl group, a carbamoyl group, a sulfamoyl group, an alkoxy carbonyl group, an aryloxy carbonyl group, an alkyloxy carbonyl amino group, an aryloxy carbonyl amino group, a hydroxyl group, a carboxyl group, a cyano group, and a halogen atom. The alkyl group includes, e.g., an ethyl group, an octyl group a 2-ethyl hexyl group, and a 2-chloro-ethyl group.

The aryl group represented by $R^{4'}$ and $R^{5'}$ should be preferably a phenyl group or a naphthyl group having 6 thru 32 carbons. The aryl group may contain substituents such as those for an alkyl group indicated by $R^{4'}$ or $R^{5'}$ and an alkyl group. Used practically as the aryl group are, e.g., a phenyl group, a 1-naphthyl group, and a 4-methyl sulfonyl phenyl group.

The heterocyclic group represented by $R^{4'}$ or $R^{5'}$ should be preferably a one that has 5 thru 6 members, may be a condensed ring, and may have substituents. Used practically as the hetero ring group are a 2-furyl group, a 2-quinolyl group, a 2-pyrimidyl group, a 2-benzothiazolyl group, and a 2-pyridyl group.

The sulfamoyl group represented by $R^{4'}$ or $R^{5'}$ includes an N-alkyl sulfamoyl group, an N,N di-alkyl sulfamoyl group, an N aryl sulfamoyl group, and an N,N di-aryl sulfamoyl group. These alkyl and aryl groups may have the substituents set forth above for the alkyl and aryl groups. Used practically as the sulfamoyl group are, e.g., a N,N di-ethyl sulfamoyl group, an N-methyl sulfamoyl group, an N-dodecyl sulfamoyl group, and an N-p-tolyl sulfamoyl group.

The carbamoyl group represented by $R^{4'}$ or $R^{5'}$ includes an N-alkyl carbamoyl group, an N,N-di-alkyl carbamoyl group, an N-aryl carbamoyl group, and an N,N di-aryl carbamoyl group. These alkyl and aryl groups may contain the substituents set forth above for te alkyl and aryl groups. Used practically as the carbamoyl group are, e.g., an N,N-di-ethyl carbamoyl group, an N-methyl carbamoyl group, an N-dodecy carbamoyl group, an N-p-cyano phenyl carbamoyl group, and an N-p-tolyl carbamoyl group.

The acyl group represented by $R^{4'}$ or $R^{5'}$ includes, e.g., an alkyl carbonyl group, an aryl carbonyl group, and a heterocyclic carbonyl group. The alkyl, aryl and heterocyclic groups may contain substituents. Used practically as the acyl group are, e.g., a hexa-fluoro butanoyl group, a 2,3,4,5,6-penta-fluoro benzoyl group, an acetyl group, a benzoyl group, a naphthoel group, and a 2-furyl carbonyl group.

The sulfonyl group represented by $R^{4'}$ or $R^{5'}$ includes an alkyl sulfonyl group, an aryl sulfonyl group, and a heterocyclic sulfonyl group, and may contain substituents. Used practically as the sulfonyl group are, e.g., an ethane sulfonyl group, a benzene sulfonyl group, an octane sulfonyl group, a naphthalene sulfonyl group, and a p-chloro-benzene sulfonyl group.

The aryloxy carbonyl group represented by $R^{4'}$ or $R^{5'}$ may containn the substituents set forth above for the aryl group, and includes, e.g., a phenoxy carbonyl group.

The alkoxy carbonyl group represented by $R^{4'}$ or $R^{5'}$ may contain the substituents set forth above for the alkyl group. Used practically as the alkoxy carbonyl group are, e.g., a methoxy carbonyl group, a dodecyloxy carbonyl group, and a benzyloxy carbonyl group.

The hetero ring formed by combination of $R^{4'}$ and $R^{5'}$ should be preferably ones having 5 or 6 members, may be saturated or unsaturated, may or may not have aromatic characteristics, and may be a condensation ring. THe hetero ring includes, e.g., an N-phthalimide group, an N-succinic acid imide group, a 4-N-urazolyl group, a 1-N-hydantoinyl group, a 3-N-2,4-di-oxo-oxazolidinyl group, a 2-N-1,1-di-oxo-3-(2H)-oxo-1,2-benzothiazolyl group, a 1-pyrrolyl a 1-prrolidinyl group, a 1-pyrazolyl group, a 1-pyrazolidinyl group, a 1-piperidinyl group, a 1-pyrrolinyl group, a 1-imidazolyl group, a 1-imidazolinyl group, a 1-indolyl group, a 1-isoindolinyl group, a 2-iso-indolyl group, a 2-isoindolinyl group, a 1-benzotriazolyl group, a 1-benzoimidazolyl group, a 1-(1,2,4-triazolyl) group, a 1-(1,2,3-triazolyl) group, a 1-(1,2,3,4-tetrazolyl) group, an N-morpholinyl group, a 1,2,3,4-tetra-hydro-quinolyl group, a 2-oxo-1-pyrrolidinyl group, a 2-1H-pyridone group, a phthaladione group, and a 2-oxo-1-piperidinyl group. The hetero ring group may have been replaced by an alkyl group, an aryl group, an alkyloxy group, an aryloxy group, an acyl group, a sulfonyl group, an alkyl amino group, an aryl amiono group, an acyl amino group, a sulfon amino group, a carbamoyl group, a sulfamoyl group, an alkyl thio group, an aryl thio group, an ureide group, an alkoxy carbonyl group, an aryloxy carbonyl group, an imide group, a nitro group, a cyano group, a carboxyl group, or a halogen atom.

The nitrogen contained heterocyclic ring formed by Z or Z' includes a pyrazole ring, an imidazole ring, a triazole ring and a tetrazole ring. It may have the substituents set forth above for R.

A substituent (for example, R or R thru R ) on a heterocyclic ring in the formula [I] or formula [II] thru [VII] described later having the following part:

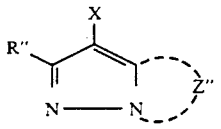

(R'', X and Z'' are equivalent to R, X and Z, respectively) forms so called a bis-type coupler, which is of course incorporated in the present invention. A ring formed by Z, Z', Z'' or $Z^1$ may have other condensed rings (e.g., cycloalkene). For example, in the formula [V], $R^5$ and $R^6$ may have been condensed, and in the formula [VI], $R^7$ and $R^8$, forming a ring (e.g., cycloalkene or benzene).

The formula [I]can be developed further to formula [II] thru [VII].

Formula [II]

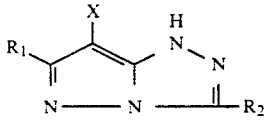

Formula [III]

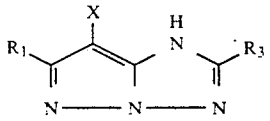

Formula [IV]

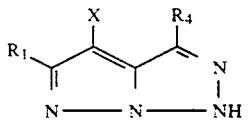

Formula [V]

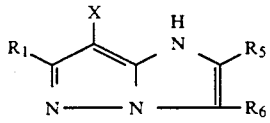

Formula [VI]

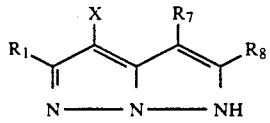

Formula [VII]

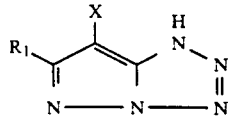

In the above formula [II] thru [VII], $R^1$ thru $R^8$ and X have the same meanings as above R and X.

The following formula [VIII] is most desirable to cover the formula [I].

Formula [VIII]

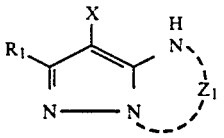

In the formula, $R^1$, X and Z are equivalent to R, X and Z in the formula [I], respectively.

The magenta coupler represented by the formula [II] is most desirable among those represented by formula [II] thru [VII].

The substituent on the heterocyclic ring in the formula [I] thru [VIII] is desirable if R in the formula [I] and $R^1$ in formula [II] thru [VIII] meet the following condition 1, further desirable if they meet following conditions 1 and 2, and most desirable if they meet all of the following conditions 1, 2 and 3.

Condition 1: The base atom coupled directly to the heterocyclic ring is a carbon atom.

Condition 2: Only one or no hydrogen atom is coupled to the carbon atom.

Condition 3: The carbon atom is single-bonded to the adjacent atoms.

The following formula [IX] provides the most desirable substituents R and R on the heterocyclic ring.

Formula [IX]

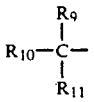

In the formula, $R^9$, $R^{10}$ and $R^{11}$ refer to a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro-compound residue, a bridged hydrocarbon compound residue, an alkoxy group, an aryloxy group, a heterocyclic oxy group, a siloxy group, an acyloxy group, a carbamoyloxy group, an mino group, an acyl amino group, a sulfon amide group, an imide group, an ureide group, a sulfamoyl amino group, an alkoxy carbonyl amino group, an aryloxy carbonyl amino group, an alkoxy carbonyl group, an aryloxy carbonyl group, an alkyl thio group, an aryl thio group, or a heterocyclic thio group. At least two of $R^9$, $R^{10}$ and $R^{11}$ cannot be a hydrogen atom.

Two of $R^9$, $R^{10}$ and $R^{11}$, e.g., $R^9$ and $R^{10}$, may be coupled to each other to form a saturated or unsaturated ring (e.g., cycloalkane, cycloalkene or hetero ring). Further, $R^{11}$ may be coupled to the ring to form a bridged hydrocarbon compound residue.

The groups represented by $R^9$ thru $R^{11}$ may contain substituents. The actual groups represented by $R^9$ thru $R^{11}$ and the substituents that may be had by them include the substituents represented by R in he formula [I].

The rings formed by coupling, e.g., $R^9$ and $R^{10}$ and the actual bridged hydrocarbon compound residues formed by $R^9$ thru $R^{11}$ and the substituents that may be had by them include cycloalkyl, cycloalkenyl and hetero ring bridged hydrocarbon compound residues represented by R in the formula [I], and their substituents.

In the formula [IX], it is desirable that:

(i) two of $R^9$ thru $R^{11}$ are alkyl groups; and (ii) one of $R^9$ thru $R^{11}$, e.g., $R^{11}$ is a hydrogen agom, and other two of them, e.g., $R^9$ and $R^{11}$ are coupled to each other to cycloalkyl along with the base carbon atom.

Further, in (i), it is most desirable that two of $R^9$ thru $R^{11}$ are alkyl groups and the other is a hydrogen atom or an alkyl group.

The alkyl and cycloalkyl groups may contain a further substituent. The alkyl and cycloalkyl groups and their substituents used practically include the alkyl and cycloalkyl groups represented by R in the formula [I] and their substituents.

The substituents that may be had by the rings formed by Z in the formula [I] and those formed by $Z^1$ in the formula [VIII], and $R^2$ thru $R^8$ in formula [II] thru [VI] should preferably be those expressed by the following formula [X]:

$$-R^1-SO_2-R^2 \qquad \text{Formula [X]}$$

where $R^1$ represents alkylene, and $R^2$ means lakyl, cycloalkyl or aryl.

The alkylene indicated by $R^1$ should have the straight chain part consisting of more than one carbon, more preferably 3 or 6 carbons, chained or branched. The alkylene may have a substituent.

The sample substituents include those that R in the formula [I] as an alkyl group may have.

A desirable substituent is phenyl

The following is desirable alkylene indicated by $R^1$:

$-CH_2CH_2CH_2-$, $-CH(CH_3)CH_2CH_2-$, $-CH(C_2H_5)CH_2CH_2-$, $-CH_2CH_2CH(C_7H_{15})-$ $-CH_2CH_2CH(C_2H_5)-$, $-CH_2CH_2CH_2CH_2-$,

-continued $-CH_2CH_2CH_2CH(C_6H_{13})-$, $-CH(C_6H_5)CH_2CH_2-$, $-C(CH_3)_2-CH_2CH_2-$ The alkyl group represented by $R^2$ may be chained or branch.

Used practically as the alkyl group are, e.g., methyl, ethyl, propyl, iso-propyl, butyl, 2-ethyl hexyl, octyl, dodecyl, tetradecyl, hexa-decyl, octa-decyl, and 2-hexyldecyl.

The cycloalkyl group represented by $R^2$ is preferably a one having 5 or 6 members like cyclohexyl Alkyl and cycloalkyl groups represented by $R^2$ may have the substituents set forth above for $R^1$.

The aryl group represented by $R^2$ includes, e.g., phenyl and naphthyl. The aryl group may have a substituent. The substituents include, e.g., chained or branching alkyl, as well as those set forth above for $R^1$.

Two substituents or more may be the same or different from one another.

The following formula [XI] provides a very desirable compound covered by the formula [I].

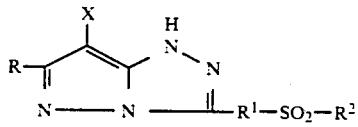

Formula [XI]

where R and X are equivalent to R and X in the formula [I], respectively, and $R^1$ and $R^2$ are equivalent to $R^1$ and $R^2$ in the formula [X], respectively.

Presented below are preferred compounds used in the present invention.

1

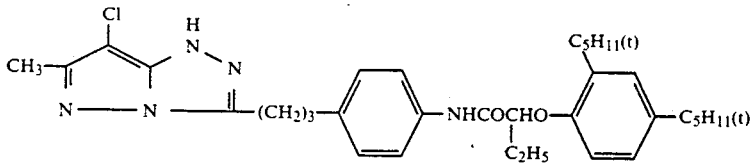

2

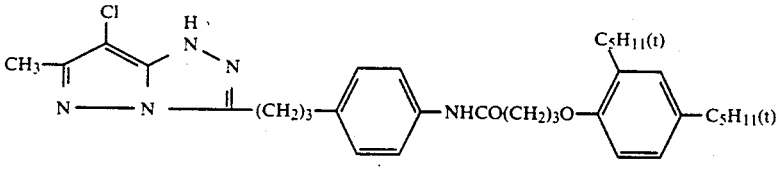

3

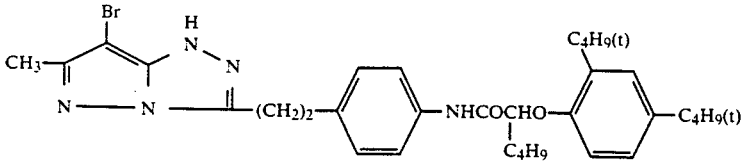

-continued
4
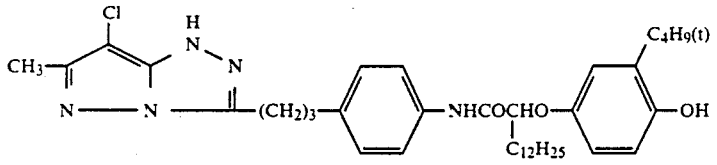
5
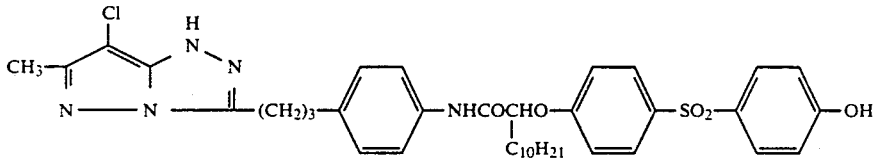
6
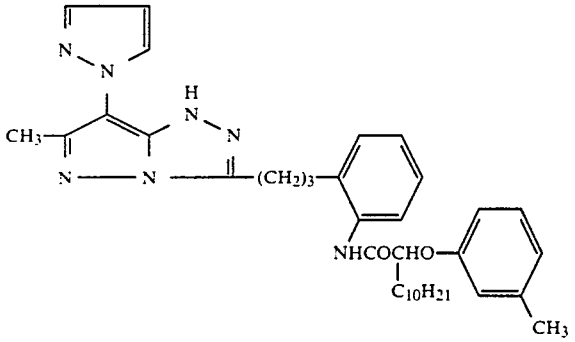
7
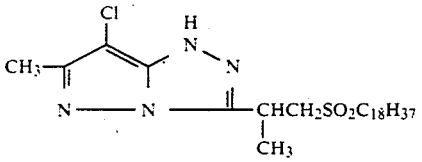
8
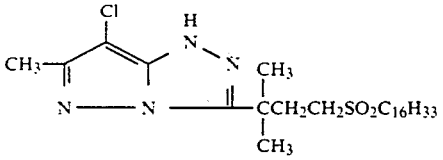
9
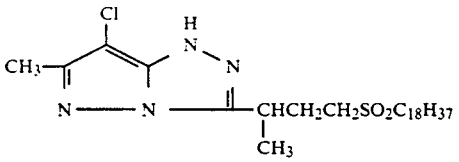
10
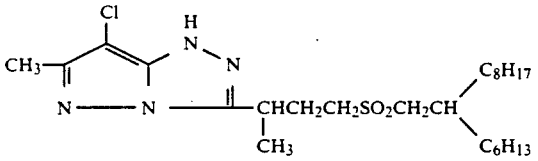
11
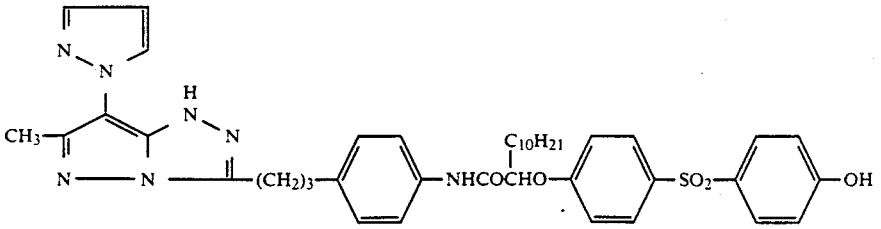

-continued
12
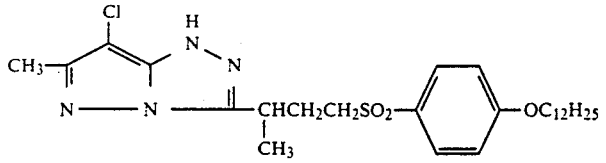
13
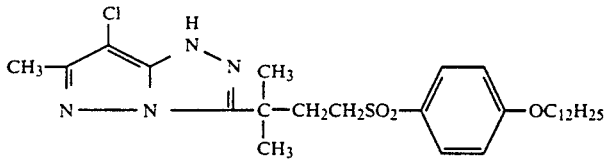
14
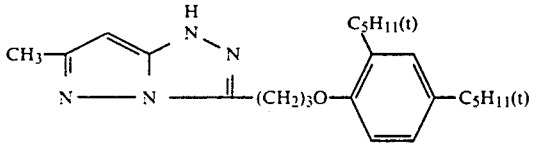
15
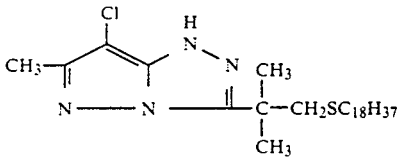
16
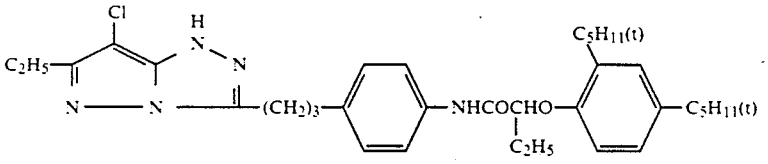
17
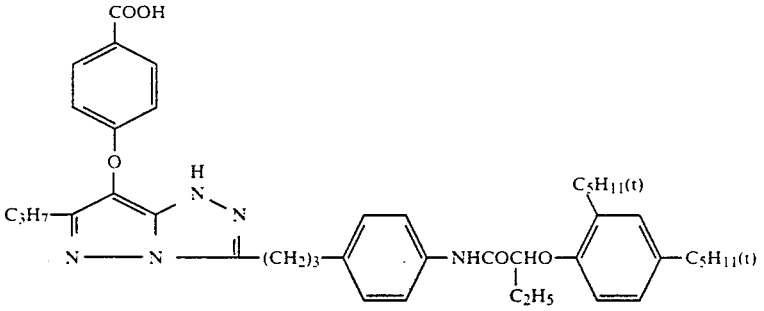
18
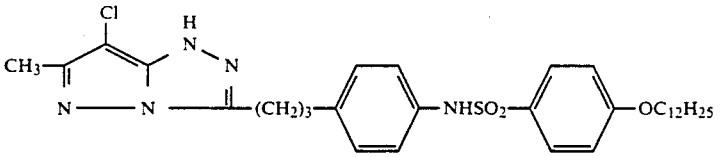
19
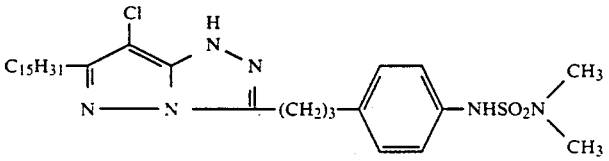
20
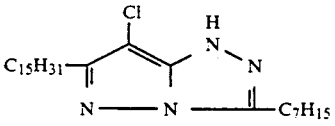

-continued
21
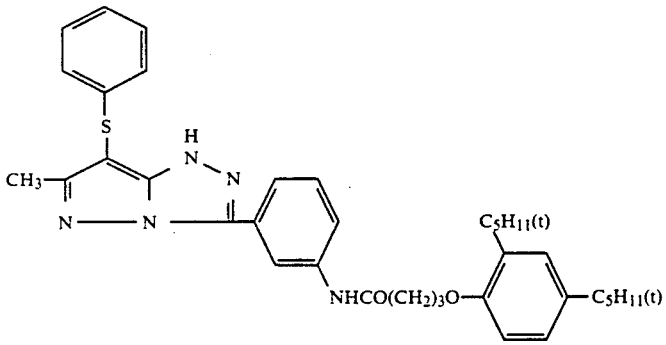
22
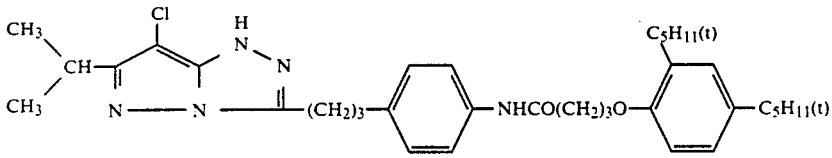
23
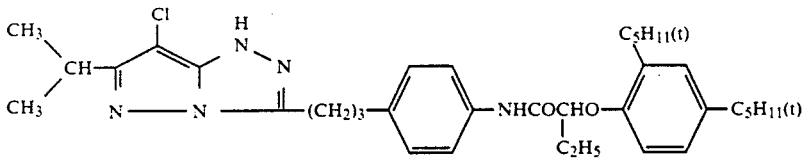
24
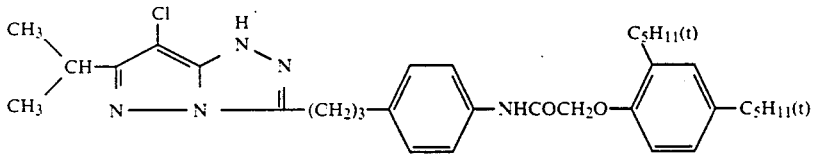
25
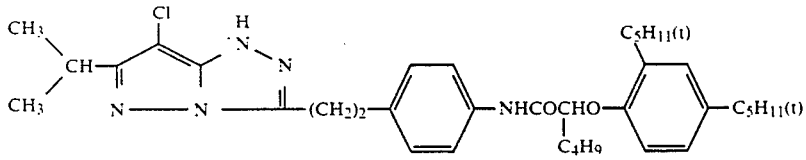
26
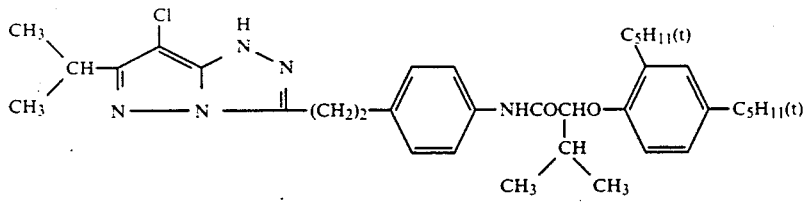
27
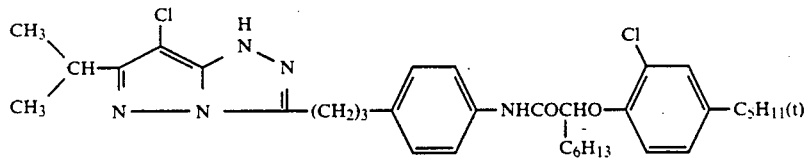
28
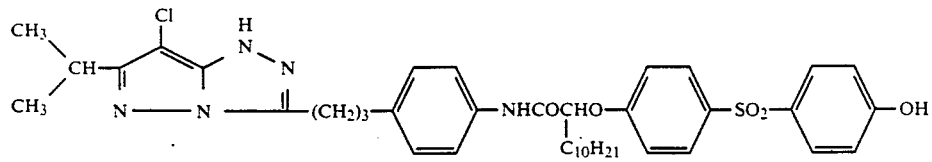

-continued
29
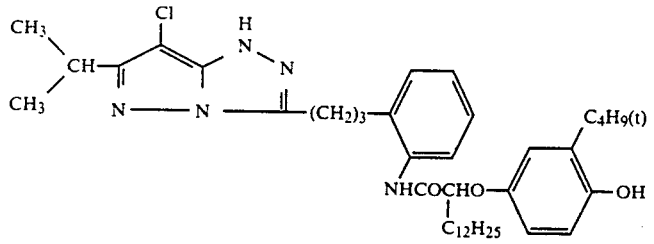
30
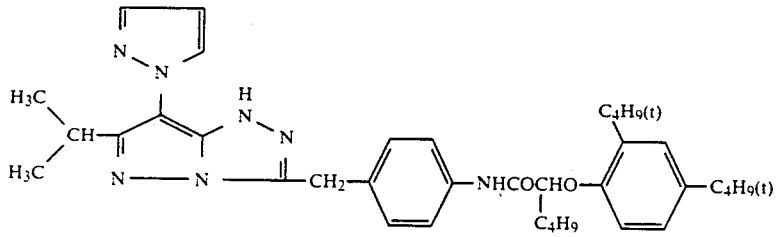
31
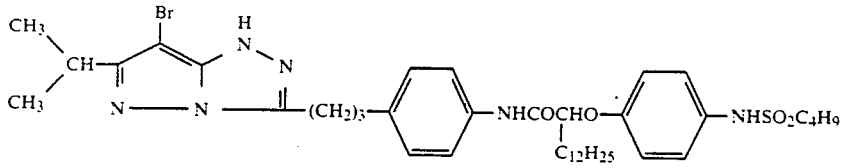
32
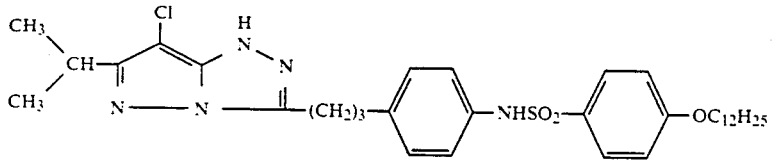
33
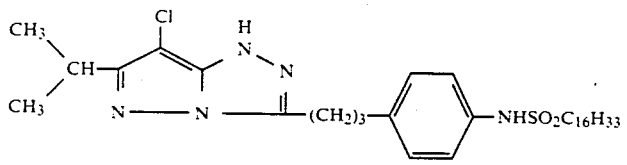
34
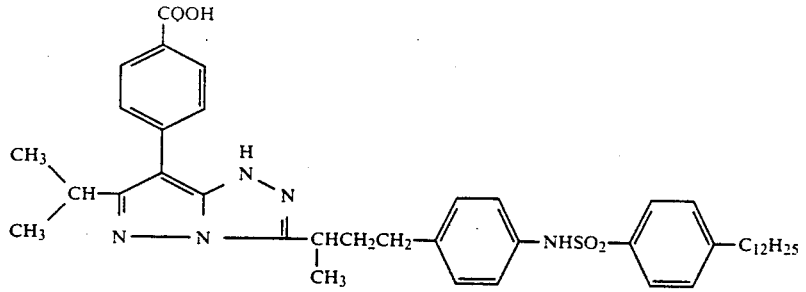
35
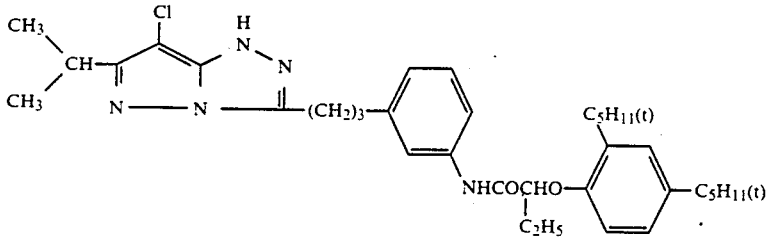

-continued
36
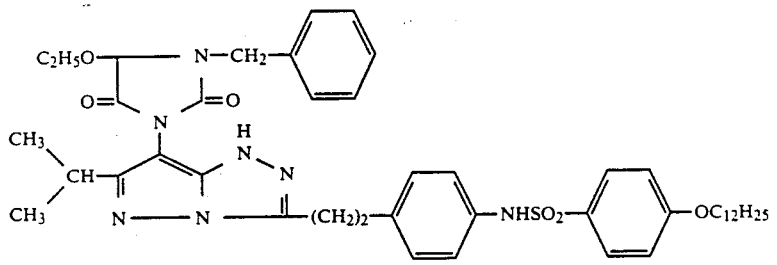
37
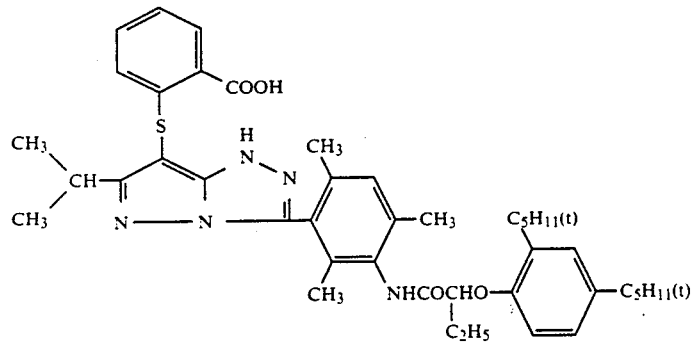
38
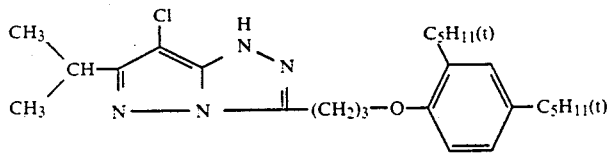
39
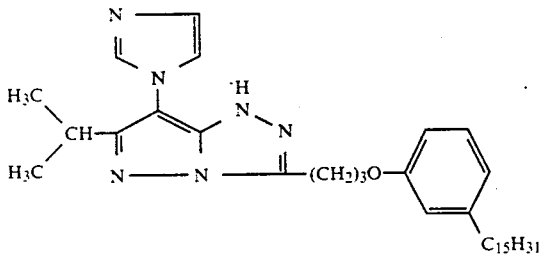
40
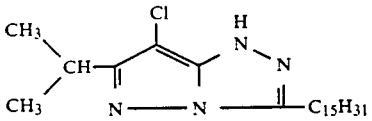
41
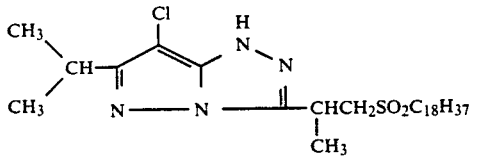
42
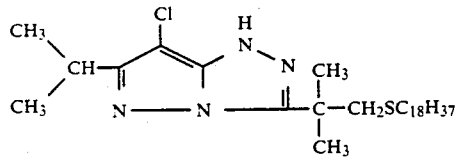

-continued
43
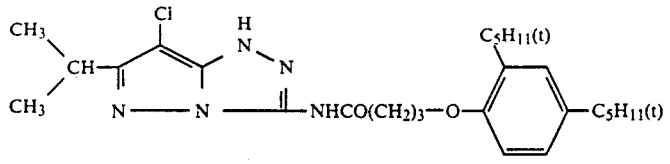
44
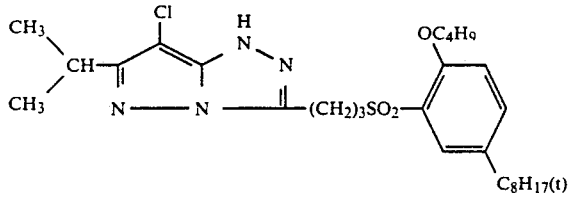
45
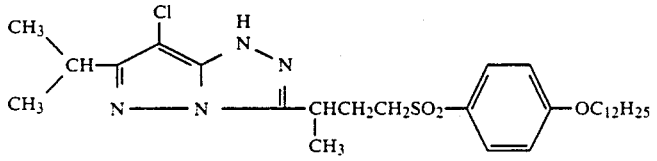
46
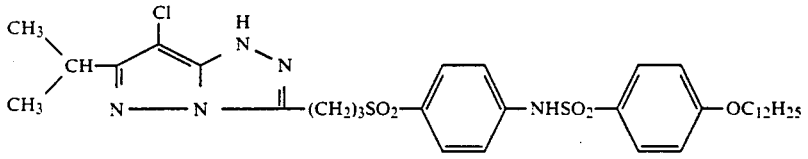
47
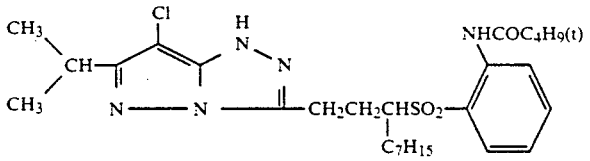
48
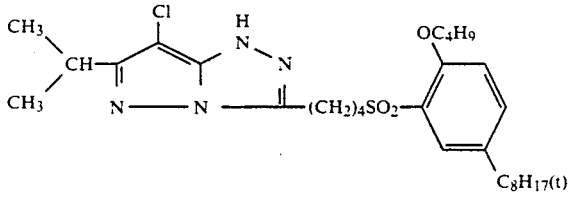
49
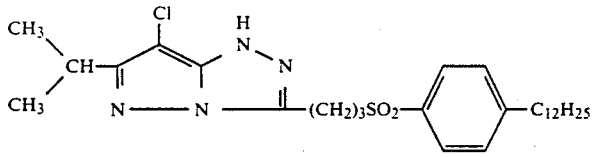
50
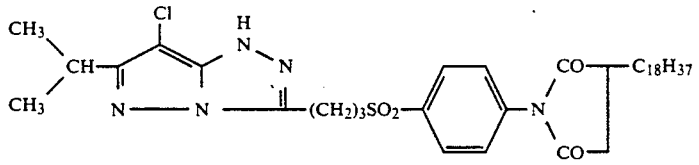
51
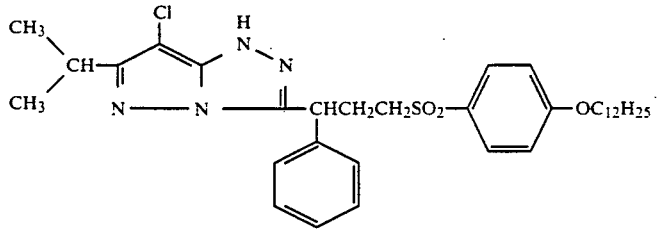

-continued
52
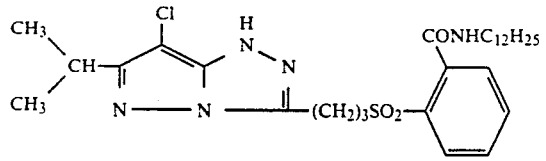
53
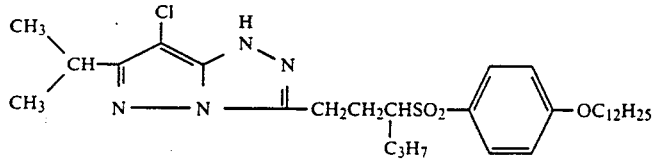
54
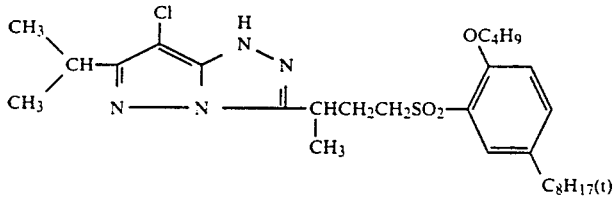
55
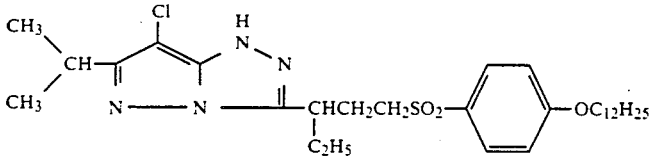
56
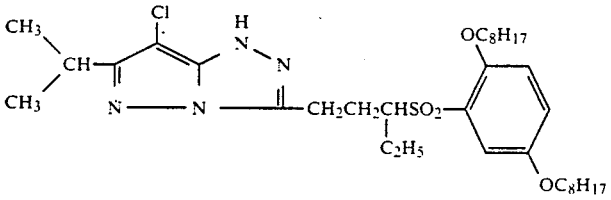
57
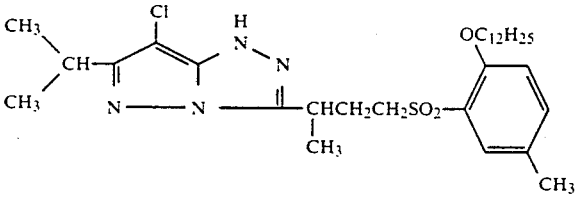
58
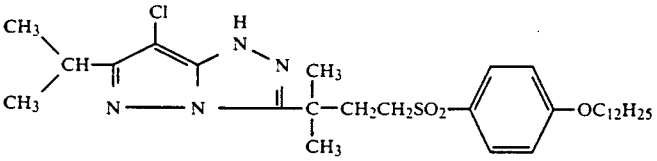
59
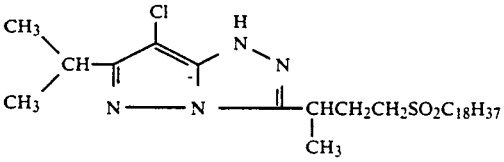
60
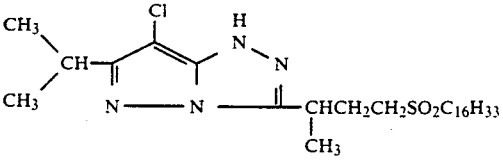

-continued
61
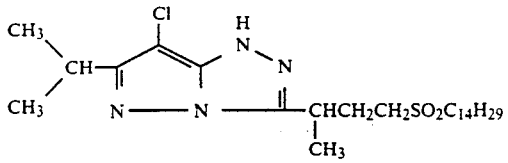
62
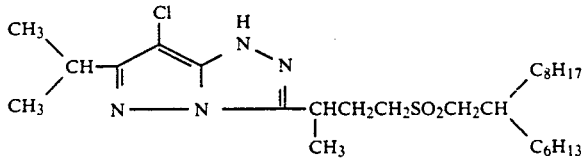
63
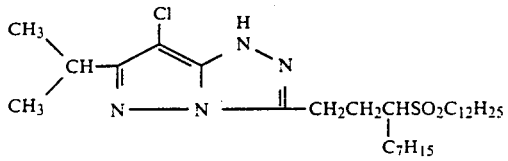
64
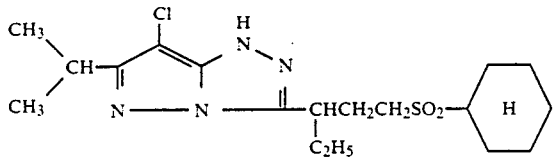
65
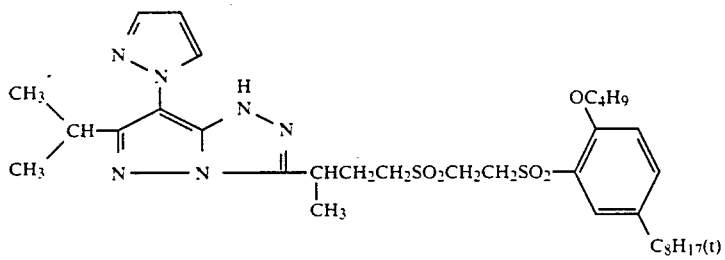
66
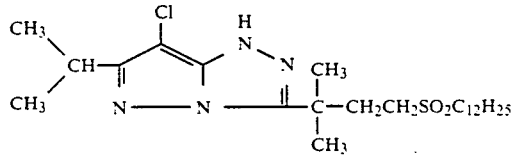
67
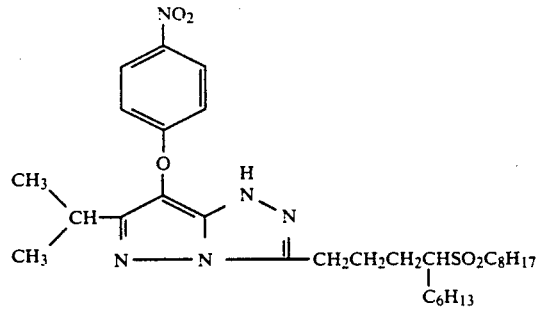
68
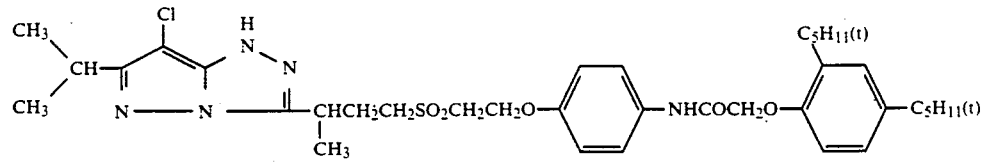

-continued
69
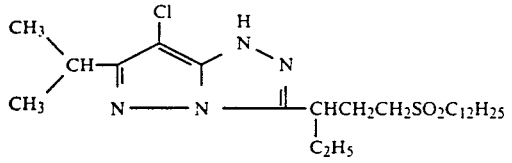
70
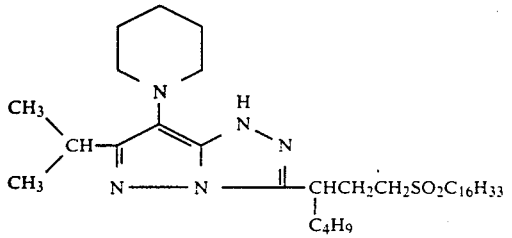
71
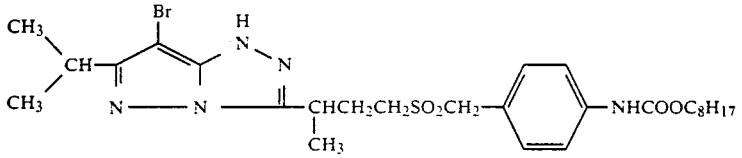
72
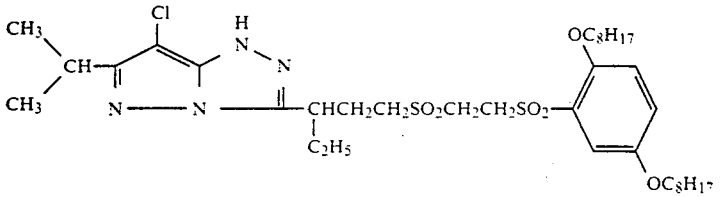
73
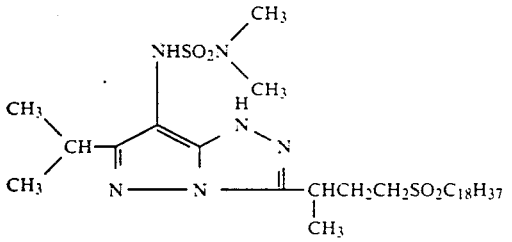
74
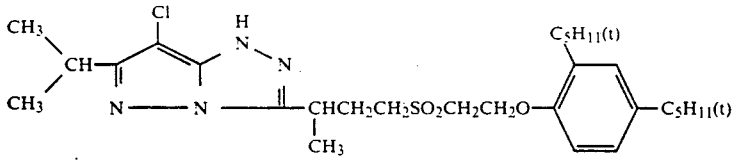
75
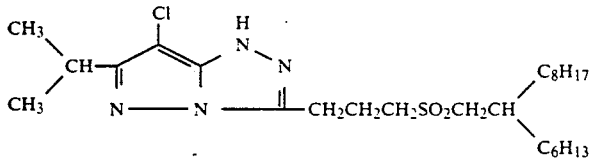
76
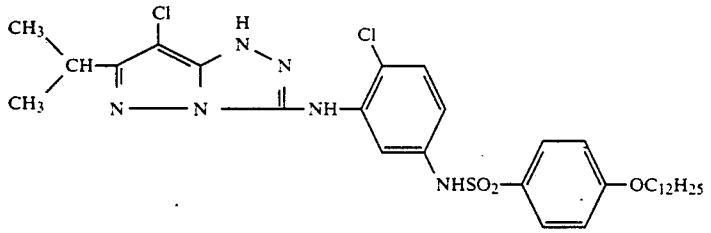

-continued
77
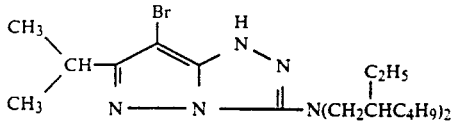
78
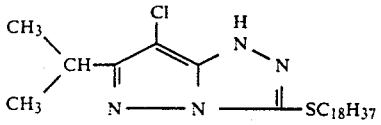
79
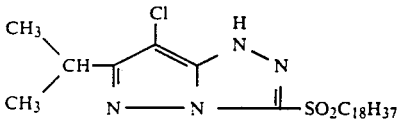
80
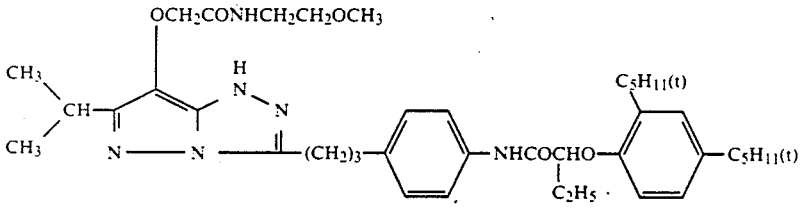
81
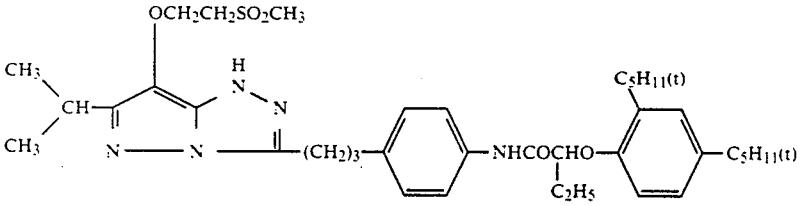
82
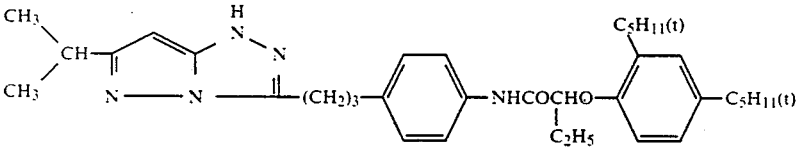
83
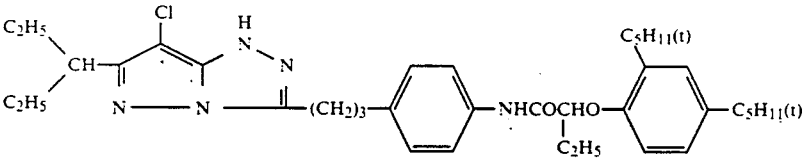
84
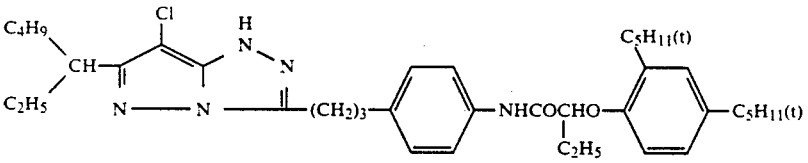
85
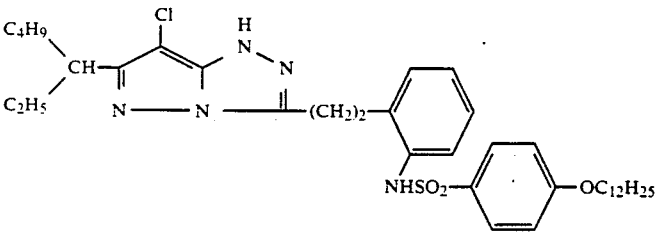

-continued
86
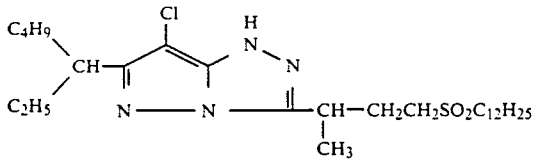
87
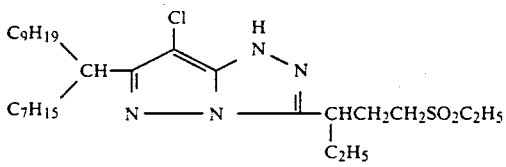
88
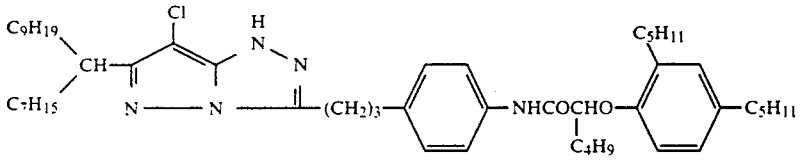
89
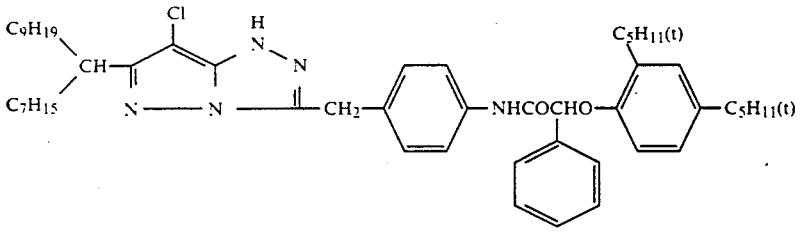
90
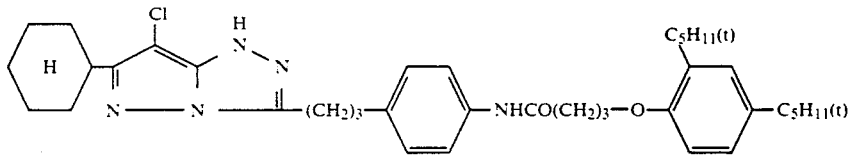
91
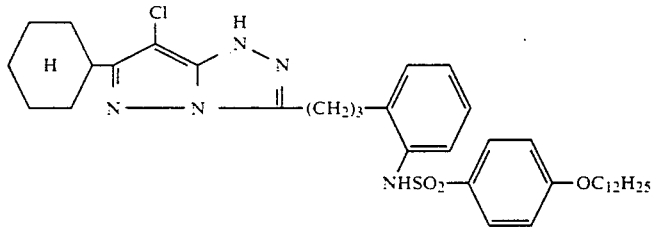
92
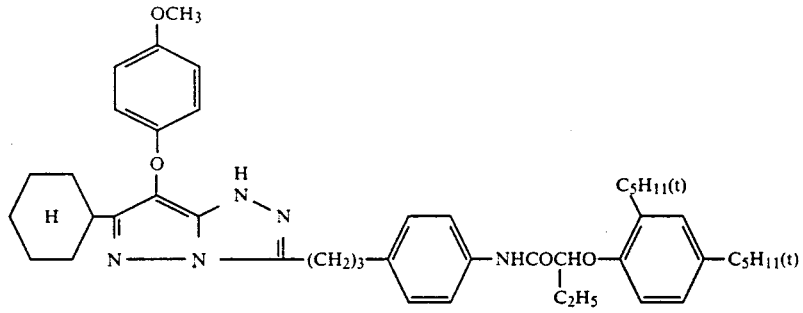
93
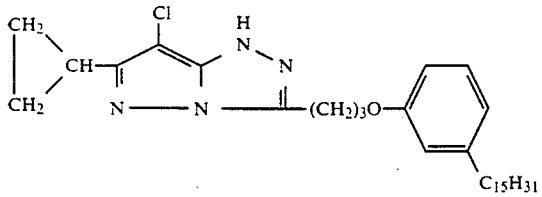

-continued
94
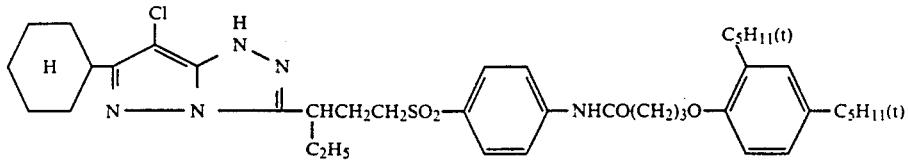
95
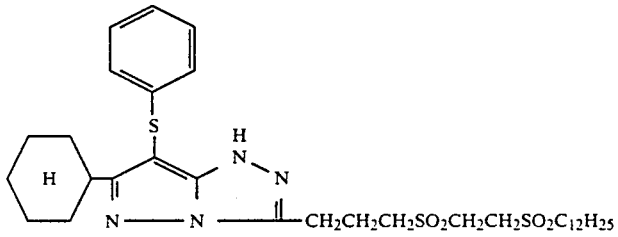
96
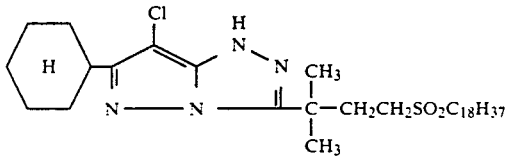
97
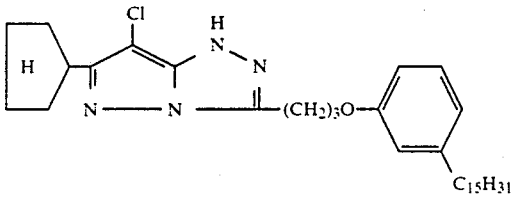
98
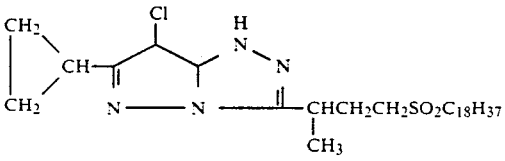
99
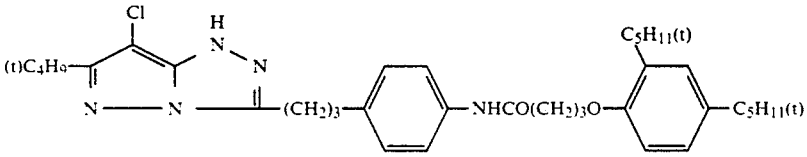
100
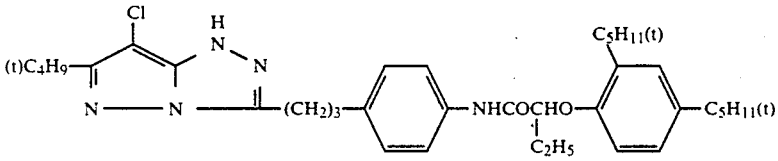
101
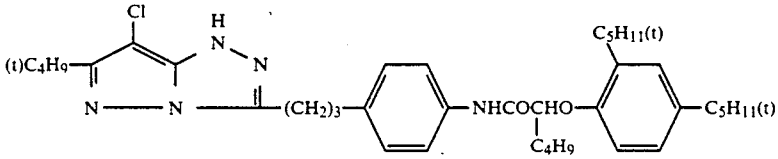
102
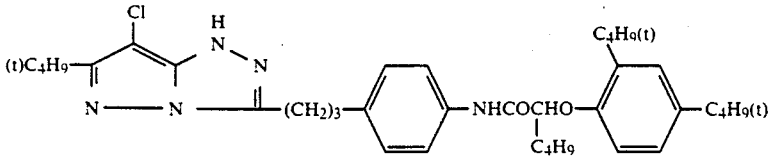

-continued
103
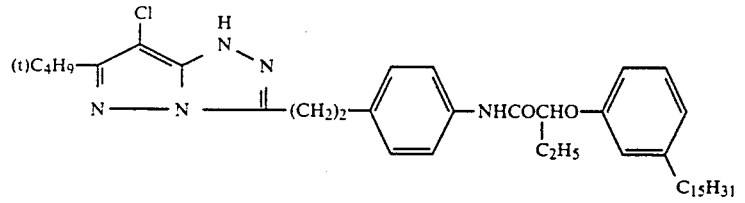
104
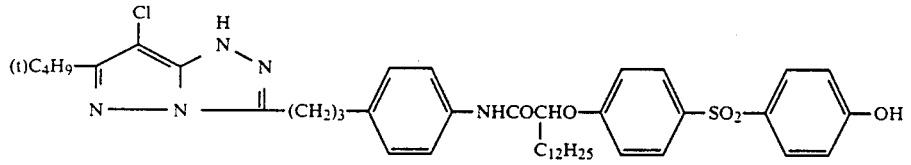
105
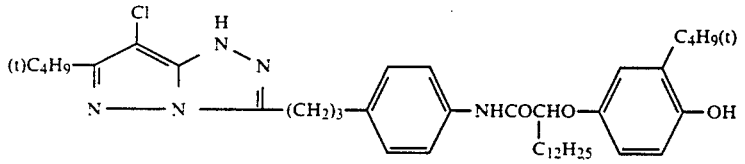
106
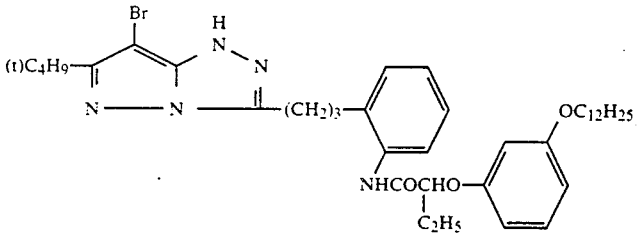
107
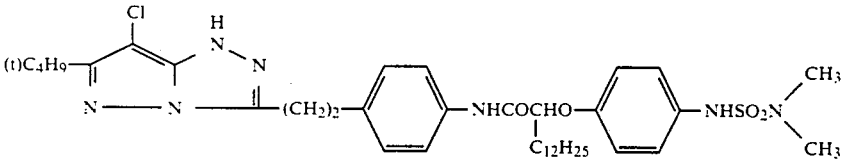
108
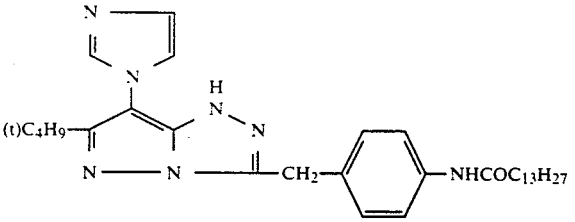
109
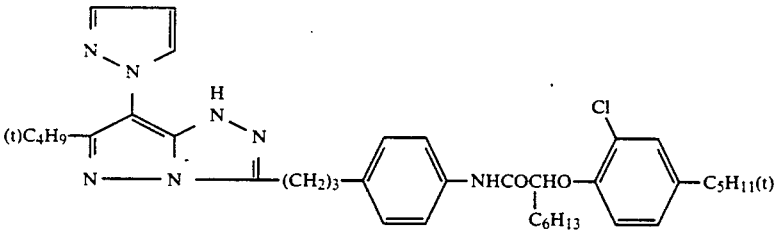
110
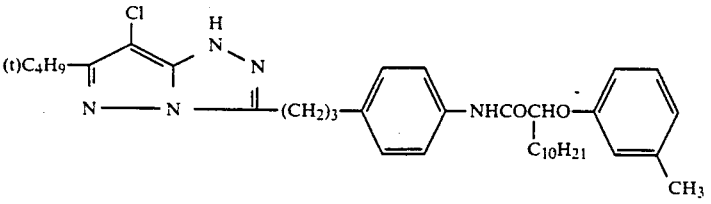

-continued
111
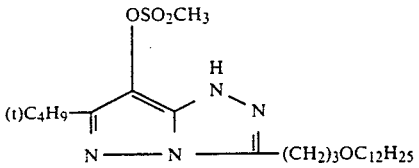
112
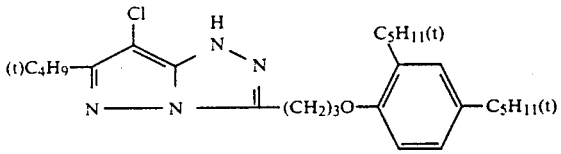
113
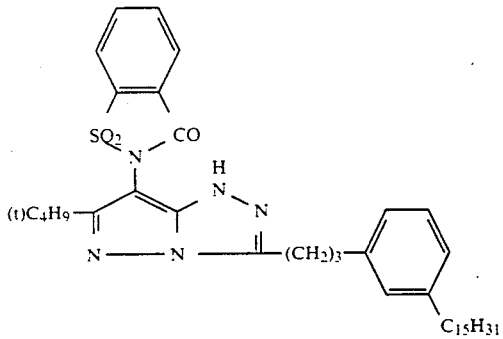
114
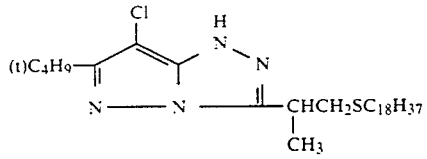
115
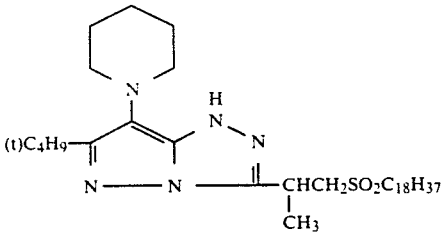
116
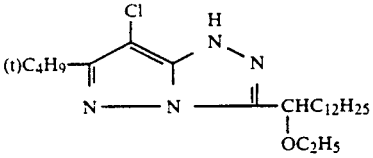
117
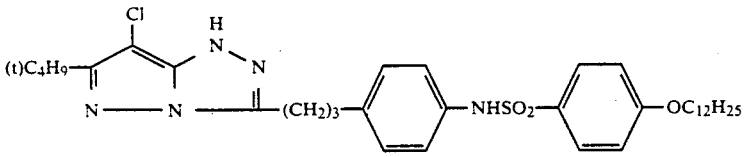

-continued
118
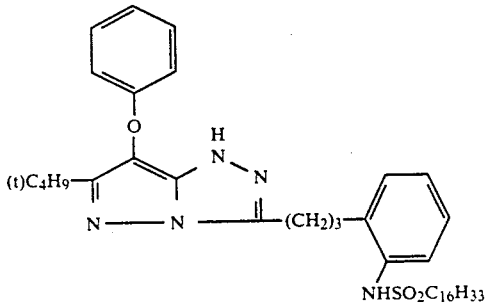
119
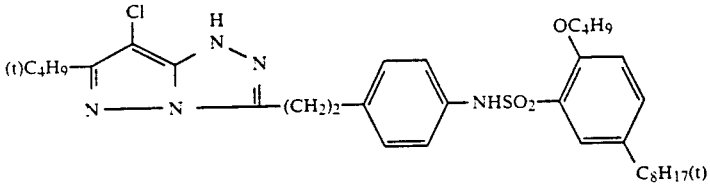
120
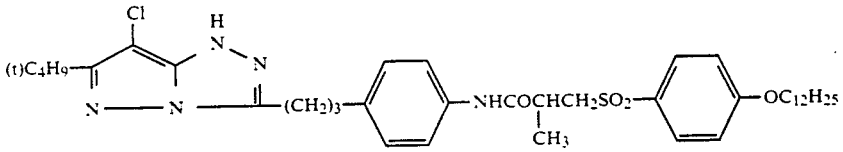
121
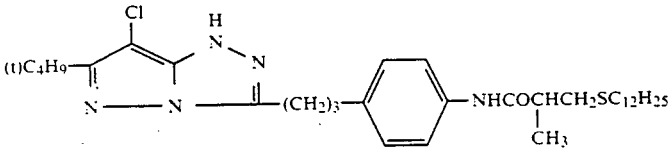
122
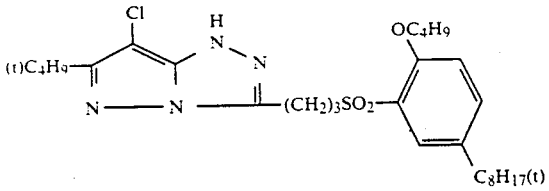
123
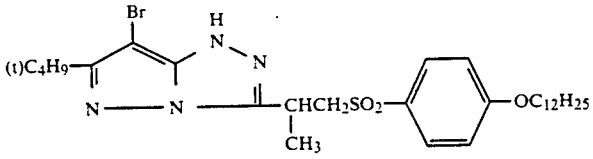
124
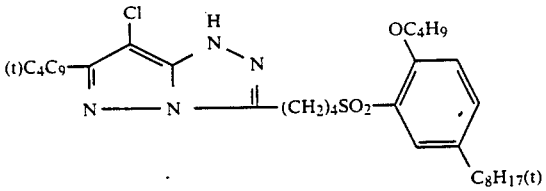

-continued
125
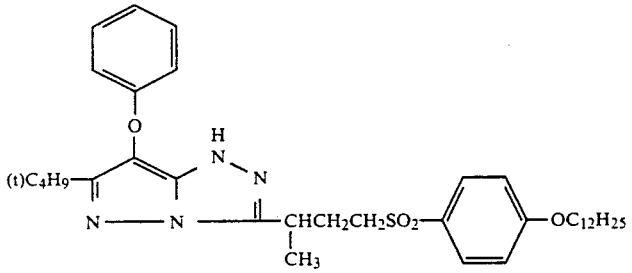
126
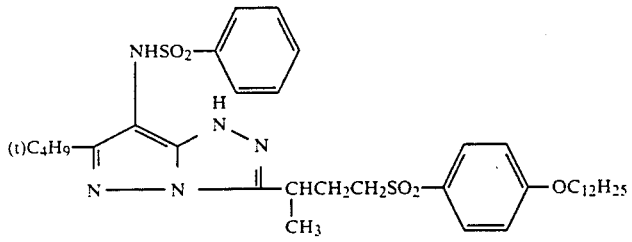
127
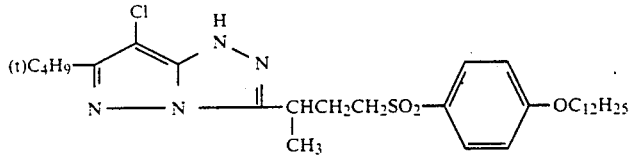
128
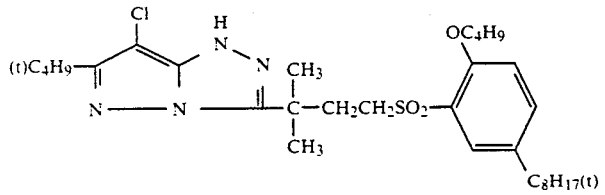
129
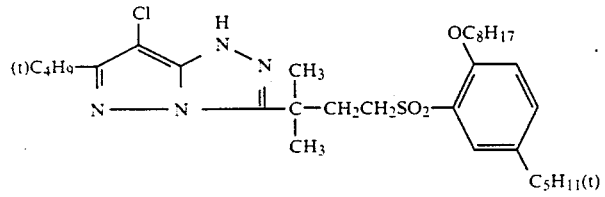
130
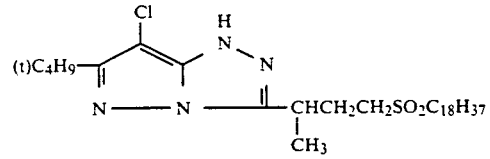
131
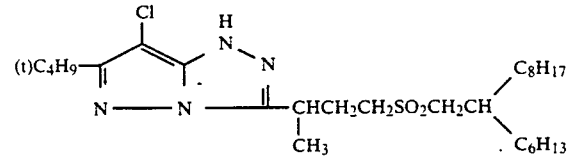
132
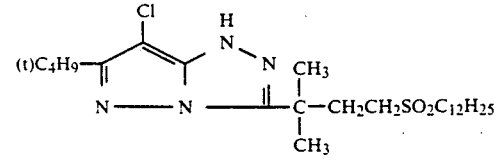

-continued
133
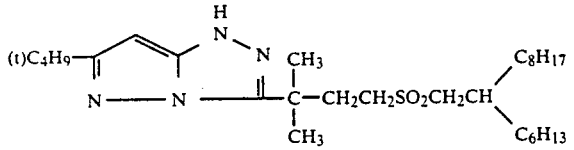
134
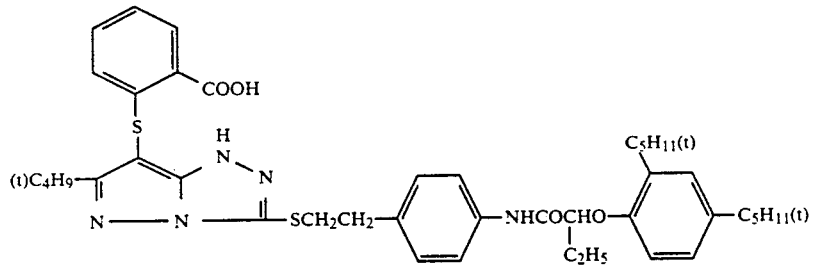
135
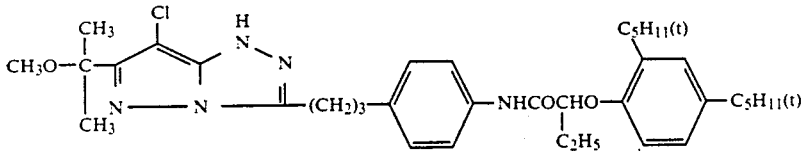
136
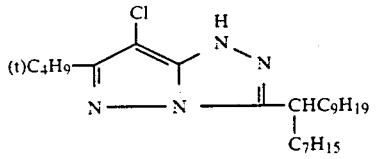
137
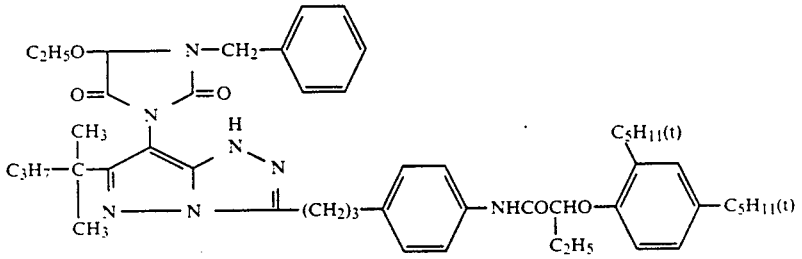
138
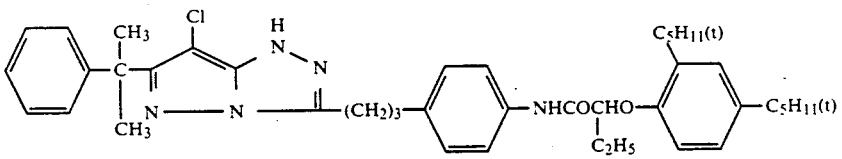
139
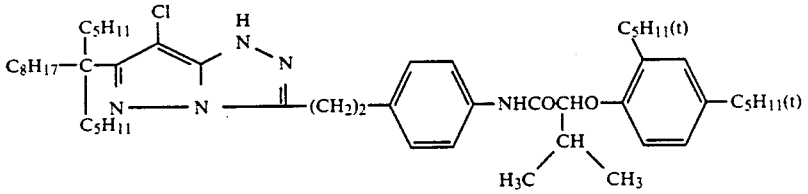
140
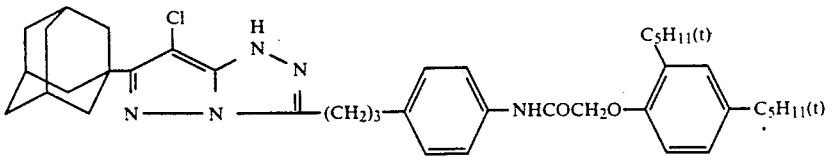

-continued
141
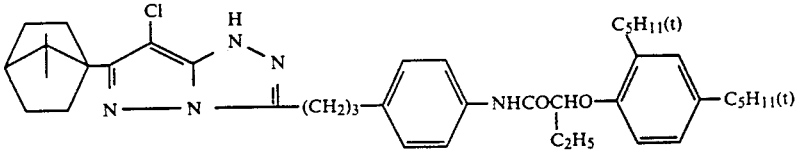
142
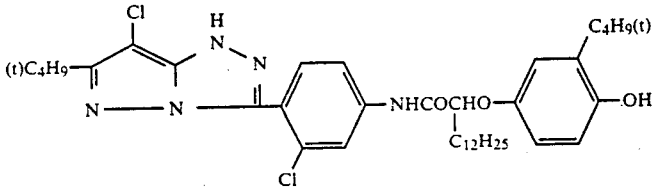
143
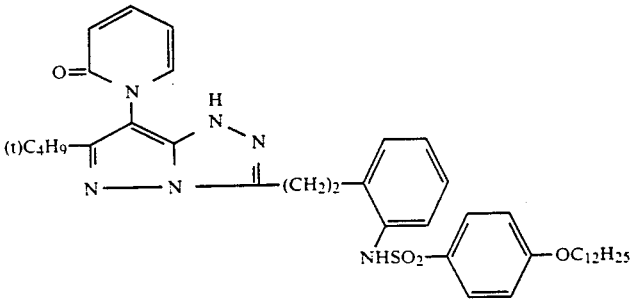
144
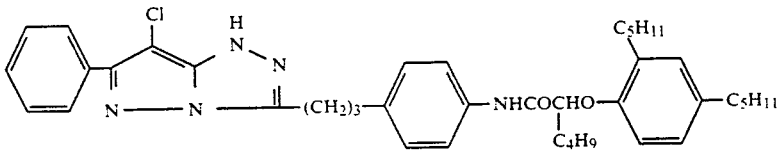
145
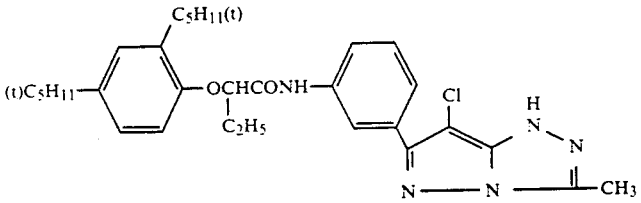
146
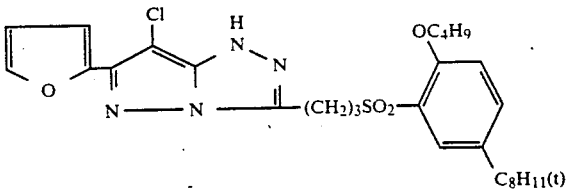
147
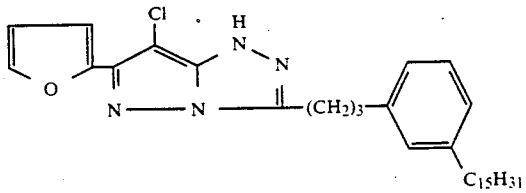

-continued
148
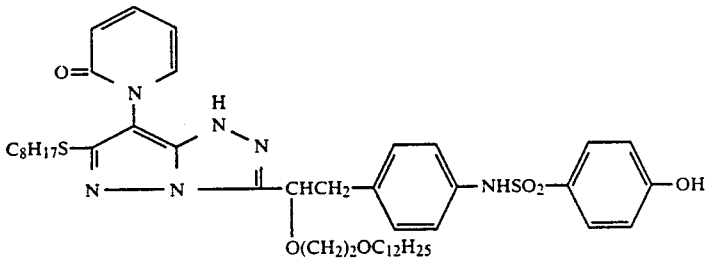
149
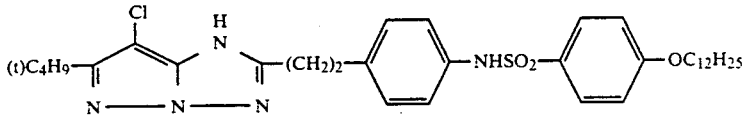
150
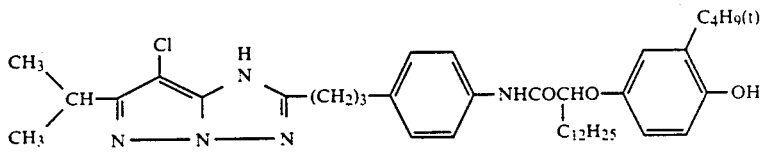
151
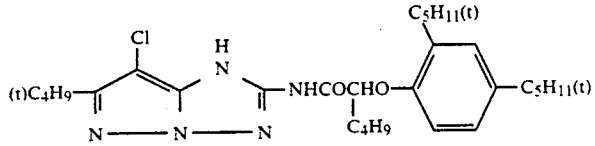
152
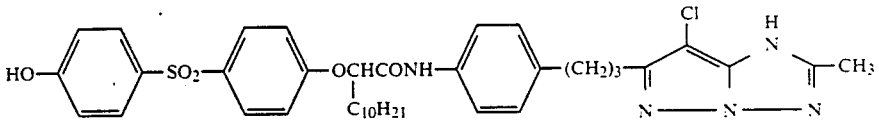
153
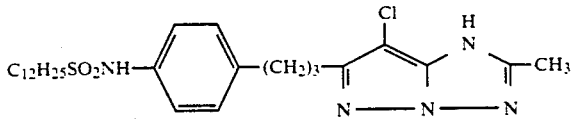
154
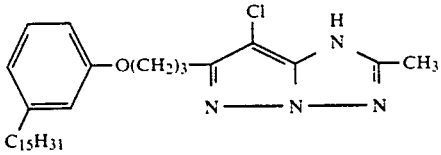
155
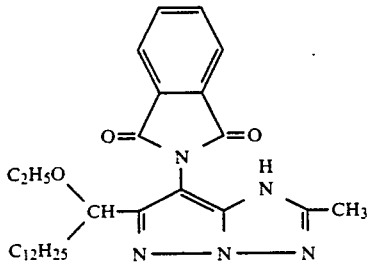
156
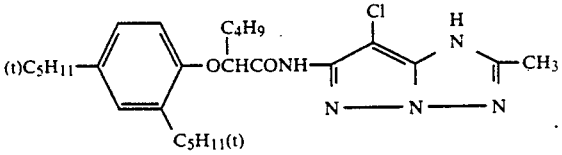

-continued
157
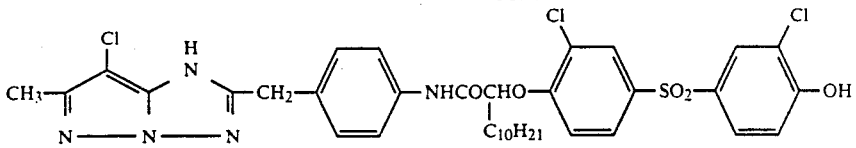
158
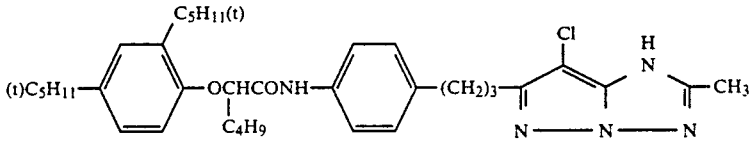
159
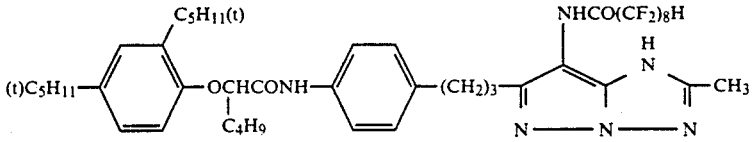
160
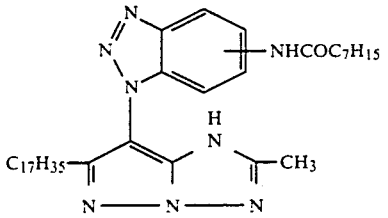
161
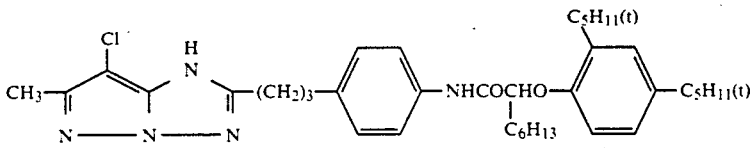
162
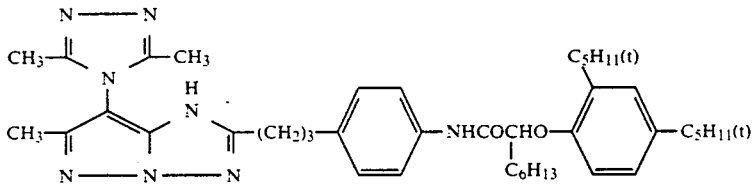
163
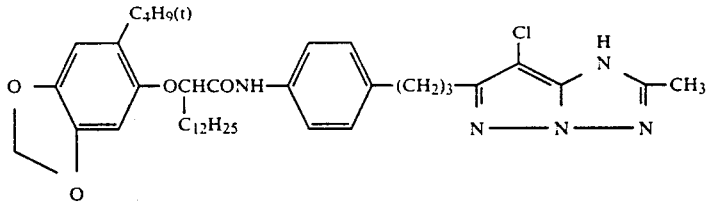
164
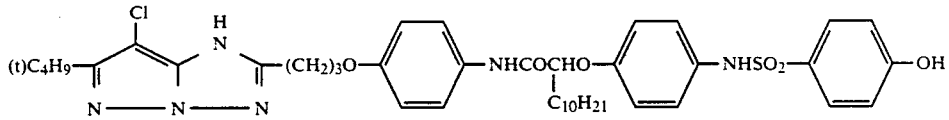
165
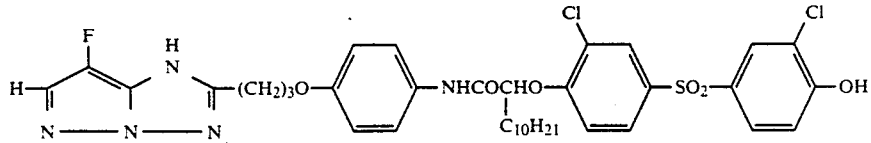
166
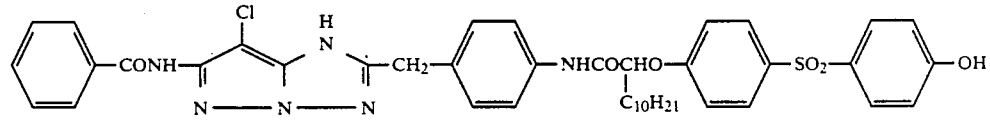

-continued
167
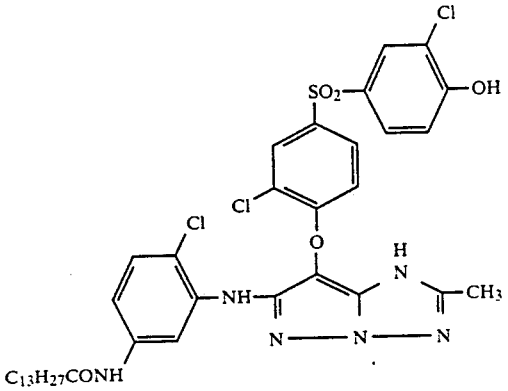
168
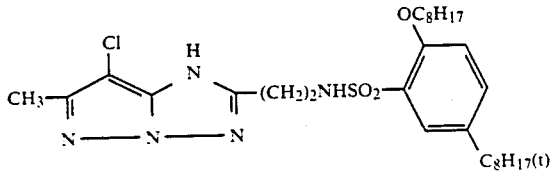
169
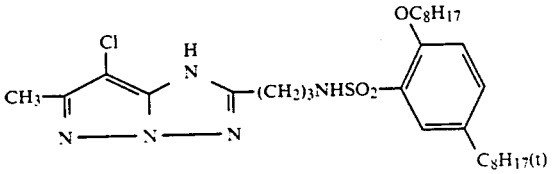
170
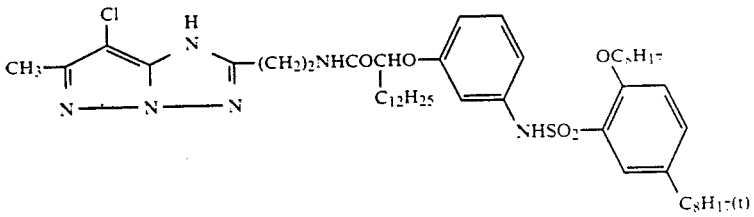
171
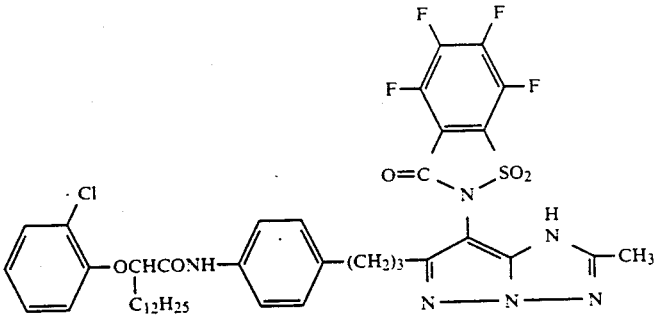
172
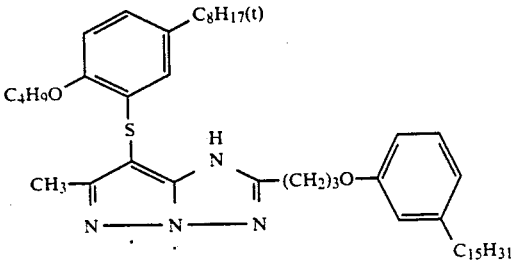

-continued
173
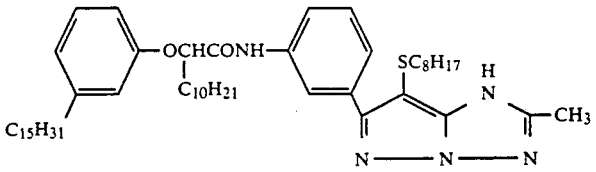
174
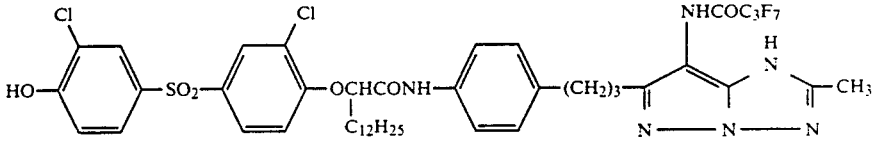
175
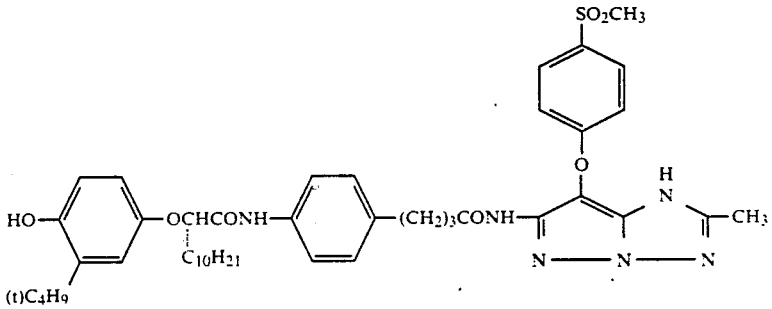
176
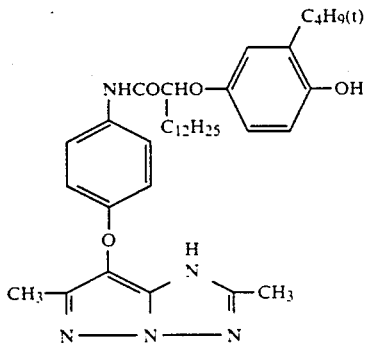
177
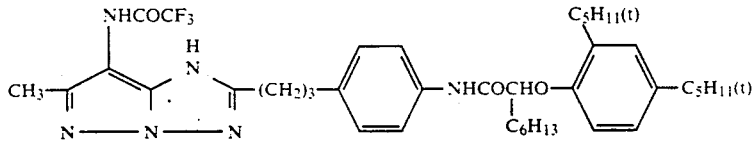
178
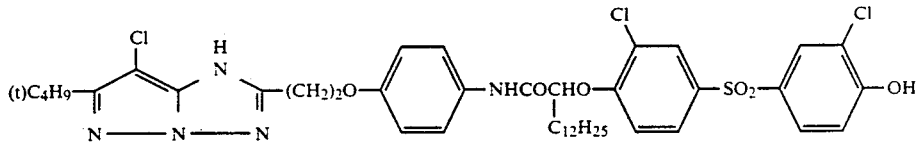
179
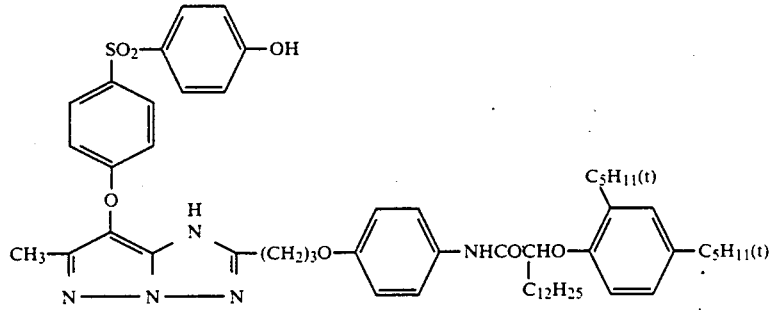

-continued
180
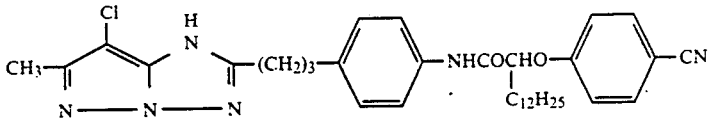
181
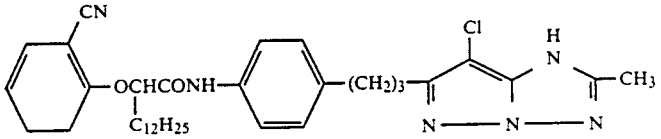
182
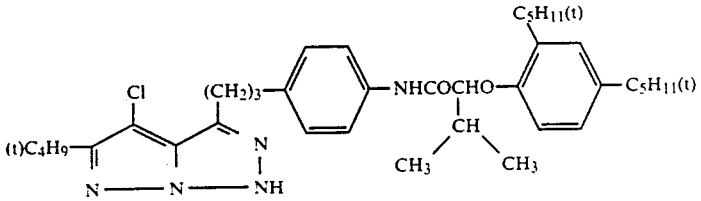
183
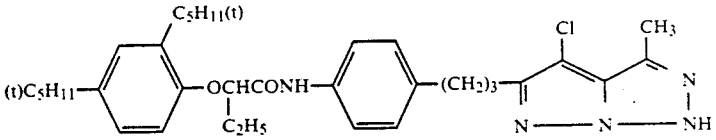
184
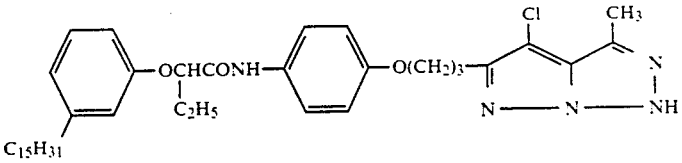
185
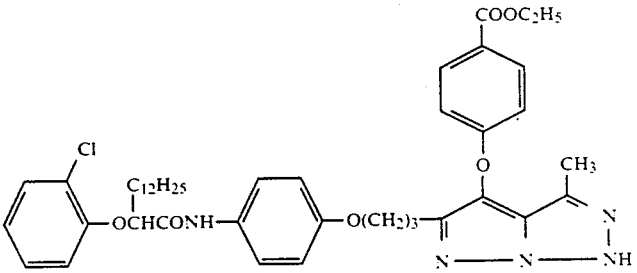
186
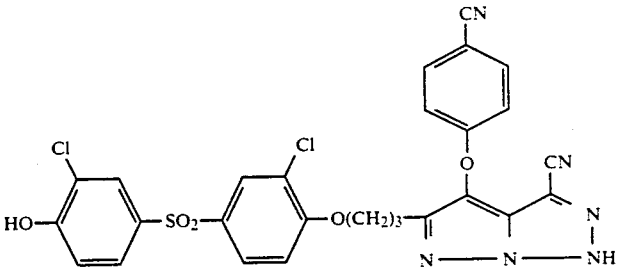
187
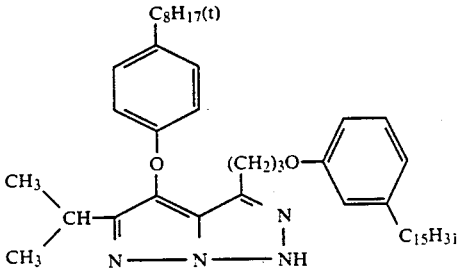

-continued
188
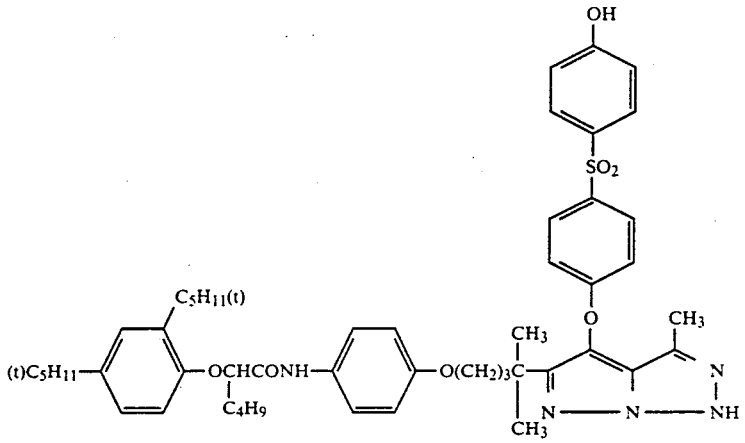
189
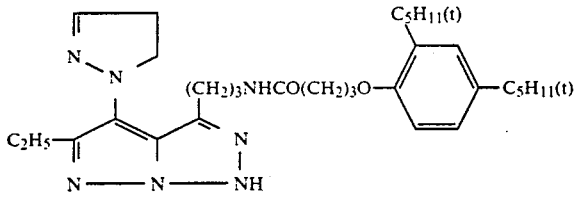
190
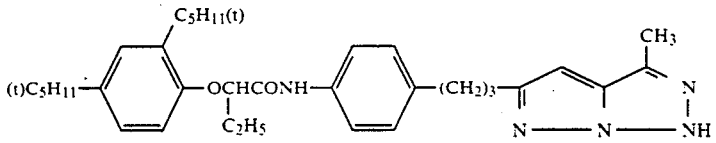
191
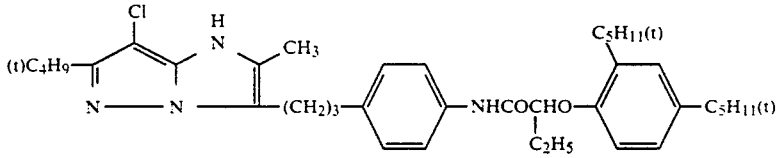
192
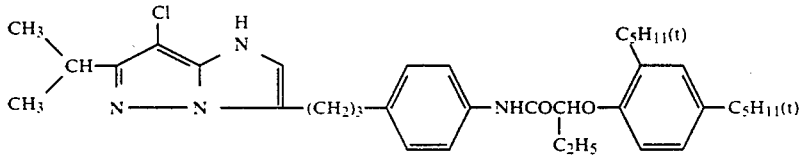
193
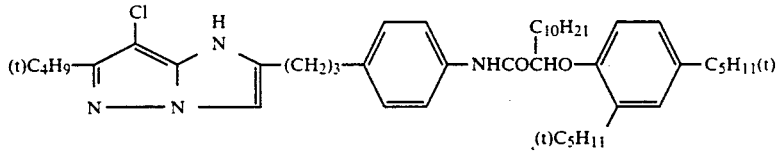
194
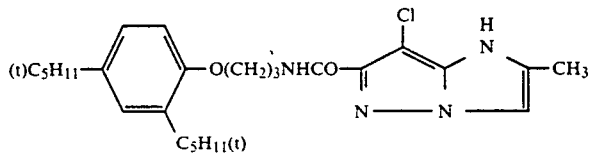
195
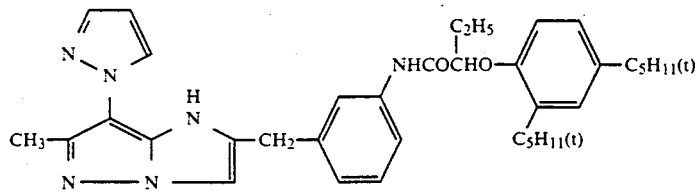

-continued
196
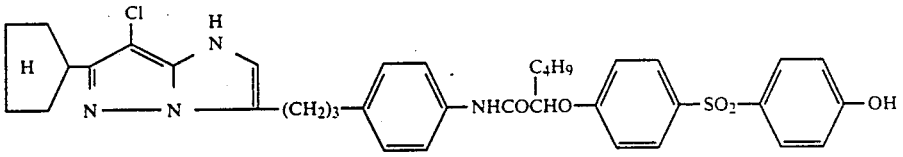
197
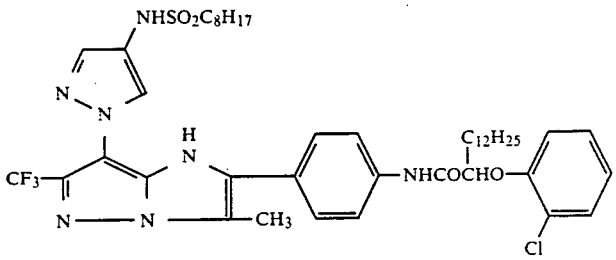
198
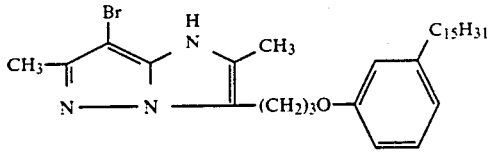
199
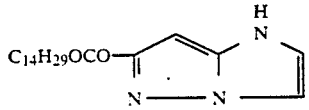
200
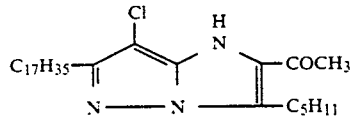
201
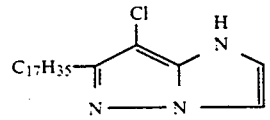
202
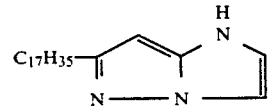
203
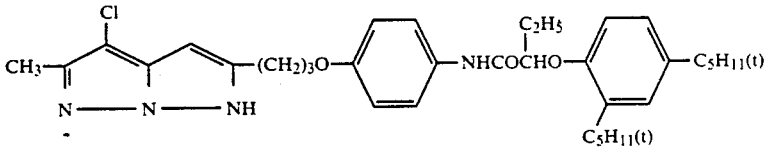
204
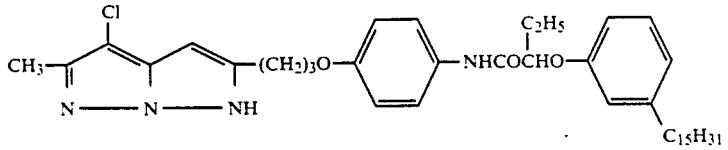

-continued
205
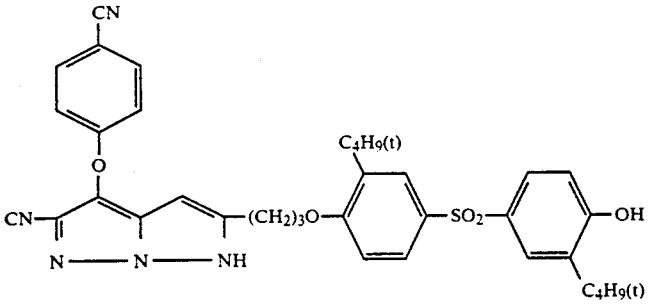
206
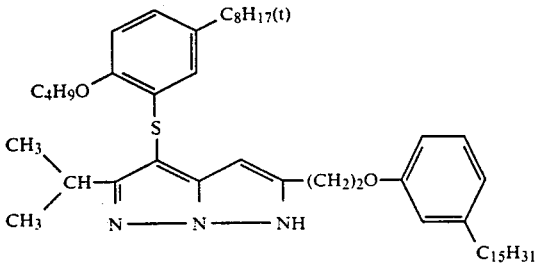
207
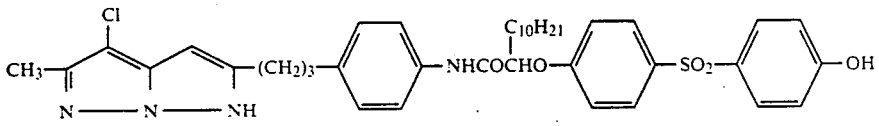
208
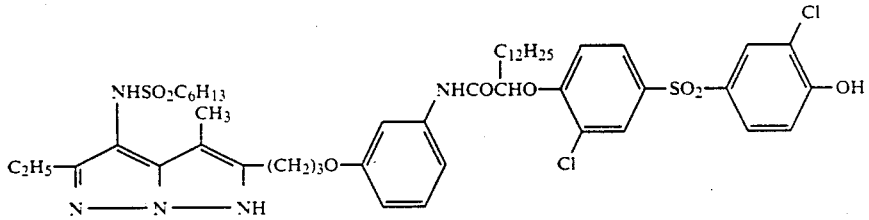
209
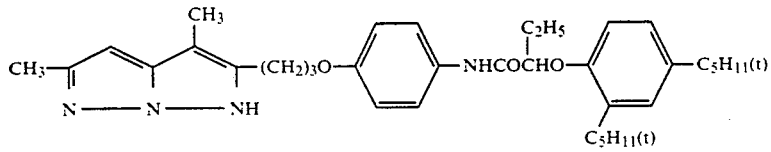
210
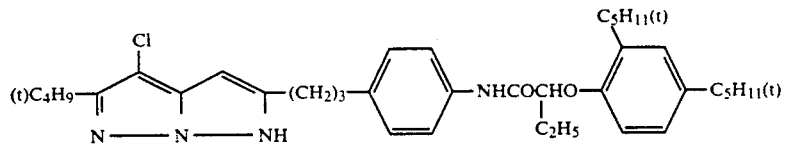
211
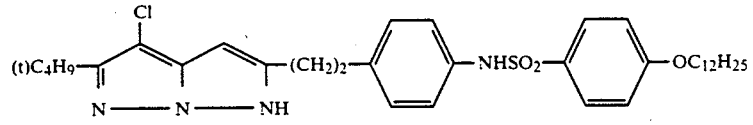
212
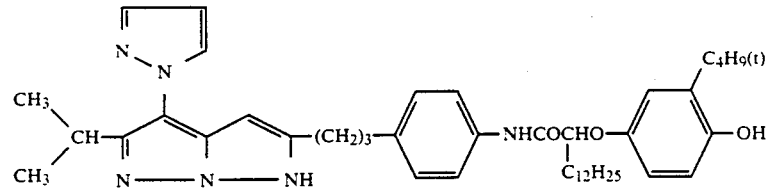

-continued
213
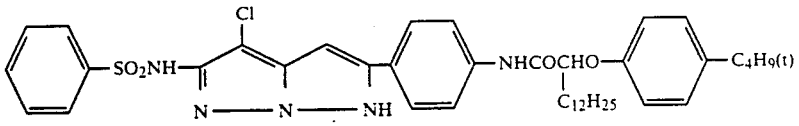
214
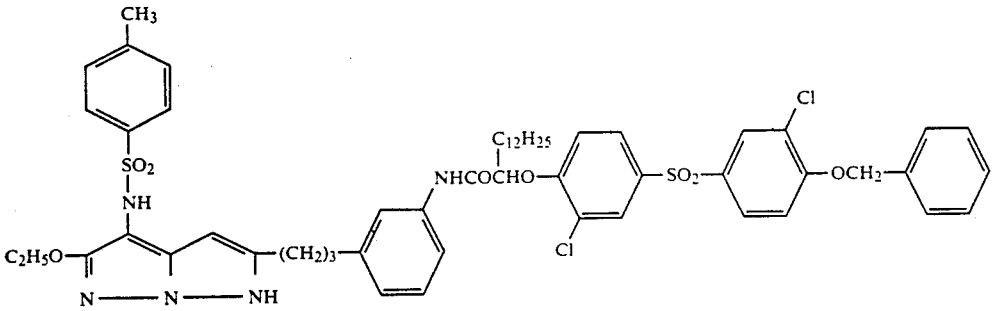
215
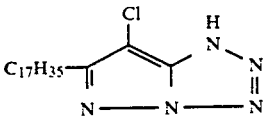
216
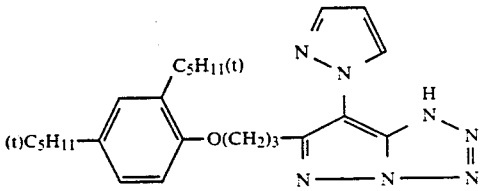
217
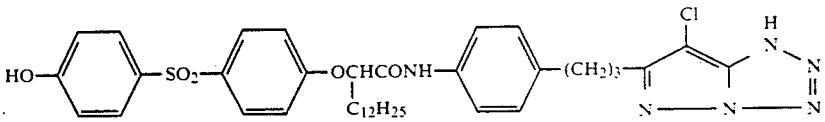
218
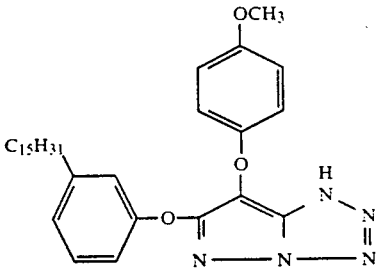
219
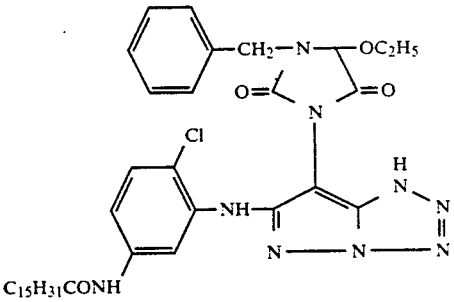
220
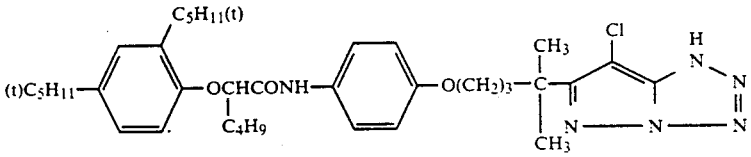

-continued

221

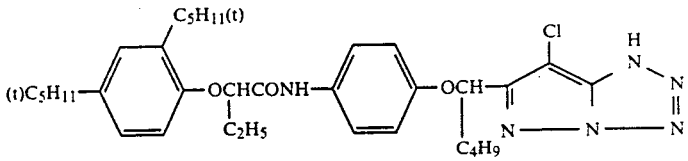

222

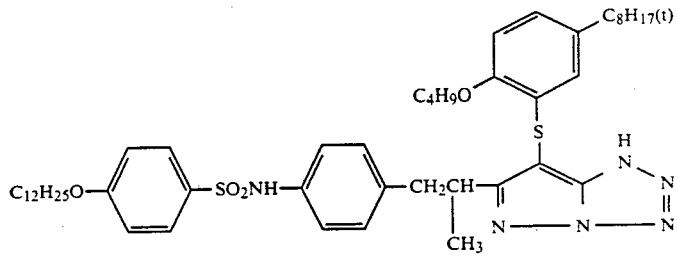

223

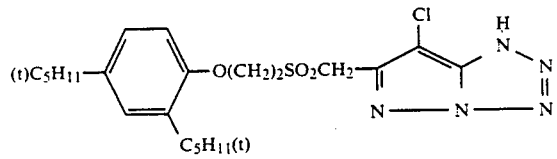

The above couplers can be produced by referring to Journal of the Chemical Society, Perkin, I (1977), 2047 thru 2052, U.S. Pat. No. 3,725,067, Japanese Patent O.P.I Publications No. 99437/1984, 42045/1983, 162548/1984, 171956/1984, 33552/ 1985, 43659/1985, 172982/1985 and 190779/1985.

The coupler provided by the present invention can be used in the range of $1\times10^{-3}$ mols to 1 mol, preferably in the range of $1\times10^{-2}$ to $8\times10^{-1}$ mols per 1 mol of silver halide.

Further, the coupler provided by the present invention can be used together with other magenta couplers.

The metal complex relevant to the present invention has a quenching rate constant of singlet oxygen of not less than $3\times10^{7}$ $M^{-1}$. sec.

The quenching rate constant of singlet oxygen can be determined by Rublane's method of measuring optical fading described in Journal of Physical Chemistry, 83, 591 (1979).

The method consists of irradiating same energy light onto a Rublane's chloroform solution and another chloroform solution obtained by mixing the above solution and a compound to be measured.

Assuming that the initial concentration of the Rublane's solution is [R], the concentration of the compound to be measured is [Q], the Rublane concentration of the Rublane's solution after the test is [R]O,F, and the Rublane concentration of the mixed solution after the test is [R]Q,F, the quenching rate constant of singlet oxygen (kg) is:

$$kg = \frac{5.3\times10^{7}([R]_F^{Q} - [R]_F^{O}) + 1.7\times10^{4}\ln([R]_F^{Q}/[R]_F^{O})}{[Q]\ln([R]/[R]_F^{Q})}$$

The metal complex provided by the present invention is a coumpound whose singlet oxy quenching rate constant defined by the above expression is not less than $3\times10^{7}$ $M^{31\ 1}$. $sec^{-1}$, preferably not less than $1\times10^{8}$ $M^{-1}$. $sec^{-1}$. The central metal of such metal complex is preferably a transition metal, further preferably Fe, Co, Ni, Pd or Pt, most preferably Ni.

Preferably, such desirable metal complex provided by the present invention should have any of the following formula [XII] thru [XV].

Formula [XII]

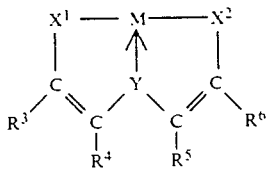

Formula [XIII]

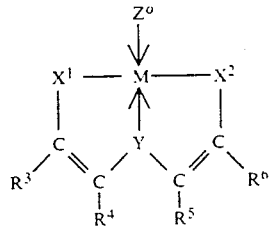

Formula [XIV]

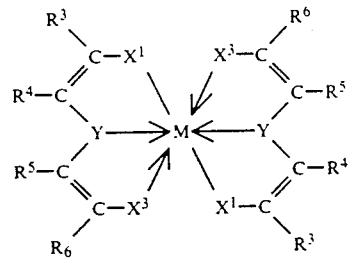

In the above formulae, [XII], [XIII] and [XIV], M represents a metal atom.

$X^1$ and $X^2$ independently represent an oxgen atom, a sulfur atom or $—NR^7$ ($R^7$ represents a hydrogen atom, an alkyl group, an aryl group or a hydroxyl group). $X^3$ represents a hydroxyl group or a mercapt group. Y represents an oxygen atom or a sulfur atom. $R^3$, $R^4$, $R^5$ and $R^6$ independently represent a hydrogen atom, a halogen atom, a cyano group, or an alkyl group, an aryl group, a cycloalkyl group or a heterocyclic group coupled directly or via a coupling group having a valence of 2 to a carbon atom. At least one of combinations of $R^3$ and $R^4$, and $R^5$ and $R^6$ may form a ring having 5- or 6-membered ring together with carbon atoms coupled with each other.

Formula [XV]

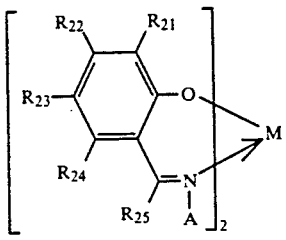

[In the above formula, $R^{21}$, $R^{22}$, $R^{23}$ and $R^{24}$ independently represent a hydrogen atom, a halogen atom, a hydroxy group, a cyano group, or an alkyl group, an aryl group, a cycloalkyl group or a heterocyclic group coupled directly or indirectly via a coupling group having a valence of 2 to a carbon atom on a benzene ring. $R^{21}$ may be coupled to $R^{22}$, $R^{22}$ to $R^{23}$, $R^{23}$ to $R^{24}$ to form a ring having 6-membered ring.

$R^{25}$ represents a hydrogen atom, an alkyl group or an aryl group. A represents a hydrogen atom, an alkyl group, an aryl group, or a hydroxy group. M represents a metal atom.]

In the above formulae [XII], [XIII] and [XIV], $X^1$ and $X^2$ may be the same or different from each other. They, however, represent an oxygen atom, a sulfur atom, or —$NR^7$ ($R^7$ represents a hydrogen atom, an alkyl group (e.g., a methyl group, an ethyl group, an n-propyl group, an i-propyl group, an n-butyl group, a t-butyl group, an i-butyl group or a benzyl group), an aryl group (e.g., a phenyl group, a tolyl group or a naphthyl group), or a hydroxyl group). Preferably, they are an oxygen atom or a sulfur atom, and further preferably, are an oxygen atom.

$X^3$ in the formula [XIV] represents mercapt group, or preferably a hydroxyl group.

Y in formulae [XII], [XIII] and [XIV] (in the formula [XIV], two Y's may be the same or different from each other) represents an oxygen atom, or preferably a sulfur atom.

$R^3$, $R^4$, $R^5$ and $R^6$ in formulae [XII], [XIII]and [XIV], which may be the same or different from each other, represent an alkyl group (e.g., a methyl group, an ethyl group, a propyl group, a butyl group, a hexyl group, an octyl group, a dodecyl group or a hexadecyl group each of which may be straight chained or branch), an aryl group (e.g., a phenyl group or a naphthyl group), a cycloalkyl group (e.g., a cyclopentyl group or a cyclohexyl group), or a heterocyclic ring (e.g., a pyridyl group, an imidazolyl group, a furyl group, a thienyl group, a pyrrolyl group, a quinolyl group or a morpholinyl group) coupled to a carbon atom via a hydrogen atom, a halogen atom (fluorine, chlorine, bromine or iodine), a cyano group, or a direct coupling group or a coupling group having a valence of 2 [e.g., —O—, —S—, —$NR^{7'}$—{$R^{7'}$ represents a hydrogen atom, a hydroxyl group, an alkyl group (e.g., a methyl group, an ethyl group, an n-propyl group, an i-propyl group, an n-butyl group, a t-butyl group or an i-butyl group), or an aryl gruop (e.g., a phenyl group, a tolyl group or a naphthyl group) having a valence of 1}, —OCO—, —CO—, —NHCO—, —CONH—, —COO—, —$SO_2$NH—, —NH$SO_2$—, or —$SO_2$9 . Of athese groups, the groups formed along with a coupling group with a valence of 2 by the alkyl group, aryl group, cycloalkyl group or heterocyclic ring group coupled via the coupling group to a carbon atom include, e.g., an alkoxy group (e.g., a chained or branching alkyl oxy group such as a methoxy gruop, an ethoxy group, an n-butyl oxy group or an octyl oxy group), an alkoxy carbonyl group (e.g., a chained or branching alkyloxy carbonyl group such as a methoxy carbonyl group, an ethoxy carbonyl group or an n-hexadecyloxy carbonyl group), an alkyl carbonyl group (e.g., a chained or branching alkyl carbonyl group such as an acetyl group, a valeryl group or a stearoyl group), an aryl carbonyl group (e.g., a benzoyl group), an alkyl amino group (e.g., a chained or branching alkyl amino group such as an N-b-nutyl amino group, an N,N-di-butyl amino group or an N,N-di-n-octyl amino group), an alkyl carbamoyl group (e.g., a chained or branching alkyl carbamoyl group such as an n-butyl carbamoyl group or a n-dodecyl carbamoyl group), an alkyl sulfamoyl group (e.g., a chained or branching alkyl sulfamoyl group such as an n-butyl sulfamoyl group or a n-dodecyl sulfamoyl group), an alkyl acyl amino group (e.g., a chained or branching alkyl carbonyl amino group such as an acetyl amino group or a palmitoyl amino group), an aryloxy group (e.g., a phenoxy group or a naphthoxy group), an aryloxy carbonyl group (e.g., a phenoxy carbonyl group or a naphthoxy carbonyl group), an aryl amino group (e.g., an N-phenyl amino group or an N-phenyl-N-methyl amino group), an aryl carbamoyl group (e.g., a phenyl carbamoyl group), an aryl sulfamoyl group (e.g., a phenyl sulfamoyl group), and an aryl acyl amino group (e.g., a benzoyl amino group).

$R^3$, $R^4$, $R^5$ and $R^6$ in formulae [XII], [XIII] and [XIV] may form a ring composed of 4 or 6 members along with a carbon atom to which at least one of combinations of $R^3$ and $R^4$, and $R^5$ and $R^6$ is coupled. The rings composed of 5 or 6 members formed along with a carbon atom to which at least of the combinations of $R^3$ and $R^4$, and $R^5$ and $R^6$ is coupled include, e.g., hydrocarbon and heterocyclic rings (e.g., a nitrogen contianed 5- or 6-member heterocyclic ring) having at least one unsaturated bond such as a cyclopentene ring, a cyclohexene ring or a benzene ring (containg a condensed benzene ring such as a naphthalene ring or an anthracene ring). The 5- or 6-member ring can be provided with a substituent such as a halogen atom (fluorine, chlorine, bromine or iodine), a cyano group, an alkyl group (e.g., a chained or branching alkyl group having 1 thru 20 carbon atoms such as a methyl group, an ethyl gruop, a n-propyl group, an n-butyl group, an n-octyl group, a t-octyl group or an n-hexadecyl group), an aryl group (e.g., a phenyl group or a naphthyl group), an alkoxy group (e.g., a chained or branching alkyloxy group such as a methoxy group, an n-butoxy group or a t-butoxy group), an aryloxy group (e.g., a phenoxy group), an alkoxy carbonyl group (e.g., a chained or branching alkyloxy carbonyl group such as an n-pentyloxy carbonyl group, a t-pentyloxy carbonyl group), an n-octyloxy carbonyl gruop or a t-octyloxy carbonyl group), an aryloxy carbonyl group (e.g., a phenoxy carbonyl group), an acyl group (e.g., a chained or branching alkyl carbonyl group such as an acetyl group or a stearoyl group), an acyl amino group (e.g., a chained or branching alkyl carbonyl amino group including an acetamide group, or an aryl carbonyl amino group including a benzoyl amino group), an aryl amino group (e.g., an N-phenyl amino group), an alkyl amino group (e.g., a chained or branching alkyl amino group such as an N-n-butyl amino group or an N,N-di-ethyl amino group), a carbamoyl group (e.g., a chained or branching alkyl carbamoyl group such as an n-butyl carbamoyl group), a sulfamoyl group (e.g., a chained or branching alkyl sulfamoyl group such as an N,N-di-n-butyl sulfamoyl group or an N-n-dodecyl sulfamoyl group), a sulfon amide group (e.g., a chained or branching alkyl sulfonyl amino group such as a methyl sulfonyl amino group, or an aryl sulfonyl amino group such as a phenyl sulfonyl amino group), a sulfonyl group (e.g., a chained or branching alkyl sulfonyl group such as a mesyl group, or an aryl sulfonyl group such as a tosyl group), or a cycloalkyl group (e.g., a cyclohexyl group).

The parts expressed by formulae [XII], [XIII] and [XIV] should preferably form a 5- or 6-member ring along with an alkyl or aryl group represented by $R^3$, $R^4$, $R^5$ and $r^6$, or a carbon atom to which at least one of the combinations of $R^3$ and $R^4$, and $R^5$ and $R^6$ is coupled, more preferably form a 6-member ring along with a carbon atom to which the combinations of $R^3$ and $R^4$, and $R^5$ and $R^6$ are coupled, and most preferably form a benzene ring.

In formulae [XII], [XIII] and [XIV], M represents a metal atom, which is preferably a transition metal atom, more preferably a nickel, copper, iron, cobalt, palladium or platinum atom, and most preferably a nickel atom.

The compound which can be located at M as Z: in the formula [XIII] is preferably an alkyl amine ahving a chained or branching alkyl group, most preferably a di-alkyl amine or a tri-alkyl amine the total carbon count of whose alkyl group is 2 thru 36, or 3 thru 24, including mono-alkyl amine such as butyl amine, octyl amine (e.g., t-octyl amine), dodecyl amine (e.g., n-dodecyl amine), hexadecyl amine or octanol amine; di-alkyl amine such as di-ethyl amine, di-butyl amine, dioctyl amine, di-dodecyl amine, di-ethanol amine or di-butanol anine; or tri-alkyl amine such as tri-ethyl amine, tri-butyl amine, tri-octyl amine, tri-ethanol amine, tri-butanol amine or tri-octanol amine.

The more desirable metal complex provided by the present invention presented in formulae [XII], [XIII] and [XIV] is as shown in the following formulae [XIIa], [XIIIa] and [XIVa]:

Formula [XIIa]

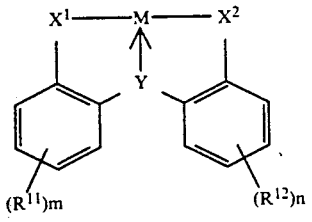

Formula [XIIIa]

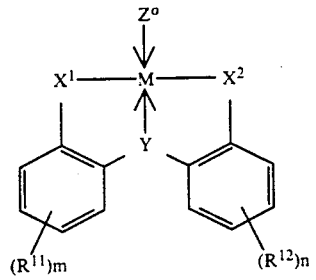

-continued

Formula [XIVa]

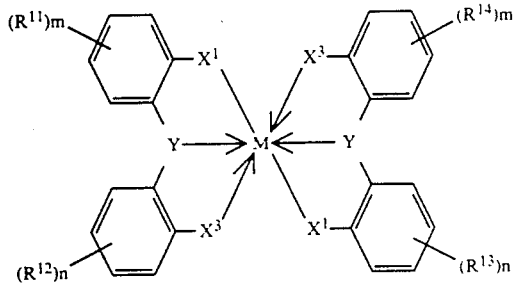

In formulae [XIIa], [XIIIa] and [XIVa], M, $X^1$, $X^2$, $X^3$, Y and $^0$ have the same meaning as above.

In these formulae, $r^{11}$, $R^{12}$, $R^{13}$ and $R^{14}$ refer to an alkyl group (e.g., a chained or branching alkyl group having 1 thru 20 carbon atoms such as a methyl group, an ethyl group, an n-propyl group, an n-butyl group, an n-octyl group, a t-octyl group or an n-hexadecyl group); aryl group (e.g., a phenyl group or a naphthyl group); an alkoxy gropu (e.g., a chained or branching alkyloxy group such as a methoxy group, an n-butoxy group or a t-butoxy group); an aryloxy gruop (e.g., a phenoxy gorup); an alkoxy carbonyl group (e.g., a chained or branching alkyloxy carbonyl group such as an n-pentyloxy carbonyl group, a t-pentyloxy carbonyl group, an n-octyloxy carbonyl group or a t-octyloxy carbonyl group); an aryloxy carbonyl group (e.g., a phenoxy carbonyl group); an acyl group (e.g., a chained or branching alkyl carbonyl group such as an acetyl group or a stearoyl group); an acyl amino group (e.g., a chained or branching alkyl carbonyl amino group such as an acetamide group, or an aryl carbonyl amino group such as a benzoyl amino group); an aryl amino group (e.g., an N-phenyl amino group); an alkyl amino group (e.g., a chained or branching alkyl amino group such as an N-n-butyl amino group or an N,N-di-ethyl amino group); a carbamoyl group (e.g., a chained or branching alkyl carbamoyl group such as an n-butyl carbamoyl group); a sulfamoyl group (e.g., a chained or branching alkyl sulfamoyl group such as an N,N-di-n-butyl sulfamoyl group or an N-n-dodecyl sulfamoyl group); a sulfon amide group (e.g., a chained or branching alkyl sulfonyl amino group such as a methyl sulfonyl amino group, or an aryl sulfonyl amino group such as a phenyl sulfonyl amino group); a sulfonyl group (a chained or branching alkyl sulfonyl group such as a mesyl group, or an aryl sulfonyl group such as a tosyl group); or a cycloalkyl group (e.g., a cyclohexyl group). m and n refer to any number of 0 thru 4.

Desirable among the compounds expressed by formulae [XIIa], [XIIIa] and [XIVa] is that having the formula [XIIIa]. Most desirable among the compounds expressed by the formula [XIIIa] is that having the formula [XIIIb].

Formula [XIIIb]

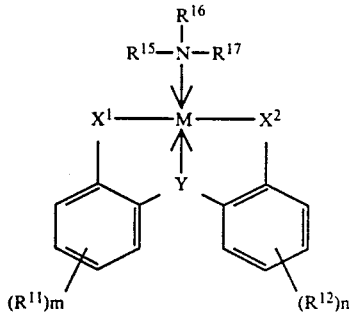

In the formula [XIIIb], M, $X^1$, $X^2$, Y, $R^{11}$, $R^{12}$, m and n have the same meaning as above. $R^{15}$, $R^{16}$ and $R^{17}$ refer to a hydrogen atom, an alkyl group (e.g., a butyl group, an octyl group or a stearyl group), or an aryl group (e.g., a phenyl group or naphthyl group). At least two of R's, $R^{15}$, $R^{16}$ and $R^{17}$ are an alkyl group or an aryl group.

In the formula [XV], the halogen atoms represented by $R^{21}$ $R^{22}$, $R^{23}$ and $R^{24}$ are a fluorine atom, a chlorine atom, a bromine atom or an iodine atom.

The alkyl groups represented by $R^{21}$, $R^{22}$, $R^{23}$ and $R^{24}$, which are preferably an alkyl group having 1 or 19 carbon atoms, may be a chained or branching alkyl group, and may have a substituent.

The aryl groups represented by $R^{21}$, $R^{22}$, $R^{23}$ and $R^{24}$, which are preferably an aryl group having 4 or 14 carbon atoms, may contain a substituent.

The heterocyclic ring groups represented by $R^{21}$, $R^{22}$, $R^{23}$ and $R^{24}$, which are preferably a 5- or 6-member ring, may contain a substituent.

The cycloalkyl groups represented by $r^{21}$, $R^{22}$, $R^{23}$ and $R^{24}$, which are preferably a 5- or 6-member ring group, may contain a substituent.

The 6-member rings formed by coupling of $R^{21}$ and $R^{22}$ include:

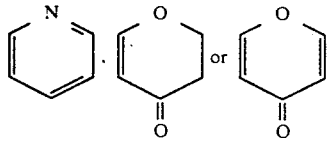

The 6-member ring formed by combination of $R^{22}$ and $R^{23}$ or $R^{23}$ and $R^{24}$ is preferably a benzene ring, which may contain a substituent or may be coupled to another compound.

The alkyl groups represented by $R^{21}$, $R^{22}$, $R^{23}$ and $R^{24}$ include e.g., a methyl group, an ethyl group, a propyl group, a butyl group, a t-butyl group, a hexyl group, an octyl group, a decyl group, a dodecyl group, a tetradecyl group, a hexadecyl group and an octa-decyl group.

The aryl groups represented by $R^{21}$, $R^{22}$, $R^{23}$ and $R^{24}$ include, e.g., a phenyl group and a naphthyl group.

The heterocyclic ring groups represented by $R^{21}$, $R^{22}$, $R^{23}$ and $R^{24}$ are preferably a 5- or 6-member heterocyclic ring group containing at least one nitrogen, oxygen or sulfur atom as the hetero atom, including, e.g., a furyl group, a hydrofuryl group, a thienyl group, a pyrrolyl group, a pyrrolidyl group, a pyridyl group, an imidazolyl group, a pyrazolyl group, a quinolyl group, an indolyl group, an oxaxolyl group, and a thiazolyl group.

The cycloalkyl groups represented by $R^{21}$, $R^{22}$, $R^{23}$ and $R^{24}$ include, e.g., a cyclopentyl group, a cyclohexyl group, a cyclohexenyl group, and a cyclohexadienyl group.

The 6-member rings formed by combination of $R^{21}$, $R^{22}$, $R^{23}$ and $R^{24}$ include e g., a benzene ring, a naphthalene ring, an iso-benzothiophene, an iso-benzofuran ring and an iso-indone ring.

The alkyl groups, cycloalkyl groups and aryl groups, and the heterocyclic ring groups represented by $R^{21}$, $R^{22}$, $R^{23}$ and $R^{24}$ may be coupled to a carbon atom on a benzene ring via a coupling group having a valence of 2, e.g., an oxy-group (—O—), a thio-group (—s—), an amino group, an oxy-carbonyl group, a carbonyl group, a carbamoyl group, a sulfamoyl group, a carbamoyl group, a sulfonyl amino group, a sulfonyl group or a carbonyloxy group, which may form a desirable group.

The alkyl groups represented by $R^{21}$, $R^{22}$, $R^{23}$ and $R^{24}$ are, e.g., couipled to a carbon atom on a benzene ring via a coupling group having a valence of 2, providing an alkoxy group (e.g., a methoxy group, an ethoxy group, a butoxy group, a propoxy group, a 2-ethyl hexyloxy group, an n-decyloxy group, an n-dodecyloxy group or an n-hexa-decyloxy group); an alkoxy carbonyl group (e.g., a methoxy carbonyl group, an ethoxy carbonyl group, a butoxy carbonyl group, an n-decyloxy carbonyl group or an n-hexa-decyloxy carbonyl group); an acyl group (e.g., acetyl group, a valeryl group, a stearoyl group, a benzoyl group or a toluoyl group); an acyloxy group (e.g., an acetoxy group or a hexadecyl carbonyloxy group); an alkyl amino group (e.g., an n-butyl amino group, an N,N di-ethyl amino group or a N,N-di-decyl amino group); an alkyl carbamoyl group (e.g., a butyl carbamoyl group, an N,N-di-ethyl carbamoyl group or an b-dodecyl carbamoyl group); an alkyl sulfamoyl group (e.g., a butyl sulfamoyl group, an N,N-di-ethyl sulfamoyl group or an n-dodecyl sulfamoyl group); a sulfonyl amino group (e.g., a methyl sulfonyl amino group or a butyl sulfonyl amino group); a sulfonyl group (e.g., a mesyl group or an ethane sulfonyl group); or acyl amino group (e.g., an acetyl amino group, a valeryl amino group, a palmitoyl amino group, a benzoyl amino group or a toluoyl amino group).

The cycloalkyl groups represented by $R^{21}$, $R^{22}$, $R^{23}$ and $R^{24}$ are, e.g., coupled to a carbon atom on a ring via a coupling group with a valence of 2, providing an cyclohexyloxy group, a cyclohexyl carbonyl group, a cyclohexyloxy carbonyl group, a cyclohexyloxy carbonyl group, a cyclohexyl amino group, a cyclohexenyl carbonyl group, or a cyclohexenyloxy group.

The aryl groups represented by $R^{21}$, $R^{22}$, $R^{23}$ and $R^{24}$ are e g., coupled to a carbon atom on a ring via a coupling group with a valence of 2, providing an aryloxy group (e.g., a phenoxy group or a naphthoxy group); an aryloxy carbonyl group (e.g., a phenoxy carbonyl group or a naphthoxy carbonyl group); an acyl group (e.g., a benzoyl group or a naphthoyl group); an anilino group (e.g., a phenyl amino group, an N-methyl anilino group or an N-acetyl anilino group); an acyloxy group (e.g., a benzoyloxy group or a toluoyloxy group); an aryl carbamoyl group (e.g., a phenyl carbamoyl group); an aryl sulfamoyl group (e.g., a phenyl sulfamoyl group); an aryl sulfonyl amino group (e.g., a phenyl sulfonyl amino group or a p-tolyl sulfonyl amino group); an aryl sulfonyl group (e.g., a benzene sulfonyl group or a tocyl group); or an acyl amino group (e.g., a benzoyl amino group).

The 6-member rings formed by coupling of alkyl, aryl, heterocyclic ring and cycloalkyl groups represented by $R^{21}$, $R^{22}$, $R^{23}$ and $R^{24}$, or combination of $R^{21}$ and $R^{22}$, $R^{22}$ and $R^{23}$ or $R^{23}$ and $R^{24}$ may be replaced by a halogen atom (e.g., chlorine, bromine or fluorine), a cyano group, an alkyl group (e.g., a methyl group, an ethyl group, an i-propyl group, a butyl group, a hexyl group, an octyl group, a decyl group, a dodecyl group, a tetra-decyl group, a hexa-decyl group, a hepta-decyl group, an octa-decyl group or a methoxy ethoxy ethyl group), an aryl group (e.g., a phenyl group, a tolyl group, a naphthyl group, a chloro-phenyl group, a methoxy phenyl group or an acetyl phenyl group), an alkoxy group (e.g., a methoxy group, an ethoxy group, a butoxy gruop, a propoxy group or a methoxy ethoxy group), an aryloxy group (e.g., a phenoxy group, a tolyloxy group, a naphthoxy group or a methoxy phenoxy group), an alkoxy carbonyl group (e.g., a methoxy carbonyl group, a butoxy carbonyl group or a phenoxy methoxy carbonyl group), an aryloxy carbonyl group (e.g., a phenoxy carbonyl group, a tolyloxy carbonyl group or a methoxy phenoxy carbonyl group), an acyl group (e.g., a formyl group, an acetyl group, a valeryl group, a stearoyl group, a benzoyl group, a toluoyl group, a naphtoyl group or a p-methoxy benzoyl group), an acyloxy group (e.g., an acetoxy group or an acyloxy group), an acyl amino group (e.g., an acetamide group, a benzamide group or a methoxy acetamide gruop), an anilino group (e.g., a phenyl amino group, an N-methyl anilino group or an N-acetyl anilino group), an alkyl amino group (e.g., an n-butyl amino group, an N,N-di-ethyl amino group or a 4-methoxy-n-butyl amino group), a carbamoyl group e.g., an n-butyl carbamoyl group, an N,N-di-ethyl carbamoyl group, an n-butyl sulfamoyl group, an N,N-di-ethyl sulfamoyl group, an n-ddodecyl sulfamoyl group or an N-(4-methoxy-n-butyl) sulfamoyl group], a sulfonyl amino group (e.g., a methyl sulfonyl amino group, a phenyl sulfonyl amino group or a methoxy methyl sulfonyl amino group), or a sulfonyl group (e.g., a mesyl group, a tocyl group or a methoxy methane sulfonyl group).

The alkyl groups represented by $R^{25}$ and A, which may be chained or branch, may contain a substituent. These alkyl groups, except for the carbon atoms on the substituent, comprise preferably 1 or 20 carbon atoms, including, e.g., a methyl group, an ethyl group, a propyl group, a butyl group, a hexyl group, an octyl group, a decyl group, a dodecyl group, a tetra-decyl group, a hexa-decyl group, a hepta-decyl group, and an octa-decyl group.

The aryl groups represented by $R^{25}$ and A may contain a substituent, and comprise preferably, except for the carbon atoms on the constituent, 6 or 16 carbon atoms, including, e.g., a phenyl group, a tolyl group or a naphthyl group. They also may have two coupling element coupled via A.

In the formula, M refers to a metal atom, being preferably a transition metal atom, more preferably Cu, Co, Ni, Pd, Fe or Pt, most preferably Ni. As A, the hydroxy group is desirable.

Among the complexes represented by the above formula [XV], R should be preferably an alkyl, cycloalkyl, aryl or heterocyclic ring group via an oxy-, thio- or carbonyl group, a hydroxy group, or a fluorine atom, and at least one of the groups represented by $R^{22}$, $R^{23}$ or $R^{24}$ is a hydrogen atom, a hydroxy group, an alkyl group or an alkoxy group. More preferably, $R^{25}$ is a hydrogen atom, and the total carbon atom count of a group represented by $R^{21}$, $R^{22}$ or $R^{2}$ is not less than 4.

The sample metal complexes provided by the present invention include, but are not limited to, the following compounds:

Sample metal complexes

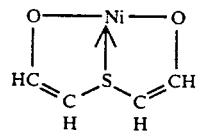

(1)

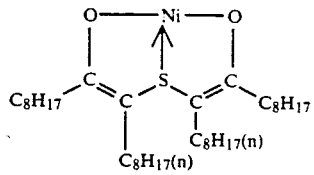

(2)

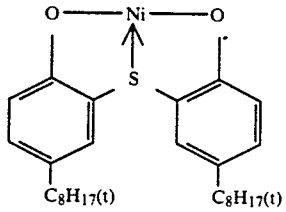

(3)

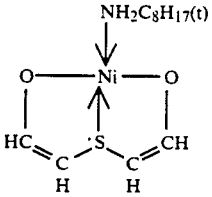

(4)

-continued
(5)
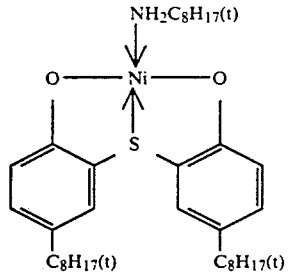
(6)
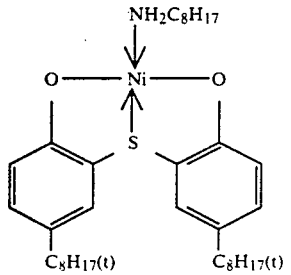
(7)
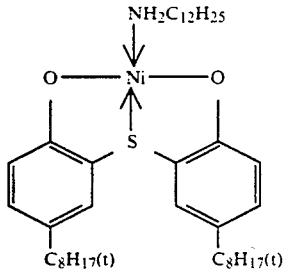
(8)
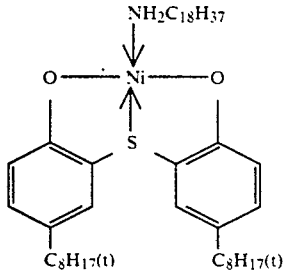
(9)
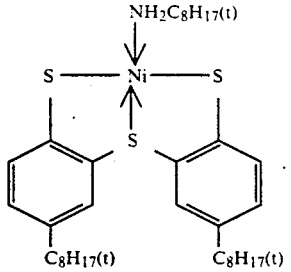
(10)
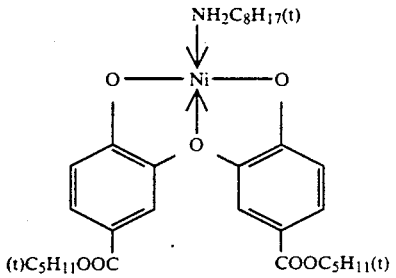

-continued
(11)
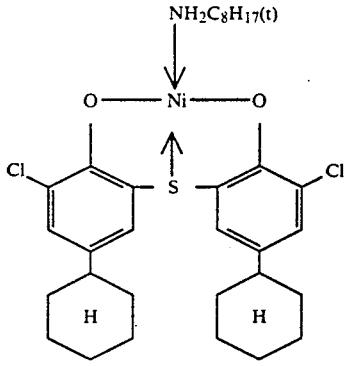
(12)
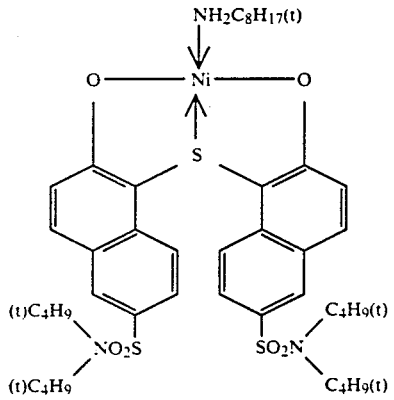
(13)
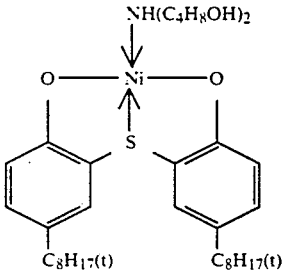
(14)
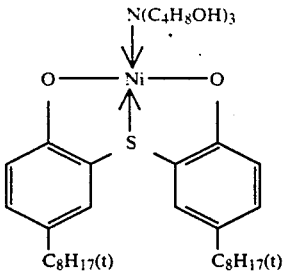
(15)
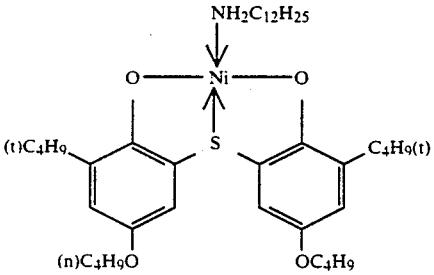

-continued
(16)
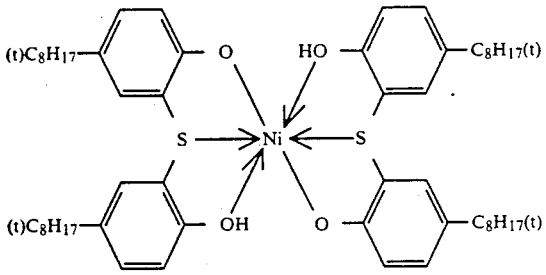
(17)
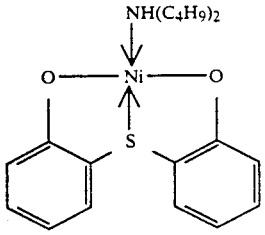
(18)
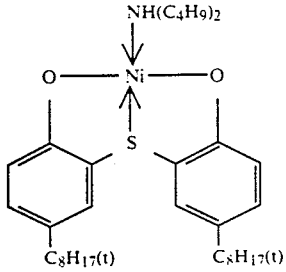
(19)
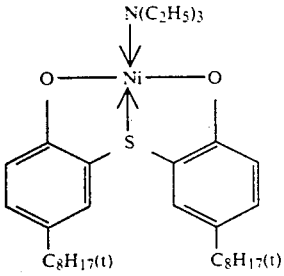
(20)
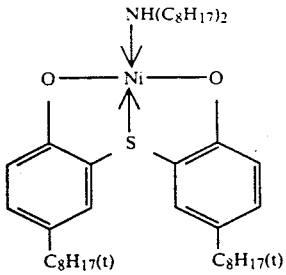
(21)
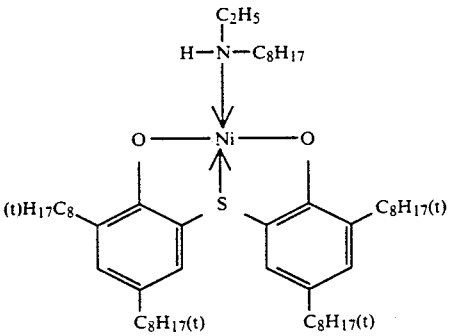

-continued
(22)
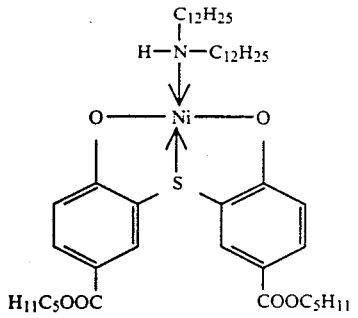
(23)
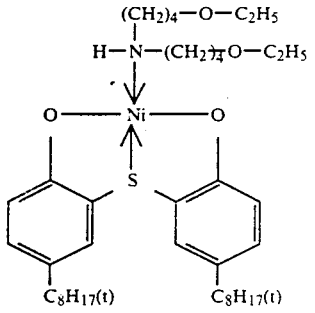
(24)
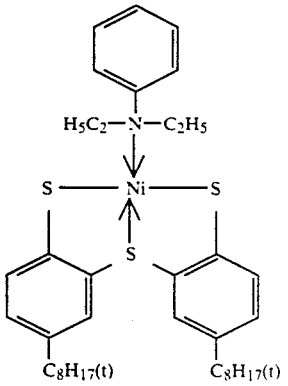
(25)
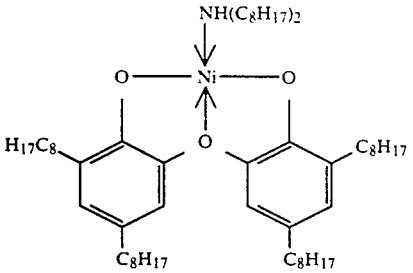
(26)
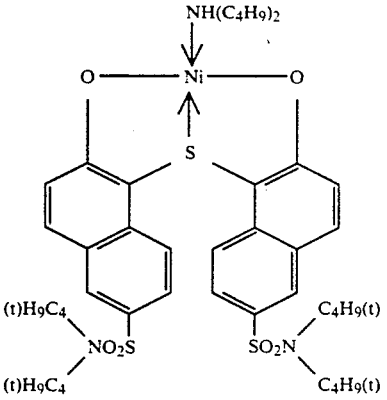

-continued
(27)
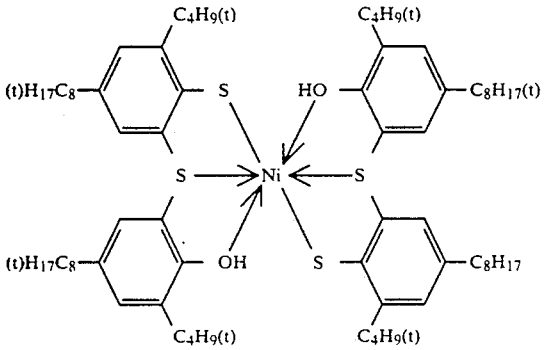
(28)
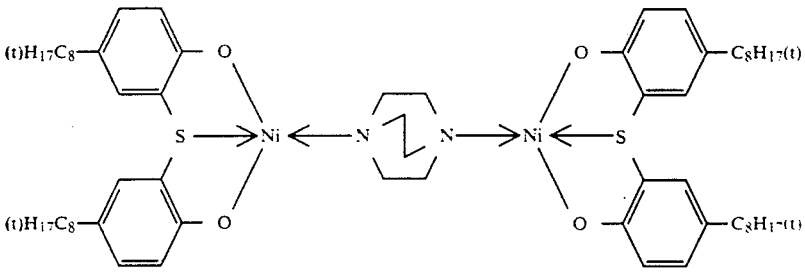
(29)
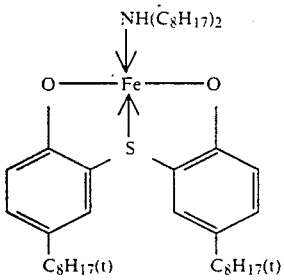
(30)
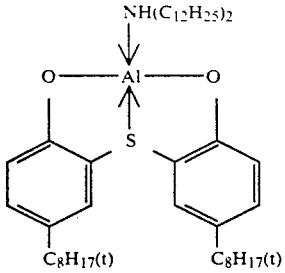
(31)
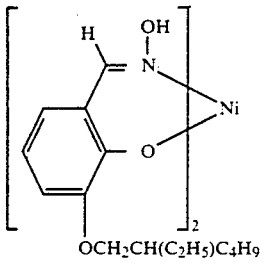

-continued
(32)
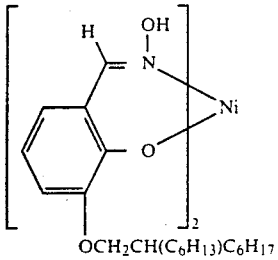
(33)
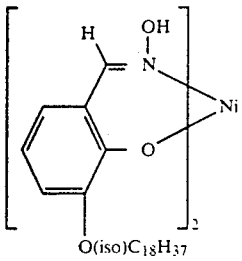
(34)
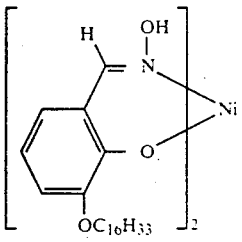
(35)
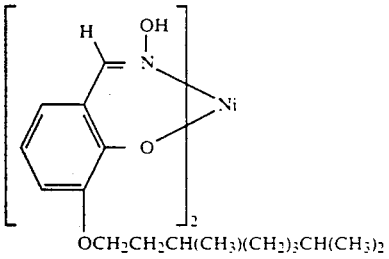
(36)
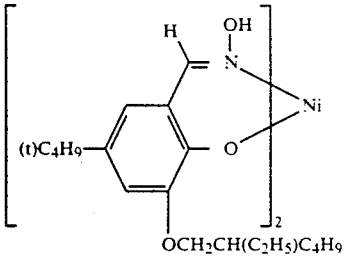
(37)
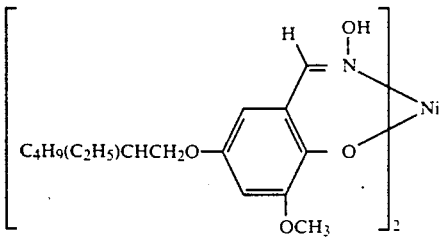

-continued
(38)
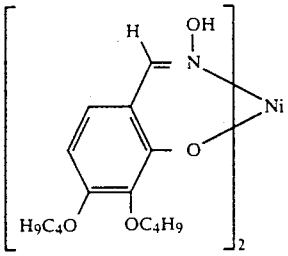
(39)
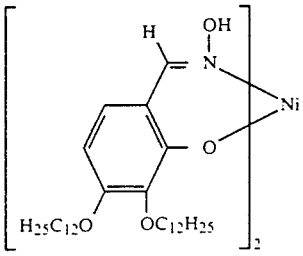
(40)
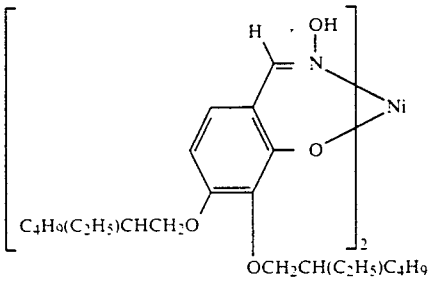
(41)
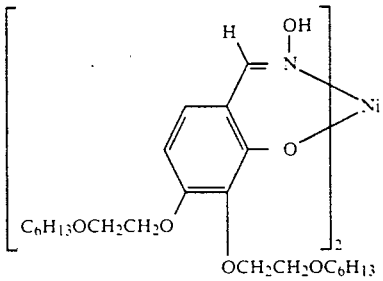
(42)
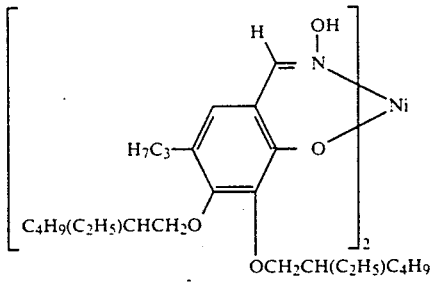
(43)
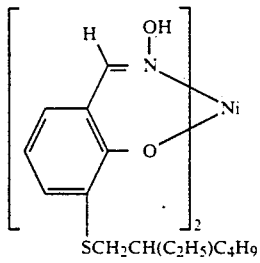

-continued
(44)
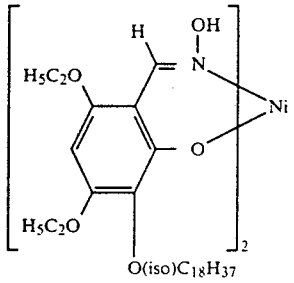
(45)
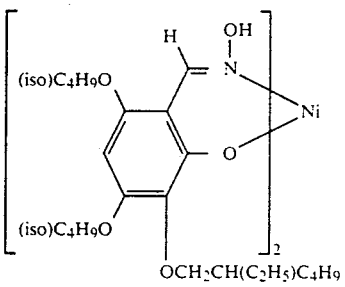
(46)
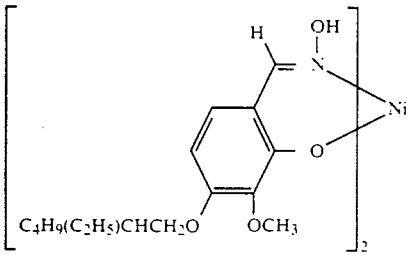
(47)
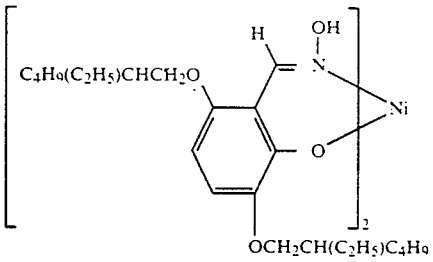
(48)
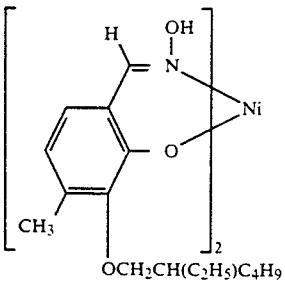

-continued
(49)
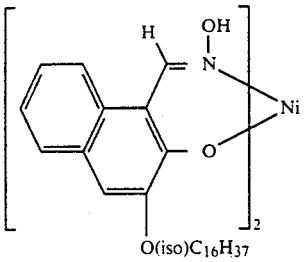
(50)
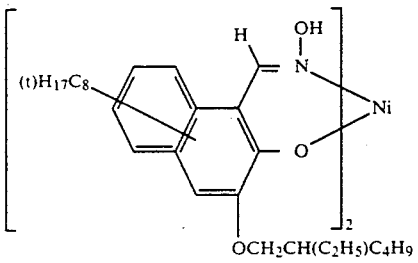
(51)
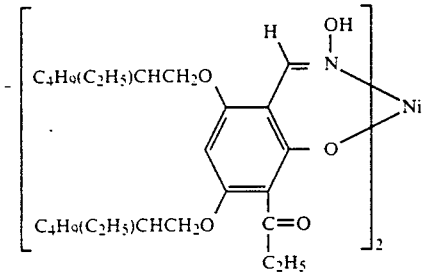
(52)
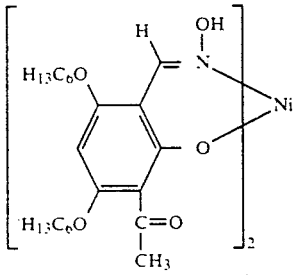
(53)
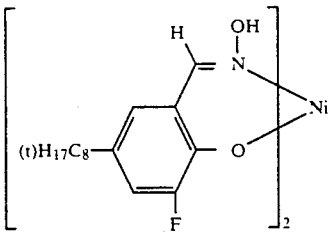
(54)
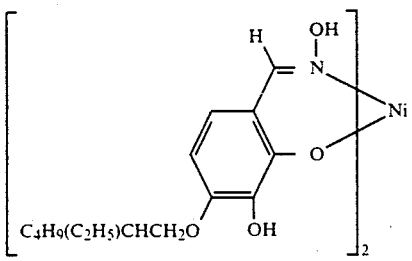

-continued
(55)
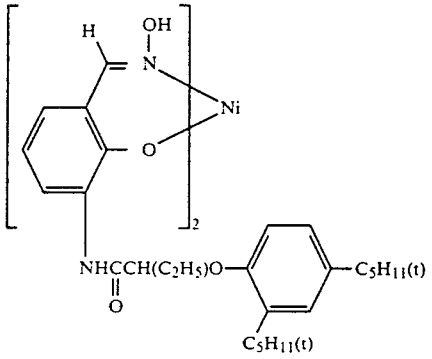
(56)
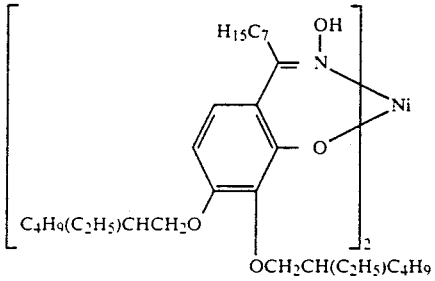
(57)
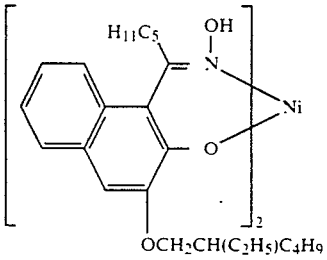
(58)
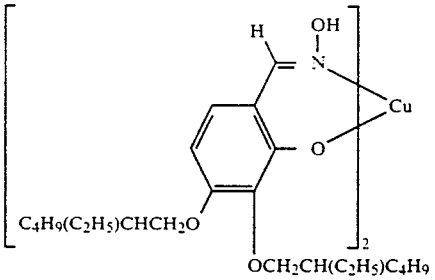
(59)
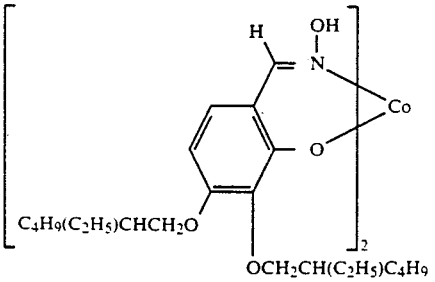

-continued
(60)
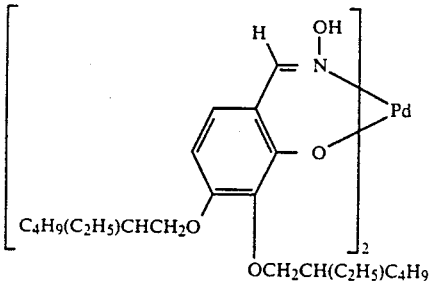
(61)
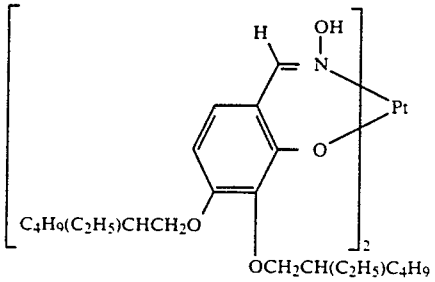
(62)
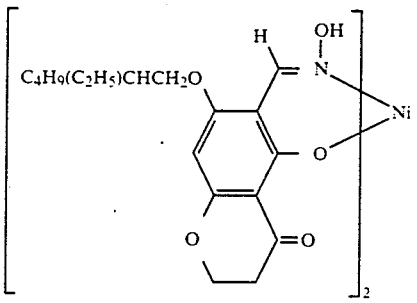
(63)
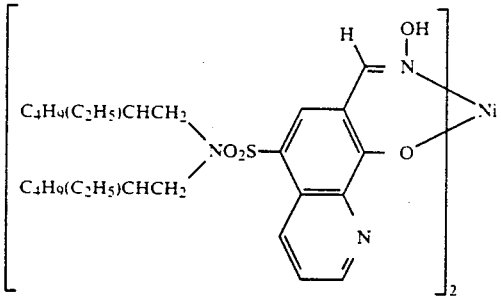
(64)
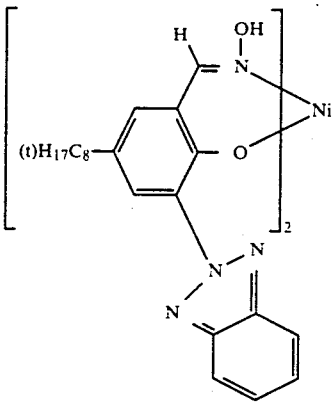

-continued
(65)
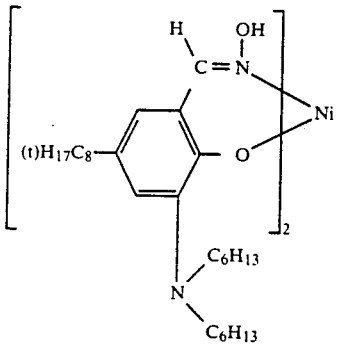
(66)
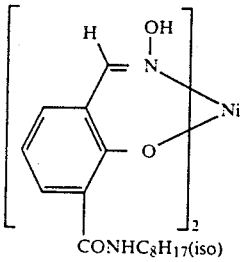
(67)
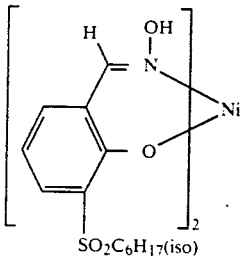
(68)
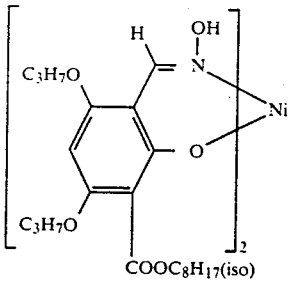
(69)
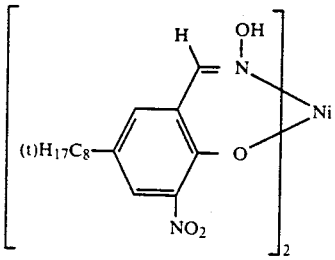

-continued
(70)
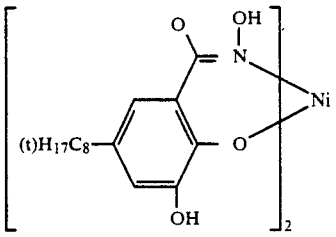
(71)
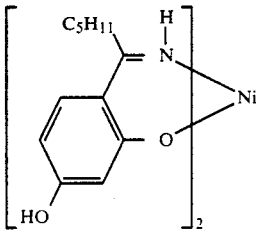
(72)
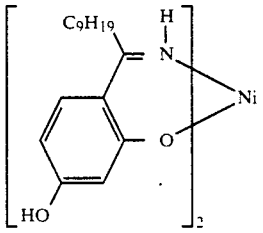
(73)
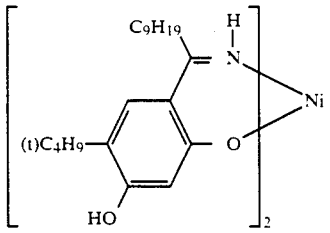
(74)
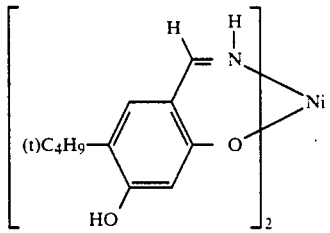
(75)
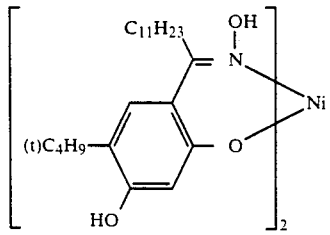

-continued
(76)
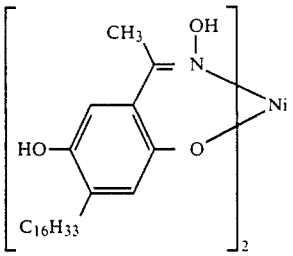
(77)
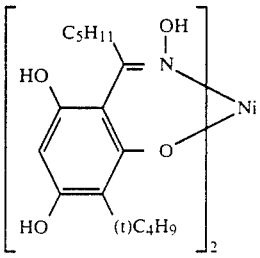
(78)
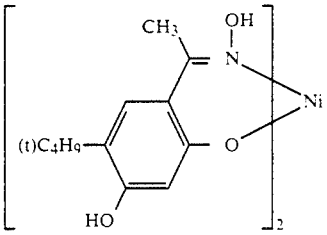
(79)
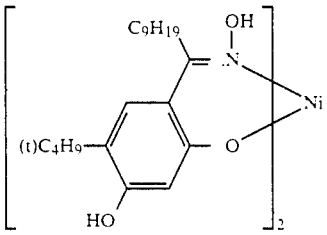
(80)
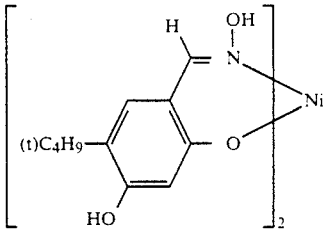
(81)
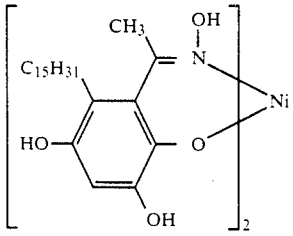

-continued
(82)
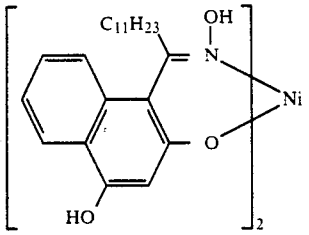
(83)
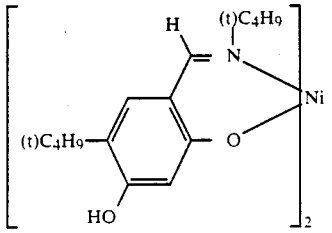
(84)
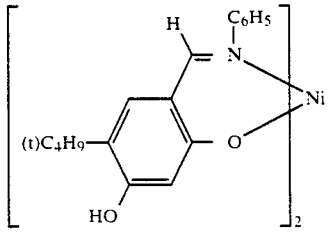
(85)
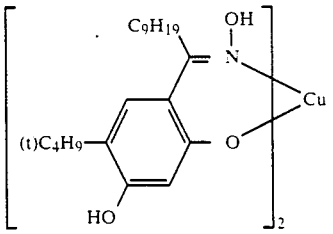
(86)
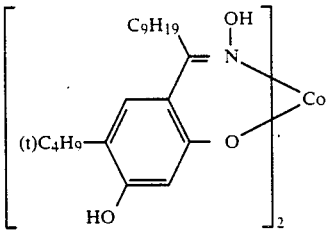
(87)
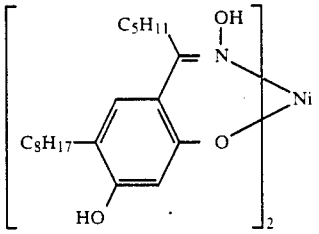

-continued
(88)
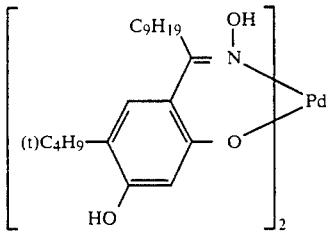
(89)
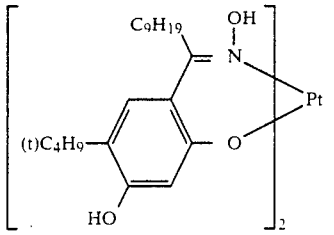
(90)
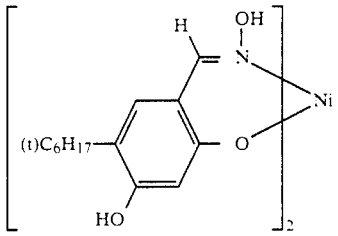
(91)
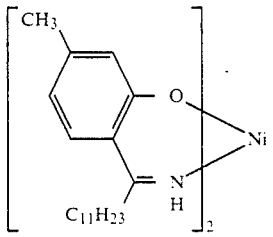
(92)
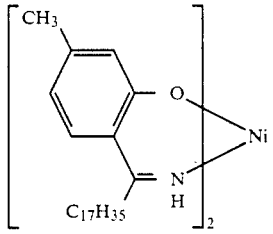
(93)
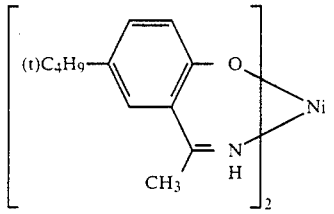

-continued
(94)
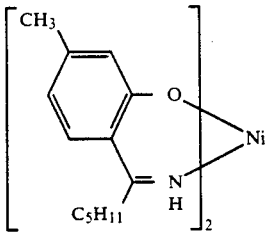
(95)
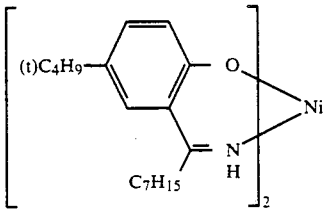
(96)
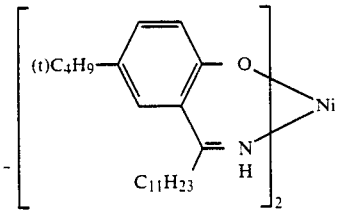
(97)
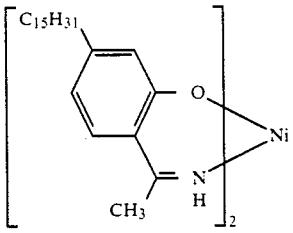
(98)
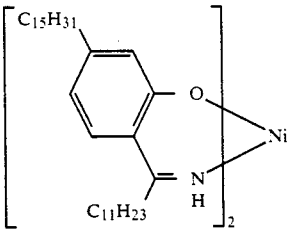
(99)
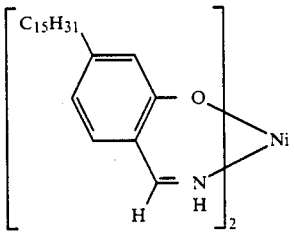
(100)
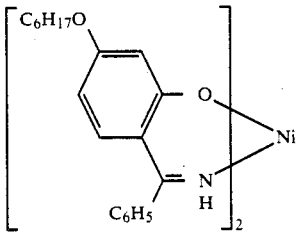

-continued
(101)
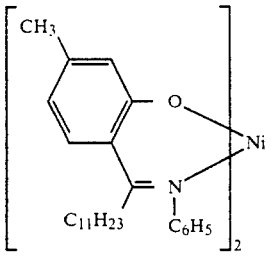
(102)
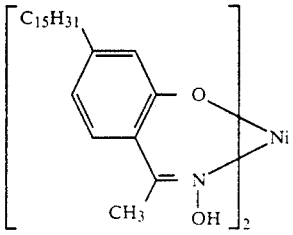
(103)
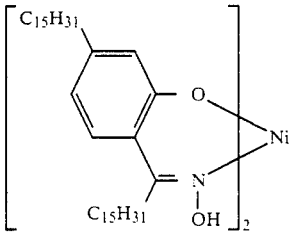
(104)
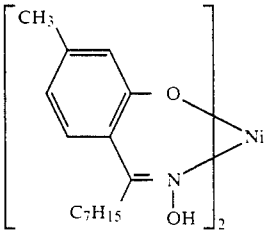
(105)
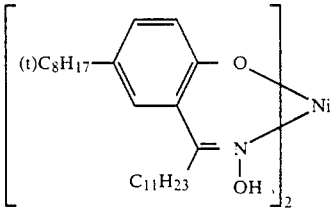
(106)
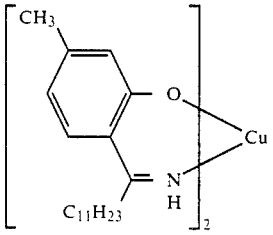

-continued
(107)
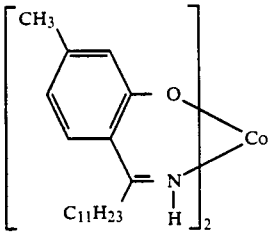
(108)
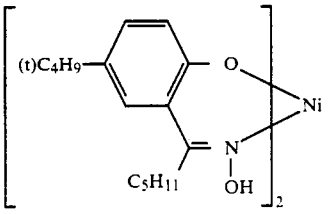
(109)
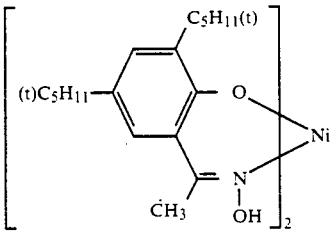
(110)
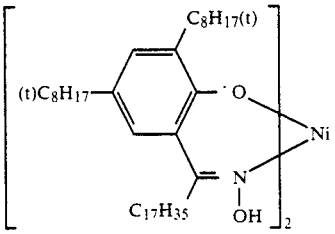
(111)
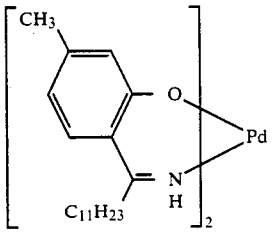
(112)
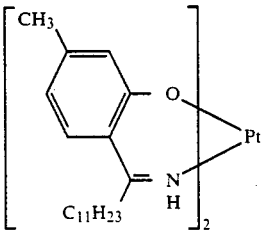

-continued
(113)
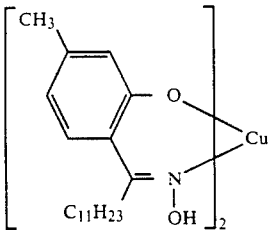
(114)
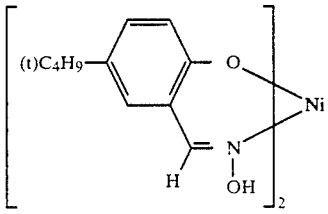
(115)
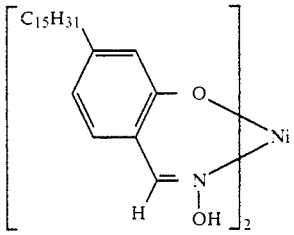
(116)
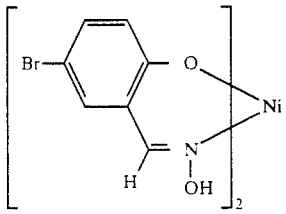
(117)
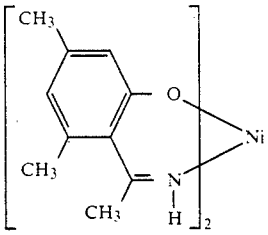
(118)
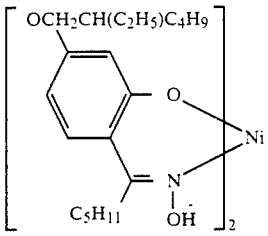
(119)
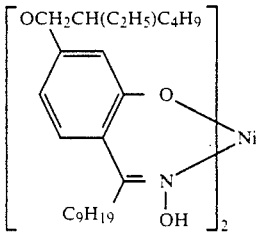

-continued
(120)
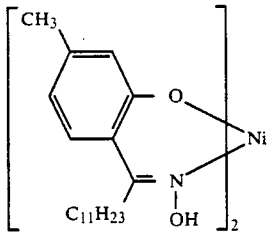
(121)
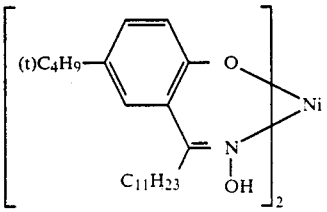
(122)
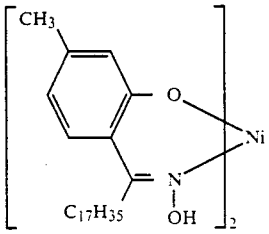
(123)
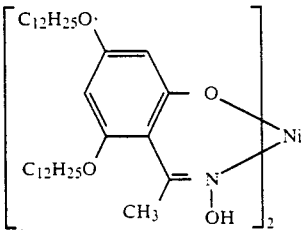
(124)
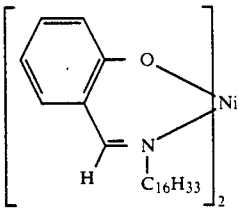
(125)
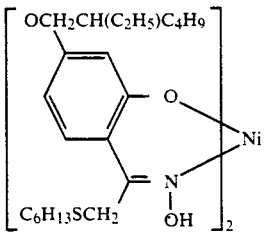

-continued
(126)
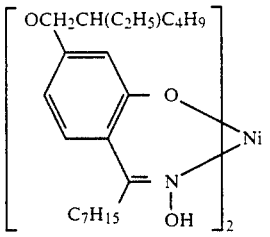
(127)
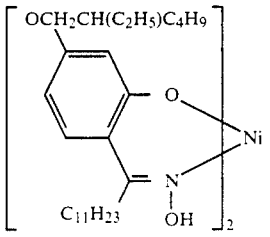
(128)
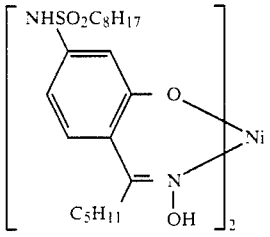
(129)
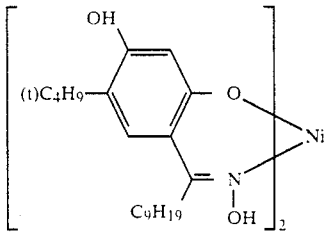
(130)
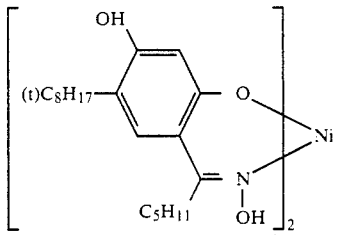
(131)
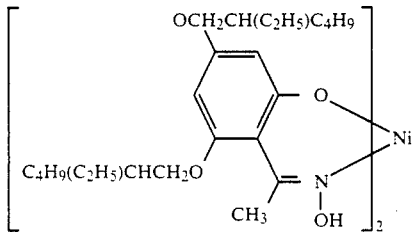

-continued
(132)
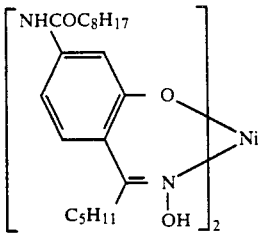
(133)
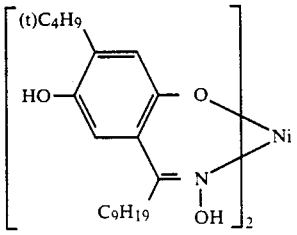
(134)
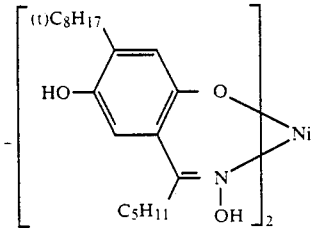
(135)
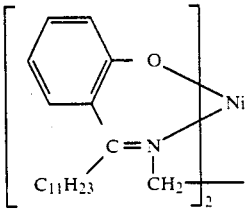
(136)
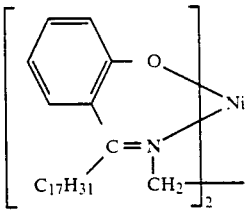
(137)
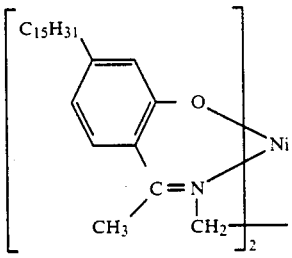
138
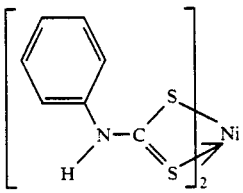

-continued
139
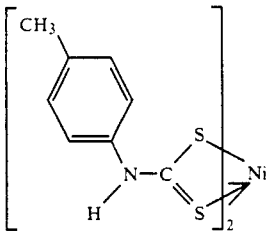
140
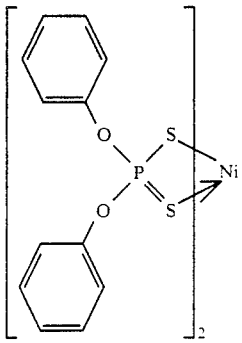
141
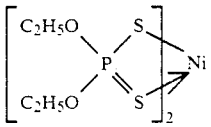
142
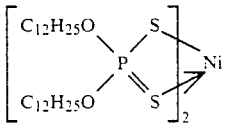
143
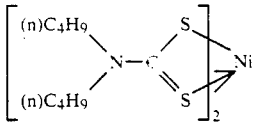
144
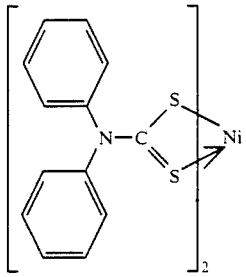
145
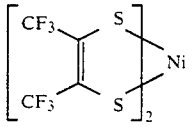

-continued

146

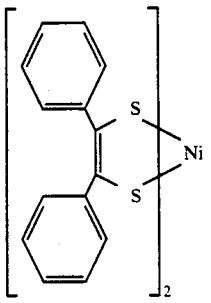

147

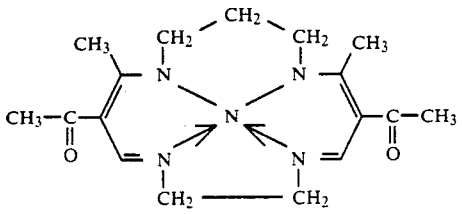

148

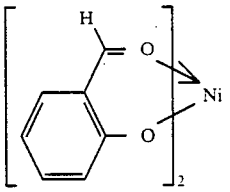

149

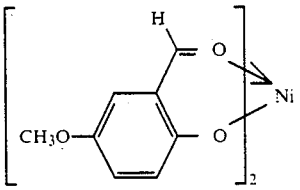

150

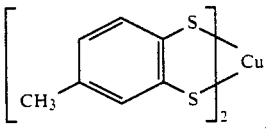

151

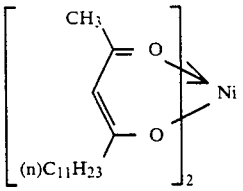

The metal complexes represented by above formulae [XII] thru [XIV] can be produced by methods disclosed in the British Patent No. 858,890 and the West German OLS Patent No. 2,042,652.

The metal complex represented by the formula [XV] can be produced by the method described in E.G. Cox, F.W. Pinkard, W. Wa-rdlaw and K.C. Webster, J. Chem. S c., 1935, 459.

The metal complex related to the present invention, depending on the types of a metal complex and coupler to be used, should be used preferably in the range of 0.1 to 2 mols with respect to 1 mol of the magenta coupler represented by the formula [I], more preferably in the range of 0.5 to 1 mols.

Presented below is a description of the compound represented by the formula [a-2].

In the present invention, the carbon atom count of the alkyl group represented by $R^4$ in the formula [a] is 1 thru 12, while the carbon atom count of the alkenyl or alkynyl group is 2 thru 4. The organic groups having a valence of 1 represent by R′ and R″ include, e.g., alkyl, alkenyl, alkynyl and aryl groups. The group represented by $R^4$ is preferably a hydrogen atom, an alkyl group (e.g., a methyl group, an ethyl group, a propyl group, a butyl group, a chloromethyl group, a hydroxy methyl group or a benzyl group), an alkyl group (e.g., a vinyl group, an aryl group or a iso-propenyl group), an alkynyl group (e.g., a ethynyl group or a provinyl gruop), or a —COR″ .

The group represented by R'' is preferably an alkyl group (e.g., a methyl group, an ethyl group, a propyl group, a butyl group or a benzyl group), an alkenyl group (e.g., a vinyl group, an aryl group or an iso-propenyl group), an alkynyl group (e.g., an ethynyl or .a propynyl group), or an aryl group (e.g., a phenyl group or a tolyl group).

The alkyl groups represented by $R^5$, $R^6$, $R^{5'}$, $R^{6'}$ and $r^9$ are preferably chained or branching alkyl groups having 1 thru 5 carbon atoms, more preferably methyl groups.

In $R^7$ and $R^8$, the organic groups having a valence of 1 represented by $R^{10}$ include, e.g., an alkyl group (e.g., a methyl group, an ethyl group, a propyl group, a butyl group, a pentyl group, an octyl group, a dodecyl group or an octa-decyl group), an alkenyl group (e.g., a vinyl group), an alkynyl group (e.g., an ethynyl group), an aryl group (e.g., a phenyl group or a naphthyl group), an alkyl amino group (e.g., an ethyl amino group), and an aryl amino group (e.g., an anilino group). The heterocyclic groups formed by $R^7$ and $r^8$ along with each other include, e.g.,

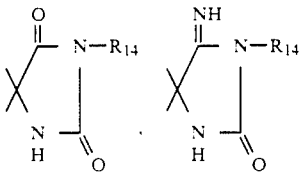

where $R^{14}$ refers to a hydrogen atom, an alkyl group, a cycloalkyl group or a phenyl group.

In the present invention, it is desirable that the compounds represented by the formula [a-2] should be covered by the following formula [a-2']:

Formula [a-2']

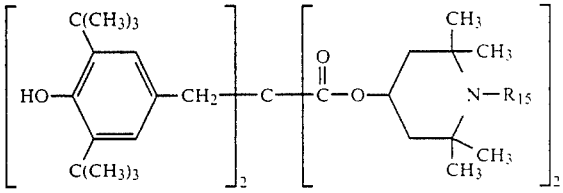

$R^{15}$ represents an alkyl group (e.g., a methyl group, an ethyl group, a propyl group, a butyl group, a pentyl group or a benzyl group), an alkenyl group (e.g., a vinyl group, an aryl group or an iso-propenyl group), an alkynyl group (e.g., an ethynyl group or a propenyl group), or an acyl group (e.g., a formyl group, ar acetyl group, a propionyl group, a butyryl group, an acryloyl group, a propioloyl group, a methacryloyl group or a crotonoyl group).

$R^{15}$ is more preferably a methyl group, an ethyl group, a vinyl group, an aryl group, a propynyl group, a benzyl group, an acetyl group, a propionyl group, an acryloyl group, a methacryloyl group, or a crotonoyl group.

In the present invention, the formula [a-2] covers, but is not limited to, the following compounds:

a-2-1

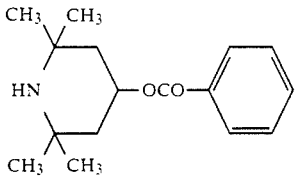

a-2-2

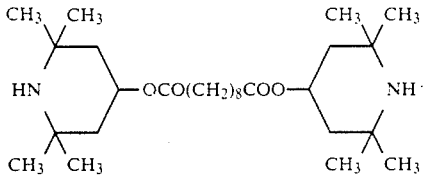

a-2-3

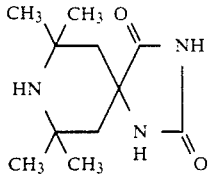

a-2-4

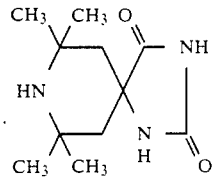

-continued
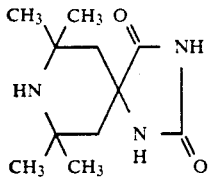
a-2-5
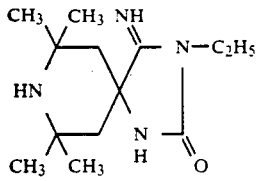
a-2-6
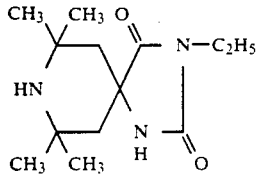
a-2-7
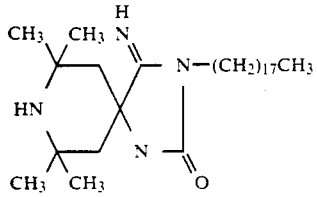
a-2-8
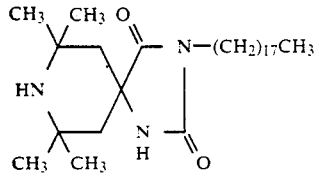
a-2-9
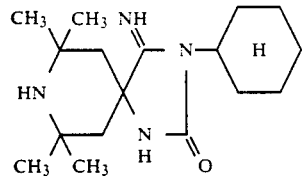
a-2-10
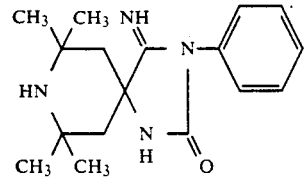
a-2-11
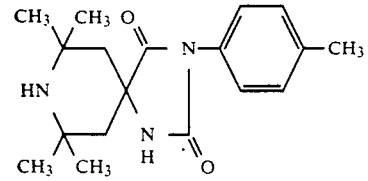
a-2-12

-continued
a-2-13
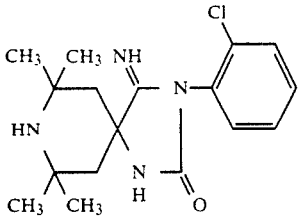
a-2-14
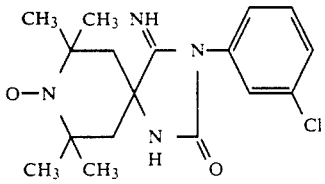
a-2-15
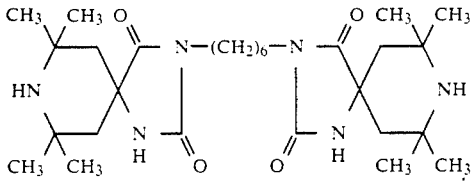
a-2-16
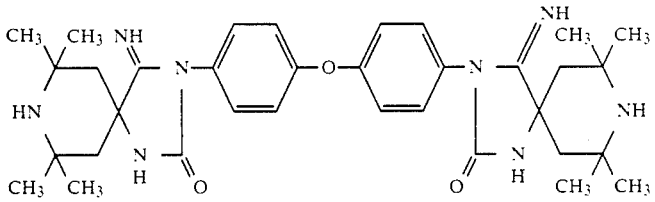
a-2-17
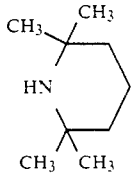
a-2-18
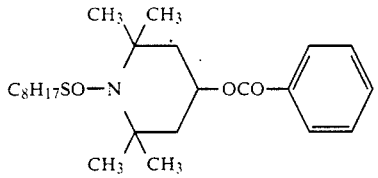
a-2-19
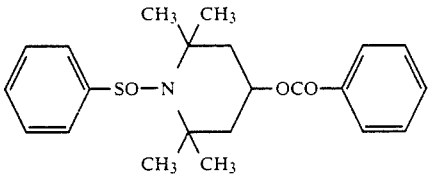
a-2-20
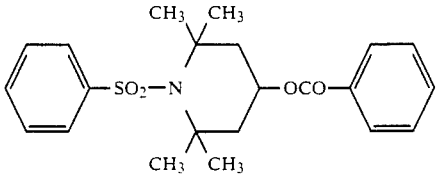

-continued
a-2-21
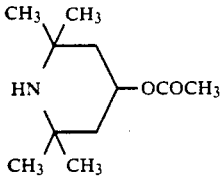
a-2-22
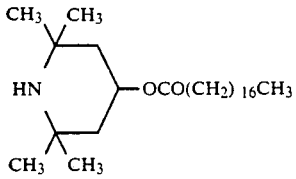
a-2-23
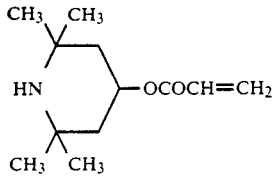
a-2-24
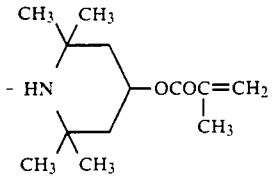
a-2-25
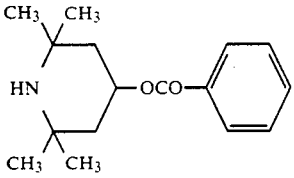
a-2-26
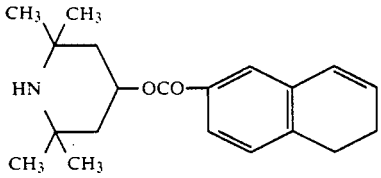
a-2-27
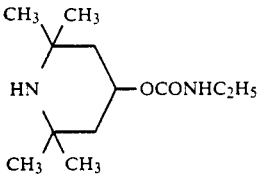
a-2-28
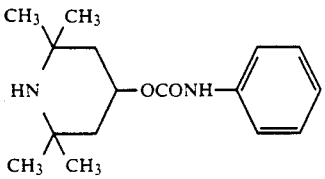
a-2-29
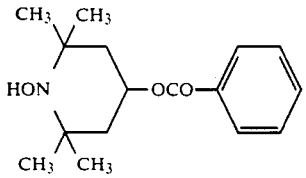

-continued
a-2-30
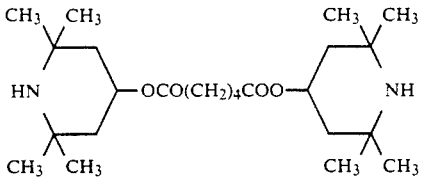
a-2-31
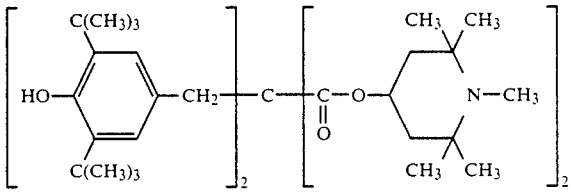
a-2-32
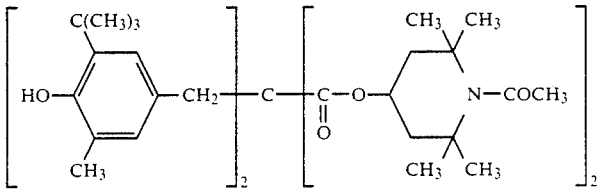
a-2-33
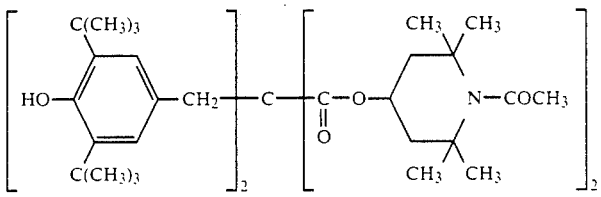
a-2-34
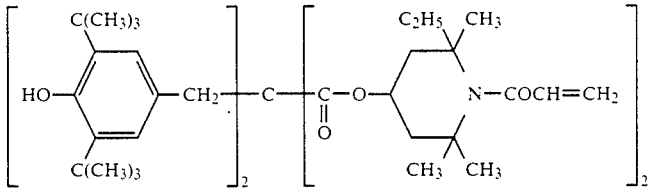
a-2-35
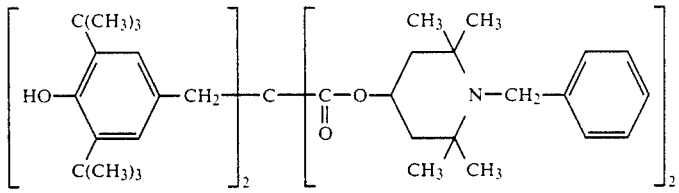
a-2-36
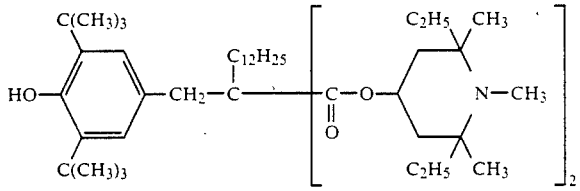
a-2-37
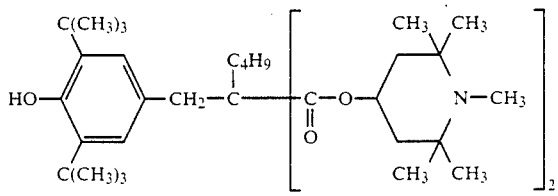

-continued
a-2-38
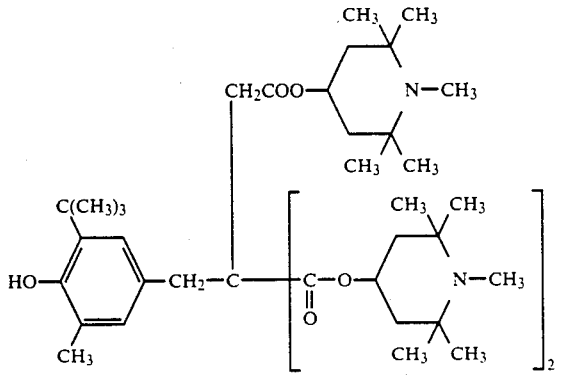
a-2-39
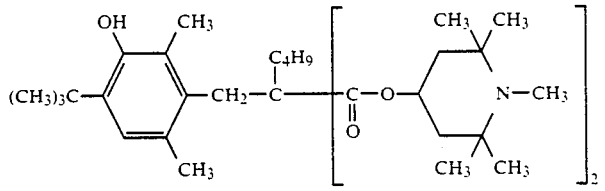
a-2-40
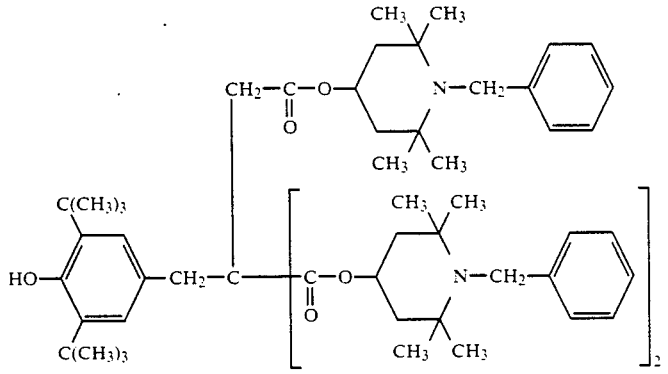
a-2-41
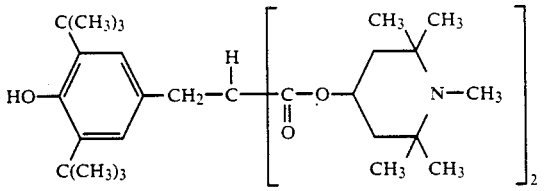
a-2-42
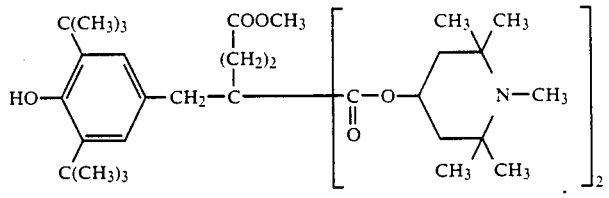

-continued
a-2-43
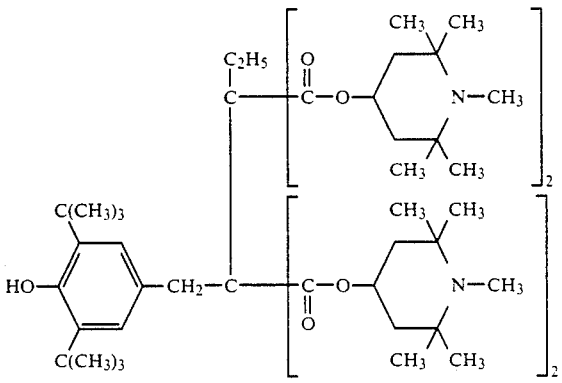
a-2-44
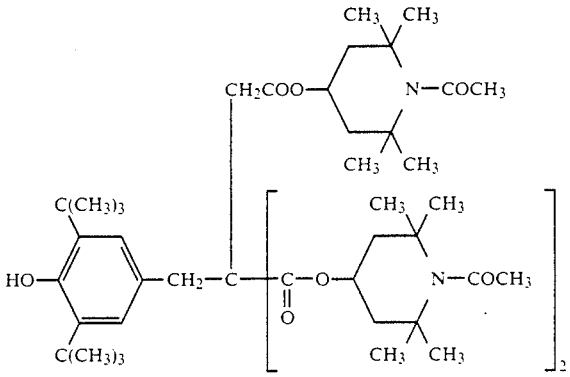
a-2-45
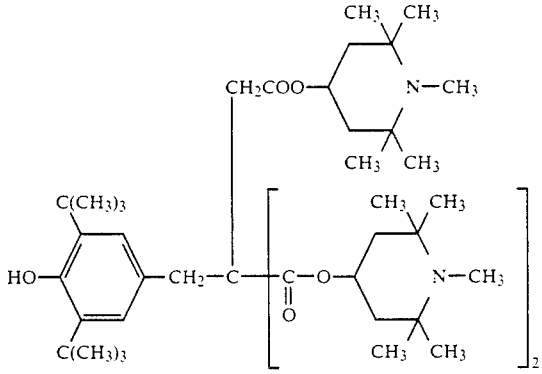
a-2-46
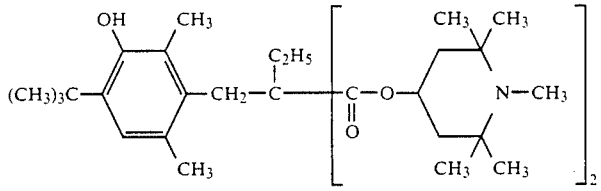
a-2-47
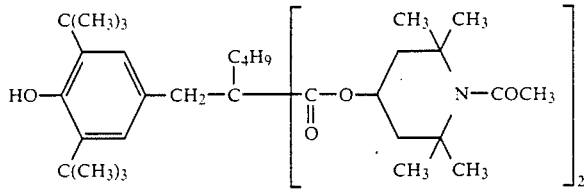

-continued
a-2-48
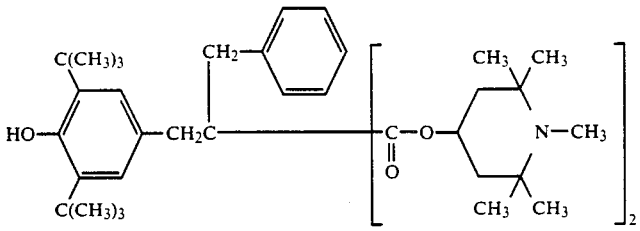
a-2-49
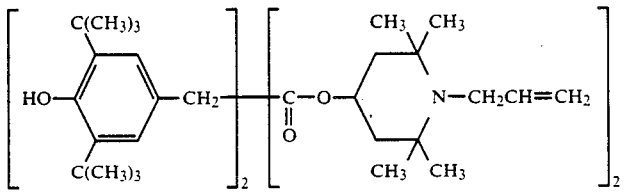
a-2-50
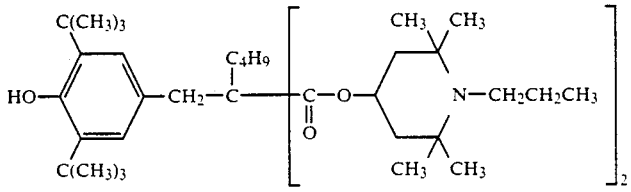
a-2-51
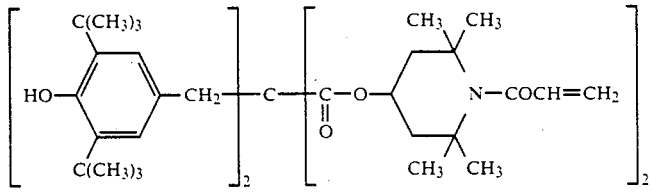
a-2-52
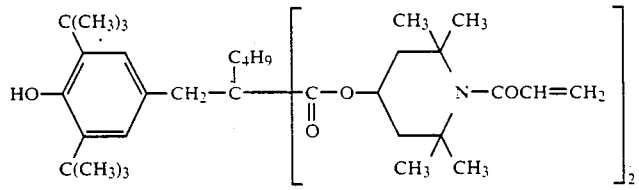
a-2-53
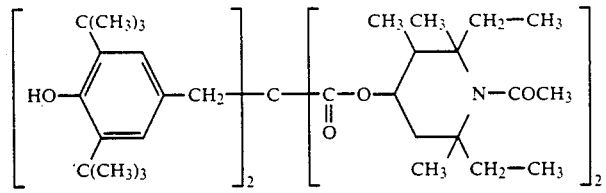
a-2-54
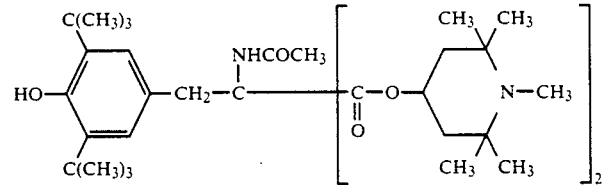
a-2-55
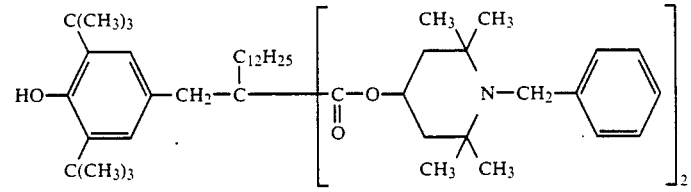

-continued

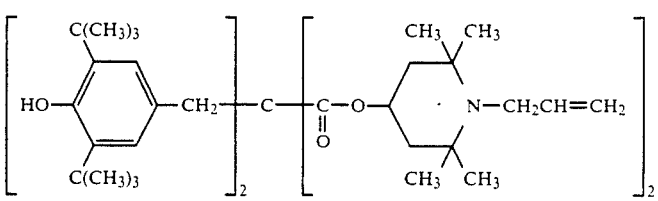

a-2-56

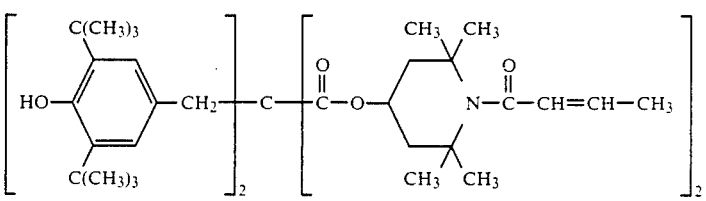

a-2-57

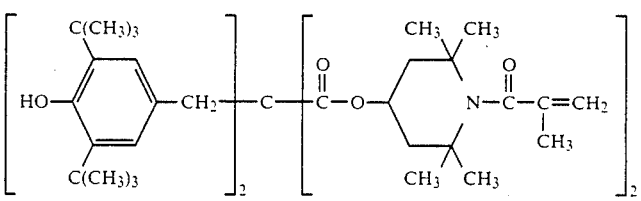

a-2-58

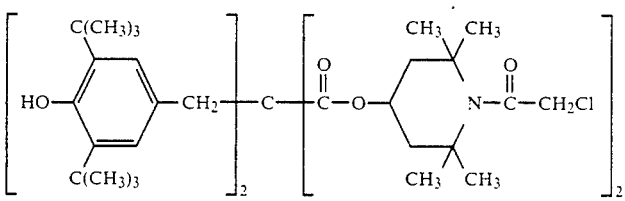

a-2-59

The usage of the compound represented by the formula [a] is preferably 0.1 to 2 mols with respect to 1 mol of the magenta coupler represented by the formula [I], more preferably 0.5 to 1 mols.

The usage ratio of the metal complex related to the present invention to the compound represented by [a] is preferably 1:3 to 3:1 in the mol ratio.

In the present invention the compound represented by the formula [a-1] is used singly or together with the compound represented by the formula [a-2].

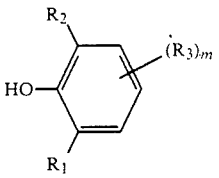

Formula [a-1]

In the above formula, $R^1$ and $R^2$ refer to an alkyl group. $R^3$ refers to an alkyl group, a —NR'R" group, a —SR' group (R' represents an organic group having a valence of 1), or a —COOR" group (R" represents a hydrogen atom or an organic group having a valence of 1). m refers to any integer of 0 thru 3.

In the present invention, the alkyl groups represented by $R^1$ and $R^2$ in the formula (b) are preferably those having 1 thru 12 carbon atoms, more preferably those having 3 thru 8 carbon atoms branching in the alpha location. $R^1$ and $R^2$ are preferably a t-butyl group or a t-pentyl group.

The alkyl group represented by $R^3$ is chained or branches, being, e.g., a methyl group, an ethyl group, a propyl group, a butyl group, a pentyl group, an octyl group, a nonyl group, a dodecyl group, or an octa-decyl group. The alkyl may contain a substituent including a halogen atom, a hydroxyl group, a nitro group, a cyano group, an aryl group (e.g., a phenyl group, a hydroxy phenyl group or a 3,5-di-t-butyl-4-hydroxy phenyl group, a 3,5-di-t-pentyl-4-hydroxy phenyl group), an amino group (e.g., a di-methyl amino group, a d-ethyl amino group or a 1,3,5-tri-alizinyl amino group), an alkyloxy carbonyl group (e.g., a methoxy carbonyl group, an ethoxy carbonyl group, a propyloxy carbonyl group, a butoxy carbonyl group, a pentyloxy carbonyl group, an octyloxy carbonyl group, a nonyloxy carbonyl group, a dodecyloxy carbonyl group or an octa-decyloxy carbonyl group), an aryloxy carbonyl group (e.g., a phenoxy carbonyl group), a carbamoyl group (e.g., an alkyl carbamoyl group such as a methyl carbamoyl group, an ethyl carbamoyl group, a propyl carbamoyl group, a butyl carbamoyl group or a heptyl carbamoyl group, an aryl carbamoyl group such as a phenyl carbamoyl group, or a cycloalkyl carbamoyl group such as a cyclohexyl carbamoyl group), an isocyanuryl group, or a heterocyclic group such as a 1,3,5-tri-azinyl group. The amino group represented by $R^3$ includes, e.g., an alkyl amino group such as a di-methyl amino group, a di-ethyl amino group or a methyl ethyl amino group; an aryl amino group such as a phenyl amino group or a hydroxyl phenyl amino group; a cycloalkyl amino group such as a cyclohexyl group; or a heterocyclic amino group such as a 1,3,5-tri-azinyl amino group or an iso-cyanuryl group. The organic groups with a valence of 1 represented by R' and R" include, e.g., an alkyl group (e.g., a methyl group, an ethyl group, a propyl group, a butyl group, an amyl group, a decyl group, a dodecyl group, a nexa-decyl group or an octadecyl group); an aryl group (e.g., a phenyl group or a naphthyl group); a cycloalkyl group (e.g., a cyclohexyl group); or a heterocyclic group (e.g., a 1,3,5-tri-azinyl group or an iso-cyanuryl group). The organic groups may contain a substituent including, e.g., a halogen atom (e.g., fluorine, chlorine or bromine); a hydroxyl group; a nitro group; a cyano group; an amino group; an alkyl group (e.g., a methyl group, an ethyl group, an i-propyl group, a t-butyl group or a t-amyl group); an aryl group (e.g., a phenyl group or a tolyl group); an alkenyl group (e.g., an aryl group); an alkyl carbonyloxy group (e.g., a methyl carbonyloxy group, an ethyl carbonyloxy group or a benzyl carbonyloxy group); or an aryl carbonyloxy group (e.g., a benzoyloxy group).

In the present invention, it is preferable that the compound expressed by the formula [a-1] has the structure as shown below.

Formula [a-1']

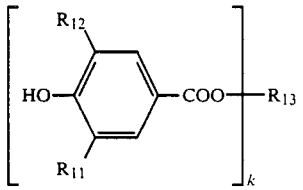

[In the above formula, $R^{11}$ and $R^{12}$ refer to a chained or branching alkyl group having 3 thru 8 carbon atoms, in particular a t-butyl group or a t-pentyl group. $R^{13}$ refers to an organic group with a valence of k. k refers to any integer of 1 thru 6.]

The organic group with a valence of k represented by $R^{13}$ includes, e.g., an alkyl group such as a methyl group, an ethyl group, a propyl group, a butyl group, a pentyl group, an octyl group, a hexa-decyl group, a methoxy ethyl group, a chloromethyl group, a 1,2-dibromoethyl group, a 2-chloroethyl group, a benzyl group or a phenytyl group; an alkenyl group such as an allyl group, a propenyl group or butgenyl group; a poly-valence unsaturated hydrocarbon group such as ethylene, tri-methylele, propylene, hexa-methylene or 2-chloro-tri-methylene; an unsaturated hydrocarbon group such as glyceryl, di-glyceryl, penta-eryslityl or di-penta-eryslityl; an alicyclic hydrocarbon group such as a cyclopropyl group, a cyclohexyl group or a cyclohexenyl group; an aryl group such as a phenyl group, a p-octyl phenyl group, a 2,4,-di-methyl phenyl group, a 2,4-di-t-butyl phenyl group, a 2,4-di-t-pentyl phenyl group, a p-chloro-phenyl group, a 2,4-di-bromo-phenyl group or a naphthyl group; an allylene group such as a 1,2-, 1,3,- or 1,4-phenylene group, a 3,5-dimethyl-1,4-phenylene group, a 2-t-butyl-1,4-phenylene group, a 2-chloro-1,4-phenylene group or a naphthalene group; or a 1,3,5-three-substitution benzene group.

In addition to the above groups, $R^{13}$ may contain the organic group having a valence of k coupled via an —O—, —S— or —$SO_2$— group.

More preferably, $R^{13}$ is a 2,4-di-t-butyl phenyl group, a 2,4-di-t-pentyl phenyl group, a p-octyl phenyl group, a p-dodecyl phenyl group, a 3,5-di-t-butyl-4-hydroxyl phenyl group, or a 3,5-di-t-pentyl-4-hydroxyl phenyl group.

k is preferably any integer of 1 thru 4.

In the present invention, the above formula [a-1] includes, but is not limited thereto, the following compounds:

-continued a-1-1

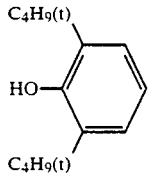

a-1-2

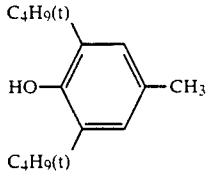

a-1-3

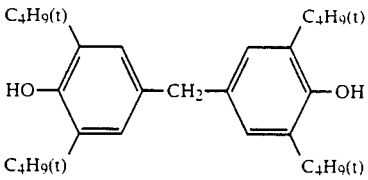

a-1-4

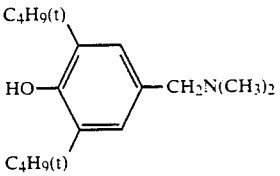

a-1-5

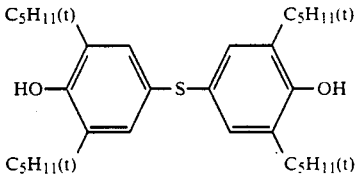

-continued
a-1-6
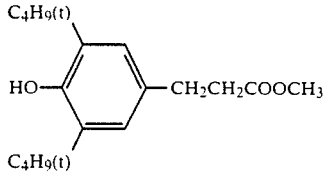
a-1-7
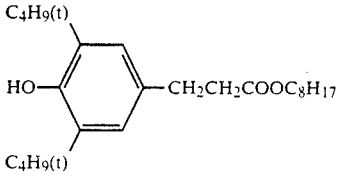
a-1-8
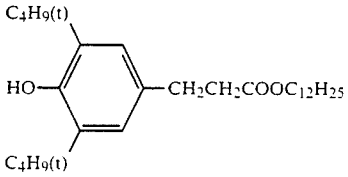
a-1-9
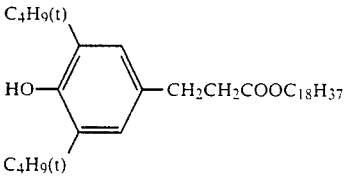
a-1-10
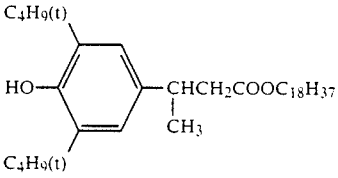
a-1-11
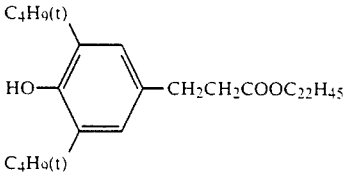
a-1-12
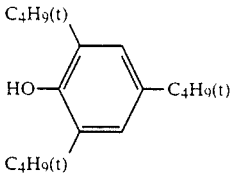
a-1-13
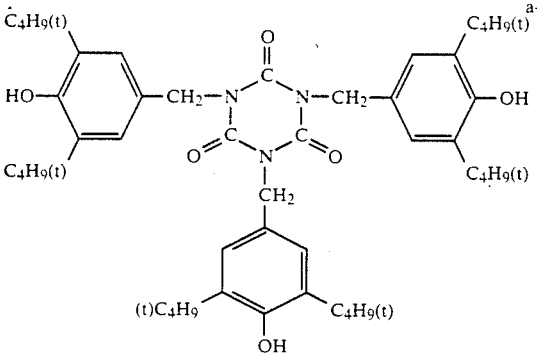
-continued
a-1-14
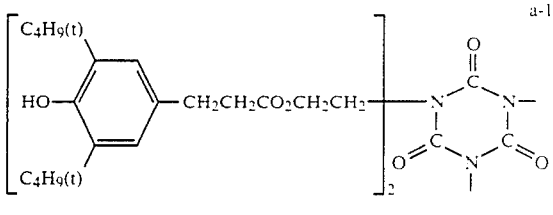
a-1-15
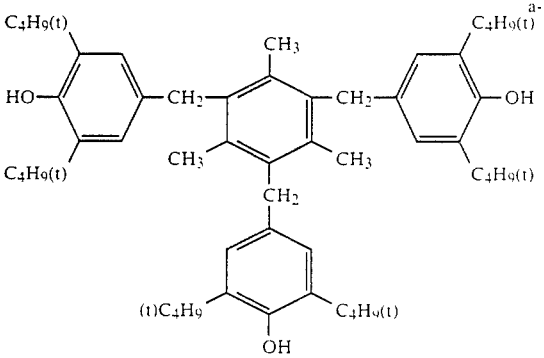
a-1-16
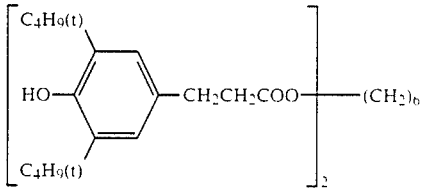
a-1-17
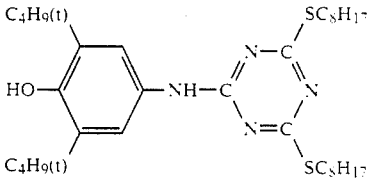
a-1-18
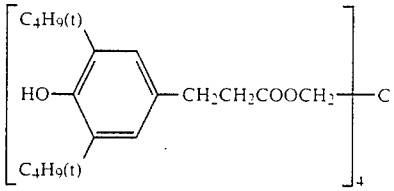
a-1-19
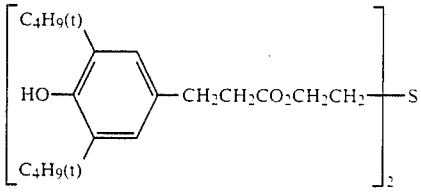
a-1-20
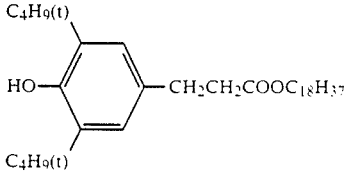

-continued
a-1-21
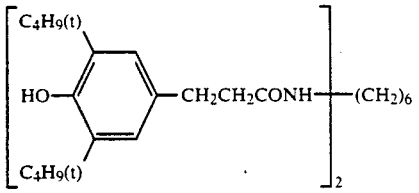
a-1-22
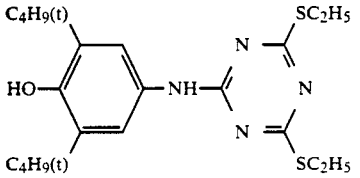
a-1-23
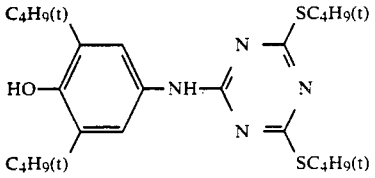
a-1-24
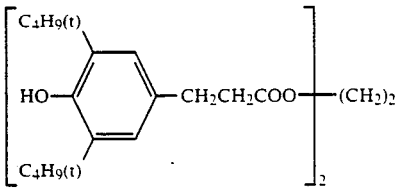
a-1-25
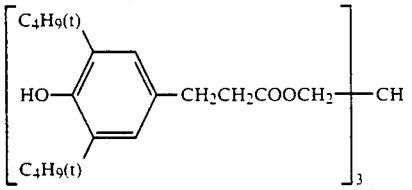
a-1-26
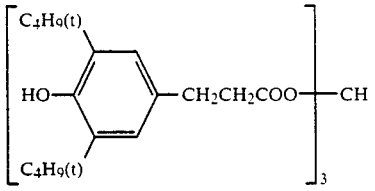
a-1-27
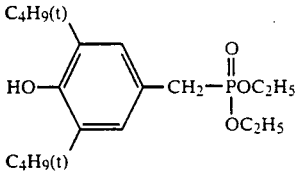
a-1-28
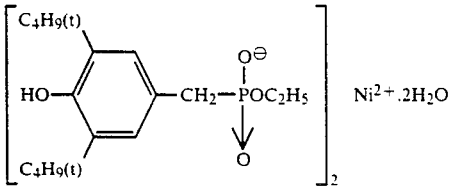
-continued
a-1-29
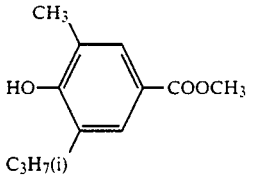
a-1-30
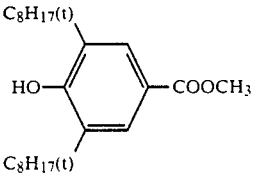
a-1-31
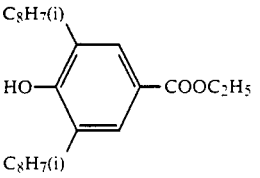
a-1-32
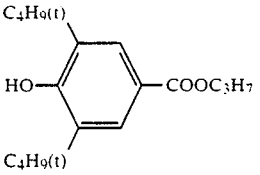
a-1-33
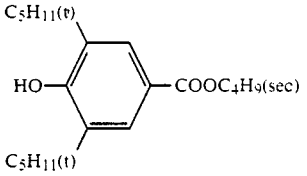
a-1-34
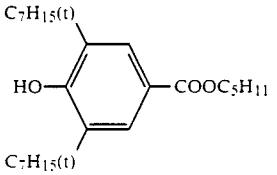
a-1-35
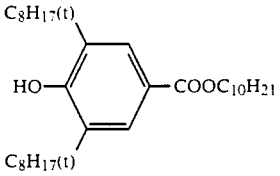
a-1-36
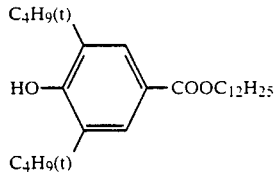
a-1-37
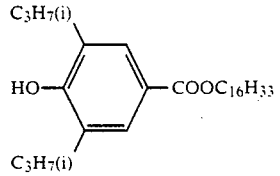

-continued
a-1-38
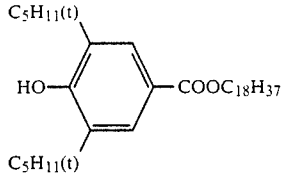
a-1-39
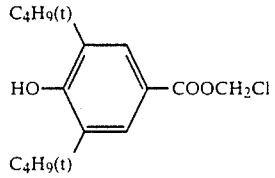
a-1-40
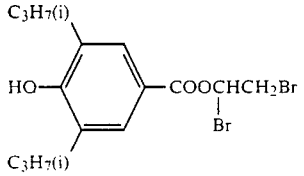
a-1-41
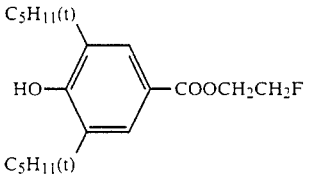
a-1-42
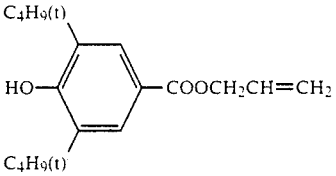
a-1-43
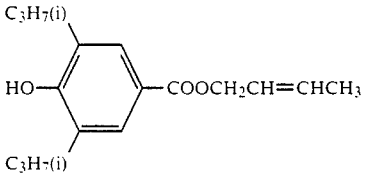
a-1-44
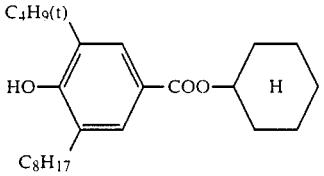
a-1-45
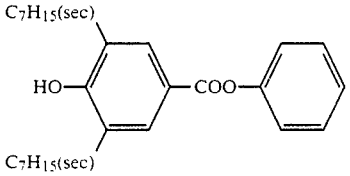
a-1-46
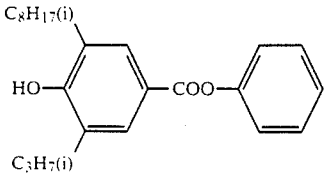
-continued
a-1-47
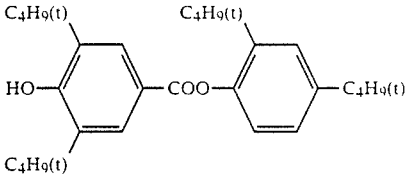
a-1-48
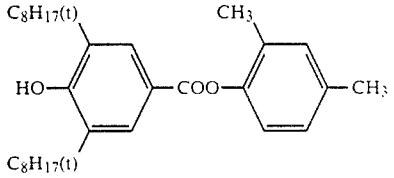
a-1-49
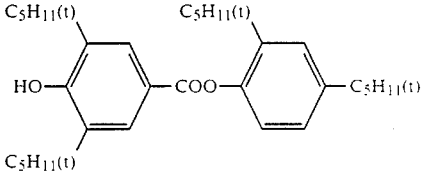
a-1-50
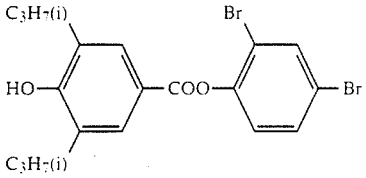
a-1-51
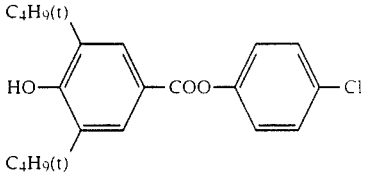
a-1-52
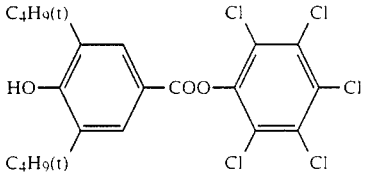
a-1-53
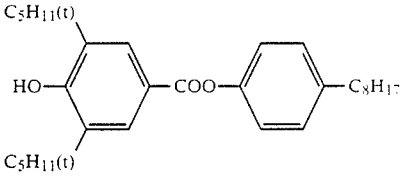
a-1-54
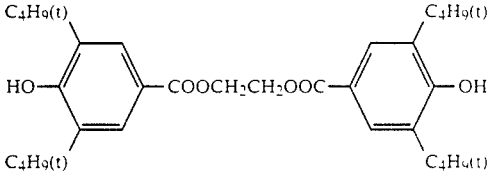
a-1-55
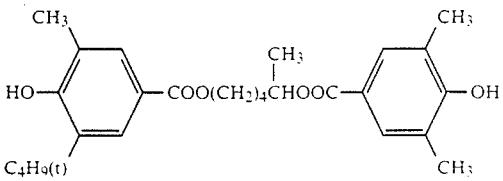

-continued
a-1-56
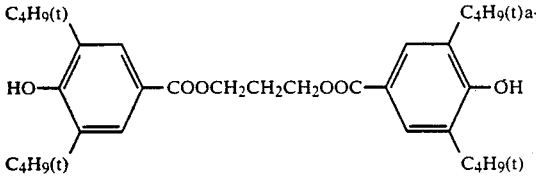
a-1-57
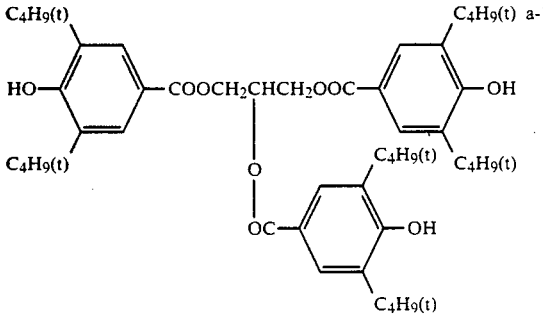
a-1-58
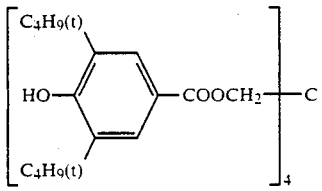
a-1-59
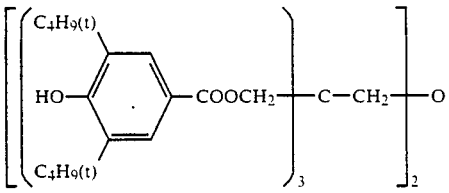
a-1-60
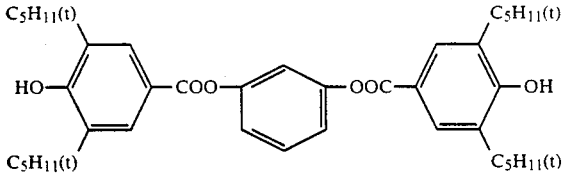
a-1-61
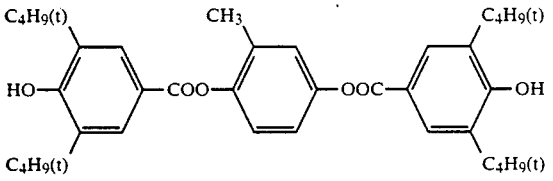
a-1-62
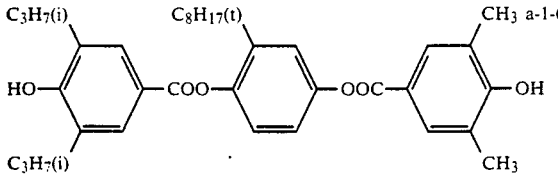
-continued
a-1-63
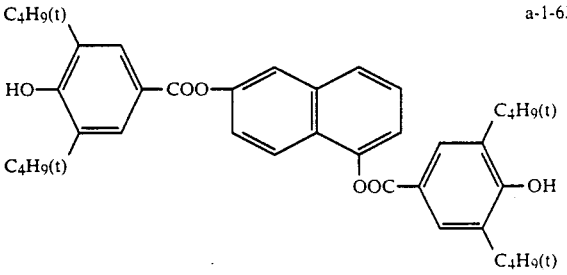
a-1-64
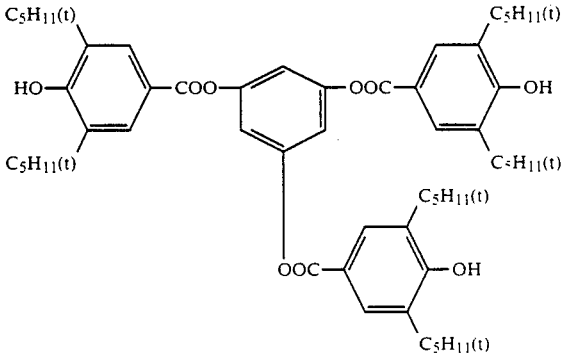
a-1-65
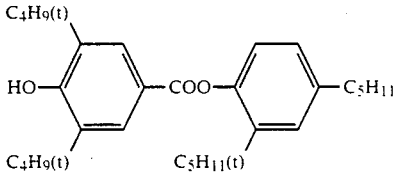
a-1-66
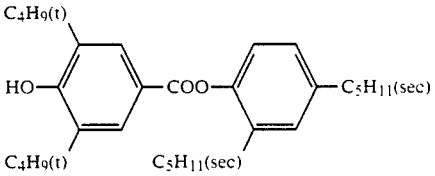
a-1-67
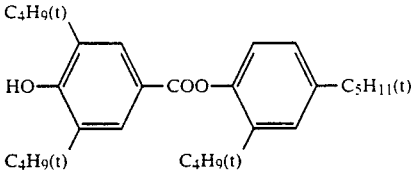
a-1-68
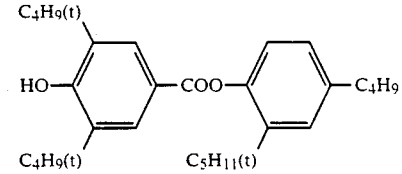
a-1-69
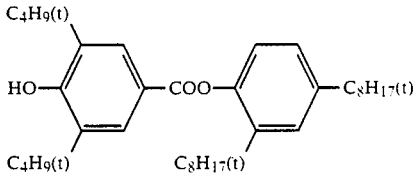

-continued
a-1-70
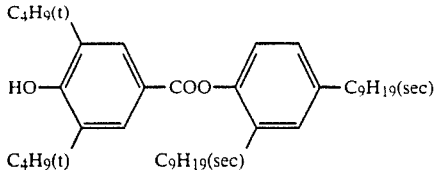
a-1-71
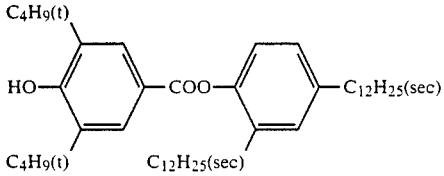
a-1-72
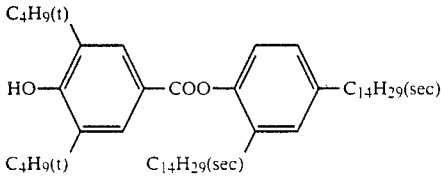
a-1-73
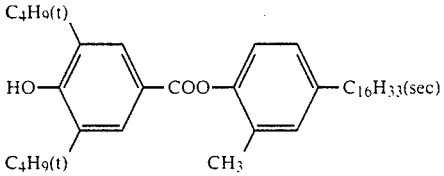
a-1-74
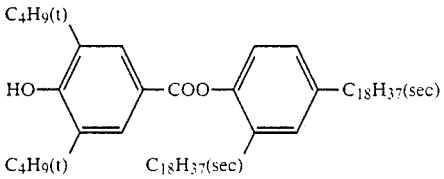
a-1-75
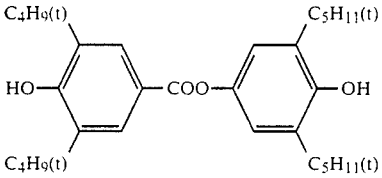
a-1-76
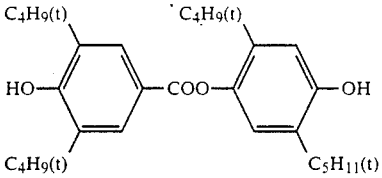
a-1-77
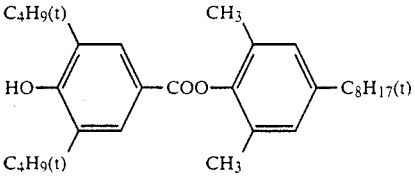
a-1-78
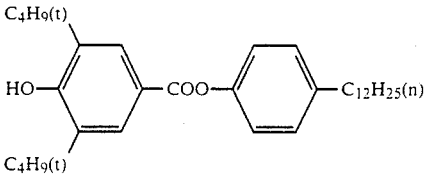
-continued
a-1-79
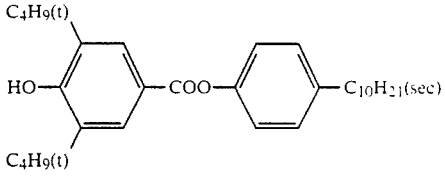
a-1-80
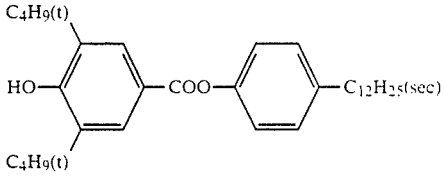
a-1-81
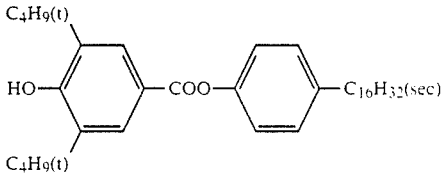
a-1-82
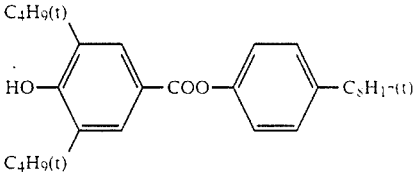
a-1-83
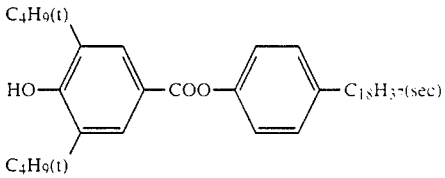
a-1-84
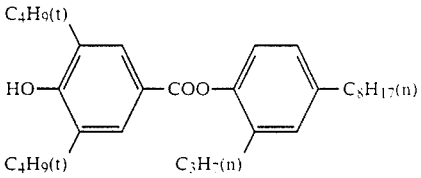
a-1-85
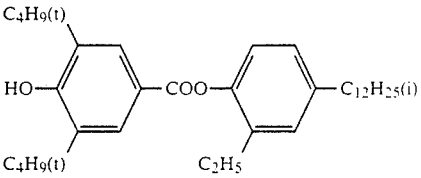
a-1-86
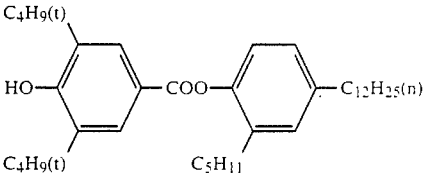
a-1-87
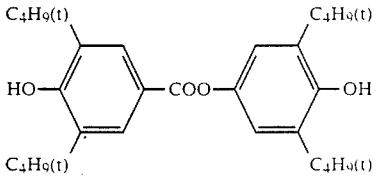

-continued a-1-88

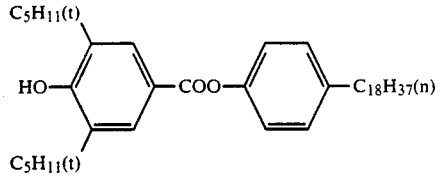

a-1-89

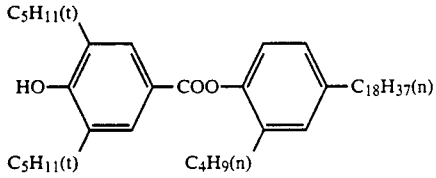

a-1-90

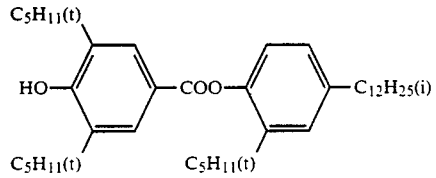

The usage of the compound represented by the formula [a-1] is preferably 0.1 to 2 mols, more preferably 0.5 to 1 mols with respect to 1 mol of the magenta coupler represented by the formula [I].

Like addition of a typical hydrophobic compound, a solid duffusion method, a latex diffusion method, an O/W emulsification diffusion method, etc. can be used to add the magenta coupler and metal complex relevant to the present invention, and the compounds represented by formulae a-1] and/or [a-2] to silver halide sensitized photographic material. Of these methods, the appropriate one cna be selected in accordance with the chemical structure of a hydrophobic compound, a coupler. The O/W emulsification diffusion method duffuses hydrophobic compounds such as couplers. In the method, the hydrophobic compound is dissolved in an organic solvent having a high boiling point of not less than 150 degrees C. by the use of a low boiling point and/or water-soluble organic solvent if necessary; is emulsified and diffused into a hydrophilic binder such as gelatin contained solution using a diffusion means including an agitator, homogenizer, colloid mill, flow mixer or supersonic device; and then, is added into a hydrophilic colloid layer. A process may be incorporated which removes dispersion or the low boiling point organic solvent on diffusion.

Used as the high boiling point organic solvent are organic solvents having a boiling point of not less than 150 degrees C. such as phenol derivtives, phthalic ester, phosphoric ester, citrate, benzoate, alkyl amide, fatty ester, and trimesic ester that do not react with the oxidant of the developing agent.

In the present invention, the organic solvent having a high boiling point that can be used preferably to diffuse the metal comlex relevant to the present invention and the compound represented by the formulae [a-1] and/or [a-2] is a compound having a dielectric constant of not more than 6.0 such as ester including phthalic ester or phosphoric ester, organic amide, ketone, or a hydrocarbon compound with a dielectric constant of not more than 6.0. Preferably, such compound should have a dielectric constant of not less than 1.9 and a vapor pressure of not more than 0.5 mmHg at a temperature of 100 degrees C. More preferably, such compound is phthalic ester or phosphoric ester in the organic solvent having a high boiling point. Further, the organic solvent having a high boiling point may consist of more than one material.

The dielectric constant in the present invention is that at a temperature of 30 degrees C.

The phthalic ester that can be preferably used in the present invention is shown by the following formula:

Formula [c]

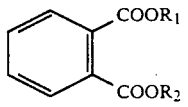

In the above formula, $R^1$ and $r^2$ refer to an alkyl group, an alkenyl group, or an aryl group, provided that the gruops represented by $R^1$ and $R^2$ have 8 thru 32 carbon atoms in total, more preferably 16 thru 24 carbon atoms.

In the present invention, the alkyl groups represented by $R^1$ and $R^2$ in the formula [c] may be chained or branch, being, e.g., a butyl group, a pentyl group, a hexyl gruop, a heptyl group, an octyl group, a nonyl group, a decyl group, an undecyl group, a dodecyl group, a tri-decyl group, a tetra-decyl group, a penta-decyl group, a hexa-decyl group, a hepta-decyl group, or an octadecyl group. The aryl gruops represented by $R^1$ and $R^2$ and include, e.g., a phenyl group or a naphthyl group, and the alkenyl group includes, e.g., a hexenyl group, heptenyl group, or an octa-decenyl group. These alkyl, alkenyl and aryl groups may have one or more substituents. The substituents for alkyl and alkenyl groups include, e.g., a halogen atom, an alkoxy group, an aryl group, an aryloxy group, alkenyl group, and an alkoxy carbonyl group. The substituents for the aryl group include, e.g., a halogen atom, an alkyl group, an alkoxy group, an aryl group, an aryloxy group, an alkenyl group, and an alkoxy crabonyl group.

The phophoric ester that can be used preferably hereunder is expressed by the following formula [d]:

Formula [d]

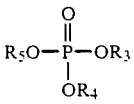

In the above formula, $R^3$, $R^4$ and $R^5$ refer to an alkyl group, an alkenyl group, or an aryl group, provided that the total carbon atom count is 24 thru 54.

The alkyl groups represented by $R^3$, $R^4$ and $R^5$ in the formula [d] include, e.g., a butyl group, a pentyl group, a hexyl group, a heptyl group, an octyl group, a nonyl group, a decyl group, an undecyl group, a dodecyl group, a tri-decyl group, a tetra-decyl group, a penta-decyl group, a hexa-decyl group, a hepta-decyl group, an octa-decyl group, and a non-decyl group. The aryl groups include, e.g., a phenyl group and a naphthyl group. The alkenyl groups include, e.g., a hexenyl group, a heptenyl group and an octa-decenyl group.

These alkyl, alkenyl and aryl groups may have one or more substituents. Preferably, $R^3$, $R^4$ and $R^5$ are an alkyl group, being, e.g., a 2-ethyl hexyl group, an n-octyl group, a 3,5,5-tri-methyl hexyl group, an n-nonyl group, an n-decyl group, a sec-decyl group, a sec-dodecyl group, or a t-octyl group.

The present invention covers, but is not limited to, the following typical organic solvents:

Typical organic solvents

S-1

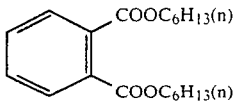

S-2

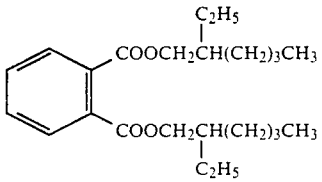

S-3

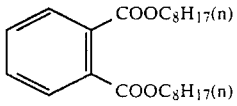

S-4

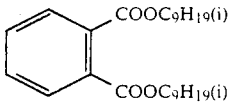

S-5

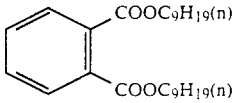

S-6

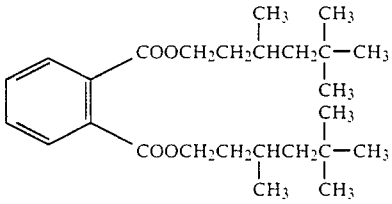

S-7

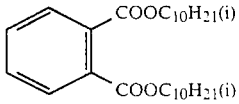

S-8

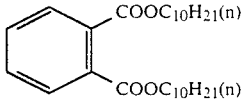

S-9

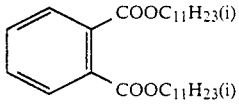

S-10

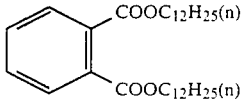

S-11

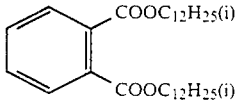

-continued

S-12

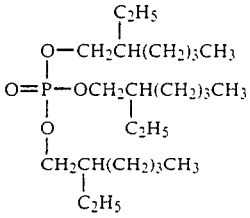

S-13

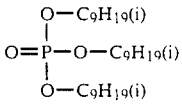

S-14

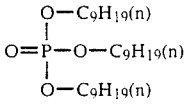

S-15

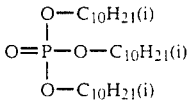

S-16

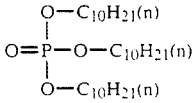

S-17

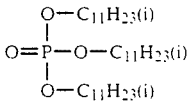

S-18

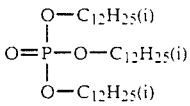

S-19

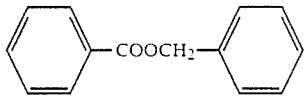

S-20

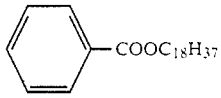

S-21

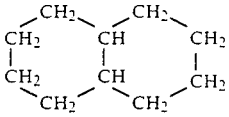

S-22

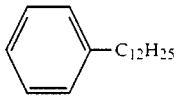

These organic solvents are used in 5 to 100 weight percent, preferably in 30 to 80 weight percent, with respect to the total amount of the metal complex hereunder and the compound represented by the formula [a-1] and/or [a-2]. The magenta coupler hereunder should preferably be dissolved in the same O/W as the metal complex hereunder and the compound represented by the formula [a-1] and/or [a-2]. An anionic, nonionic or cationic surface active agent can be used as the diffusion promoter to diffuse mechanically or supersonically a hydrophobic compound including the coupler into a solvent having a high boiling point which may contain a low boiling point solvent.

The light-sensitive silver halide photographic material provided by the present invention includes, e.g., a negative or positive color film and a color photographic paper. Especially, such photographic material is useful to the color photographic paper for direct appreciation.

The light-sensitive silver halide photographic material including color photographic paper provided hereby can cover mono- and multi-color applications. For subtractive color process color reproduction, the light-sensitive silver halide photographic material for multi-color applications has a structure that silver halide emulsion layers containing magenta, yellow and cyan couplers as the photographic dye-forming coulers, and non-sensitized layers are coated on a support in an appropriate layer arranging order. THe number of such layers and the layer arranging order may be changed depending on the performance to be achieved and the object.

For the light-sensitive silver halide photographic multicolor material, the very desirable actual layer arrangement is such that a yellow dye image-forming layer, an intermediate layer, a magenta dye image-forming layer, an intermediate layer, a cyan dye image-forming layer, an intermediate layer, and a protective layer are arranged from the support in that order.

As the silver halide emulsion for the silver halide sensitized photographic hereunder, any of silver bromide, silver iodobromide, silver iodo-chloride, silver bromochloride and silver chloride as silver halide can be used.

Silver halide grains to be used for the silver halide emulsion hereunder can be obtained by an acid method, a neutral method or an ammonia method. SUch grains may be grown together, or after forming base grains. Forming base grains and growing grains may be made in a same method or different methods.

For the silver halide emulsion, halide ions and silver ions may be mixed into each other, or the former may be mixed into the latter and vice versa. Allowing for the critical growth rate of silver halide crystals, such grains may be developed by adding halide and silver ions to each other through controlling pH and pAg in the mixing vessel. After growthm, a conversion method may be used to change the halogen compisition of grains.

The silver halide grain size, the grain shape, the grain size distribution, and the grain growth rate can be controlled using a silver halide solvent if necessary during production of the silver halide emulsion hereunder.

To silver halide grains to be used for the silver halide emulsion hereunder, metal ions can be added during the grain forming and/or growing process using cadmium salt, zinc salt, lead salt, thallium salt, iridium salt or complex salt, rhodium salt or complex salt, iron salt or complex salt to be incorporated inside grains and/or on grain surfaces. Further, under an appropriate reductive atmosphere, reductive sensitizing nuclei can be given inside grians and/or on grain surfaces.

For the silver halide emulsion hereunder, unnecessary soluble salts may or may not be removed after termination of the growth of silver halide grains. The method described in Research Disclosure No. 17643 can be used to remove the salts.

For the silver halide grain to be used for the silver halide emulsion hereunder, its inside and surface may be composed of a same layer or of different layers.

The silver halide grain to be used for the silver halide emulsion hereunder may be such that latent images ae formed mainly on its usrface or mainly inside it.

The silver halide grain to be used for the silver halide emulsion hereunder may consist of regular crystals or irregular bulb-like or tabular crystals. Such grain may have any {100} surface to {111} surface ratio. Further, such grain may have composite or combined crystals.

The silver halide emulsion hereunder may be composed of more than one kind of silver halide emulsion.

The silver halide emulsion hereunder can be chemically sensitized by a sulfur sensitizing method that uses a compound containing sulfur reactive with silver ions, and active gelatin, a selenium sensitizing method that uses a selenium compound, a reduction sensitizing method that uses a reductive material, and/or a noble metal sensitizing method that uses gold or other noble metal compounds.

The silver halide emulsion hereunder can be sensitized optically over a desired wave length region by a coloring matter known as a sensitizing coloring matter in the photographic industry. A single sensitizing coloring matter, as well as a combination of a plurality of sensitizing coloring matters may be used. A coloring matter that has no sensitizing effect, or a sensitizer which absorbs substantially no visible light and enhances the sensitizing effect of a sensitizing coloring matter may be contained in the emulsion along with the sensitizing coloring matter.

To the silver halide emulsion hereunder, a compound known as a fog inhibitor or a stabilizer in the photographic industry can be added during a process of manufacturing sensitized material or storage of such material, or during chemical maturing and/or on termination of chemical maturing and/or after termination of chemical maturing before application of the silver halide emulsion to prevent fogs from being produced during photographic processing and/or to stabilize photographic performance.

As the binder (or protective colloid) for the silver halide emulsion hereunder, gelatin is used efficiently; in addition, hydrophilic colloid such as monomeric or interpolymeric composed hydrophilic material including gelatin derivatives, a graft polymer containing gelatin, protein, sugar derivatives, and cellulose derivatives can be used.

The photographic emulsion layer made of sensitized material that uses the silver halide emulsion hereunder, and the other hydrophilic colloid layers are hardened by bridging binder (or protective colloid) molecules and utilizing a hardener that enhances their hardness. THe hardner should be preferably added by amount that permits to harden sensitized material to the extent that any additional hardener needs not be added in processing liquid. But it is also possible to add a hardner in processing liquid.

A plasticizer can be added to enhance the flexibility of the silver halide emulsion layer made of sensitized material that uses the silver halide emulsion hereunder, and/or of the other hydrophilic colloid layers. Latex consisting of synthetic polymer not water-soluble or difficult to dissolve can be contained in the photographic emulsion layer made of sensitized material that uses the silver halide emulsion hereunder and the other hydrophilic colloid layers to improve dimension stability.

For the emulsion layer of the silver halide sensitized photographic color material hereunder, a dye forming couler is used which forms dyes through coupling reaction with the oxidant of aromatic primary amine developer (e.g., a pphenylene diamine derivative or an amino phenol derivative) in coloring developing processing. In general, the dye forming coupler is selected so that dyes which absorb light having spectra sensed by emulsion layers are formed in respect of the emulsion layers. For a blue light sensitive emulsion layer, a yellow dye-forming coupler is used; for a green light sensitive emulsion layer, a magenta dye-forming coupler; and for a red light sensitive emulsion layer, a cyan dye-forming coupler. In accordance with the purpose, however, silver halide sensitized photogrpahic color material may be made in a manner different from the above combinations.

The typical cyan dye-forming coupler used in the present invention includes 2- or 4-equivalent coupler of phenol or naphthol type, as described in U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308 and 3,839,044, British Patent Nos. 478,991, 945,542, 1,084,480, 1,377,233, 1,388,024 and 1,543,040, and Japanese Patent O.P.I. Publication Nos. 37435/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979 and 32071/1980.

Preferably, the cyan dye forming coupler to be used for the silver halide emulsion hereunder has the following formulae [C-1] and [C-2.

Formula [C-1]

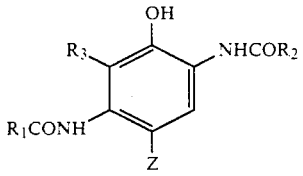

In the formula, $R^1$ represents an alkyl group or an aryl group. $R^2$ represents an alkyl group, a cycloalkyl group, an aryl group, or a heterocyclic group. $R^3$ represents a hydrogen atom, a halogen atom, an alkyl group, or an alkoxy group. $R^3$ may form a ring together with $R^1$. Z represents a hydrogen atom, or a group which is capable of being split off upon coupling reaction with the oxidant of an aromatic primary amine color developing agent.

Formula [C-2]

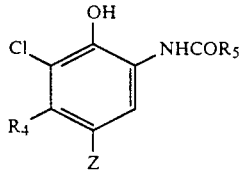

In he formula, $R^4$ represents a chained or branched alkyl group having 1 thru 4 carbon atoms. $R^5$ represents a ballast group. Z is the same as Z in the formula [C-1]. Most preferably, $R^4$ is a chained or branched alkyl group having 2 to 4 carbon atoms.

The alkyl group represented by $R^1$ in the formula [C-1] herein is, e.g., a chained or branched methyl, ehtyl, isopropyl, butyl, pentyl, octyl, nonyl, or tri-decyl group. The aryl group is, e.g., a phenyl or naphthyl group. The groups represented by $R^1$ may contain one or more substituents. The typical substituents contained, e.g., in the phenyl group include a halogen atom (e.g., fluorine, chlorine or bromine), an alkyl group (e.g., a methyl group, an ethyl group, a propyl group, a butyl group or a dodecyl group), a hydroxyl group, a cyano group, a nitro group, an alkoxy group (e.g., a methoxy gruop or an ethoxy group), an alkyl sulfon amide group (e.g., a methyl sulfon amide group or an octyl sulfon amide group), an aryl sulfon amide group (e.g., a phenyl sulfon amide group or a naphthyl sulfon amide group), an alkyl sulfamoyl group (e.g., a butyl sulfamoyl group), an aryl sulfamoyl group (e.g., a phenyl sulfamoyl group), an alkyloxy carbonyl group (e.g., a methyloxy carbonyl group), an aryloxy carbonyl group (e.g., a phenyloxy carbonyl group), an amino sulfon amide (e.g., an N,N-di-methyl amino sulfon amide group), an acyl amino group, an acyl amino group, a carbamoyl group, a sulfonyl group, a sulfinyl group, a sulfoxy group, a sulfo group, an aryloxy group, an alkoxy group, a carboxyl group, an alkyl carbonyl group, and an aryl carbonyl group.

More than one of these substituents may be contained in the phenyl group.

The alogen atom represented by $R^3$ is, e.g., fluorine, chlorine or bromine. The alkyl group is, e.g., a methyl group, an ethyl group, a propyl group, a butyl group, or a dodecyl group. The alkoxy group is, e.g., a methoxy group, an ethoxy group, a propyloxy group, or a butoxy group. $R^3$ may form a ring along with $R^1$.

The alkyl group represented by $R^2$ in the formula [C-1] herein includes so called a poly-fluoro alkyl group replaced, e.g., by a methyl group, an ethyl group, a butyl group, a hexyl group, a tri-decyl group, a pentadecyl group, a haptadecyl group or a fluorine atom.

The aryl group represented by $R^2$ is, e.g., a phenyl group or a naphthyl group, preferably a phenyl group. The heterocyclic group represented by $R^2$ includes, e.g., a pyridyl group or a furan group. The cycloalkyl group represented by $R^2$includes, e.g., a cyclopropyl group or a cyclohexyl group. The groups represented by $R^2$ may contain one or more substituents. The typical substituents contained, e.g., in the phenyl group include a halogen atom (e.g., fluorine, chlorine or bromine), an alkyl group (e.g., a methyl group, an ethyl group, a propyl group, a butyl gruop or a dodecyl group), a hydroxyl group, a cyano group, a nitro group, an alkoxy gruop (e.g., a methoxy gruop or an ethoxy gruop), an alkyl sulfon amide group (e.g., a methyl sulfon amide gruop or an octyl sulfon amide group), an aryl sulfon amide group (e.g., a phenyl sulfon amide group or a naphthyl sulfon amide group), an alkyl sulfamoyl group (e.g., a butyl sulfamoyl group), an aryl sulfamoyl group (e.g., a phenyl sulfamoyl group), an alkyloxy carbonyl group (e.g., a methyloxy carbonyl group), an aryloxy carbonyl group (e.g., a phenyloxy carbonyl group), an amino sulfon amide group, an acyl amino group, a carbamoyl group, a sulfonyl group, a sulfinyl group, a sulfoxy group, a sulfo group, an aryloxy group, an alkoxy group, a carboxyl group, an alkyl carbonyl group, and an aryl carbonyl group. More than one of these substituents may be contained in a phenyl group.

The desirable group represented by $R^2$ includes a polyfluoro alkyl group or a phenyl group, or a phenyl group having as the substituents one or more halogen atoms, alkyl groups, alkoxy groups, alkyl sulfon amide groups, aryl sulfon amide groups, alkyl sulfamoyl groups, aryl sulfamoyl groups, alkyl sulfonyl groups, aryl sulfonyl groups, alkyl carbonyl groups, aryl carbonyl groups or cyano groups.

Preferably, the cyan dye-forming coupler represented by the formula [C-1] herein has the following formula [C-3].

Formula [C-3]

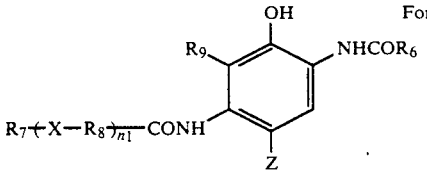

In the formula [C-3], $R^6$ represents a phenyl group. The phenyl group may contain one or more substituents. The typical substituents that may be contained include a halogen atom (e.g., fluorine, chlorine or bromine), an alkyl group (e.g., a methyl group, an ethyl group, a propyl group, a butyl group, an octyl group or a dodecyl group), a hydroxyl group, a cyano group, a nitro group, an alkoxy group (e.g., a methoxy group or an ethoxy group), an alkyl sulfon amide group (e.g., a methyl sulfon amide group or an octyl sulfon amide group), an aryl sulfon amide group (e.g., a phenyl sulfon amide group or a naphthyl sulfon amide group), an alkyl sulfamoyl group (e.g., a butyl sulfamoyl group), an aryl sulfamoyl group (e.g., a phenyl sulfamoyl group), an alkyloxy carbonyl group (e.g., a methyloxy carbonyl group), and an aryloxy carbonyl group (e.g., a phenyloxy carbonyl group). More than one of these substituents may have been replaced by a phenyl group. The preferable group represented by R, includes a phenyl group, or a phenyl group having as the substituents one or more halogen atoms (preferably fluorine, chlorine or bromine), alkyl sulfon amide groups (preferably o-methyl sulfon amide groups, p-octyl sulfon amide groups or o-dodecyl sulfon amide groups), aryl sulfon amide groups (preferably phenyl sulfon amide groups), alkyl sulfamoyl groups (preferably butyl sulfamoyl groups), aryl sulfamoyl groups (preferably phenyl sulfamoyl gruops), alkyl groups (preferably methyl groups or tri-fluoro-methyl groups), or alkoxy groups (preferably methoxy groups or ethoxy groups).

$R^7$ is an alkyl group or an aryl group. The alkyl group or aryl group may contain one or more substituents including, but not limited to, a halogen atom (e.g., fluorine, chlorine or bromine), a hydroxyl group, a carboxyl group, an alkyl group (e.g., a methyl group, an ethyl group, a propyl group, a butyl gruop, an octyl group or dodecyl group), an aralkyl group, a cyano group, a nitro group, an alkoxy group (e.g., a methoxy group or an ethoxy group), an aryloxy group, an alkyl sulfon amide group (e.g., a methyl sulfon amide group or an octyl sulfon amide group), an aryl sulfon amide group (e.g., a phenyl sulfon amide group or a naphthyl sulfon amide group), an alkyl sulfamoyl group (e.g., a butyl sulfamoyl group), an aryl sulfamoyl group (e.g., a phenyl sulfamoyl group), an alkyloxy carbonyl group (e.g., a methyloxy carbonyl group), an aryloxy carbonyl group (e.g.., a phenyloxy carbonyl group), an amino sulfon amide group (e.g., a di-methyl amino sulfon amide group), an alkyl sulfonyl group, an aryl sulfonyl group, an alkyl carbonyl group, an aryl carbonyl group, an amino carbonyl amide group, a carbamoyl group, and a sulfinyl group. More than one of these substituents may be contained.

Preferably, the group represented by $R^7$ is an alkyl group when $N1=0$, and an aryl grop when nl is equal to or more than 1. More preferably, the group represented by $R^7$ is an alkyl group having 1 thru 22 carbon atoms when $n1=0$ (preferably a methyl group, an ethyl group, a propyl group, a butyl group, an octyl group or a dodecyl group), and, when n1 is equal to or more than 1, a phenyl grup, or a phenyl group having as the substituents one or more alkyl groups (preferably a t-butyl group, a t-amyl group or an octyl group), alkyl sulfon amide groups (preferably a butyl sulfon amide group, an octyl sulfon amide group or a dodecyl sulfon amide group), aryl sulfon amide groups (preferably a phenyl sulfon amide group), amino sulfon amide groups (preferably a di-methyl amino sulfon amide group), and/or alkyloxy carbonyl groups (preferably a methyloxy carbonyl group or a butyloxy carbonyl group).

$R^8$ represents a chained or branching alkylene group having 1 thru 20 or 1 thru 12 carbon atoms.

$R^9$ represents a hydrogen atom or a halogen atom (fluorine, chlorine, bromine or iodine), preferably a hydrogen atom.

$R^1$ is 0 or a positive number, preferably 0 or 1.

X represents a —O—, —CO—, —COO—, —OCO—, $—SO_2NR—$, $NR'SO_2NR''—$, —S—, —SO— or $—SO_2$ group having a valence of 2. R' and R'' represent an alkyl group, which may contain substituent(s). Preferably, X is a —O—, —S—, —SO— or $—SO_2—$ group.

Z has the same meaning as Z in the formula [C-1].

The chained or branched alkyl group having 1 thru 4 carbon atoms represented by $R^4$ in the formula [C-2] hereunder includes, e.g., an ethyl group, a propyl group, a butyl group, an iso-propyl group, an iso-butyl group, a sec-butyl group, or a tert-butyl group, which may contain substituent(s). The substituents include, e.g., an acyl amino group (e.g., a acetyl amino group) and an alkoxy group (e.g., a methoxy group).

$R^4$ is preferably an alkyl group having 2 thru 4 carbon atoms.

The ballast group represented by $R^5$ is an organic group having such size and shape that provide coupler molecules with weight suffient to prevent the coupler from being diffused substantially to the other layers from that layer on which it is applied.

The typical ballast group includes an alkyl or aryl group having 8 thru 32 carbon atoms.

These alkyl and aryl groups may contain substituent(s). The substituents for the aryl group include. e.g., an alkyl group, an aryl group, an alkoxy group, an aryloxy group, a caboxyl group, an acyl group, an ester group, a hydroxy group, a cyano group, a nitro group, a carbamoyl group, a carbon amide group, an alkylthio group, an arylthio group, a sulfonyl group, a sulfon amide group, a sulfamoyl group, and a halogen atom. The substituents for the alkyl group include the above ones for the aryl group other than an alkyl group.

The most preferably ballast group is expressed by the following formula [C-4].

Formula [C-4]

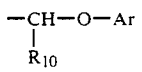

$R^{10}$ represents a hydrogen atom, or an alkyl group having 1 thru 12 carbon atoms. At represents an aryl group such as a phenyl group, which may contain substituent(s). The substituents include an alkyl group, a hydroxy group, and an alkyl sulfon amide group, being most preferably a branching alkyl group such as a t-butyl group.

In formulae [C-1], [C-2] and [C-3], the groups represented by Z which are freed through reaction with the oxidant of the Class 1 aromatic amine system coloring developing agent are known to those who are skilled in the art. They improve its reactivity, or are freed from it to implement functions such as development suppression, bleaching suppression and color correction in the coating layer or other layers containing the coupler inside the silver halide sensitized photographic color material. The typical groups include, e.g., a halogen atom such as chlorine or fluorine, an alkoxy group replaced or not replaced, an aryloxy group, an arylthio group, a carbamoyloxy group, a sulfonyloxy group, a sulfon amide group, or a heteroylthio or heteroyloxy group. Most preferably, Z is a hydrogen or chlorine atom.

For actual applications, see Japanese Patent O.P.I. Publication Nos. 10135/1975, 12034/1975, 130441/1975, 48237/ 1979, 146828/1976, 14736/1979, 37425/1972, 123341/1975 and 95346/1983, Japanese Patent Examined Publication No. 36894/ 1973, and U.S. Pat. Nos. 3,476,563, 3,737,316 and 3,227,551.

The following are the typical cyan couplers expressed by the formula [C-1]. The couplers provided by the present invention are not limited to those.

C-1

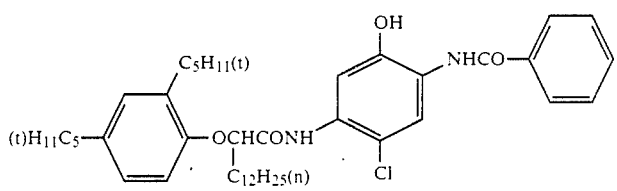

C-2

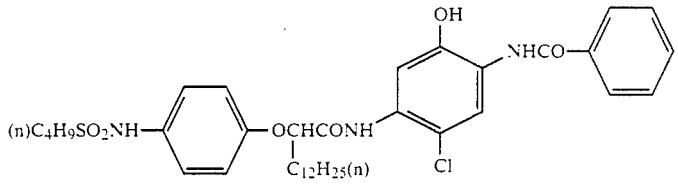

C-3

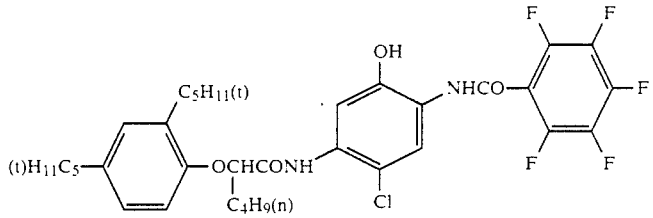

C-4

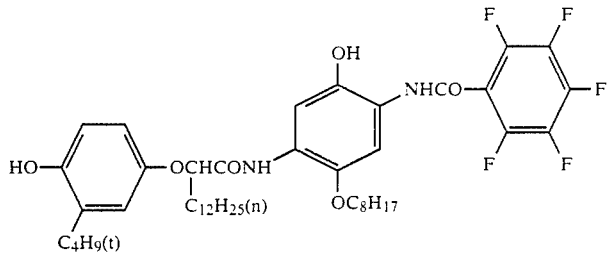

C-5

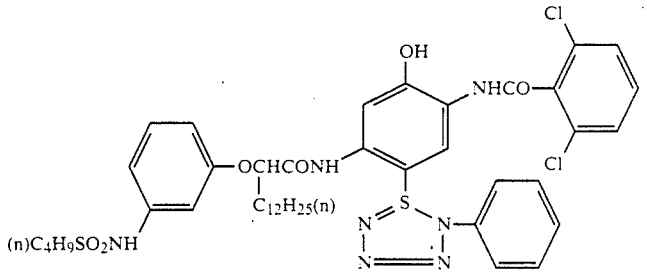

-continued
C-6
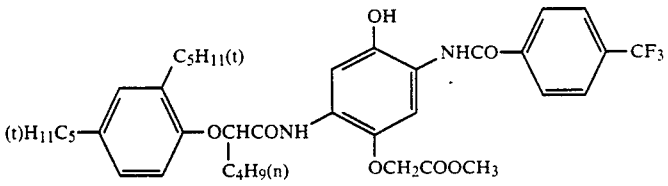
C-7
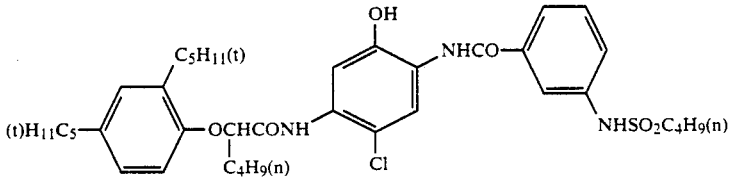
C-8
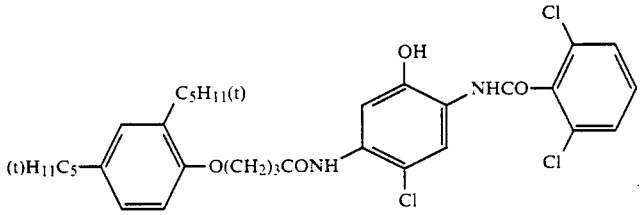
C-9
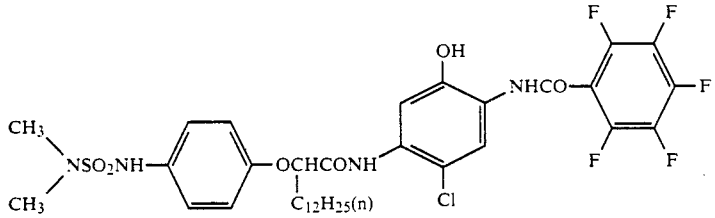
C-10
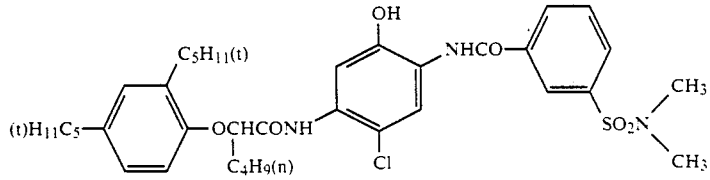
C-11
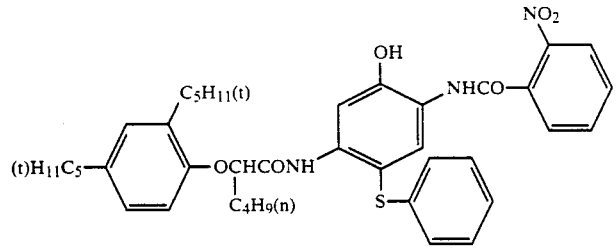
C-12
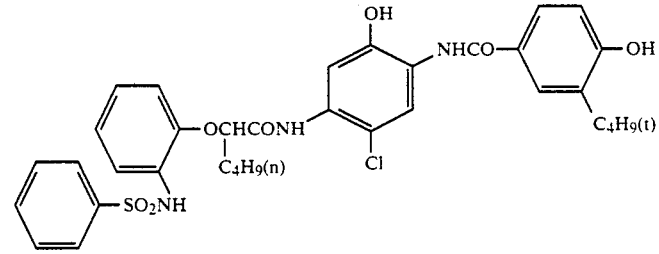

-continued
C-13
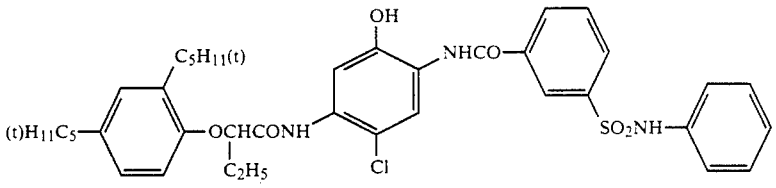
C-14
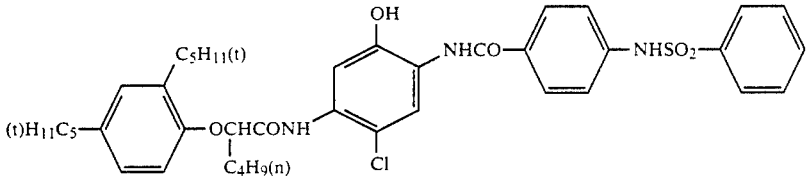
C-15
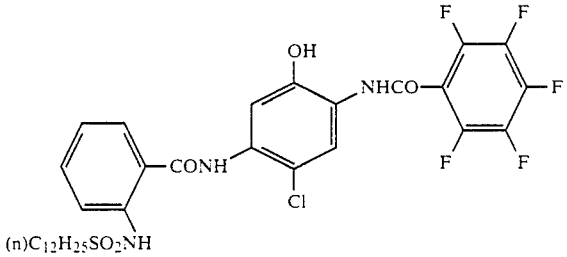
C-16
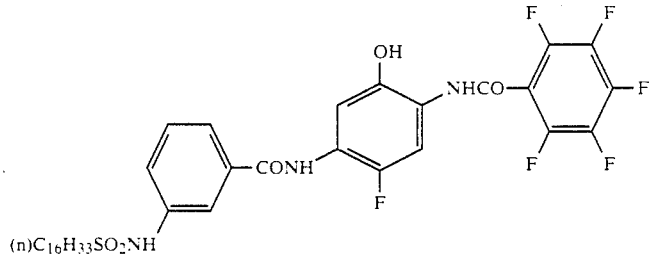
C-17
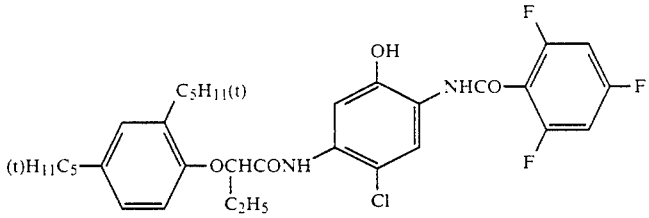
C-18
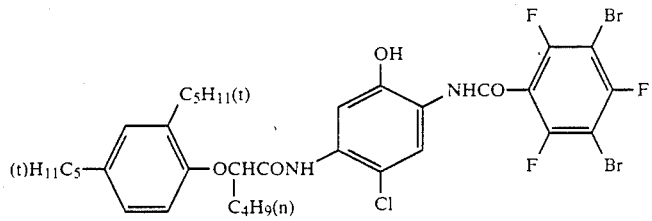
C-19
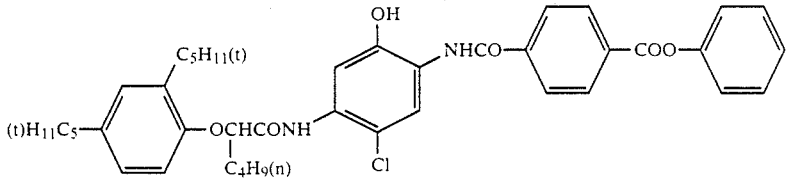

-continued
C-20
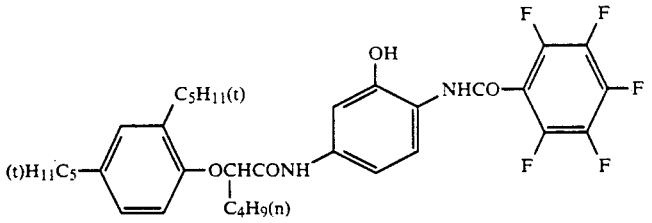
C-21
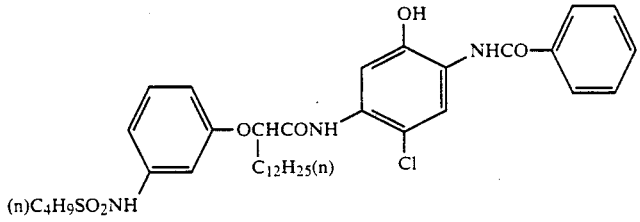
C-22
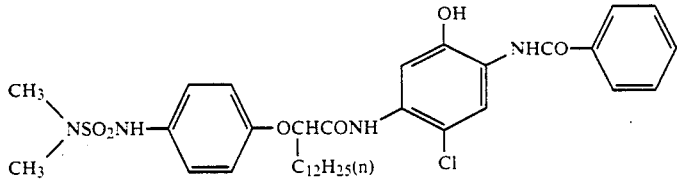
C-23
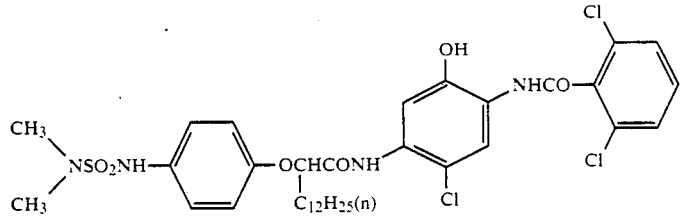
C-24
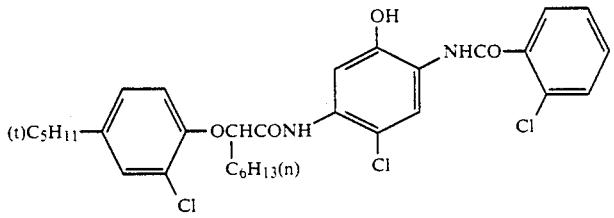
C-25
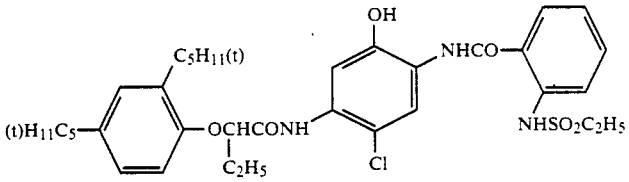
C-26
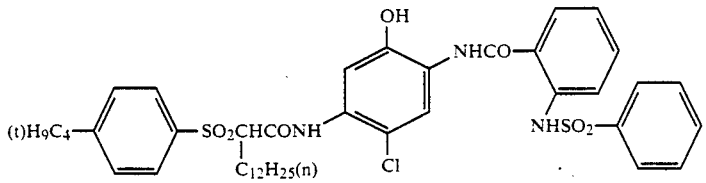

-continued
C-27
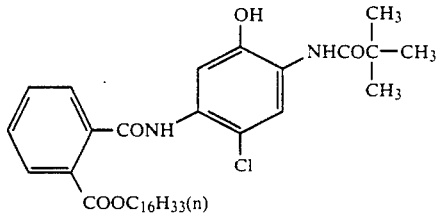
C-28
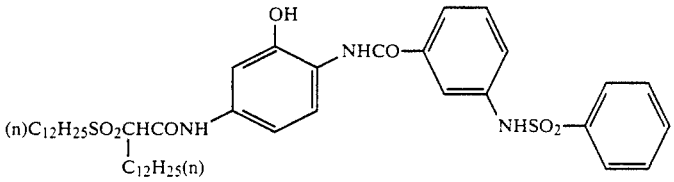
C-29
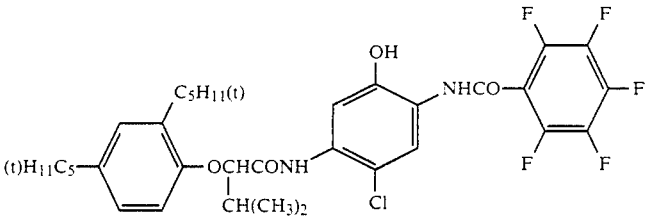
C-30
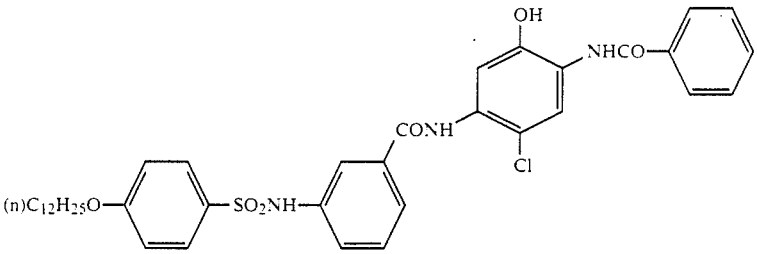
C-31
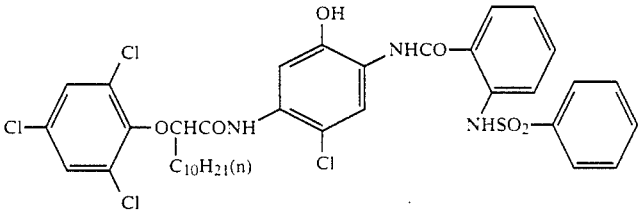
C-32
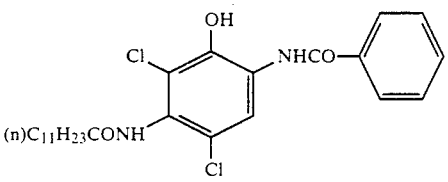
The following are the typical couplers expressed by the formula [C-2]. The couplers provided by the present invention are not limited t those.

Formula [C-2]
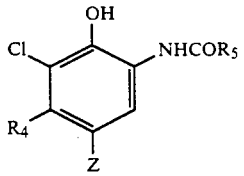
| Coupler No. | $R_4$ | Z | $R_5$ |
|---|---|---|---|
| C-33 | $-C_2H_5$ | $-Cl$ | 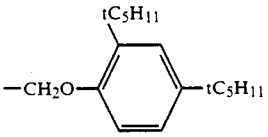 |
| C-34 | $-C_2H_5$ | 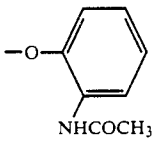 | 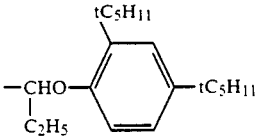 |
| C-35 | 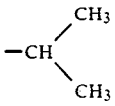 | $-Cl$ | 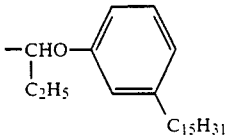 |
| C-36 | $-C_2H_5$ | $-Cl$ | 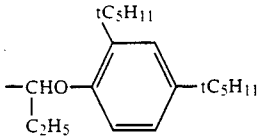 |
| C-37 | $-C_2H_5$ | $-Cl$ | 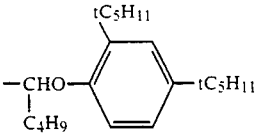 |
| C-38 | $-C_4H_9$ | $-F$ | 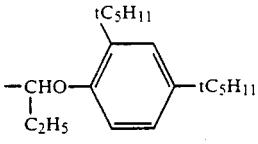 |
| C-39 | $-C_2H_5$ | $-F$ | 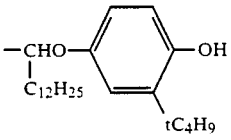 |
| C-40 | $-C_2H_5$ | $-Cl$ | 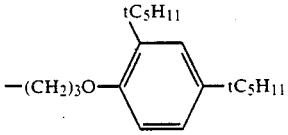 |
| C-41 | $-C_2H_5$ | $-F$ | 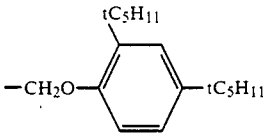 |

-continued
Formula [C-2]
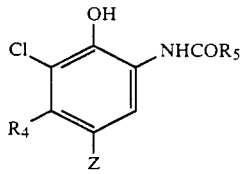
| Coupler No. | $R_4$ | Z | $R_5$ |
|---|---|---|---|
| C-42 | $-CH_3$ | $-Cl$ | 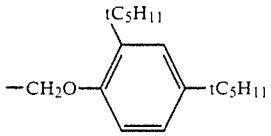 |
| C-43 | $-C_2H_5$ | $-Cl$ | 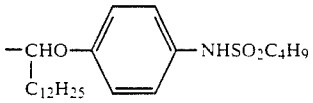 |
| C-44 | $-C_2H_5$ | $-Cl$ | 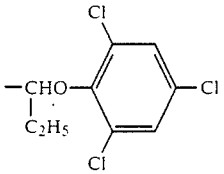 |
| C-45 | $-CH(CH_3)_2$ | $-Cl$ | $-C_{18}H_{37}$ |
| C-46 | $-C_2H_5$ | $-F$ | 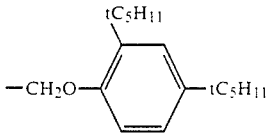 |
| C-47 | $-CH_3$ | $-Cl$ | 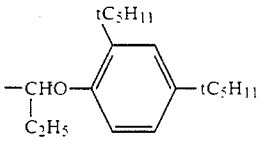 |
| C-48 | $-C_2H_5$ | $-Cl$ | 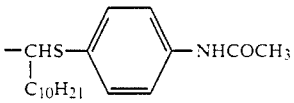 |
| C-49 | $-C_3H_7$ | $-Cl$ | 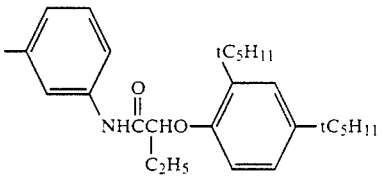 |
| C-50 | $-C_3H_7$ | $-Cl$ | 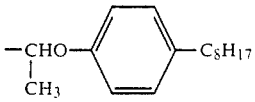 |
| C-51 | $-C_2H_4NHCCH_3$ ‖ O | $-Cl$ | 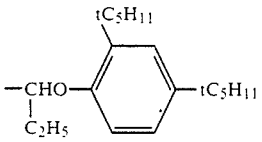 |

-continued
Formula [C-2]
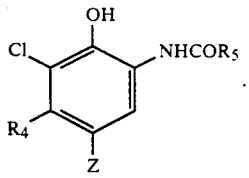
| Coupler No. | $R_4$ | Z | $R_5$ |
|---|---|---|---|
| C-52 | $-C_3H_6OCH_3$ | $-Cl$ | 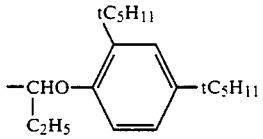 |
| C-53 | $-C_2H_5$ | $-Cl$ | 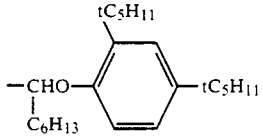 |
| C-54 | $-C_2H_5$ | $-Cl$ | 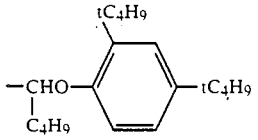 |
| C-55 | $-CH(CH_3)_2$ | $-Cl$ | 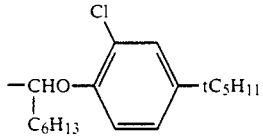 |
| C-56 | $-C_2H_5$ | $-Cl$ | 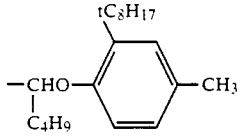 |
| C-57 | $-C_2H_5$ | $-Cl$ | 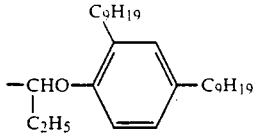 |
| C-58 | $-C_4H_9$ | $-OCH_2CH_2SO_2CH_3$ | 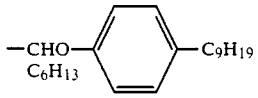 |
| C-59 | $-C_2H_5$ | $-Cl$ | 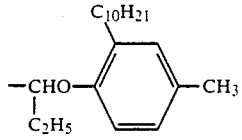 |
| C-60 | $-C_4H_9$ | 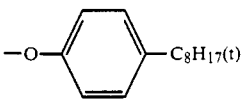 | 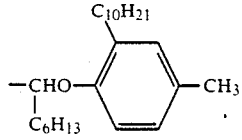 |

-continued

Formula [C-2]

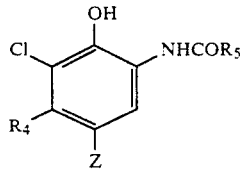

| Coupler No. | $R_4$ | Z | $R_5$ |
|---|---|---|---|
| C-61 | $-C_2H_5$ | $-Cl$ | 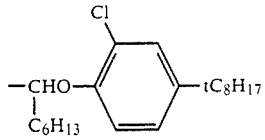 |
| C-62 | $-C_2H_5$ | $-OCH_2CH_2SCHCOOH$ (with $C_2H_5$) | 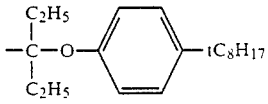 |
| C-63 | $-C_2H_5$ | $-Cl$ | 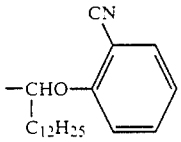 |
| C-64 | $-C_2H_5$ | $-Cl$ | 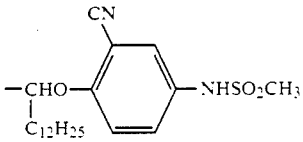 |

For this invention, the compound represented by the following formula [Y] is recommended as a yellow dye-forming coupler.

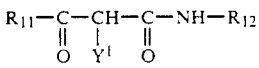

Formula [Y]

where $R^{11}$ represents an alkyl group (e.g., a methyl group, an ethyl group, a propyl group, a butyl group, etc.) or an aryl group (e.g., a phenyl group, p-methoxyphenyl etc.), $R^{12}$ presents an aryl group, $Y^1$ represents hydrogen or a group capable of being split off during the process of coupling reaction.

The most desirable compound as a yellow dye-forming coupler is the compound represented by the following formula [Y'].

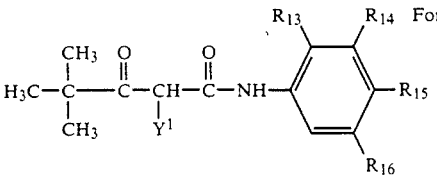

Formula [Y']

where $R^{13}$ represents a halogen, an alkoxy group or an aryloxy group, $R^{14}$, $R^{15}$ and $R^{16}$ represent a hydrogen, a halogen group, an alkyl group, an alkenyl group, an alkoxy group, an aryl group, an aryloxy group, a carbonyl group, a sulfonyl group, a carboxyl group, an alkoxycarbonyl group, a carbamyl group, a sulfon group, sulfamyl group, a sulfonamide group, an acylamide group, a ureide group or an amino group, and $Y^1$ is explained earlier in this text.

These are described in the following patent publications: U.S. Pat. Nos. 2,778,658, 2,875,057, 2,908,573, 3,227,550, 3,253,924, 3,265,506, 3,277,155, 3,341,331, 3,369,895, 3,384,657, 3,408,194, 3,415,652, 3,447,928, 3,551,155, 3,582,322, 3,725,072, 3,894,875, West German OLS Patent Nos. 1,547,868, 2,057,941, 2,162,899, 2,163,812, 2,213,461, 2,219,917, 2,261,361, 2,263,875, Japanese Patent Examined Publication Nos. 49-13576, 48-29432, 48-66834, 49-10736, 49-122335, 50-28834, and 50-132926.

The following are some of the typical examples, but not limited to, of the yellow color forming couplers represented by the formula [Y].

Y-1
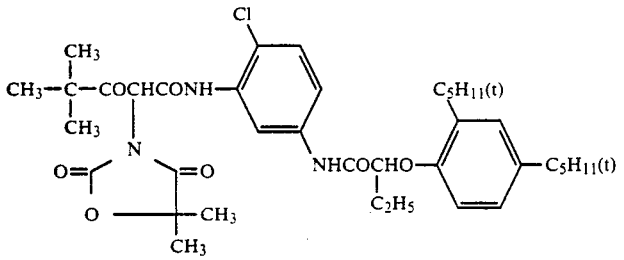
Y-2
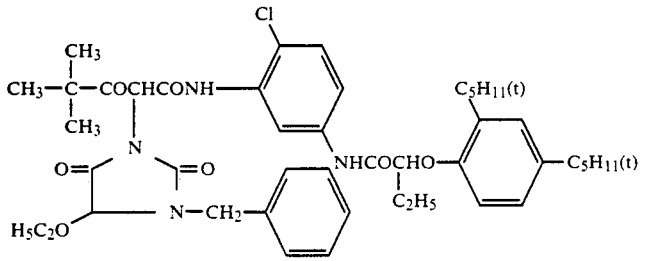
Y-3
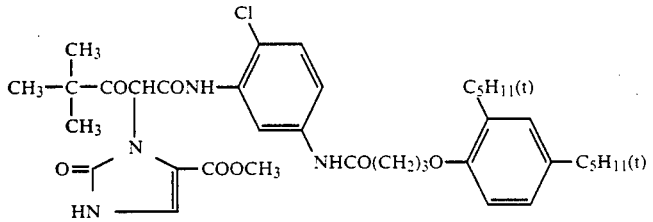
Y-4
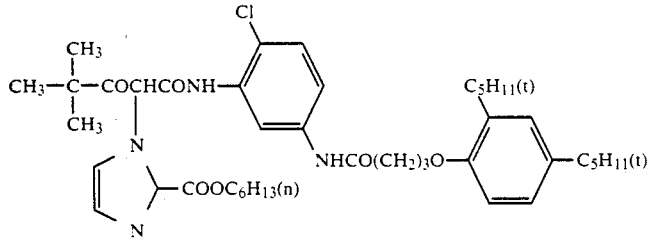
Y-5
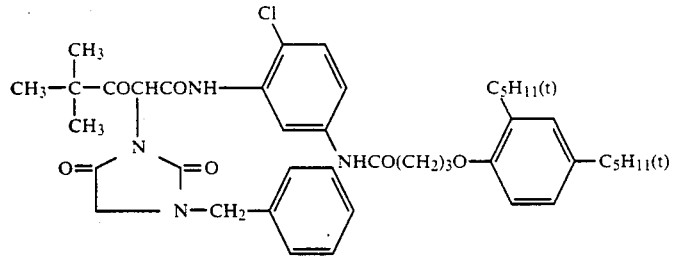
Y-6
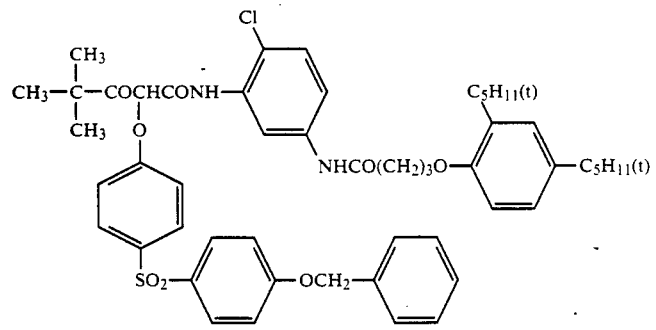

-continued

Y-7

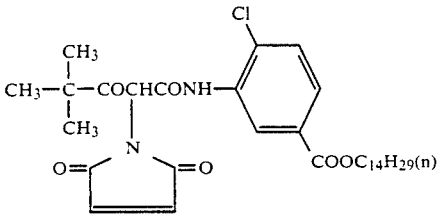

Y-8

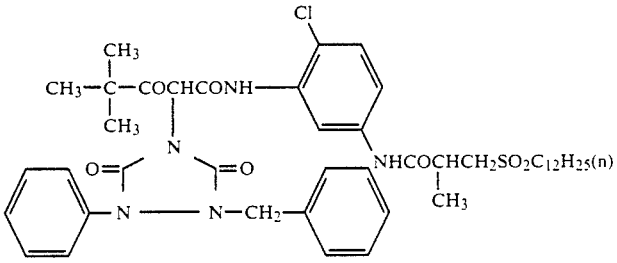

Y-9

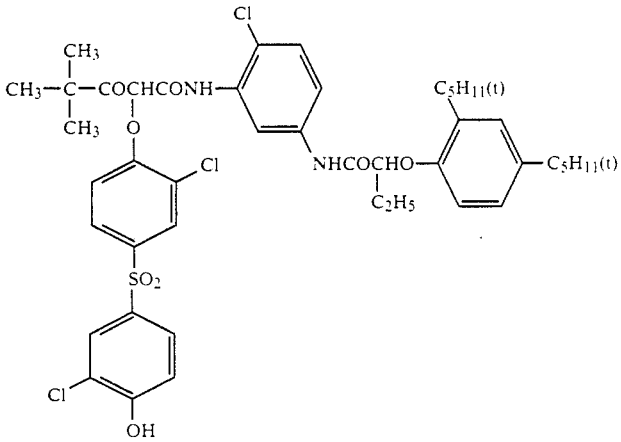

Y-10

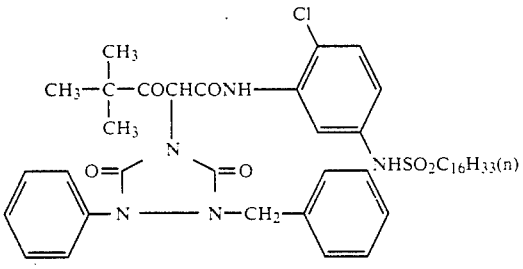

In this invention, an anti-fogging agent is used to prevent occurrence of color turbidity, deterioration of clarity and noticeable graininess resulted from the oxidant in a developing agent or the electron shift agent moving between emulsifying agent layers (between single color sensivity layers) of a color film sensitized material.

This anti-fogging agent can apply either directly to the emulsifying agent layers themselves or to the interlayers provided between the adjacent emulsifying agent layers.

The following compound represented by formula [HQ] is recommended as an anti-fogging agent to be used in this invention.

Formula [HQ]

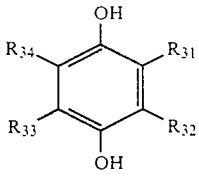

where $R^{31}$, $R^{32}$, $R^{33}$, and $R^{34}$ independently represent a hydrogen, a halogen, an alkyl group, an alkenyl group, an aryl group, a cycloalkyl group, an alkoxy group, an aryloxy group, an alkyl thio group, an aryl thio group, an acyl group, an alkyl acyl amino group, an aryl acyl amino group, an alkyl carbamoyl group, an aryl carbamoyl group, an alkyl sulfon amide group, an aryl sulfon amide group, an alkyl sulfamoyl group, an aryl sulfamoyl group, an alkyl sufonyl group, a nitro group, a cyano group, an alkyl oxy carbonyl group, an aryl oxy carbonyl group, an alkyl acyl oxy group, or aryl acyl oxy group.

In the above formula [HQ], the atoms or the atom groups represented by $R^{31}$, $R^{32}$, $R^{33}$ and $R^{34}$ include such halogen atoms as flourine, chlorine, bromine; and an alkyl group such as methyl, ethyl, n-propyl, i-propyl, n-butyl, t-butyl, n-amyl, n-octyl, n-dodecyl, and n-octadecyl; and an alkyl group with 1-32 carbon atoms is most preferable.

The aryl group include aryl, octenyl, oleyl; and an alkenyl group with 2-32 carbon atoms is most preferable.

The anyl group includes phenyl and naphthyl groups.

The acyl group includes acetyl, octanoyl and lauroyl groups.

The cycloalkyl, group includes cyclohexyl, cyclopentyl groups.

The alkoxy group includes methoxy, ethoxy, and dodecyl groups; the aryloxy group, phenoxy group; the alkyl thio group, methyl thio, n-butyl and n-dodecyl thio groups; the aryl thio group, phenyl thio group; the alkyl acyl amino group, acetyl amino group; the aryl acyl amino group, benzoyl amino group; the alkyl carbamoyl group, methyl carbamoyl group; the aryl carbamoyl group, phenyl carbamoyl group; the alkyl sulfon amide group, methyl sulfon amide group; the aryl sulfon amide group, phenyl sulfon amine group, the alkyl sulfamoyl group, methyl sulfamoyl group; the aryl sulfamoyl group, phenyl sulfamoyl group; the alkyl sulfonyl group, methyl sulfonyl group; the aryl sulfonyl group, phenyl sulfonyl group; the alkyl oxy carbonyl group, methyl oxy carbonyl group; the aryl oxy carbonyl group, phenyl oxy carbonyl group; the alkyl acyl oxy group, acetyl oxy group; the aryl acyl oxy group, benzoyl oxy group.

Some of these atoms groups contain substituents, which include groups of alkyl, aryl, aryl oxy, alkyl thio, cyano, acyl oxy, alkoxy carbonyl, acyl, sulfamoyl, hydroxy, nitro, amino and a hetedrocyclic group.

Among those compounds represented by the formula [HQ] shown earlier in this text, the compounds represented by the following formula [HQ'] are most preferably used.

Formula [HQ']

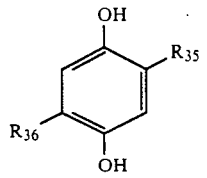

where $R^{35}$ and $R^{36}$ represent hydrogen atom, groups of alkyl, alkenyl, aryl, acyl and cycloalkyl, or heterocyclic group respectively provided that $R^{35}$ and $r^{36}$ do not represent hydrogen atom at the same time.

In the above formula [HQ'], the alkyl group represented by $R^{35}$ and $R^{36}$ include methyl, ethyl, n-propyl, i-propyl, n-butyl, n-amyl, i-amyl, n-octyl, n-dodecyl, n-octadecyl; and an alkyl group with 1-32 carbon atoms is most preferable.

The alkenyl group includes aryl, octenyl and oreyl (?) groups; and an alkenyl group with 2 - 32 carbon atoms is especially preferable.

The aryl group includes groups of phenyl and naphthyl.

The acyl group includes groups of acetyl, octanoyl and lauroyl.

The cycloalkyl group includes groups of cyclohexyl and cyclopentyl.

The heterocyclic group includes groups of imidazolyl, furyl, pyridyl, triazinyl, and thiazolyl.

It is further preferable that the atoms or atom groups represented by $R^{35}$ and $R^{36}$ in the above formula [HQ'] have a total of 8 or more carbon atoms and can provide a non-diffusion characteristics.

The following are some of the exmaples, but not to limited to, of the compounds represented by the above formula [HQ].

(HQ-1)

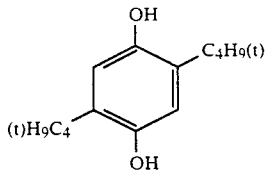

(HQ-2)

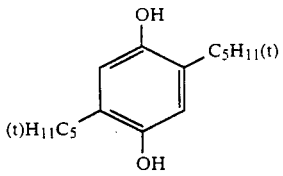

(HQ-3)

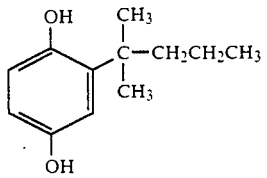

-continued
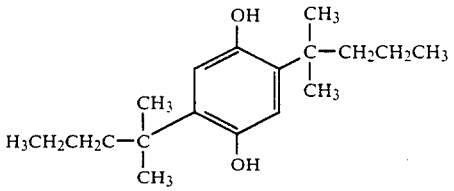
(HQ-4)
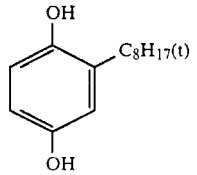
(HQ-5)
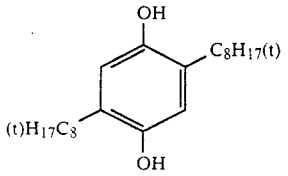
(HQ-6)
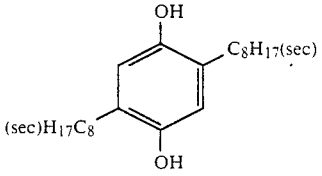
(HQ-7)
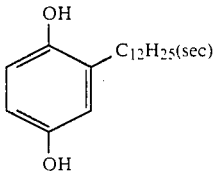
(HQ-8)
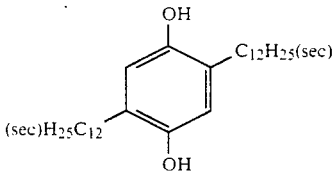
(HQ-9)
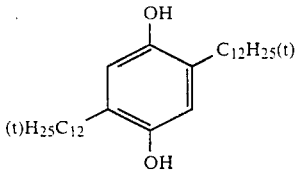
(HQ-10)
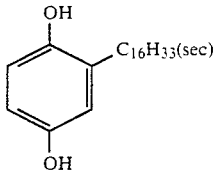
(HQ-11)
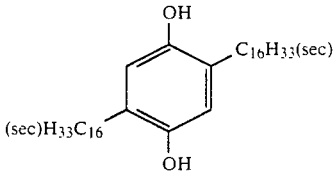
(HQ-12)

-continued
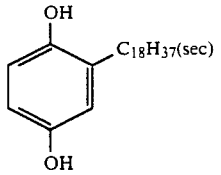
(HQ-13)
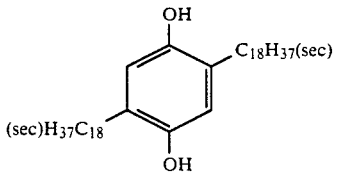
(HQ-14)
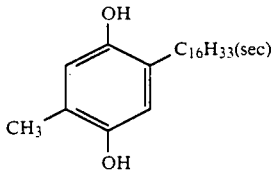
(HQ-15)
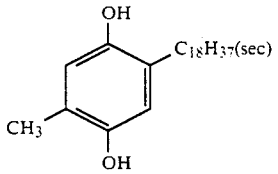
(HQ-16)
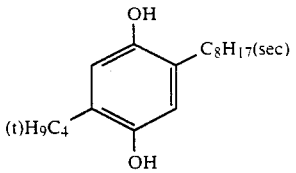
(HQ-17)
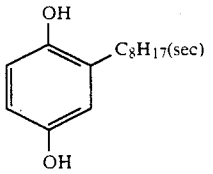
(HQ-18)
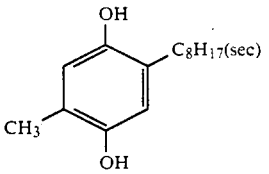
(HQ-19)
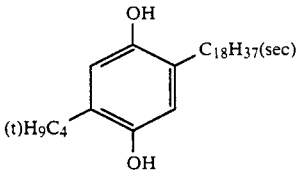
(HQ-20)
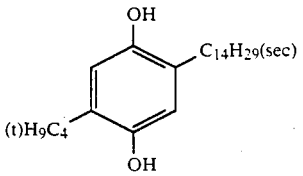
(HQ-21)

-continued
(HQ-22)
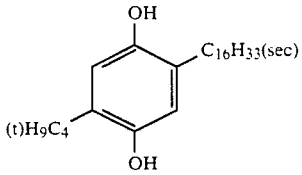
(HQ-23)
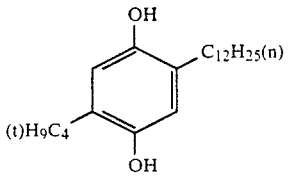
(HQ-24)
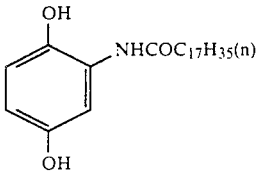
(HQ-25)
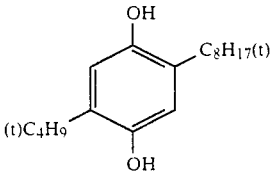
(HQ-26)
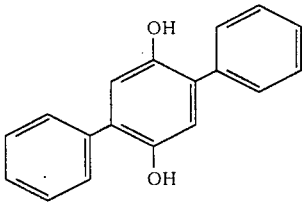
(HQ-27)
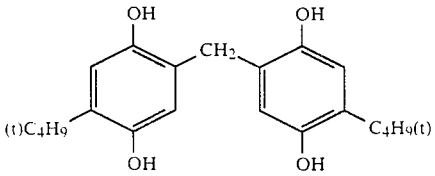
(HQ-28)
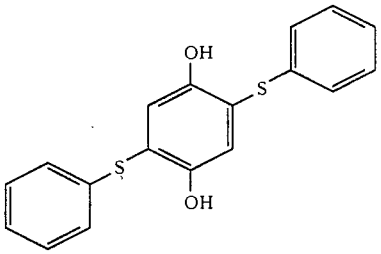
(HQ-29)
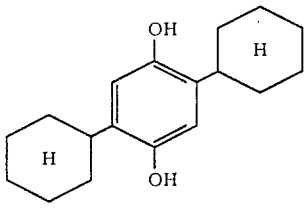

-continued
(HQ-30)
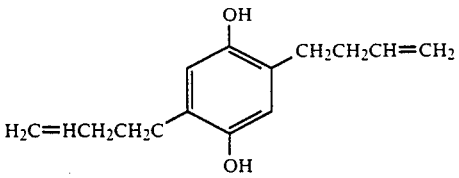
(HQ-31)
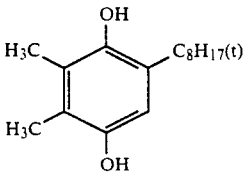
(HQ-32)
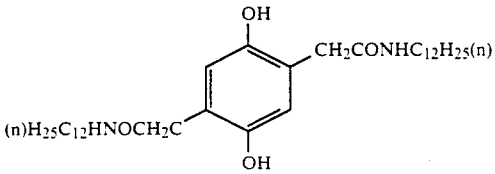
(HQ-33)
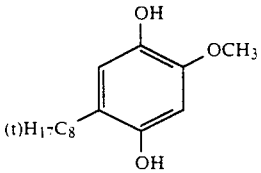
(HQ-34)
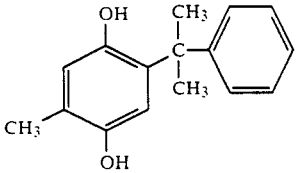
(HQ-35)
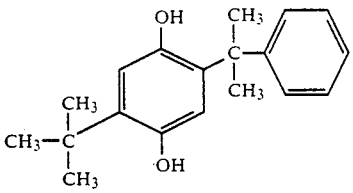
(HQ-36)
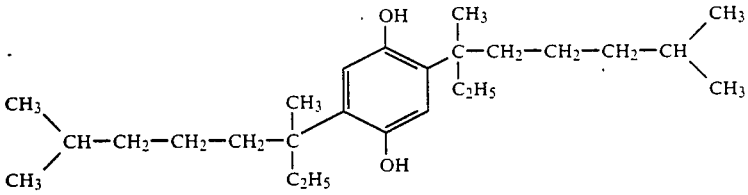
(HQ-37)
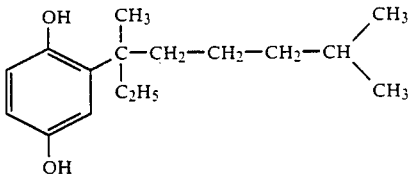

-continued (HQ-38)

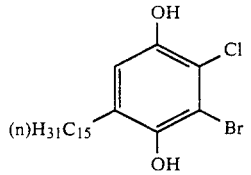

These compounds are described in publications such as Research Disclosure, Volume 176 (1978), VII-I of Section 17643.

For the light-sensitive silver halide photographic material used in this invention, an image stabilizer can be utilized to prevent deterioration of color images. Preferable image stabilizers for use in this invention include those presented below in the formulas of [A]-[H], [J] and [K].

Formula [A]

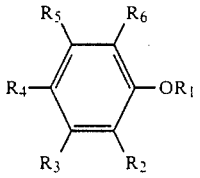

where $R^1$ represents hydrogen atom, groups of alkyl, alkenyl, aryl, or hedrocyclic group; $R^2$, $R^3$, $R^5$ and $R^6$ independently represent hydrogen atom, halogen atom, groups of hydroxy, alkyl, alkenyl, aryl, alkoxy or acyl amino respectively; $R^1$ refers to groups of alkyl, hydroxy, aryl or alkoxy.

$R^1$ and $R^2$ may be combined with each other to form a 5- or 6-membered ring, where $R^4$ is a hydroxy group or an alkoxy group. $R^3$ and $R^4$ may also be combined to form a 5-membered hydrocarbon ring, where $R^1$ represents alkyl, aryl or a heterocyclic group, with the exception of the case where $R^1$ represents hydrogen atom and $R^4$, hydroxy group.

In the above formula [A], $R^1$ represents a hydrogen atom, groups of alkyl, alkenyl, aryl or a heterocyclic group, and the alkyl group includes chained or branched alkyl groups such as groups of methyl, ethyl, propyl, n-octyl, tert-octyl and hexadecyl. The alkenyl group represented by $R^1$ includes groups of allyl, hexenyl and octenyl. The aryl group represented by $R^1$ includes groups of phenyl and naphthyl. The heterocyclic group represented by $R^1$ includes tetrahydropyranyl and pyrimidyl. These atom groups can have substituents. For example, alkyl group having substituents includes benzyl and ethoxymethyl; aryl group representing and/or having substituents includes groups of methoxyphenyl, chlorphenyl, 4-hydroxy-3, and 5-dibutylphenyl.

In the formula [A], $R^2$, $R^3$, $R^5$ and $R^6$ represents hydrogen atom, halogen atom, groups of hydroxy, alkyl, alkenyl, aryl, alkoxy or acyl amino. Further, groups of alkyl, alkenyl and aryl in this formula include those groups of alkyl, alkenyl and aryl represented by $R^1$.The halogen atom includes fluorine chlorine, and bromine. The alkoxy group includes methoxy group and ethoxy group. The acyl amino group is represented by R'CONH—, where R' includes alkyl group (e.g., groups of methyl, ethyl, n-propyl, n-butyl, n-octyl, tert-octyl, benzyl, etc.), alkenyl group (e.g., groups of allyl, octynyl, oleyl, etc.), aryl group (e.g., phenyl, methoxyphenyl, naphtyl, etc.) or heterocyclic group (e.g., pyridyl, pyrimidyl, etc.).

Also, in the above formula [A], $R^4$ represents groups of alkyl, hydroxy, aryl or alkoxy. The alkyl group and the aryl group in this formula includes the same groups of alkyl and aryl represented by $R^1$. The alkenyl group represented by $R^4$ here includes the same alkoxy group represented by $R^2$, $R^3$, $R^5$ and $R^6$.

$R^1$ and $R^2$ may be ring-closed each other to form, with a benzene ring, a chroman, coumaran and methylene dioxybenzene ring.

$R^3$ and $R^4$ may be ring closed each other to form, with a benzen ring, an indane ring. These rings can have substituents (e.g., alkyl, alkoxy, aryl).

Also, $R^1$ and $R^2$, or $R^3$ and $R^4$ may be ring-closed each other to form spiro compound using the atoms in the rings as a spiro atom. Also, $R^2$ and $R^4$ may be used as a connecting group to form a bis groups.

Among those compounds of a phenol group or a phenyl ether group, a preferable compound is a bi-indane compound having 4 RO— groups (R refers to groups of alkyl, alkenyl, aryl or heterocyclic group). The most preferable compound is the one represented by the formula [A-1] below.

Formula [A-1]

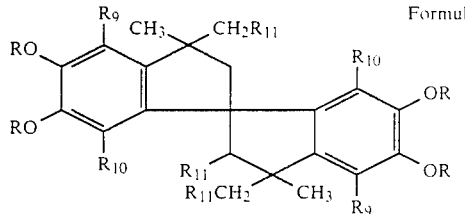

where R represents an alkyl group (e.g. methyl, ehtyl, propyl, n-octyl, tert-octyl, benzyl, hexadecyl), an alkenyl group (e.g. aryl, octenyl, oleyl, an aryl group (e.g. phenyl, naphtyl), or a heterocyclic group (e.g. tetrahydropyranyl, pyrimidyl). $R^9$ and $R^{10}$ independently represent hydrogen atom, a halogen atom (e.g. fluorine, chlorine, bromine), an alkyl group (e.g. methyl, ethyl, n-butyl, benzyl), an alkoxy group (e.g. aryl, hexenyl, octenyl), or an alkoxy group (e.g. methoxy, ethoxy, benzyloxy). $R^{11}$ refers to hydrogen atom, an alkyl group (e.g. methyl, ethyl, n-butyl, benzyl), an alkenyl group (e.g. 2-propenyl, hexenyl, octenyl), or an aryl group (e.g. phenyl, methoxyphenyl, chlorophenyl, naphtyl).

The compound represented by the above formula [A] also includes those compounds described in such publications as U.S. Pat. Nos. 3,935,016, 3,982,944 and 4,254,216, Japanese Patent O.P.I. Publication Nos. 21004/1980 and 145530/1979, British Patent Nos. 2,077,455 and 2,062,888, U.S. Pat. Nos. 3,764,337, 3,432,300, 3,574,627 and 3,573,050, Japanese Patent O.P.I. Publication Nos. 152225/1977, 20327/1978, 17729/1978, and 6321/1980, British Patent No. 1,327,556, British Patent (open to public inspection) No.

2,066,975, Japanese Patent Examined Publication Nos. 12337/1979, and 31625/1973, U.S. Pat. No. 3,700,455.

The compounds represented by formula [A]are used preferably in an amount of 5 to 300 mol % for magenta couplers, and more preferably 10 to 200 mol %.

The following are some of the typical exmaples of compounds represented by the formula [A]:

TYPE (1)

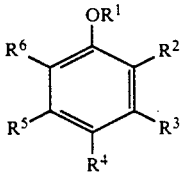

TYPE (2)

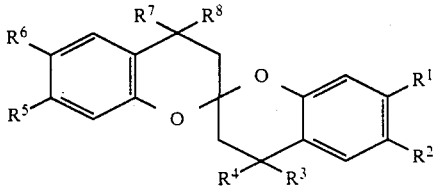

TYPE (3)

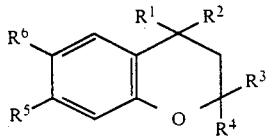

TYPE (4)

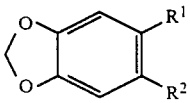

TYPE (5)

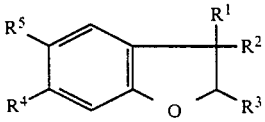

-continued

TYPE (6)

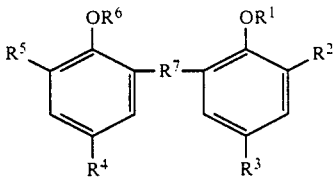

TYPE (7)

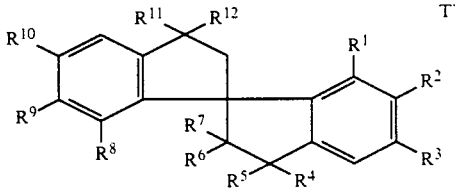

TYPE (1)

| Compound No. | $R^1$ | $R^2$ | $R^3$ | $R^4$ | $R^5$ | $R^6$ |
|---|---|---|---|---|---|---|
| A-1 | H | OH | $-C(CH_3)_2CH_2C(CH_3)_3$ | $CH_3O$ | H | $-C(CH_3)_2CH_2C(CH_3)_3$ |
| A-8 | $C_8H_{17}$ | $C(CH_3)_2C_2H_5$ | H | $C_8H_{17}O$ | $C(CH_3)_2C_2H_5$ | H |
| A-14 | H | H | OH | $C(CH_3)_2CH_2C(CH_3)_3$ | H | H |
| A-16 | H | $C(CH_3)_2C_3H_7$ | H | $CH_3O$ | $C(CH_3)_2C_3H_7$ | H |

TYPE (2)

| Compound No. | $R^1$ | $R^2$ | $R^3$ | $R^4$ | $R^5$ | $R^6$ | $R^7$ | $R^8$ |
|---|---|---|---|---|---|---|---|---|
| A-2 | $CH_3$ | OH | $CH_3$ | $CH_3$ | $CH_3$ | OH | $CH_3$ | $CH_3$ |
| A-10 | $CH_3$ | $OCH_3$ | $CH_3$ | $CH_3$ | $CH_3$ | $CH_3O$ | $CH_3$ | $CH_3$ |

TYPE (3)

| Compound No. | $R^1$ | $R^2$ | $R^3$ | $R^4$ | $R^5$ | $R^6$ |
|---|---|---|---|---|---|---|
| A-3 | $CH_3$ | $CH_3$ | H | $CH_3$ | $(t)C_8H_{17}$ | OH |
| A-11 | $CH_3$ | $CH_3$ | H | $CH_3$ | $(t)C_8H_{17}$ | $C_8H_{17}O$ |
| A-12 | $CH_3$ | $CH_3$ | H | $CH_3$ | $CH_3$ | $O(CH_2)_2OC_{10}H_{21}$ |
| A-17 | H | $CH_3$ | $CH_3$ | $CH_3$ | $(t)C_8H_{17}$ | OH |
| A-18 | $CH_3$ | $CH_3$ | $CH_3$ | OH | $CH_3$ | OH |

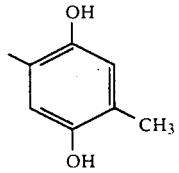

TYPE (4)

| Compound No. | $R^1$ | $R^2$ |
|---|---|---|
| A-4 | $C_3H_7$ | 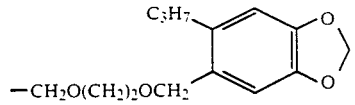 |
| A-9 | $C_3H_7$ | $-CH_2O(CH_2)_2OC_4H_9$ |

TYPE (5)

| Compound No. | $R^1$ | $R^2$ | $R^3$ | $R^4$ | $R^5$ |
|---|---|---|---|---|---|
| A-5 | $CH_3$ | $CH_3$ | $C_2H_5O$ | (t)$C_8H_{17}$ | OH |

TYPE (6)

| Compound No. | $R^1$ | $R^2$ | $R^3$ | $R^4$ | $R^5$ | $R^6$ | $R^7$ |
|---|---|---|---|---|---|---|---|
| A-6 | H | (t)$C_4H_9$ | $CH_3$ | $CH_3$ | (t)$C_4H_9$ | H | $CH_2$ |
| A-15 | $CH_3$ | (t)$C_4H_9$ | $CH_3$ | $CH_3$ | (t)$C_4H_9$ | $CH_3$ | $CH_2$ |

TYPE (7)

| Compound No. | $R^1$ | $R^2$ | $R^3$ | $R^4$ | $R^5$ | $R^6$ | $R^7$ | $R^8$ | $R^9$ | $R^{10}$ | $R^{11}$ | $R^{12}$ |
|---|---|---|---|---|---|---|---|---|---|---|---|---|
| A-13 | H | $C_3H_7O$ | $C_3H_7O$ | $CH_3$ | $CH_3$ | H | H | H | $C_3H_7O$ | $C_3H_7O$ | $CH_3$ | $CH_3$ |
| A-19 | H | $CH_3O$ | $CH_3O$ | $CH_3$ | $CH_3$ | H | H | H | $CH_3O$ | $CH_3O$ | $CH_3$ | $CH_3$ |
| A-20 | $CH_3$ | $C_4H_9O$ | $C_4H_9O$ | $CH_3$ | $CH_3$ | H | H | $CH_3$ | $C_4H_9O$ | $C_4H_9O$ | $CH_3$ | $CH_3$ |
| A-21 | H | $C_2H_5O$ | $C_2H_5O$ | $CH_3$ | $CH_3$ | H | H | H | $C_2H_5O$ | $C_2H_5O$ | $CH_3$ | $CH_3$ |
| A-22 | H | $CH_3O$ | $CH_3O$ | $C_2H_5$ | $CH_3$ | H | $CH_3$ | H | $CH_3O$ | $CH_3O$ | $CH_3$ | $C_2H_5$ |
| A-23 | H | $C_7H_{15}COO$ | $C_7H_{15}COO$ | $CH_3$ | $CH_3$ | H | H | H | $C_7H_{15}COO$ | $C_7H_{15}COO$ | $CH_3$ | $CH_3$ |
| A-24 | H | $C_4H_9O$ | $C_4H_9O$ | $CH_3$ | $CH_3$ | H | H | H | $C_4H_9O$ | $C_4H_9O$ | $CH_3$ | $CH_3$ |
| A-25 | H | $CH_3O(CH_2)_2O$ | $CH_3O(CH_2)_2O$ | $CH_3$ | $CH_3$ | H | H | H | $CH_3O(CH_2)_2O$ | $CH_3O(CH_2)_2O$ | $CH_3$ | $CH_3$ |
| A-26 | H | $CH_2{=}CHCH_2O$ | $CH_2{=}CHCH_2O$ | $CH_3$ | $CH_3$ | H | H | H | $CH_2{=}CHCH_2O$ | $CH_2{=}CHCH_2O$ | $CH_3$ | $CH_3$ |
| A-27 | H | $C_3H_7O$ | $C_3H_7O$ | $C_6H_5CH_2$ | $CH_3$ | $C_6H_5$ | H | H | $C_3H_7O$ | $C_3H_7O$ | $C_6H_5O$ | $CH_3$ |
| A-28 | $CH_3O$ | $C_4H_9O$ | $C_4H_9O$ | $CH_3$ | $CH_3$ | H | H | $CH_3$ | $C_4H_9O$ | $C_4H_9O$ | $CH_3$ | $CH_3$ |
| A-29 | H | (s)$C_5H_{11}O$ | (s)$C_5H_{11}O$ | $CH_3$ | $CH_3$ | H | H | H | (s)$C_5H_{11}O$ | (s)$C_5H_{11}O$ | $CH_3$ | $CH_3$ |
| A-30 | H | $C_4H_9O$ | $C_4H_9O$ | (i)$C_3H_7$ | $CH_3$ | $CH_3$ | $CH_3$ | H | $C_4H_9O$ | $C_4H_9O$ | (i)$C_3H_7$ | $CH_3$ |
| A-31 | H | $C_{18}H_{37}O$ | $C_{18}H_{37}O$ | $CH_3$ | $CH_3$ | H | H | H | $C_{18}H_{37}O$ | $C_{18}H_{37}O$ | $CH_3$ | $CH_3$ |
| A-32 | H | $C_6H_5CH_2O$ | $C_6H_5CH_2O$ | $CH_3$ | $CH_3$ | H | H | H | $C_6H_5CH_2O$ | $C_6H_5CH_2O$ | $CH_3$ | $CH_3$ |

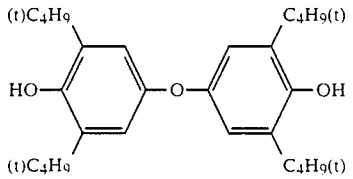

A-7

Formula [B]

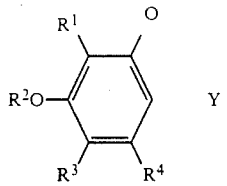

In the formula $R^1$ and $R^4$ represent hydrogen atom, halogen atom, alkyl group, alkenyl group, alkoxy group, alkenyloxy group, hydroxy group, aryl group, aryloxy group, acyl group, acyl amino group, acyloxy group, sulfon amido group, cyclo alkyl group, or alkoxy carbonyl group, $R^2$ represents hydrogen atom, alkyl group, alkenyl group, aryl group, acyl group, cyclo alkyl group, or heterocyclic group, and $R^3$ represents hydrogen atom, halogen atom, alkyl group, alkenyl group, aryl group, aryloxy group, acyl group, acyloxy group, sulfon amido group, cyclo alkyl group, or alkoxy carbonyl group.

These groups may be each replaced by other substituents. The substituents include, e.g., alkyl group, alkenyl group, alkoxy group, aryl group, aryloxy group, hydroxy group, alkoxy carbonyl group aryloxy carbonyl group, acyl amino group, acyloxy group, carbamoyl group, sulfon amido group, and sulfamoyl group.

$R^2$ and $R^3$ may be combined with each other to form a 5- or 6-membered ring. $R^2$ and $R^3$ may be closed to form a ring and the rings formed with benzene ring include, e.g., chroman ring, and methylene dioxy benzene ring.

Y represents the groups of atoms required to form a chroman or a coumarane ring.

Chroman or coumarane ring may be replaced by halogen atom, alkyl group, cycloalkyl group, alkoxy group, alkenyl group, alkenyloxy group, hydroxy group, aryl group, aryloxy group, or hetero ring, and may form spiro ring.

Of the compounds represented by formula [B], the compounds useful especially for the invention are covered by formulae [B-1], [B-2], [B-3], B-4], and [B-5].

Formula [B-1]

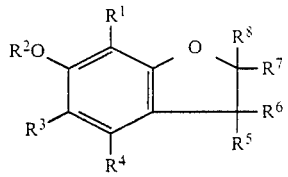

Formula [B-2]

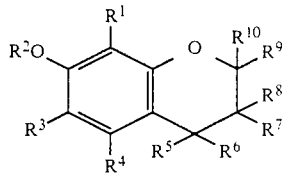

Formula [B-3]

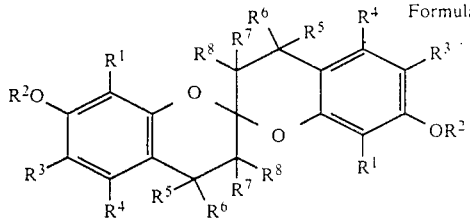

-continued

Formula [B-4]

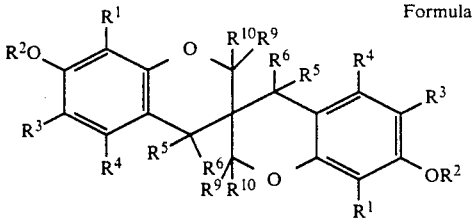

Formula [B-5]

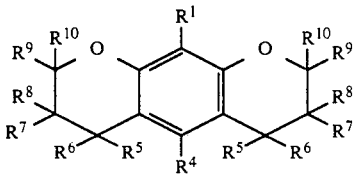

$R^1$, $R^2$, $R^3$, and $R^4$ in formulae [B1], [B-2], [B-3], [B-4], [B-5] have the same meanings as in the formula [B], and $R^5$, $R^6$, $R^7$, $R^8$, $R^9$, and $R^{10}$ represent hydrogen atom, halogen atom, alkyl group, alkoxy group, hydroxy group, alkenyl group, alkenyloxy group, aryl group, aryloxy group, or heterocyclic ring.

Furthermore, $R^5$ and $R^6$, $R^6$ nd $R^7$, $R^7$ and $R^8$, $R^8$ and $R^9$, and $R^9$ and $R^{10}$ may be cyclized with each other to form carbon rings, and the carbon rings may be replaced by alkyl group.

In the formulae [B-1], [B-2], [B-3], [B-4], and [B-5], particularly useful compounds are those whose $R^1$ and $R^4$ are hydrogen atom, alkyl group, alkoxy group, hydroxy group, or cycloalkyl group, and whose $R^5$, $R^6$, $R^7$, $R^8$, $R^9$, and $R^{10}$ are hydrogen atom, alkyl group, or cycloalkyl group.

The compounds represented by formula [B] can represent and include those listed in Tetrahedron, 1970, vol. 126, P. 4743~4751, Japan Chemical Society Journal, 1972, No. 10, P. 0987~1990, chem. Lett., 1972 (4), P. 315~316, and Japanese Patent O.P.I. Publication No. 139383/1980, and can be synthesized in accordance with the methods stated in those.

The compounds represented by formula [B] are used in an amount of preferably 5~300 mol % for magenta couplers related with the emulsion of the invnetion. and more preferably, 10~200 mol %.

The followings are the typical compounds.

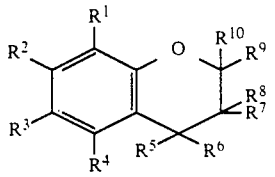

| Compound No. | $R^1$ | $R^2$ | $R^3$ | $R^4$ | $R^5$ | $R^6$ | $R^7$ | $R^8$ | $R^9$ | $R^{10}$ |
|---|---|---|---|---|---|---|---|---|---|---|
| B-1 | H | H | H | H | H | $CH_3$ | H | H | $CH_3$ | $CH_3$ |
| B-2 | H | H | $CH_3$ | H | H | $CH_3$ | H | H | $CH_3$ | $CH_3$ |
| B-3 | H | H | $C_{12}H_{25}$ | H | H | $CH_3$ | H | H | $CH_3$ | $CH_3$ |
| B-4 | H | H | 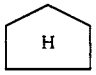 | H | H | $CH_3$ | H | H | $CH_3$ | $CH_3$ |
| B-5 | H | $CH_3$ | H | H | H | $CH_3$ | H | H | $CH_3$ | $CH_3$ |
| B-9 | $CH_3$ | H | $CH_3$ | H | H | H | H | 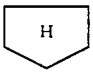 (Condensed) | | H |
| B-10 | H | $CH_3CO$ | H | H | H | (i)$C_3H_7$ | H | H | $CH_3$ | $CH_3$ |
| B-11 | H | $C_3H_7$ | (t)$C_8H_{17}$ | H | H | $CH_3$ | H | $CH_3$ | $CH_3$ | $CH_3$ |
| B-12 | Br | H | Br | H | H | H | H | $CH_3$ | $CH_3$ | $CH_3$ |
| B-13 | H | 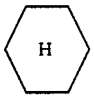 | H | H | $CH_3$ | $CH_3$ | H | H | $CH_2OH$ | $CH_3$ |
| B-14 | H | 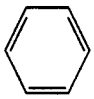 | H | H | $CH_3$ | $CH_3$ | H | H | $CH_3$ | $CH_3$ |
| B-15 | H | H | $CH_2{=}CHCH_2CO$ | $CH_3$ | $CH_3$ | H | H | OH 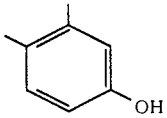 OH | | $CH_3$ |

-continued

| | | | | | | | | | | |
|---|---|---|---|---|---|---|---|---|---|---|
| B-16 | H | H | H | $CH_3SO_2NH$ | $CH_3$ | $CH_3$ | H | H | OH 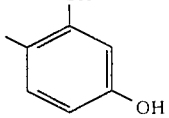 OH | $CH_3$ |
| B-17 | H | 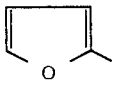 O | $CH_3$ | H | Cl | H | Cl | H | $CH_3$ | $CH_3$ |
| B-18 | H | 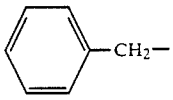 $CH_2$— | $CH_3CONH$ | H | H | H | H | H | $CH_3$ 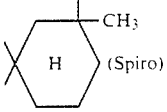 $CH_3$ H (Spiro) | |
| B-54 | $CH_3O$ | $CH_3O$ | H | H | H | H | H | H | $CH_3$ | $CH_3$ |
| B-55 | H | 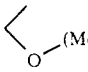 O (Methylenedioxy) | | H | H | H | H | H | $CH_3$ | $CH_3$ |

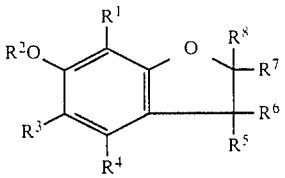

| Compound No. | $R^1$ | $R^2$ | $R^3$ | $R^4$ | $R^5$ | $R^6$ | $R^7$ | $R^8$ |
|---|---|---|---|---|---|---|---|---|
| B-6 | H | H | H | H | H | 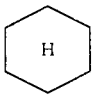 H (Condensed) | | H |
| B-7 | H | H | (i)$C_3H_7$ | H | H | H | $CH_3$ | $CH_3$ |
| B-8 | H | $CH_3$ | Cl | H | H | H | $CH_3$ | $CH_3$ |
| B-19 | H | H | 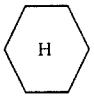 H | H | $CH_3$ | $CH_3$ | $CH_3$ | $CH_3$ |
| B-20 | H | $CH_2{=}CHCH_2$ | $CH_3$ | H | $CH_3$ | $CH_3$ | $CH_3$ | H |
| B-21 | H | $C_3H_7$ | $C_3H_7$ | H | $CH_3$ | $CH_3$ | 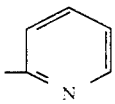 N | H |
| B-22 | $CH_3$ | H | $CH_3$ | H | 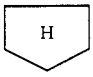 H (Spiro) | | H | H |
| B-23 | $CH_3$ | H | 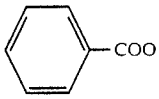 COO | H | $CH_3$ | $CH_3$ | $CH_3$ | $CH_3$ |

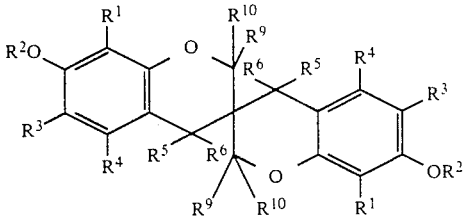

-continued

| Compound No. | $R^1$ | $R^2$ | $R^3$ | $R^4$ | $R^5$ | $R^6$ | $R^9$ | $R^{10}$ |
|---|---|---|---|---|---|---|---|---|
| B-24 | H | H | H | H | $CH_3$ | $CH_3$ | H | H |
| B-25 | H | H | $CH_3$ | H | $CH_3$ | $CH_3$ | H | H |
| B-26 | H | H | (t)$C_4H_9$ | H | H | H | H | H |
| B-27 | H | $CH_3$ | H | H | $CH_3$ | $CH_3$ | H | H |
| B-28 | H | H | 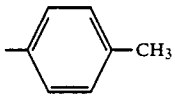 | H | $CH_3$ | $CH_3$ | H | H |
| B-29 | H | H | $C_2H_5COOCH_2$ | H | $CH_3$ | $CH_3$ | H | H |
| B-30 | $CH_3$ | 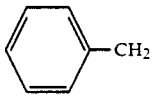 | H | $CH_3$ | $CH_3$ | $CH_3$ | H | H |
| B-31 | Cl | H | H | H | 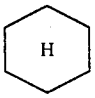 (Spiro) | | H | H |
| B-32 | H | H | $CH_3CONH$ | H | $CH_3$ | $CH_3$ | H | H |
| B-33 | $CH_3$ | 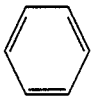 | (t)$C_8H_{17}$ | H | $CH_3$ | $CH_3$ | H | H |
| B-34 | H | H | 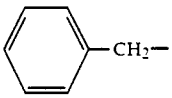 | H | $CH_3$ | $CH_3$ | H | H |

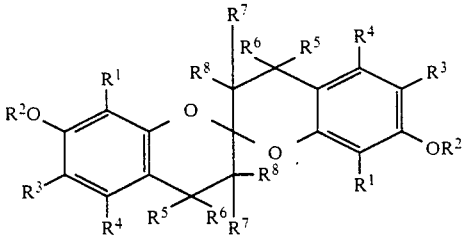

| Compound No. | $R^1$ | $R^2$ | $R^3$ | $R^4$ | $R^5$ | $R^6$ | $R^7$ | $R^8$ |
|---|---|---|---|---|---|---|---|---|
| B-35 | H | H | H | H | $CH_3$ | $CH_3$ | H | H |
| B-36 | H | $C_3H_7$ | H | H | $CH_3$ | $CH_3$ | H | H |
| B-37 | H | $CH_3$ | $CH_3$ | H | $CH_3$ | $CH_3$ | H | H |
| B-38 | H | H | (t)$C_4H_9$ | H | $CH_3$ | $CH_3$ | H | |
| B-39 | H | H | 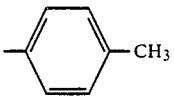 | H | $CH_3$ | $CH_3$ | H | H |
| B-40 | H | H | $CH_3SO_2NH$ | H | H | H | H | H |
| B-41 | $CH_3$ | 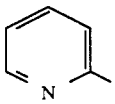 | H | $CH_3$ | $CH_3$ | $CH_3$ | H | H |
| B-42 | Cl | (t)$C_4H_9$ | H | H | 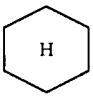 (Spiro) | | H | H |
| B-43 | H | $C_{12}H_{25}$ | $CH_3CONH$ | H | $CH_3$ | $CH_3$ | H | H |
| B-44 | H | H | (t)$C_8H_{17}$ | H | $CH_3$ | $CH_3$ | H | H |

-continued

| | | | | | | | | |
|---|---|---|---|---|---|---|---|---|
| B-45 | H | H | 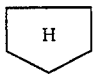 | H | $CH_3$ | $CH_3$ | H | H |

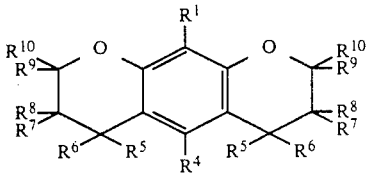

| Compound No. | $R^1$ | $R^4$ | $R^5$ | $R^6$ | $R^7$ | $R^8$ | $R^9$ | $R^{10}$ |
|---|---|---|---|---|---|---|---|---|
| B-46 | H | H | H | H | H | H | $CH_3$ | $CH_3$ |
| B-47 | OH | H | H | H | H | H | $CH_3$ | $CH_3$ |
| B-48 | H | H | H | H | H | H | $CH_3$ | $C_2H_5$ |
| B-49 | H | H | H | H | H | H | 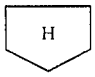 (Spiro) | |
| B-50 | $C_3H_7O$ | H | $CH_3$ | H | H | H | $CH_3$ | $CH_3$ |
| B-51 | H | H | H | H | $C_3H_7$ | H | $C_3H_7$ | H |
| B-52 | H | OH | H | H | H | H | $CH_3$ | $CH_3$ |
| B-53 | H | $C_3H_7O$ | H | H | H | H | $CH_3$ | $CH_3$ |

Formula [C]

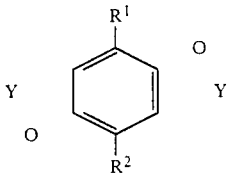

Formula [D]

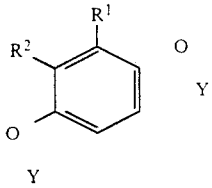

$R^1$ and $R^2$ in the formula represent hydrogen atom, halogen atom, alkyl group, alkenyl group, alkoxy group, alkenyloxy group, hydroxy group, aryl group, aryloxy group, acyl group, acyl amino group, acyloxy group, sulfon amido group, or alkoxy carbonyl group.

These groups may be each replaced by other substituents. The substituents include, e.g., halogen atom, alkyl group, alkenyl group, alkoxy group, aryloxy group, hydroxy group, alkoxy carbonyl group, aryloxy carbonyl group, acyl amino group, carbamoyl group, sulfon amido group, and sulfamoyl group.

Y represents the groups of atoms required to form dichroman or dicoumarane ring along with benzen ring.

Chroman or coumarane ring may be replaced by halogen atom, cyclo alkyl group, alkoxy group, alkenyl group, alkenyloxy group, hydroxy group, aryl group, aryloxy group, or heterocyclic group, and may form spiro ring.

Of the compounds represented by formula [C] or [D], the compounds useful particularly for the invention are covered by formulae [C-1], [C-2], [D-1], and [D-2].

Formula [C-1]

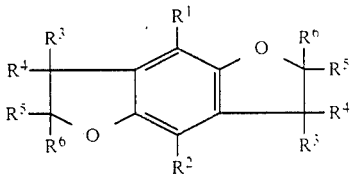

Formula [C-2]

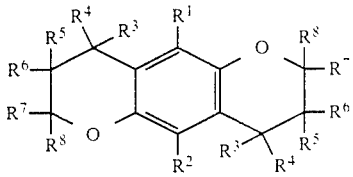

Formula [D-1]

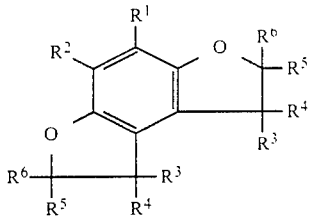

Formula [D-2]

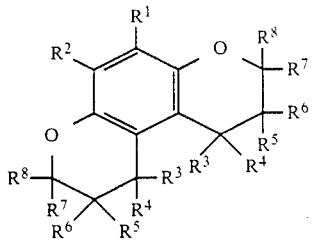

$R^1$ and $R^2$ in formulae [C-1], [C-2], [D-1], and [D-2]have the same meanings as in the formulae [C] and [D], and $R^3$, $R^4$, $R^5$, $R^6$, $R^7$, and $R^8$ represent hydrogen atom, halogen atom, alkyl group, alkoxy group, hydroxy group, alkenyl group, alkenyloxy group, aryl group, aryloxy group, or heterocyclic group. Furthermore, $R^3$ and $R^4$, $R^4$ and $R^5$, $R^5$ and $R^6$, $R^6$ and $R^7$, and $R^7$ and $R^8$ may be cyclized with each other to form carbon rings, and the carbon rings may be replaced by alkyl group.

In the formulae [C-1], [C-2], [D-1], and [D-2], particularly useful compounds are those whose $R^1$ and $R^2$ are hydrogen atom, alkyl group, alkoxy group, hydroxy group, or cycloalkyl group, and whose $R^3$, $R^4$, $R^5$, $R^6$, $R^7$, and $R^8$ are hydrogen atom, alkyl group, cycloalkyl group.

The compounds represented by formulae [C] and [D] can include those stated in Japan Chemical Society Journal, Part C, 1968. (14), P. 1937~18, Journal of the Society of Synthetic Organic Chemistry Japan 1970, 28(1), P. 60~65, Tetrahedron Letters, 1973. (29), P. 2707~2710, and can be synthesized in accordance with the methods stated in those.

-continued

| Compound No. | $R^1$ | $R^2$ | $R^3$ | $R^4$ | $R^5$ | $R^6$ |
|---|---|---|---|---|---|---|
| C-11 | H | H | H | H | $CH_3$ | $CH_3$ |
| C-12 | H | H | H | H | 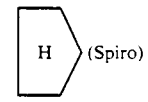 (Spiro) | |
| C-13 | H | H | H | 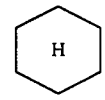 (Condensed) | | H |

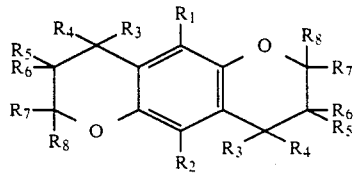

| Compound No. | $R_1$ | $R_2$ | $R_3$ | $R_4$ | $R_5$ | $R_6$ | $R_7$ | $R_8$ |
|---|---|---|---|---|---|---|---|---|
| C-1 | H | H | H | H | H | H | H | H |
| C-2 | H | H | H | H | H | H | $CH_3$ | $CH_3$ |
| C-3 | H | H | $CH_3$ | H | H | H | $CH_3$ | $CH_3$ |
| C-4 | $CH_3$ | H | $CH_3$ | $CH_3$ | H | H | $CH_3$ | $CH_3$ |
| C-5 | OH | H | H | H | H | H | $C_2H_5$ | $CH_3$ |
| C-6 | $OCH_3$ | H | H | H | H | H | H | H |
| C-7 | $OC_3H_7$ | H | H | H | H | H | H | H |
| C-8 | $OC_{12}H_{25}$ | H | H | H | H | H | H | H |
| C-9 | $CH_3COO$ | H | H | H | H | H | $CH_3$ | $CH_3$ |
| C-10 | $CH_3CONH$ | H | H | H | H | H | 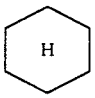 (Spiro) | |
| C-14 | $(CH_3)_2CCHCH_2$ (Cl) | $(CH_3)_2CCH_2CH_2$ (Cl) | H | H | H | H | $CH_3$ | $CH_3$ |
| C-15 | $CH_3$ | $CH_3$ | H | H | H | H | $CH_3$ | $CH_3$ |
| C-16 | $(CH_3)_2C{=}CHCH_2$ | $(CH_3)_2C{=}CCH_2$ | H | H | H | H | $CH_3$ | $CH_3$ |
| C-17 | Cl | H | H | H | H | H | H | H |

The usage of the compounds represented by the formulae [C] and [D] are preferably 5~300 mol % for magenta couplers related with the invention, and more preferably, 10~200 mol %.

The followings are the typical examples.

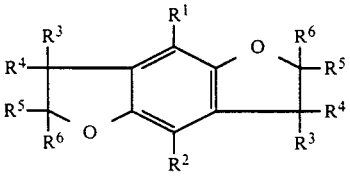

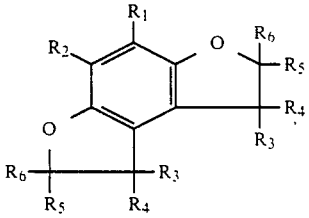

| Compound No. | $R_1$ | $R_2$ | $R_3$ | $R_4$ | $R_5$ | $R_6$ |
|---|---|---|---|---|---|---|
| D-1 | $CH_3$ | $CH_3$ | H | H | H | H |
| D-2 | H | H | H | H | $CH_3$ | $CH_3$ |

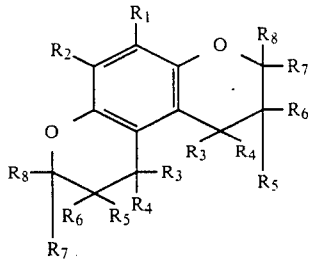

| Compound No. | $R_1$ | $R_2$ | $R_3$ | $R_4$ | $R_5$ | $R_6$ | $R_7$ | $R_8$ |
|---|---|---|---|---|---|---|---|---|
| D-3 | H | H | H | H | H | H | H | H |
| D-4 | H | H | H | H | H | H | $CH_3$ | $CH_3$ |
| D-5 | $CH_3$ | $CH_3$ | H | H | H | H | $CH_3$ | $CH_3$ |
| D-6 | $(CH_3)_2CCH_2CH_2$ \| Cl | $(CH_3)_2CCH_2CH_2$ \| Cl | H | H | H | H | $CH_3$ | $CH_3$ |
| D-7 | H | H | Cl | H | Cl | H | H | H |
| D-8 | H | H | H | H | H | H | 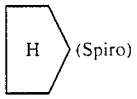 (Spiro) | |
| D-9 | $CH_3O$ | H | H | H | H | H | 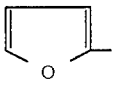 | H |
| D-10 | H | H | H | H | H | H | $CH_2OH$ | $CH_3$ |
| D-11 | 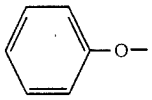 | H | H | H | H | H | $CH_3$ | $CH_3$ |

Formula [E]

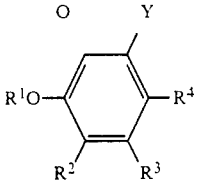

$R^1$ in the formula represents hydrogen atom, alkyl group, alkenyl group, aryl group, acyl group, cycloalkyl group, or heterocyclic group, $R^3$ represents hydrogen atom, halogen atom, alkyl group, alkenyl group, aryl group, aryloxy group, acyl group, acyl amino group, acyloxy group, sulfon amido group, cycloalkyl group or alkoxy carbonyl group.

$R^2$ and $R^4$ represent hydrogen atom, halogen atom, alkyl group, alkenyl group, aryl group, acyl group, acyl amino group, sulfon amido group, cycloalkyl group, or alkoxy carbonyl group.

These groups may be each replaced by other substituents. The substituents include, e.g., alkyl group, alkenyl group, alkoxy group, aryl group, aryloxy group, hydroxy group, alkoxy carbonyl group, aryloxy carbonyl group, acyl amino group, and sulfamoyl group.

$R^1$ and $R^2$ may be ring-closed with each other to form a 5- or 6-member ring.

In that case, $R^3$ and $R^4$ represent hydrogen atom, halogen atom, alkyl group, alkenyl group, alkoxy group, alkenyloxy group, hydroxy group, aryl group, aryloxy group, acyl group, acyl amino group, acyloxy group, sulfon amido group, or alkoxy carbonyl group.

Y represents the groups of atoms required to form chroman or coumarane ring.

Chroman or coumarane ring may be replaced by halogen atom, alkyl group, cyclo alkyl group, alkoxy group, alkenyl group, alkenyloxy group, hydroxy group, aryl group, aryloxy group, or heterocyclic group, and may form spiro ring.

Of the compounds represented by formula [E], the compounds useful especially for the invention are covered by formulae [E-1], [E-2], [E-3], [E-4], and [E-5].

Formula [E-1]

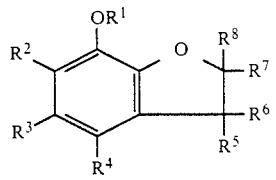

Formula [E-2]

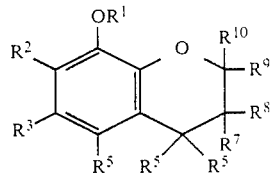

-continued

Formula [E-3]

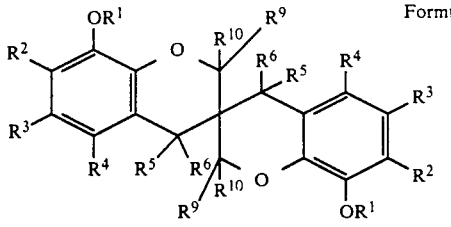

Formula [E-4]

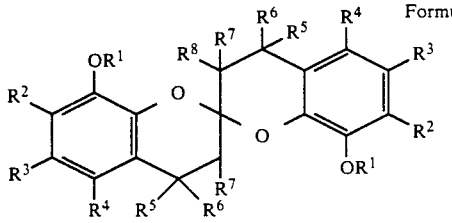

Formula [E-5]

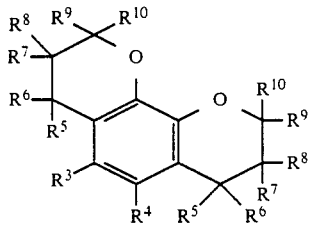

$R^1$, $R^2$, $R^3$, and $R^4$ in formulae [E-1] to [E-5] have the same meanings as in the formula [E], and $R^5$, $R^6$, $R^7$, $R^8$, $R^9$, and $R^{10}$ represent hydrogen atom, halogen atom, alkyl group, alkoxy group, hydroxy group, alkenyl group, alkenyloxy group, aryl group, aryloxy group, or heterocyclic ring. $R^5$ and $R^6$, $R^6$ and $R^7$, $R^7$ and $R^8$, $R^8$ and $R^9$, and $R^9$ and $r^{10}$ may be cyclized with each other to form carbon rings, and the carbon rings may be replaced by alkyl group.

In the formulae [E-1] to [E-5, ] particularly useful compounds are those whose $R^1$, $R^2$, $R^3$, and $R^4$ are hydrogen atom, alkyl group, or cycloalkyl group, whose $R^3$ and $R^4$ are hydrogen atom, alkyl group, alkoxy group, hydroxy group, or cycloalkyl group, and whose $R^5$, $R^6$, $R^7$, $R^8$, $R^9$, and $R^{10}$ are hydrogen atom, alkyl group, or cycloalkyl group.

The compounds represented by formula [E] can include those listed in Tetrahedron Letters, 1965. (8), P. 457~460, Japan Chemical Society Journal, Part C, 1966. (22), P. 2,013 2,016, and Zh. Org. Khim., 1970, (6), P. 1,230~1,237, and can be synthesized in accordance with the methods stated in those.

The compounds represented by formula [E-1] are used in an amount of preferably 5~300 mol % for magenta couplers related with the invention, and more preferably, 10~200 mol %.

The followings are the examples.

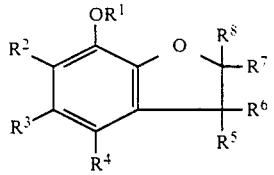

| Compound No. | $R_1$ | $R_2$ | $R_3$ | $R_4$ | $R_5$ | $R_6$ | $R_7$ | $R_8$ |
|---|---|---|---|---|---|---|---|---|
| E-19 | H | H | H | H | H | | 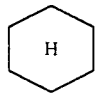 (Condensed) | H |
| E-20 | $C_3H_7$ | H | H | H | H | | 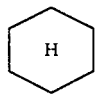 (Condensed) | H |
| E-21 | H | H | H | H | H | H | 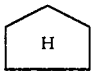 (Spiro) | |
| E-22 | $CH_3$ | H | H | H | H | H | 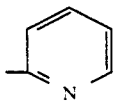 | H |
| E-23 | H | H | H | H | H | H | $CH_3$ | $CH_3$ |
| E-24 | $CH_3$ | H | 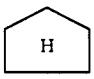 | H | H | H | $CH_3$ | $CH_3$ |

-continued

| | | | | | | | | |
|---|---|---|---|---|---|---|---|---|
| E-25 | 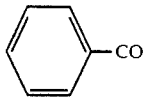 | H | H | H | H | H | $CH_3$ | $CH_3$ |
| E-26 | $C_{12}H_{25}$ | H | H | H | $CH_3$ | $CH_3$ | $CH_3$ | $CH_2OH$ |

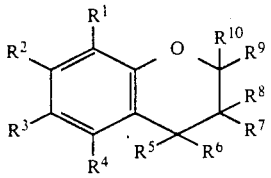

| Compound No. | $R_1$ | $R_2$ | $R_3$ | $R_4$ | $R_5$ | $R_6$ | $R_7$ | $R_8$ | $R_9$ | $R_{10}$ |
|---|---|---|---|---|---|---|---|---|---|---|
| E-1 | H | H | H | H | H | H | H | H | H | H |
| E-2 | H | H | H | H | H | H | H | H | $CH_3$ | $CH_3$ |
| E-3 | H | H | H | H | $CH_3$ | H | H | H | $CH_3$ | $CH_3$ |
| E-4 | H | H | $CH_2{=}CHCH_2$ | H | H | H | H | H | $CH_3$ | $CH_3$ |
| E-5 | $CH_3$ | H | H | H | H | H | H | H | $CH_3$ | $CH_3$ |
| E-6 | $C_3H_7$ | H | H | H | H | H | H | H | $CH_3$ | $CH_3$ |
| E-7 | $C_{12}H_{25}$ | H | H | H | $CH_3$ | H | H | H | $CH_3$ | $CH_3$ |
| E-8 | 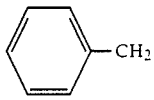 | H | H | H | H | H | H | H | H | H |
| E-9 | 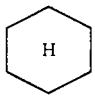 | H | H | H | H | H | H | H | $CH_3$ | $CH_3$ |
| E-10 | 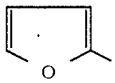 | H | H | H | H | H | H | H | $CH_3$ | $CH_3$ |
| E-11 | H | H | H | H | H | H | H | H | $CH_3$ | $C_{16}H_{33}$ |
| E-12 | H | H | 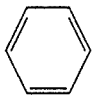 | H | H | H | H | H | $CH_3$ | $CH_3$ |
| E-13 | $CH_3$ | H | $CH_3CO$ | H | H | H | H | H | $CH_3$ | $CH_3$ |
| E-14 | $CH_3$ | H | H | H | H | Br | Br | H | H | H |
| E-15 | $CH_3$ | H | H | H | H | Cl | Cl | H | H | H |
| E-16 | $CH_3$ | H | H | H | H | $CH_3O$ | Br | H | H | H |
| E-17 | $CH_3$ | H | H | H | H | OH | Br | H | $CH_3$ | $CH_3$ |
| E-18 | $CH_3$ | H | H | H | H | $C_2H_5O$ | OH | H | $CH_3$ | $CH_3$ |

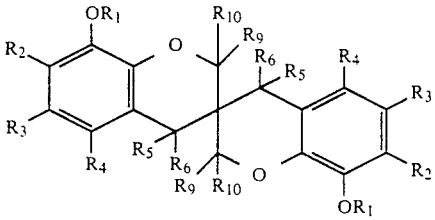

| Compound No. | $R_1$ | $R_2$ | $R_3$ | $R_4$ | $R_5$ | $R_6$ | $R_9$ | $R_{10}$ |
|---|---|---|---|---|---|---|---|---|
| E-27 | H | H | H | H | H | H | H | H |
| E-28 | $CH_3$ | H | H | H | H | H | H | H |

-continued

| | | | | | | | | |
|---|---|---|---|---|---|---|---|---|
| E-29 | 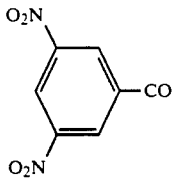 | H | H | H | H | H | H | H |
| E-30 | H | H | $CH_3$ | H | H | H | $CH_3$ | $CH_3$ |
| E-31 | $C_3H_7$ | H | H | H | H | H | H | H |
| E-32 | $C_3H_7$ | H | H | H | $CH_3$ | $CH_3$ | H | H |
| E-37 | H | H | H | $CH_3CONH$ | H | H | H | H |
| E-38 | CO | H | H | H | H | H | H | H |

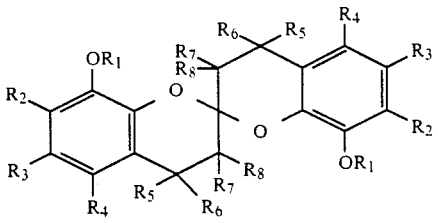

| Compound No. | $R_1$ | $R_2$ | $R_3$ | $R_4$ | $R_5$ | $R_6$ | $R_7$ | $R_8$ |
|---|---|---|---|---|---|---|---|---|
| E-33 | H | H | H | H | H | H | H | H |
| E-34 | H | H | H | H | $CH_3$ | $CH_3$ | H | H |
| E-35 | $C_{12}H_{25}$ | H | H | H | $CH_3$ | $CH_3$ | H | H |
| E-36 | $CH_3$ | H | $CH_3$ | H | $CH_3$ | $CH_3$ | H | H |

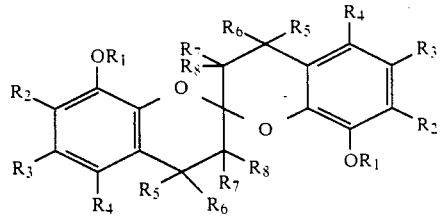

| Compound No. | $R_1$ | $R_2$ | $R_3$ | $R_4$ | $R_5$ | $R_6$ | $R_7$ | $R_8$ |
|---|---|---|---|---|---|---|---|---|
| E-33 | H | H | H | H | H | H | H | H |
| E-34 | H | H | H | H | $CH_3$ | $CH_3$ | H | H |
| E-35 | $C_{12}H_{25}$ | H | H | H | $CH_3$ | $CH_3$ | H | H |
| E-36 | $CH_3$ | H | $CH_3$ | H | $CH_3$ | $CH_3$ | H | H |

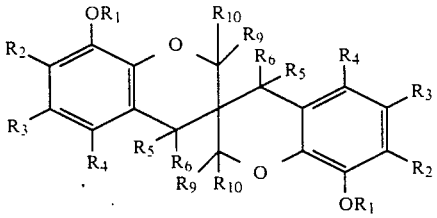

| Compound No. | $R_1$ | $R_2$ | $R_3$ | $R_4$ | $R_5$ | $R_6$ | $R_9$ | $R_{10}$ |
|---|---|---|---|---|---|---|---|---|
| E-27 | H | H | H | H | H | H | H | H |
| E-28 | $CH_3$ | H | H | H | H | H | H | H |
| E-29 | 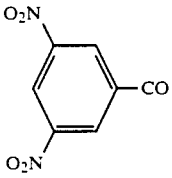 | H | H | H | H | H | H | H |
| E-30 | H | H | $CH_3$ | H | H | H | $CH_3$ | $CH_3$ |
| E-31 | $C_3H_7$ | H | H | H | H | H | H | H |
| E-32 | $C_3H_7$ | H | H | H | $CH_3$ | $CH_3$ | H | H |
| E-37 | H | H | H | $CH_3CONH$ | H | H | H | H |
| E-38 | CO | H | H | H | H | H | H | H |

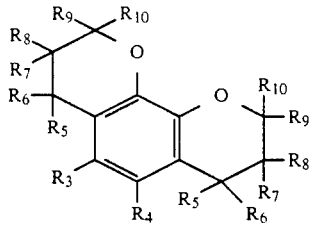

| Compound No. | $R_3$ | $R_4$ | $R_5$ | $R_6$ | $R_7$ | $R_8$ | $R_9$ | $R_{10}$ |
|---|---|---|---|---|---|---|---|---|
| E-39 | H | H | H | H | H | H | H | H |
| E-40 | H | H | H | H | H | H | $CH_3$ | $CH_3$ |
| E-41 | OH | H | H | H | H | H | $CH_3$ | $CH_3$ |
| E-42 | $C_3H_7O$ | H | $CH_3$ | $CH_3$ | H | H | H | H |

Formula [F]

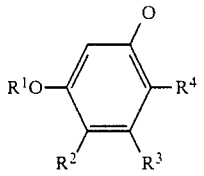

$R^1$ in the formula represents hydrogen atom, alkyl group, alkenyl group, aryl group, acyl group, cycloalkyl group, or heterocyclic group, and $R^2$ represents hydrogen atom, halogen atom, alkyl group, alkenyl group, aryl group, aryloxy group, acyl group, acyl amino group, acyloxy group, sulfon amido group, cycloalkyl group, or alkoxy carbonyl group.

$R^3$ represents hydrogen atom, halogen atom, alkyl group, alkenyl group, aryl group, acyl group, acyl amino group, sulfon amido group, cycloalkyl group, or alkoxy carbonyl group.

$R^4$ represents hydrogen atom, alkyl group, alkenyl group, alkoxy group, alkenyloxy group, hidroxy group, aryl group, aryloxy group, acyl group, acyl amino group, acyloxy group, sulfon amido group, or alkoxy carbonyl group.

These gruops may be each replaced by other substituents. The substituents include, e.g., alkyl group, alkenyl group, alkoxy group, aryl group, aryloxy group, hydroxy group, alkoxycarbonyl group, aryloxy carbonyl group, acyl amino group, carbamoyl group, sulfon amido group, and sulfamoyl group.

$R^1$ and $R^2$ may be cyclized with each other to form a 5- or 6-member ring. In that case, $R^3$and $R^4$ represent hydrogen atom, halogen atom, alkyl group, alkenyl group, alkoxy group, alkenyloxy group, hydroxy group, aryl group, aryloxy group, acyl group, acyl amino group, acyloxy group, sulfon amido gruop, or alkoxy carbonyl group.

Y represents the groups of atoms required to form a chroman or a coumarane ring.

The chroman or the coumarane ring may be replaced by halogen atom, alkyl group, cycloalkyl group, alkoxy group, alkenyl group, alkenyloxy group, hydroxy group, aryl group, aryloxy group, or heterocyclic ring, and may form spiro ring.

Of the comounds represented by formula [F], the compounds useful especially for the invention are covered by formuale [F-1], [F-2], [F-3], [F-4], and [F-5].

Formula [F-1]

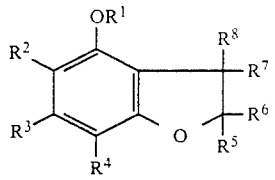

Formula [F-2]

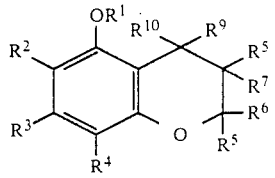

Formula [F-3]

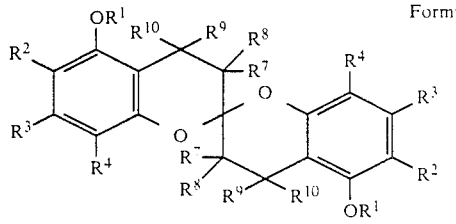

Formula [F-4]

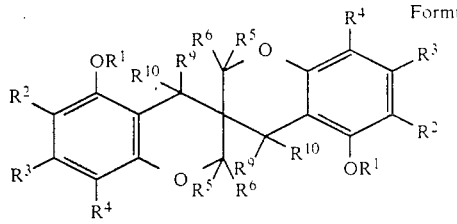

Formula [F-5]

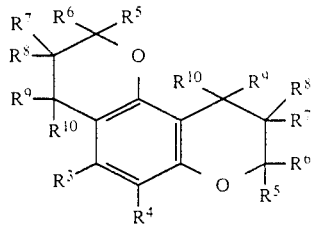

where $R^1$, $R^2$, $R^3$, and $R^4$ of the Formula [F] are the same as those in the formula [F], and $R^5$, $R^6$, $R^7$, $R^8$, $R^9$, and $R^{10}$ indicate hydrogen atom, halogen atom, alkyl group, alkoxy group, hydroxy group, alkenyl group, alkenyloxy group, aryl group, aryloxy group, or heterocyclic group, respectively.

In addition, $R^5$ and $R^6$, $R^6$ and $R^7$, $R^7$ and $R^8$, and $R^8$ and $R^9$ may be cyclized each other to form a carbon ring. This carbon ring may be replaced by alkyl group.

Two R's to R's in the formulas [F-3], F-4], and [F-5]may be or may not be identical.

In the formulas [F-1], [F-2], [F-3], [F-4], and [F-5], the compound where $R^1$, $R^2$, and $R^3$ are hydrogen atom, alkyl group, and cycloalkyl group, respectively, and $R^4$ is hydrogen atom, alkyl group, alkoxy group, hydroxy group, or cycloalkyl group, and $R^5$, $R^6$, $R^7$, $R^8$, $R^9$, and $R^{10}$ are hydrogen atom, alkyl group, or cycloalkyl group, is useful in particular.

The compound expressed by the formula [F]contains a compound described in the Tetrahedron Letters 1970, vol 26, page 4743 to 4751, the Japanese Chemical Society Journal 1972, No. 10, page 1987 to 1990, the Synthesis 1975, vol 6, page 392 to 393, and the Bul Soc. Chim. Belg 1975, vol 84(7), page 747 to 759, and can be synthesized in accordance with the methods set forth in these publications.

Preferably, the usage of the compound expressed by the formula [F] is 5 to 300 mol percent for magenta coupler relevant to this present invention, more preferably 10 to 200 mol percent.

The typical examples of the compound expressed by the formula [F] includes:

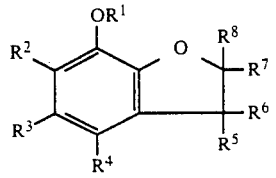

| Compound No. | $R_1$ | $R_2$ | $R_3$ | $R_4$ | $R_5$ | $R_6$ | $R_7$ | $R_8$ |
|---|---|---|---|---|---|---|---|---|
| F-11 | H | H | H | H | H | 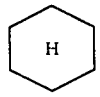 (Condensed) | | H |
| F-12 | $C_3H_7$ | H | H | H | H | 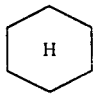 (Condensed) | | H |
| F-13 | H | H | H | H | H | H | H | H |
| F-14 | H | H | H | H | H | H | $CH_3$ | H |
| F-15 | H | H | $CH_3$ | H | H | H | $CH_3$ | H |
| F-16 | H | H | 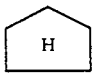 | H | H | H | $CH_3$ | H |
| F-17 | H | H | 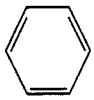 | H | H | H | $CH_3$ | H |
| F-18 | $C_3H_7$ | H | $CH_3$ | H | H | H | $CH_3$ | H |
| F-19 | 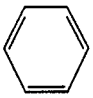 | H | H | H | 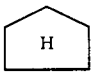 (Spiro) | | H | H |
| F-24 | $CH_2{=}CHCH_2$ | $CH_3$ | $CH_3$ | H | H | $C_2H_5O$ | $CH_3$ | $CH_3$ |
| F-25 | $C_3H_7$ | H | H | H | H | 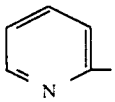 | $CH_3$ | $CH_3$ |
| F-26 | H | $CH_3$ | $CH_3$ | H | H | H | 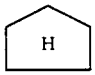 (Spiro) | |

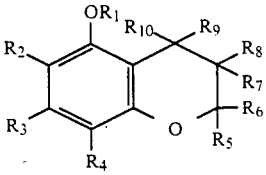

| Compound No. | $R_1$ | $R_2$ | $R_3$ | $R_4$ | $R_5$ | $R_6$ | $R_7$ | $R_8$ | $R_9$ | $R_{10}$ |
|---|---|---|---|---|---|---|---|---|---|---|
| F-1 | H | H | H | H | H | H | H | H | H | H |

-continued

| | | | | | | | | | | |
|---|---|---|---|---|---|---|---|---|---|---|
| F-2 | H | H | H | H | $CH_3$ | $CH_3$ | H | H | $CH_3$ | H |
| F-3 | H | H | H | H | $CH_3$ | $CH_3$ | H | H | H | H |
| F-4 | H | $(CH_3)_2C{=}CCHCH_2$ | H | H | $CH_3$ | $CH_3$ | H | H | H | H |
| F-5 | $CH_3$ | H | H | H | $CH_3$ | $CH_3$ | H | H | H | H |
| F-6 | $C_3H_7$ | H | H | H | $CH_3$ | $CH_3$ | H | H | H | H |
| F-7 | $C_{12}H_{25}$ | H | H | H | $CH_3$ | $CH_3$ | H | H | H | H |
| F-8 | 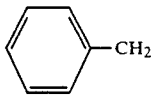 | H | H | H | $CH_3$ | $CH_3$ | H | H | H | H |
| F-9 | 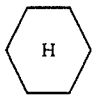 | H | H | H | $CH_3$ | $CH_3$ | H | H | H | H |
| F-10 | 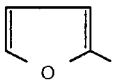 | H | H | H | $CH_3$ | $CH_3$ | H | H | H | H |
| F-20 | H | Cl | H | H | H | 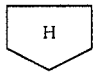 (Condensed) | H | H | H | |
| F-21 | H | H | H | H | $CH_3$ | $CH_2OH$ | H | H | $CH_3$ | $CH_3$ |
| F-22 | $C_3H_7$ | $(t)C_8H_{17}$ | H | H | $C_2H_5$ | $CH_3$ | H | H | H | H |
| F-23 | $CH_3CO$ | H | H | H | $CH_3$ | $CH_3$ | H | H | $CH_3$ | H |

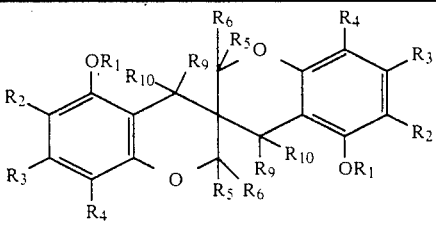

Compound

-continued

| No. | $R_1$ | $R_2$ | $R_3$ | $R_4$ | $R_5$ | $R_6$ | $R_9$ | $R_{10}$ |
|---|---|---|---|---|---|---|---|---|
| F-27 | H | H | H | H | H | H | $CH_3$ | $CH_3$ |
| F-28 | $C_3H_7$ | H | H | H | H | H | $CH_3$ | $CH_3$ |
| F-29 | H | H | H | $(t)C_8H_{17}$ | H | H | H | H |
| F-30 | H | Cl | H | H | H | H | 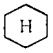 (Spiro) | |
| F-31 | 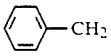 | H | H | H | H | H | $CH_3$ | $CH_3$ |

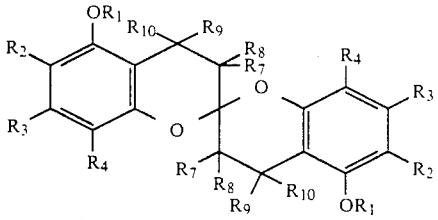

| Compound No. | $R_1$ | $R_2$ | $R_3$ | $R_4$ | $R_7$ | $R_8$ | $R_9$ | $R_{10}$ |
|---|---|---|---|---|---|---|---|---|
| F-32 | H | H | H | H | H | H | $CH_3$ | $CH_3$ |
| F-33 | $CH_3$ | H | H | H | H | H | $CH_3$ | $CH_3$ |
| F-34 | H | $CH_3$ | H | H | H | H | H | H |
| F-35 | H | H | H | $(t)C_4H_9$ | H | H | $CH_3$ | $CH_3$ |
| F-36 | H | 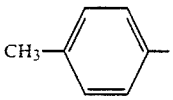 | H | H | H | H | $CH_3$ | $CH_3$ |
| F-37 | H | H | H | $CH_3SO_2NH$ | H | H | H | H |

-continued

| | | | | | | | | |
|---|---|---|---|---|---|---|---|---|
| F-38 | 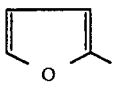 | H | H | H | H | H | $CH_3$ | $CH_3$ |
| F-39 | $C_{12}H_{25}$ | H | H | H | H | H | $CH_3$ | $CH_3$ |
| F-40 | 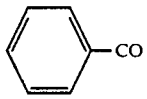 | H | H | H | H | H | 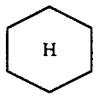 (Spiro) | |
| F-41 | H | H | 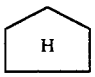 | H | H | H | $CH_3$ | $CH_3$ |

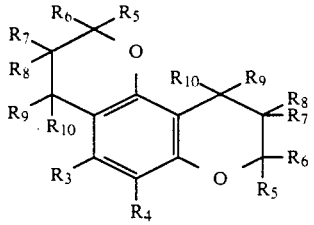

| Compound No. | $R_3$ | $R_4$ | $R_5$ | $R_6$ | $R_7$ | $R_8$ | $R_9$ | $R_{10}$ |
|---|---|---|---|---|---|---|---|---|
| F-42 | H | H | $CH_3$ | $CH_3$ | H | H | H | H |
| F-43 | H | H | 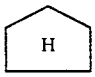 (Spiro) | | H | H | H | H |
| F-44 | H | OH | $CH_3$ | $CH_3$ | H | H | $CH_3$ | H |
| F-45 | H | $C_3H_7O$ | H | H | H | H | $CH_3$ | $CH_2OH$ |
| F-46 | OH | H | $CH_3$ | $CH_3$ | H | H | H | H |
| F-47 | $C_3H_7O$ | H | $CH_3$ | $CH_3$ | H | H | H | H |

Formula [G]

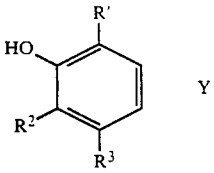

where $R^1$ and $R^3$ in the formula indicate hydrogen atom, halogen atom, alkyl group, alkenyl group, alkoxy group, hydroxy group, aryl group, aryloxy group, acylamino group, acyloxy group, sulfon amide group, cycloalkyl group, or alkoxy carobnyl group.

$R^2$ indicates hydrogen atom, halogen atom, alkyl group, alkenyl group, hydroxy group, aryl group, acyl group, acylamino group, acyloxy group, sulfon amide group, cycloalkyl group, or alkoxy carbonyl group.

Each of the groups shown above may be replaced by other substituent. The substituent includes alkyl, alkenyl, alkoxy, aryl, aryloxy, hydroxy, alkoxy carbonyl, aryl oxycarbonyl, acyl amino, carbamoyl, sulfon amide, and sulfamoyl group, etc.

$R^2$ and $R^3$ may be ring-closed each other to form 5- or 6-member hydrocarbon ring. This 5- or 6-member hydrocarbon ring may be replaced by halogen atom, alkyl, cycloalkyl, alkoxy, alkenyl, hydroxy, aryl, aryloxy group, or hetero cyclic group.

Y indicates an atomic group required to form indane ring. THe indane ring may be replaced by halogen atom, alkyl, alkenyl, alkoxy, cycloalkyl, hydroxy, aryl, aryloxy group, or hetero ring group, and may form spiro ring.

Of the compounds expressed by the formula [G], the compound especially useful for the invention herein are included in the compounds shown in the formulas [G-1] to [G-3].

Formula [G-1]

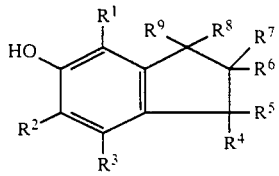

Formula [G-2]

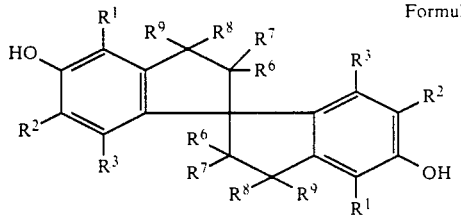

Formula [G-3]

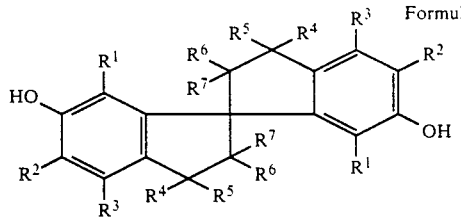

where $R^1$, $R^2$, and $R^3$ in the formulas [G-1] to [G-3] are the same as those in the formula [G], and $R^4$, $R^5$, $R^6$, $R^7$, $R^8$, and $R^9$ represent hydrogen atom, halogen atom, alkyl group, alkoxy group, alkenyl group, hydroxy group, aryl group, aryloxy group, or hetero ring group. $R^4$ and $r^5$, $R^5$ and $R^6$, $R^6$ and $R^7$, $R^7$ and $R^8$, and $R^8$ and $R^9$ may be ring-closed each other to form hydrocarbon ring, and in addition the hydrocarbon ring may be replaced by alkyl group.

In the formulas [G-1] to [G-3], the compound where $R^1$ and $R^3$ are hydrogen atom, alkyl group, alkoxy group, hydroxy group, or cycloalkyl group, and $R^2$ is hydrogen atom, alkyl group, hydroxy group, or cycloalkyl, and $R^4$, $R^5$, $R^6$, $R^7$, $R^8$, and $R^9$ are hydrogen atom, alkyl group, or cycloalkyl group, :s especially useful.

Preferably, the usage of the compound expressed by the formula [G] is 5 to 300 mol percent for magenta coupler, more preferably 10 to 200 mol percent.

The typical example of tghe compound expressed by the formula [G] indcludes:

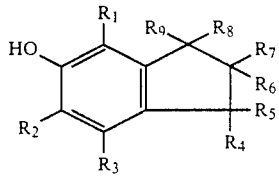

| Compound No. | $R^1$ | $R^2$ | $R^3$ | $R^4$ | $R^5$ | $R^6$ | $R^7$ | $R^8$ | $R^9$ |
|---|---|---|---|---|---|---|---|---|---|
| G-1 | H | H | H | H | H | H | H | H | H |
| G-2 | H | H | H | H | H | H | H | $CH_3$ | $CH_3$ |
| G-3 | H | H | H | H | H | H | H | $CH_3$ | $C_{16}H_{33}$ |
| G-4 | H | OH | H | H | H | H | H | $CH_3$ | $C_{16}H_{33}$ |
| G-5 | H | H | H | $CH_3$ | $CH_3$ | H | H | $CH_3$ | $CH_3$ |
| G-6 | H | Cl | H | $CH_3$ | $CH_3$ | H | H | $CH_3$ | $CH_3$ |
| G-7 | Cl | Cl | H | $CH_3$ | $CH_3$ | H | H | $CH_3$ | $CH_3$ |
| G-8 | H | H | $CH_3$ | $CH_3$ | $CH_3$ | H | H | $CH_3$ | $CH_3$ |
| G-9 | H | H | H | H | 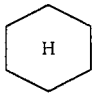 | (Condensed) | H | H | H |
| G-10 | H | H | H | H | H | H | H | 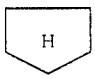 | (Spiro) |
| G-11 | H | $C_3H_7$ | H | $CH_3$ | $CH_3$ | H | H | $CH_3$ | $CH_3$ |
| G-12 | H | (t)$C_8H_{17}$ | H | $CH_3$ | $CH_3$ | H | H | $CH_3$ | $CH_3$ |
| G-13 | H | 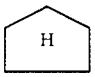 | H | $CH_3$ | $CH_3$ | H | H | $CH_3$ | $CH_3$ |
| G-14 | H | H | H | 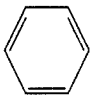 | $CH_3$ | H | H | $CH_3$ | $CH_3$ |
| G-15 | H | H | $CH_3O$ | $CH_3$ | $CH_3$ | H | H | $CH_3$ | $CH_3$ |
| G-16 | $CH_3H$ | H | H | H | 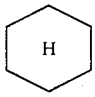 | (Condensed) | H | H | H |
| G-17 | H | $CH_3SO_2NH$ | H | $CH_3$ | $CH_3$ | H | H | $CH_3$ | $CH_3$ |
| G-18 | H | $CH_3CO$ | H | $CH_3$ | $CH_3$ | H | H | $CH_3$ | $CH_3$ |
| G-19 | H | 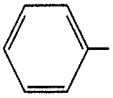 | H | $CH_3$ | $CH_3$ | H | H | $CH_3$ | $CH_3$ |
| G-20 | H | 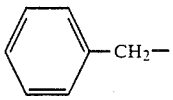 | H | $CH_3$ | $CH_3$ | H | H | $CH_3$ | $CH_3$ |
| G-21 | H | 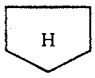 | (Condensed) | H | H | H | H | H | H |

-continued

| | | | | | | | | |
|---|---|---|---|---|---|---|---|---|
| G-22 | H | 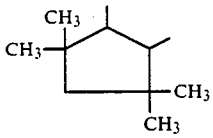 | (Condensed) | $CH_3$ | $CH_3$ | H | H | $CH_3$ | $CH_3$ |
| G-23 | H | 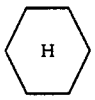 | (Condensed) | $CH_3$ | $CH_3$ | H | H | $CH_3$ | $CH_3$ |
| G-24 | $CH_3$ | 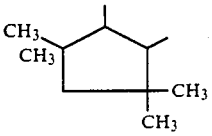 | ( ) | $CH_3$ | $CH_3$ | H | H | $CH_3$ | $CH_3$ |

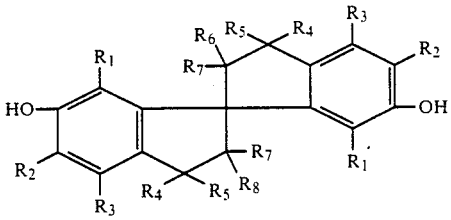

| Compound No. | $R_1$ | $R_2$ | $R_3$ | $R_4$ | $R_5$ | $R_6$ | $R_7$ |
|---|---|---|---|---|---|---|---|
| G-25 | H | $CH_3$ | H | $CH_3$ | $C_2H_5$ | H | H |
| G-26 | Cl | Cl | H | $CH_3$ | $CH_3$ | H | H |
| G-27 | H | OH | H | $CH_3$ | $CH_3$ | H | H |
| G-28 | H | $C_3H_7$ | H | $CH_3$ | $CH_3$ | H | H |
| G-30 | H | Cl | H | $CH_3$ | $CH_3$ | H | H |
| G-31 | H | $C_2H_5$ | H | $CH_3$ | $CH_3$ | H | H |
| G-33 | $CH_3$ | $CH_3$ | H | $CH_3$ | $CH_3$ | H | H |
| G-34 | H | 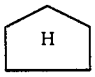 | H | $CH_3$ | $CH_3$ | H | H |
| G-35 | H | $CH_3$ | H | H | H | H | H |
| G-36 | H | H | H | 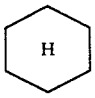 (Spiro) | | H | H |
| G-37 | $CH_3$ | H | H | $CH_3$ | $CH_3$ | H | H |
| G-38 | H | $CH_3$ | H | $CH_3$ | $C_2H_5$ | H | H |
| G-39 | 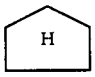 | H | H | $CH_3$ | $CH_3$ | H | H |
| G-40 | $CH_3$ | $CH_3$ | H | $C_2H_5$ | $C_2H_5$ | H | H |
| G-41 | H | H | H | H | H | $CH_3$ | $CH_3$ |
| G-42 | H | OH | H | 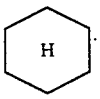 (Spiro) | | H | H |
| G-43 | H | 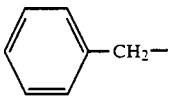 | H | H | H | H | H |

-continued

| | | | | | | | |
|---|---|---|---|---|---|---|---|
| G-44 | H | (t)$C_4H_9$ | H | $CH_3$ | $CH_3$ | H | H |
| G-45 | H | (t)$C_8H_{17}$ | H | $CH_3$ | $CH_3$ | H | H |

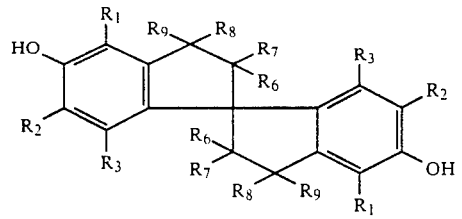

| Compound No. | $R^1$ | $R^2$ | $R^3$ | $R^6$ | $R^7$ | $R^8$ | $R^9$ |
|---|---|---|---|---|---|---|---|
| G-29 | H | H | H | H | H | $CH_3$ | $CH_3$ |
| G-32 | $CH_3$ | H | H | H | H | $CH_3$ | $CH_3$ |

Formula [H]

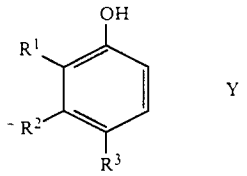

$R^1$ and $R^2$ in the formula represent hydrogen atom, halogen atom, alkyl group, alkenyl group, aryl group, acyl group, acyl amino group, acyloxy group, sulfon amide group, cyclo alkyl group, or alkoxy carbonyl group.

$R^3$ represents hydrogen atom, halogen atom, alkyl group, alkenyl group, alkoxy group, hydroxy group, aryl group, aryloxy group, acyl gruop, acyl amino group, acyloxy group, sulfon amide group, cyclo alkyl group, or alkoxy carbonyl.

Each of the groups listed above may be replaced by other groups, e.g. alkyl group, alkenyl group, alkoxy group, aryl group, aryloxy group, hydroxy group, alkoxy carbonyl group, aryloxy carbonyl group, acyl amino group, carbamoyl group, sulfon amide group, sulfamoyl group.

$R^1$ and $R^2$, and $R^2$ and $R^3$ may be ring-closed each other to form 5- or 6-member hydrocarbon ring. This hydrocarbon ring may be replaced by halogen atom, alkyl group, cycloalkyl group, alkoxy group, alkenyl group, hydroxy group, aryl group, aryloxy group, or hetero ring group.

Y represents an atomic group required to form indane ring. This indane ring may be replaced by substituent which can be substituted for the hydrocarbon ring. Furthermore, it may form spiro ring.

Of the compounds expressed by the formula [H], the compound especially useful for the invention herein is included in the compound expressed by the formulas [H-1] to [H-3].

Formula [H-1]

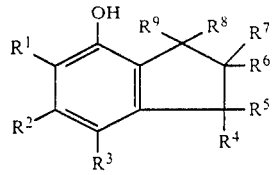

Formula [H-2]

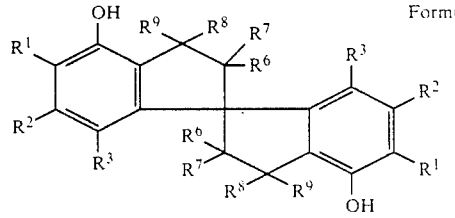

Formula [H-3]

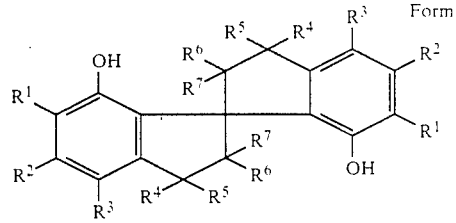

$R^1$, $R^2$, and $R^3$ in the formulas [H-1] to [H-3] are the same as those in the formula [H]. $R^4$, $R^5$, $R^6$, $R^7$, $R^8$, and $R^9$ represent hydrogen atom, halogen atom, alkyl group, alkoxy group, hydroxy group, alkenyl group, aryl group, aryloxy group, or hetero ring group. $R^4$ and $R^5$, $R^5$ and $R^6$, $R^6$ and $R^7$, $R^7$ and $R^8$, and $R^8$ and $R^9$ may be ring-closed each other to form hydrocarbon ring. Furthermore, the hydrocarbon ring may be replaced by alkyl group.

In the formulas [H-1] to [H-3], the compound where $R^1$ and $R^2$ are hydrogen atom, alkyl group, or cycloalkyl group, and $R^3$ is hydrogen atom, alkyl group, alkoxy gruop, hydroxy group, or cycloalkyl group, and $R^4$, $R^5$, $R^6$, $R^7$, $R^8$, and $R^9$ are hydrogen atom, alkyl group, or cycloalkyl group, is especially useful.

The compound expressed by the formula [H], whose synthesizing methods are already known, can be manufactured in accordance with U.S. Pat. No. 3,057,929 Chem. Bar. 1972, 95(5), page 1673 to 1674 and Chemistry Letters, 1980, page 739 to 742.

Preferably, the usage of a compound expressed by the formula [H] is 5 to 300 mol percent for magenta coupler, more preferably 10 to 200 mol percent.

The typical example of the compound expressed by the formula [H] includes:

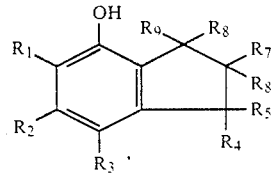

-continued

| Compound No. | $R^1$ | $R^2$ | $R^3$ | $R^4$ | $R^5$ | $R^6$ | $R^7$ | $R^8$ | $R^9$ |
|---|---|---|---|---|---|---|---|---|---|
| H-1 | H | H | H | H | H | H | H | H | H |
| 2 | $CH_3$ | H | H | H | H | H | H | H | H |
| 3 | H | H | H | H | H | H | H | $CH_3$ | $C_{16}H_{33}$ |
| 4 | H | H | OH | H | H | H | H | H | H |
| 5 | $CH_2{=}CHCH_2$ | H | Cl | H | H | H | H | H | H |
| 6 | H | H | H | H | H | H | H | $CH_3$ | $CH_3$ |
| 7 | H | H | H | $CH_3$ | $CH_3$ | H | H | H | H |
| 8 | H | H | H | $CH_3$ | $CH_3$ | $CH_3$ | H | H | H |
| 9 | $CH_2{=}CHCH_2$ | H | $CH_3O$ | H | H | H | H | H | H |
| 10 | H | H | H | $CH_3$ | $CH_3$ | H | H | $CH_3$ | $CH_3$ |
| 11 | H | $C_3H_7$ | H | $CH_3$ | $CH_3$ | H | H | $CH_3$ | $CH_3$ |
| 12 | Cl | H | Cl | H | H | H | H | $CH_3$ | $CH_3$ |

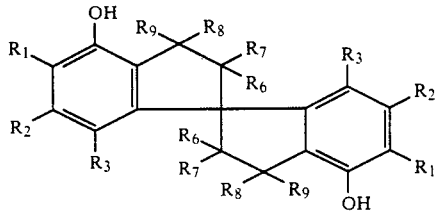

| Compound No. | $R_1$ | $R_2$ | $R_3$ | $R_6$ | $R_7$ | $R_8$ | $R_9$ |
|---|---|---|---|---|---|---|---|
| H-23 | H | H | H | H | H | H | H |
| 24 | H | H | OH | H | H | H | H |
| 25 | $CH_3$ | H | $CH_3$ | H | H | H | H |
| 26 | H | H | $CH_3$ | H | H | H | H |
| 27 | Cl | H | Cl | H | H | $CH_3$ | $CH_3$ |
| 28 | H | H | H | H | H | H | 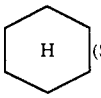 (Spiro) |
| 29 | H | H | H | H | H | $CH_3$ | 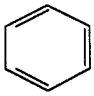 |
| 30 | H | H | 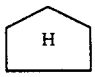 | H | H | H | H |
| 31 | H | H | 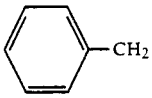 | H | H | $CH_3$ | $CH_3$ |
| 36 | H | H | (t)$C_4H_9$ | H | H | $CH_3$ | $CH_3$ |

| Compound No. | $R_1$ | $R_2$ | $R_3$ | $R_4$ | $R_5$ | $R_6$ | $R_7$ | $R_8$ | $R_9$ |
|---|---|---|---|---|---|---|---|---|---|
| H-13 | H | H | H | H | 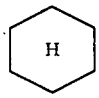 | (Condensed) | H | H | H |
| 14 | H | H | H | H | H | H | H | 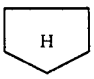 | (Spiro) |

-continued

| | | | | | | | | | |
|---|---|---|---|---|---|---|---|---|---|
| 15 | H | 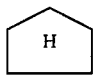 | H | $CH_3$ | $CH_3$ | H | H | $CH_3$ | $CH_3$ |
| 16 | H | $CH_3SO_2NH$ | H | $CH_3$ | $CH_3$ | H | H | $CH_3$ | $CH_3$ |
| 17 | H | $CH_3CO$ | H | H | H | H | H | $CH_3$ | $CH_3$ |
| 18 | H | 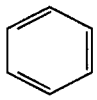 | H | $CH_3$ | $CH_3$ | H | H | $CH_3$ | $CH_3$ |
| 19 | H | 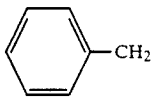 | H | $CH_3$ | $CH_3$ | H | H | $CH_3$ | $CH_3$ |
| 21 | 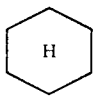 | (Condensed) | $CH_3$ | H | H | H | H | $CH_3$ | $CH_3$ |
| 22 | H | H | H | $CH_3$ | 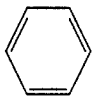 | H | H | $CH_3$ | $CH_3$ |

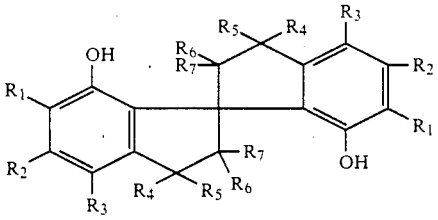

| Compound No. | $R_1$ | $R_2$ | $R_3$ | $R_4$ | $R_5$ | $R_6$ | $R_7$ |
|---|---|---|---|---|---|---|---|
| H-32 | H | H | H | H | H | H | H |
| 33 | H | H | H | $CH_3$ | $CH_3$ | H | H |
| 34 | H | H | (t)$C_4H_9$ | $CH_3$ | $CH_3$ | H | H |
| 35 | H | H | (t)$C_8H_{17}$ | $CH_3$ | $CH_3$ | H | H |

Other compound
H-20

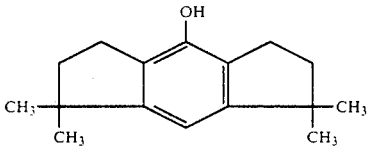

Formula [J]

(In the formula, $R^1$ represents aliphatic series group, cycloalkyl group, or aryl group, and Y represents non-metallic atomic group required to form 5- to 7-member heterocyclic ring together with nitrogen atom. If non-metallic atom containing nitrogen atoms constituing the hetero cyclic ring contains hetero atom not less than 2, at least two hetero-atoms are not adjacent to each other.)

The aliphatic series group represented by R'0 includes saturated alkyl group that may have a substituent and unsaturated alkyl group that may have a substituent. Saturated alkyl group includes methyl gruop, ethyl group, butyl group, octyl group, dodecyl group, tetradecyl group, hexadecyl group, etc., and unsaturated alkyl group includes ethenyl group and propenyl group, etc.

Cycloalkyl group represented by R includes 5- or 7-member cycloalkyl gruop which may have a substituent, for example, cyclopentyl group, cyclohexyl, etc.

Aryl group represented by $R^1$ includes phenyl group and naphtyl group which may have a substituent.

The substituent for aliphatic series group, cycloalkyl group, and aryl group represented by $R^1$ include alkyl group, aryl group, alcoxy group, carbonyl group, carbamoyl group, sulfamoyl group, sulfon amide group, carbonyloxy group, alkyl sulfonyl group, aryl sulfonyl group, hydroxy group, hetero ring group, alkylthio group, and arylthio group. Furthermore, these substituents may have substituents.

In the formula [J], Y represents non-metallic atom required to form 5- to 7-member heterocyclic ring together with nitrogen atom. At least two non-metallic atom groups containing nitrogen atom to form the heterocyclic ring must be hetero atoms, and these two hetero atoms must not be adjacent to each other.

In the heterocyclic ring of the compound expressed by the formula [J], if all of the hetero atoms are adjacent to one another, the compound cannot provide the function of magenta dye image stabilizer.

5- to 7-member heterocyclic ring of the compound expressed by the formula [J] may have substituents, e.g. alkyl group, aryl group, acyl group, carbamoyl group, alcoxy carbonyl group, sulfonyl group, sulfamoyl group, etc. Furthermore, they may have substituents. Preferably, 5- to 7-member heterocyclic ring may be a saturated one. Benzen ring may be condensed to the heterocyclic ring and formation of a spiro ring is permitted.

Preferably, the usage of the compound expressed by the formula [J] of the invention hedrein is 5 to 300 mol percent for magenta coupler expressed by the formula

[I] of the invention herein, more preferably 10 to 200 mol percent.

The typical exmaple expressed by the formula [J] of the invention herein includes:

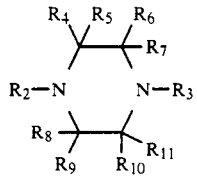

| | $R^2$ | $R^3$ | $R^4$ | $R^5$ | $R^6$ | $R^7$ | $R^8$ | $R^9$ | $R^{10}$ | $R^{11}$ |
|---|---|---|---|---|---|---|---|---|---|---|
| J-1 | $C_{12}H_{25}$ | $C_{12}H_{25}$ | H | H | H | H | H | H | H | H |
| J-2 | $C_{14}H_{29}$ | $C_{14}H_{29}$ | H | H | H | H | H | H | H | H |
| J-3 | $C_{14}H_{29}$ | H | H | H | H | H | H | H | H | H |
| J-4 | $C_{14}H_{29}$ | $CH_3CO$ | H | H | H | H | H | H | H | H |
| J-5 | $C_{15}H_{30}$ | $C_{15}H_{30}$ | H | H | H | H | H | H | H | H |
| J-6 | $C_{14}H_{29}$ | $CH_3$ | H | H | H | H | H | H | H | H |
| J-7 | 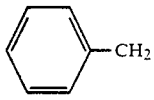 | 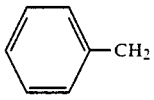 | H | H | H | H | H | H | H | H |
| J-8 | 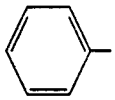 | 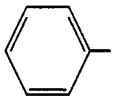 | H | H | | H | H | H | H | H |
| J-11 | $CH_3$ | 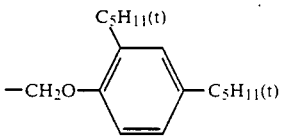 | H | H | H | H | H | H | H | H |
| J-13 | $C_{14}H_{29}$ | $C_4H_9NHCO$ | H | H | H | H | H | H | H | H |
| J-14 | $(t)C_8H_{17}$ | 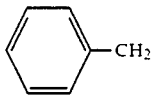 | H | H | H | H | H | H | H | H |
| J-15 | $C_{14}H_{29}$ | $CF_3CO$ | H | H | H | H | H | H | H | H |
| J-16 | $C_{14}H_{29}$ | $C_2H_5OCO$ | H | H | H | H | H | H | H | H |
| J-17 | $CH_3$ | 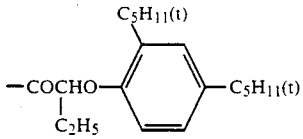 | H | H | H | H | H | H | H | H |
| J-18 | $C_{14}H_{29}$ | $C_{14}H_{29}$ | $CH_3$ | H | H | H | H | H | H | H |
| J-19 | $C_{14}H_{29}$ | $C_{14}H_{29}$ | $CH_3$ | H | H | H | H | H | $CH_3$ | H |
| J-20 | $C_{14}H_{29}$ | $C_{14}H_{29}$ | $CH_3$ | $CH_3$ | $CH_3$ | $CH_3$ | $CH_3$ | $CH_3$ | $CH_3$ | $CH_3$ |
| J-21 | $CH_3$ | 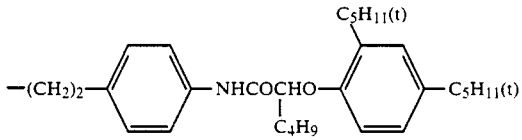 | H | H | H | H | H | H | H | H |
| J-22 | $C_{12}H_{25}$ | $CH_3$ | $CH_3$ | H | H | H | $CH_3$ | H | H | H |
| J-23 | $C_{12}H_{25}$ | $C_{15}H_{30}$ | $CH_3$ | H | H | H | H | H | $CH_3$ | H |
| J-24 | $C_{15}H_{30}$ | $C_{15}H_{30}$ | $CH_3$ | H | H | H | H | H | $CH_3$ | H |
| J-25 | $C_2H_5CH{=}CH{-}CH_2{-}$ | $C_{12}H_{25}$ | H | H | H | H | H | H | H | |
| J-26 | $C_{12}H_{25}$ | $C_2H_5$ | $CH_3$ | H | H | H | H | H | H | H |
| J-27 | $C_{16}H_{33}$ | H | $C_2H_5$ | H | H | H | H | H | H | H |
| J-29 | $C_{14}H_{29}$ | $CH_2BrCH_2$ | H | H | H | H | H | H | H | H |
| J-30 | $CH_3O(CH_2)_4{-}$ | $CH_3O(CH_2)_4$ | H | H | H | H | H | H | H | H |

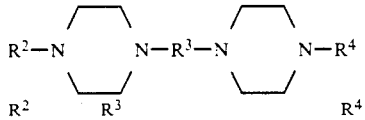
| | $R^2$ | $R^3$ | $R^4$ |
|---|---|---|---|
| J-9 | $C_{14}H_{29}$ | $(CH_2)_2$ | $C_{14}H_{29}$ |
| J-10 | $(t)C_8H_{17}$ | $(CH_2)_6$ | $(t)C_8H_{17}$ |
| J-12 | $C_{14}H_{29}$ | $CH_2$ | $C_{14}H_{29}$ |
| J-28 | $C_{12}H_{25}$ | 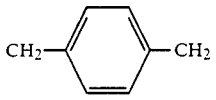 | $C_{12}H_{25}$ |
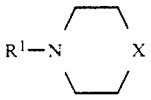
| | X | $R_1$ |
|---|---|---|
| J-31 | O | $C_{12}H_{25}$ |
| J-32 | O | $C_{14}H_{29}$ |
| J-33 | O | $C_6H_5CH{=}CH-$ |
| J-34 | O | 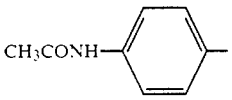 |
| J-35 | O | α- |
| J-36 | | 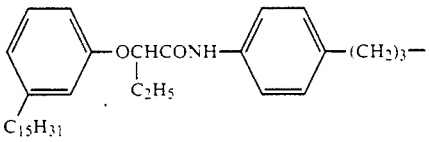 |
| J-37 | O | 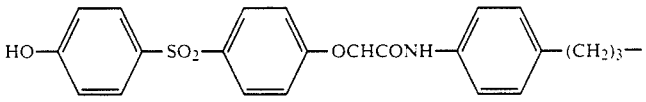 |
| J-38 | O | 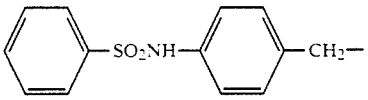 |
| J-39 | O | 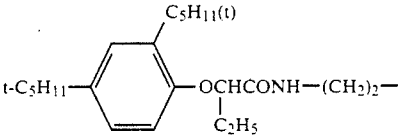 |
| J-40 | O | 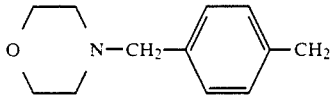 |
| J-41 | S | $C_{14}H_{29}$ |
| J-42 | S | 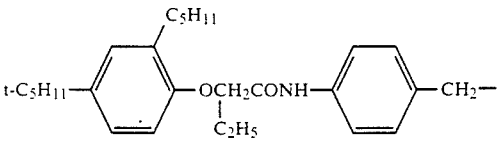 |

-continued
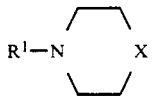
| | X | $R_1$ |
|---|---|---|
| J-43 | S | 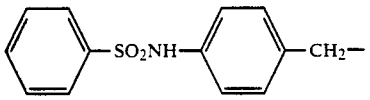 |
| J-44 | S | 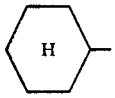 |
| J-45 | S | 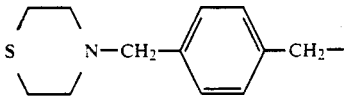 |
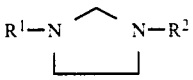
| | $R^1$ | $R^2$ |
|---|---|---|
| J-46 | $C_{12}H_{25}$ | $C_{12}H_{25}$ |
| J-47 | $C_{14}H_{29}$ | $C_{14}H_{29}$ |
| J-48 | $C_6H_5CH_2$ | $C_6H_5CH_2$ |
| J-49 | $C_{16}H_{33}$ | H |
| J-50 | $C_{16}H_{33}$ | $CH_3CO$ |
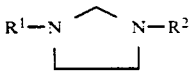
| | | |
|---|---|---|
| J-51 | $C_{16}H_{33}$ | $C_{16}H_{33}$ |
| J-52 | $C_{14}H_{29}$ | $C_{14}H_{29}$ |
| J-53 | $C_{12}H_{25}$ | $C_{12}H_{25}$ |
| J-54 | $C_{14}H_{29}$ | $CH_3CO$ |
| J-55 | $C_{14}H_{29}$ | $CF_3CO$ |
| J-56 | $C_2H_5$ | 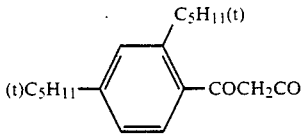 |
| J-57 | $C_{14}H_{29}$ | $C_2H_5OCO$ |
| J-58 | $C_{14}H_{29}$ | $CH_3NHCO$ |
| J-59 | $C_{14}H_{29}$ | $C_4H_9SO_2$ |
| J-60 | $C_{14}H_{29}$ | $(CH_3)_2NSO_2$ |
| J-61 | $C_{12}H_{25}$ | 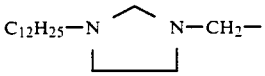 |
| J-62 | H | 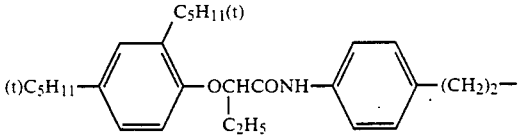 |

J-63

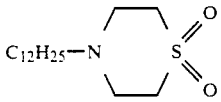

J-64

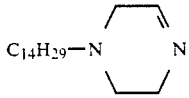

J-65

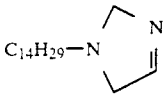

J-66

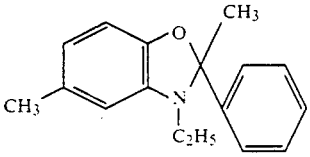

J-67

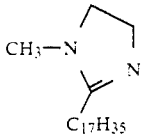

J-68

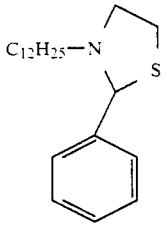

J-69

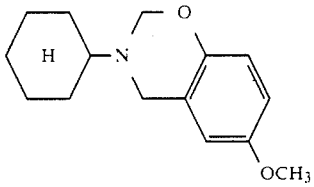

J-70

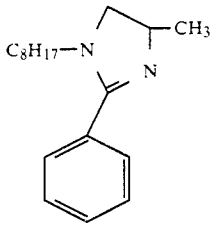

J-71

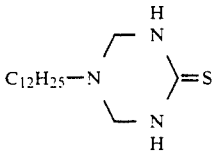

J-72

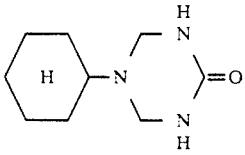

-continued

J-73

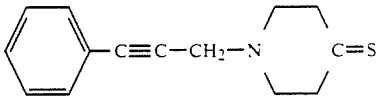

J-74

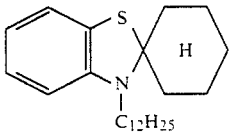

Of the compounds expressed by the formula [J], piperazine compound and homopiperazine compound are recommended in particular, and those expressed by the following formula [J-1] or [J-2] are more preferable.

Formula [J-1]

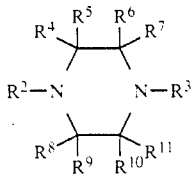

Formula [J-2]

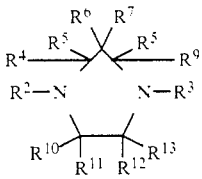

$R^2$ and $R^3$ and in the formula represent hydrogen atom, alkyl group, or aryl group. However, $R^2$ and $R^3$ do not become hydrogen at the same time. $R^4$ through $R^{13}$ represent hydrogen atom, alkyl group, or aryl group.

$R^2$ and $R^3$ in the formula [J-1] and [J-2] represent hydrogen atom, alkyl group, or aryl group. The alkyl group represented by $R^2$ and $R^3$ includes methyl group, ethyl group, butyl group, octyl group, dodecyl group, tetradecyl group, hexadecyl group, octadecyl group, etc. Aryl group represented by $R^2$ or $R^3$ includes phenyl group, etc. The alkyl or aryl group represented by $R^2$ or $R^3$ may have a substituent, e.g. halogen atom, alkyl group, aryl group, alcoxy group, aryloxy group, or heterocyclic ring group.

Preferably, the number of total carbon atoms for $R^2$ and $R^3$ (including substituents) is 6 to 40.

$R^4$ through $R^{13}$ in the formulas [J-1] or J-2] represent hydrogen atom, alkyl group, or aryl group. The alkyl group represented by $R^4$ to $R^{13}$ includes methyl group and ethyl group. The aryl group represented by $R^4$ to $R^{13}$ includes phenyl group, etc.

The typical examples of the compound expressed by the formula [J-1] or J-2] are as shown in pipeazine compound (J-1) to (J-30) and homopiperazine compund (J-51) to (J-62).

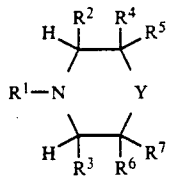

Formula [K]

$R^1$ in the formula represents aliphatic series group, cycloalkyl group, or aryl group and Y represents hydrocarbon group with typical bond or a valence of 2 required to form 5- to 7-member heterocyclic ring together with nitrogen atom. $R^2$, $R^3$, $R^4$, $R^5$, $R^6$, and $R^7$ represent hydrogen atom, aliphatic series group, cycloalkyl group, or aryl group. $R^2$ and $R^4$, and $R^3$ and $R^6$ bond each other to form normal bond and may form unsaturated 5- to 7-member hedterocyclic ring together with Y. If Y is a normal bond, $R^5$ and $R^7$ bond each other to form normal bond and may form unsaturated 5-member heterocyclic ring together with nitrogen atom and Y. If Y is not normal bond, $r^5$ and Y, $R^7$ and Y, or Y itself forms unsaturated bond and may form unsaturated 6- or 7-member heterocyclic ring together with nitrogen atom and Y.

Aliphatic series group represented by $R^1$ includes saturated alkyl group which may have a substituent, and unsaturated alkyl group which may have a substituent. Saturated alkyl group includes methyl grou, ethyl gruop, butyl group, octyl group, dodecyl group, tetradecyl group, and hexadecyl group. Unsaturated alkyl group includes ethenyl group and propenyl group, etc.

Cycloalkyl group represented by R includes 5- to 7-member cycloalkyl group which may have substituent, e.g. cyclopentyl group and cyclohexyl, etc.

Aryl group represented by $R^1$ includes phenyl group and naphthyl group which may have substituent.

The substituent for aliphatic series group, cycloalkyl group, and aryl group represented by $r^1$ includes alkyl group, aryl group, alcoxy group, carbonyl group, carbamoyl group, acyl amino group, sulfamoyl group, sulfon amide, carbonyloxy group, alkylsulfonyl group, aryl sulfonyl group, hydroxy group, hetero ring group, alkylthio group, arylthio group, etc. Furthermore, they may have substituents.

Y in the formula [K] represents hydrocarbon with normal bond or a valence of 2 required to form 5- to 7-member heterocyclic ring together with nitrogen atom. If Y, however, is a normal bond, $R^5$ and $R^7$ may bond each other to form a normal bond and may form unsaturated 5-member heterocyclic ring. If Y is hydrocarbon loop with a valence of 2 or methylene group, $R^5$ and Y or $R^7$ and Y may form unsaturated bond to form unsaturated 6-member heterocyclic ring. If it is ethylene group, $R^5$ and Y, $R^7$ and Y, or Y itself may form unsaturated bond to form unsaturated 7-member heterocyclic ring. Furthermore, hydrocarbon group with a valence of 2 represented by Y may have a substituent, e.g. alkyl group, carbamoyl group, alkyloxy carbonyl group, acyl amino group, sulfon amide group, sulfamoyl group, aryl group, and hetero ring group, etc.

$R^2$, $R^3$, $R^4$, $R^5$, $R^6$, and $r^7$ in the formula [K] represent hydrogen atom, aliphatic series grou, cycloalkyl group, or aryl group. The aliphatic series group represented by $R^2$ to $R^7$ includes saturated alkyl group which may have substituent, and unsaturated alkyl group which may have substituent. Saturated alkyl group includes methyl group, butyl group, octyl group, dodecyl group, tetradecyl group, and hexadecyl group. Unsaturated alkyl group includes ethenyl group and propenyl group, etc.

Cycloalkyl group represented by $R^2$ to $R^7$ includes 5- to 7-member cycloalkyl group which may have substituent, e.g. cyclopentyl group and cyclohexyl group, etc.

Aryl group represented by $R^2$to $R^7$ includes phenyl group and naphtyl group which may have substituents. The substituent for aliphatic series, cycloalkyl group, and aryl group includes alkyl group, aryl group, alcoxy group, carbonyl group, carbamoyl group, acyl amino group, sulfamoyl group, sulfon amide group, carbonyloxy group, alkylsulfonyl group, arylsulfonyl group, hydroxy group, hetero ring group, and alkylthio group, etc.

The compound with saturated 5- to 7-member heterocyclic ring, expressed by the formula (K), is preferable to that unsaturated.

The usage of the compound expressed by the formula (K) is 5 to 300 mol percent for magenta coupler expressed by the formula (I), more preferably 10 to 200 mol percent.

The typical example of the compound expressed by the formula (K) includes:

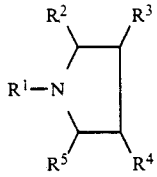

| | $R^1$ | $R^2$ | $R^3$ | $R^4$ | $R^5$ |
|---|---|---|---|---|---|
| K-1 | $C_8H_{17}$ | H | H | H | H |
| K-2 | 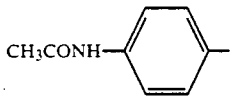 | H | H | H | H |

-continued
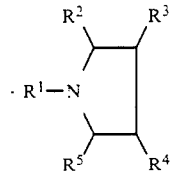
| | $R^1$ | $R^2$ | $R^3$ | $R^4$ | $R^5$ |
|---|---|---|---|---|---|
| K-3 | 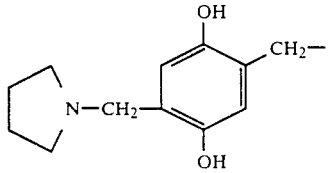 | H | H | H | H |
| K-4 | $C_{12}H_{25}$ | H | H | H | H |
| K-5 | $C_{14}H_{29}$ | H | H | H | H |
| K-6 | $C_{16}H_{33}$ | H | H | H | H |
| K-7 | $C_{14}H_{29}$ | H | 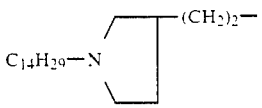 | H | H |
| K-8 | 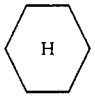 | $CH_3$ | $CH_3$ | H | H |
| K-9 | $C_6H_5CH{=}CHCH_2-$ | H | H | H | H |
| K-10 | 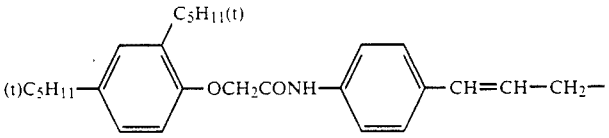 | H | H | H | H |
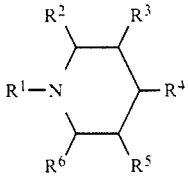
| | $R^1$ | $R^2$ | $R^3$ | $R^4$ | $R^5$ | $R^6$ |
|---|---|---|---|---|---|---|
| K-11 | $(t)C_8H_{17}$ | H | H | H | H | H |
| K-12 | 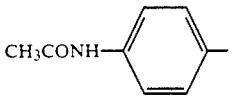 | H | H | H | H | H |
| K-13 | $C_{12}H_{25}$ | H | H | H | H | H |
| K-14 | $C_{14}H_{29}$ | H | H | H | H | H |
| K-15 | $C_{16}H_{33}$ | H | H | H | H | |
| K-16 | $C_{14}H_{29}$ | $CH_3$ | H | H | H | H |
| K-17 | 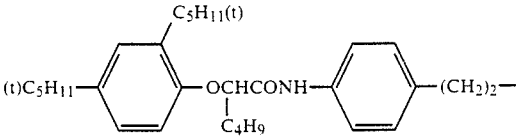 | | | H | H | H |
| K-18 | $C_8H_{17}$ | $CH_3$ | $CH_3$ | H | $CH_3$ | $CH_3$ |

-continued
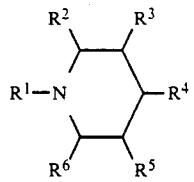
| | $R^1$ | $R^2$ | $R^3$ | $R^4$ | $R^5$ | $R^6$ |
|---|---|---|---|---|---|---|
| K-19 | 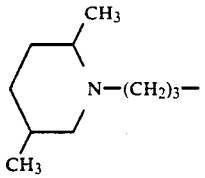 | $CH_3$ | H | H | $CH_3$ | H |
| K-20 | $CH_3$ | H | H | $C_{12}H_{25}OCOCH_2$— | H | H |
| K-21 | $CH_3$ | $CH_3$ | H | $C_{16}H_{33}OCOCH_2$— | H | $CH_3$ |
| K-22 | $CH_3$ | $C_{16}H_{33}$ | H | H | H | H |
| K-23 | $C_2H_5$ | H | H | $C_{12}H_{25}OCO$— | H | H |
| K-24 | $CH_3$ | $C_6H_5$ | H | H | H | H |
| K-25 | 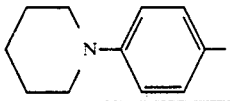 | H | H | H | H | H |
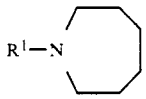
| | $R^1$ | $R^2$ |
|---|---|---|
| K-26 | $C_8H_17$ | H |
| K-27 | 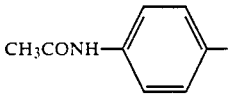 | H |
| K-28 | 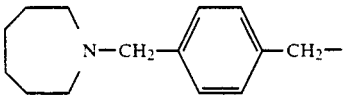 | H |
| K-29 | $C_{14}H_{29}$ | H |
| K-30 | 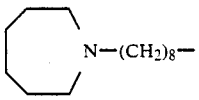 | H |
| K-31 | $C_{16}H_{33}$ | $CH_3$ |
| K-32 | 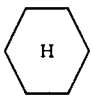 | |
| K-33 | 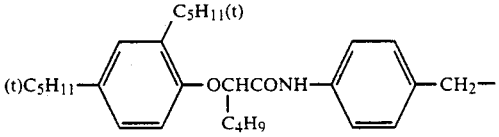 | H |
-continued
K-34
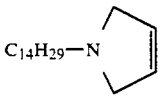
K-35
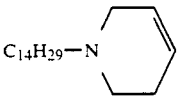

-continued

K-36

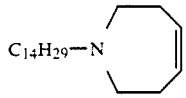

K-37

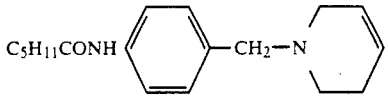

K-38

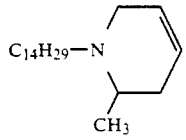

K-39

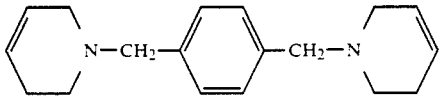

K-40

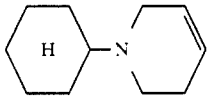

K-41

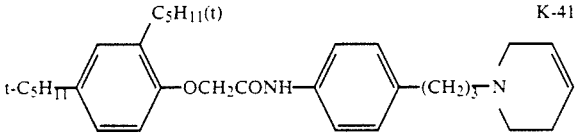

The protective layer, intermediate layer or any other hydrophilic colloidal layer of the sensitized material of the present invention may contain an ultraviolet absorbent to prevent fogging caused when the sensitized material is electrically charged due to friction or a similar cause, and to prevednt images from being deteriorated when exposed to ultraviolet rays.

The color sensitized material using a silver halide emulsion developed under the present invention may have an auxiliary layer or layers such as a filter layer, antihalation layer and/or anti-irradiation layer. Each of these layers and/or emulsion layer may contain a dye which will flow out from the color sensitized material or bleached during developing.

A matting compound may be added to the silver halide emulsion layer and/or any other hydrophilic colloidal layer of the silver halide sensitized material using the silver halide emulsion described hereunder for purposes of reducing the gloss of the sensitized material, enhancing the retouchability, and preventing one sensitized material from sticking to another.

A lubricant may be added to reduce the friction by sliding of the sensitive material using the silver halide emulsion of the invention.

An anti-static agent may be added to the sensitized material using the silver halide emulsion of the invention for preventing it from being charged with static electricity. Such an anti-static agent may be used in the anti-static layer on the side having no emulsion support, or in an emulsion layer and/or in any protective colloidal layer other than the emulsion layer on the side haivng an emulsion support.

A variety of surface-active agents are used in the photographic emulsion layer and/or any other hydrophilic colloidal layer of the sensitized material using the silver halide emulsion hereunder to improve the coating property, prevent static charge, enhance the sliding property, disperse emulsification, prevent sticking and improve the photographic properties (such as accelerated development, intensification, and sensitization).

The sensitized material using the silver halide emulsion hereunder can be applied to a photographic emulsion layer and other layers including baryta paper or paper laminated with alpha-olefin polymer or the like, synthetic paper or any other similar flexible reflective support, a film consisting of semi-synthetic or synthetic high-molecules of cellulose acetate, cellulose nitrate, polystylene, vinyl polychloride, polyethylene terephthalate, polycarbonate, polyamide, etc., and a rigid body of glass, metal, ceramics, etc.

The silver halide sensitized material described hereunder may have the surface of its support undergo corona discharge, ultraviolet irradiation or flaming, as appropriate, and then be applied directly (or via one or two first coats arming at enhancing the adhesion, anti-static property, dimensional stability, wear resistance, hardness, anti-halation property, friction and/or any other charactgeristics of the material.

In the coating of the sensitized material using the silver halide emulsion hereunder, a thickening agent may be used for improving its coating properties. The most useful coating technique is either extrusion or curtain coating which allows a simultaneous coating of two or more different layers.

The sensitized material described hereunder can be exposed to light using electromagnetic waves having a spectrum to and within which the material itself is sensitive. The light source to which the sensitized material can be exposed may be natural light (sunshine) or any other known light emitted from the fluoroscent substance excited by a tungsten lamp, fluorescent lamp, mercury lamp, xenon arc lamp, carbon arc lamp, xenon flash lamp, cathode-ray flying spot, laser, light-emitting diode, electron rays, X-rays, gamma-rays, or alpha-rays.

The exposure time may of course be 1 millisecond to 1 second as with an ordinary camera, but may be shorter than 1 millisecond, for exmaple, 100 microseconds to 1 microsecond with a cathode-ray tube or xenon flash lamp, or longer than 1 second. The sensitized material may be exposed continuously or intermittently.

The sensitized material of silver halide hereunder can generate color images through a color developing method known to those who are skilled in the art.

The first-grade aromatic amine-based coloring developing agents used to develop colors in the present invention include those developing agents widely known in various color photographing processes in the industry. These agents contain an aminophenol-based or p-phenylenediamine-based derivative. Such a compound is normally used in the form of salt, for examp;le, hydrochloride or sulfate, because of higher stability than in free form. The compound is used with concentrations of, typically, about 0.1–30g, or preferably, about 1–15g, per liter of coloring developing agent.

Aminophenol-based developing agents include, for example, O-aminophenol, p-aminophenol, 5-amino-2-oxytoluene, 2-amino-3-oxytoluene, and 2-oxy-3-amino-1,4-dimethylbenzene.

The especially useful first-grade aromatic amine-based coloring agents are N,N'-dialkyl-p-phenylenediamine-based compounds, in which the alkyl group and phenyl group may be substituted for by any substituent; for examp;le, N,N'-generate diethyl-p-phenylenediamine hydrochloride, N-methyl-p-phenylenediamine hydrochloride, 2-amino-5-(N-ethyl-N-dodecylamino)-toluene, N-ethyl-N-B-methanesulfonamidethyl-3-methyl-4-aminoaniline sulfate, N-ethyl-N-B-hydroxyethylaminoaniline, 4-amino-3-methyl-N,N'-diethylaniline, and 4-amino-N-(2-methoxyethyl)-N-ethyl-3-methylaniline-p-toluene sulfonate.

The coloring developing agent used in the process incorporating the teachings of the present invention, or a firstgrade aromatic amine-based coloring developing agent, may contain various additives which are normally used in the color developing process, for examp;led, an alkaline compound such as sodium hydroxide, sodium carbonate or potassium carbonate, alkaline metal sulfite, alkaline metal bisulfite, alkaline metal thiocyanate, alkaline metal halide, benzylalcohol, water softening agent or thickening agent as appropriate. The pH-value of such a coloring developing agent is, normally, 7 or more, and most typically, between 10 and 13.

In the process implemented according to he present invention, the coloring developing process is followed by the treatment using an agent having a fixing capability. If the processing agent having such a fixing capability is a fixing solution, bleaching takes place before the fixing process. THe bleaching agent used in the bleaching process is organic metal complex salt, which not only oxidizes the metal silver generated by developing and reduces it to silver halide but also develops any uncolored portion of the coloring agent. It is constituted of iron, cobalt, copper or other metal ions coordinated with such an organic acid as aminopolycarbonic acid, oxalic acid or citric acid. The most preferable organic acid used to form such metal complex salt is polycarbonate or aminopolycarbonate. It may be alkaline metal salt, ammonium salt or water-soluble amine salt. Examples include:

[1] ethylenediaminetetraacetic acid
[2] nitrilotriacetic acid
[3] iminodiacetic acid
[4] ethylenediaminetetraacetic acid disodium salt
[5] ethylenediaminetetraacetic acid tetra (trimethylammonium) salt
[6] ethylenediaminetetraacetic acid tetrasodium salt
[7] nitrilotriacetic acid sodium salt The bleaching agent contains above-mentioned organic metal complex salt and may contain a variety of additives. A preferable additive is alkali halide or ammonium halide, for example, a rehalogenating compound including potassium bromide, sodium bromide, sodium chloride or ammonium bromide, or a metal salt or chelating agent. Also, the bleaching agent can contain a pH buffering agent such as borate, oxalate, acetate, carbonate or phosphate, or alkylamine, polyethylene oxide or any other compound normally known for addition to a bleaching agent.

Furthermore, the fixing solution or bleaching/fixing solution may contain one or more pH buffering agents comprising various sulfites such as ammonium sulfite, potassium sulfite, ammonium bisulfite, potassium bisulfite, sodium bisulfite, meta-ammonium bisulfite, metapotassium bisulfite or meta-sodium bisulfite, or various types of salts such as boric acid, borax, sodium hydroxide, potassium hydroxide, sodium carbonate, sodium bisulfite, sodium bicarbonate, potassium bicarbonate, acetic acid, sodium acetate or ammonium hydroxide.

For processing hereunder with a bleaching/fixing replenisher being added to the bleaching/fixing solution (bath), the solution (bath) may contain a thiosulfate, thiocyanate or sulfite, or a replenisher to which such a salt is added.

According to the subject invention, the bleaching-/fixing solution bath or the tank storing its replenisher may be charged with a blast of air or oxygen to enhance the degree of activation of the bleaching/fixing solution. Another way to achieve the same purpose may be by adding a proper oxidizer such as hydrogen peroxide, bromate or persulfate, as appropriate.

As described in the foregoing, the light-sensitive silver halide photographic material of the present invention provides excellent reproduction of magenta color images, improved fastness of the dye image against light and a lower increase in fog of a raw sample with lapse of time.

The present invention is further described with reference to working examples. However, of course, the invention is not limited to these examples.

EXAMPLE 1

A support comprising polyethylene-covered paper was coated with a silver halide emulsion containing a control magenta coupler to a build-up of 4 mg/dm$^2$, green-sensitive silver chloride/bromide emulsion to a build-up of 4 mg/dm$^2$ in terms of silver, dioctyl phathalate as a solvent for coupler to a build-up of 4 mg/dm$^2$ and gelatin to a build-up of 16 mg/dm$^2$.

The sample thus prepared is hereinafter referred to as Sample 1.

Then Samples 2 thru 28 were prepared in the same manner as Sample 1 except that in these samples combination of coupler, metal complex and compound of formula [a-1] or [a-2] as shown in Table 1 was used in place of the control magenta coupler in the silver halide emulsion layer, and that the coated amount of silver in Samples 5 thru 28 was made to be 2 mg/dm$^2$.

In the Example the metal complex and the compound of formula [a-1] or [a-2] were incorporated in the Samples after being dissolved in the solvent together with the coupler.

After being exposed to green light through an optical wedge in a sensitometer (Model KS-7, a product of Konishiroku Photo Industry Co., Ltd.), the individual samples were subjected to the following processes:

<Standard processes (temperature and time)>

[1] Color development: (38° C., 3'30")
[2] Bleach-fixing: (33° C., 1'30")
[3] Rinsing: 25-30° C., 3'
[4] Drying 75-80° C., about 2'

<Color developer>

Benzyl alcohol: 15 ml
Ethylene glycol: 15 ml
Potassium sulfite: 2.0 g
Sodium bromide: 0.7 g
Sodium chloride: 0.2 g
Potassium carbonate: 30.0 g
Hydroxylamine sulfate: 3.0 g
Polyphosphate (TPPS): 2.5 g
3-methyl-4-amino-N-(β-methanesulfoamide ethyl-)aniline sulfate: 5.5 g
Optical brightening agent (4,4'-diaminostylbenzsulfonate derivative): 1.0 g
Potassium hydroxide: 2.0 g
Water is added to make a total volume of solution of one liter, with a pH value of 10.20.

<Bleach-fixing solution>

Ferrous ethylenediaminetetraacetic acid ammonium-dihydrate: 60 g
Ethylenediaminetetraacetic acid: 3 g
Ammonium thiosufate: (70% solution): 100 ml
Ammonium sulfite: (40% solution): 27.5 ml Potassium carbonate or glacial acetic acid is added to the mixture of these compounds to obtain a pH value of 7.1. Then water is added to the mixture, making a total of one liter.

Each of the samples thus prepared was subjected to light resistance tests, as follows:

<Light resistance test>

Each sample was exposed to sunshine for 30 days in an underglass outdoor exposure table. Its green densities before and after fading test were measured. The formula used to obtain the magnitude of fading (fading ratio) by light is as follows:

$$\text{Fading ratio} = (D_0 - D)/D_0 \times 100\ (\%)$$

where $D_0$ is the density before fading by light and D is the density after fading by light. The results are shown in Table 1.

TABLE 1

| Sample No. | Magenta Coupler | Metal-Complex | Compound of [a-1] or [a-2] | Fastness Fading Ratio (%) |
|---|---|---|---|---|
| 1 (Comp.) | Control | None | None | 63 |
| 2 (Comp.) | Control | 16 | None | 46 |
| 3 (Comp.) | Control | None | a-1-47 | 50 |
| 4 (Comp.) | Control | 16 | a-1-47 | 30 |
| 5 (Comp.) | Control | None | a-2-51 | 51 |
| 6 (Comp.) | Control | 16 | a-2-51 | 30 |
| 5 (Comp.) | 5 | None | None | 89 |
| 7 (Comp.) | 5 | 16 | None | 45 |
| 8 (Comp.) | 5 | None | a-1-47 | 58 |
| 9 (Inv.) | 5 | 16 | a-1-47 | 34 |
| 10 (Comp.) | 5 | None | a-2-51 | 58 |
| 11 (Inv.) | 5 | 16 | a-2-51 | 32 |
| 11A (Comp.) | 7 | None | None | 87 |
| 12 (Comp.) | 7 | 16 | None | 48 |
| 13 (Comp.) | 7 | None | a-1-47 | 56 |
| 14 (Inv.) | 7 | 16 | a-1-47 | 35 |
| 15 (Comp.) | 7 | None | a-2-51 | 57 |
| 16 (Inv.) | 7 | 16 | a-2-51 | 35 |
| 17 (Inv.) | 28 | 16 | a-1-47 | 29 |
| 18 (Inv.) | 28 | 16 | a-2-51 | 31 |
| 19 (Inv.) | 44 | 16 | a-1-47 | 30 |
| 20 (Inv.) | 44 | 16 | a-2-51 | 32 |
| 21 (Inv.) | 99 | 16 | a-1-47 | 28 |
| 22 (Inv.) | 99 | 16 | a-2-51 | 30 |
| 23 (Inv.) | 152 | 16 | a-1-47 | 30 |
| 24 (Inv.) | 152 | 16 | a-2-51 | 28 |
| 25 (Inv.) | 157 | 16 | a-1-47 | 31 |
| 26 (Inv.) | 157 | 16 | a-2-51 | 29 |
| 27 (Inv.) | 172 | 16 | a-1-47 | 31 |
| 28 (Inv.) | 172 | 16 | a-2-51 | 30 |

Note: The amount of addition of the metal comlex and the compound of [a-1] or [a-21] aws 0.5 moles per 1 mole of magenta coupler. In the table, "Comp." refers to "comparative sample" and "Inv." means "sample according to the present invention".

The chemical structure of the Control coupler is as follows:

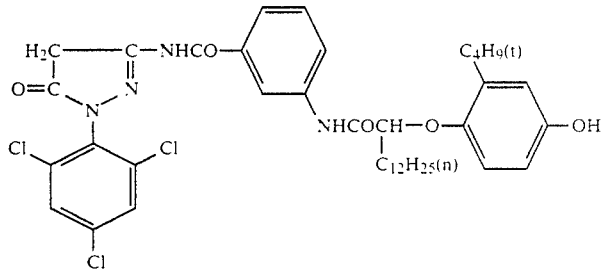

It is found from the data listed in Table 1 that a magenta coupler combined with the metal complex and a compound represented by formula [a-1] or [a-2] provides a significantly enhanced light resistance, especially to the magenta dye which is formed from the magenta coupler represented by formula [I] of the present invention. In addition, since the magenta dye formed from the coupler represented by formula [I]of the present invention has a small secondary absorption, it has been confirmed that the samples in accordance with the present invention have excellent color reproduction capabilities.

EXAMPLE 2

A support comprising polyethylene-covered paper was coated with the following layers in sequence to form a multicolor light-sensitive silver halide photographic material:

First layer: Blue-sensitive silver halide emulsion layer

As a yellow coupler, the first layer was coated with a-pivalyl-a-(1-benzyl-2,4-dioxy-imidalyzin-3-il)-2-chloro-5-[r-(2,4-di- t-amylphenoxy) butylamide]-acetoanilide to a build-up of 8 mg/dm$^2$, blue-sensitive silver chloride/bromide emulsion to a build-up of 3 mg/dm$^2$ in terms of silver, 2,4-d-t-butylphenol3',5'-di-t-amyl-4'-hydroxybenzoate to a build-up of 3 mg/dm$^2$, dioctylphthalate to a build-up of 3 mg/dm$^2$ and gelatin to a build-up of 16 mg/dm$^2$.

Second layer: Intermediate layer

The second layer was coated with gelatin to a build-up of 4 mg/dm$^2$.

Third layer: Green-sensitive silver chloride/bromide emulsion layer

The third layer was coated with the above-mentioned magenta coupler 44 to a bult-up of 4 mg/dm$^2$, grene-sensitive silver chloride/bromide emulsion to a build-up of 2 mg/dm$^2$ in terms of silver, dioctylphthalate to a build-up of 4 mg/dm$^2$ and gelatin to a build-up of 16 mg/dm$^2$.

Fourth layer: Intermediate layer

As an ultraviolet absorbent, the fourth layer was coated with 2-hydroxy-3',5'-di-t-amylphenyl)-benzotriazol to a build-up of 3 mg/dm$^2$, 2-(2'-hydroxy-3',5'-di-t-butyl-phenyl)-benzotriazol to a build-up of 3 mg/dm$^2$, dioctylphthalate to a build-up of 4 mg/dm$^2$to a build-up of 14 mg/dm$^2$.

Fifth layer: Red-sensitive silver chloride/bromide emulsion layer

As a cyan coupler, the fifth layer was coated with 2,4-dichloro-3-methyl-6[a-(2,4-di-t-amylphenoxy) butylamide]phenol to a build-up of 1 mg/dm$^2$, 2-(2,3,4,5,6-pentafluorophenyl) acylamino-4-chloro-5-a-(2,4-di-tert-amylphenoxy) pentylamide] to a build-up of 3 mg/dm$^2$, dioctylphthalate to a build-up of 2 mg/dm$^2$and red-sensitive silver chloride/bromide emulsion to a build-up of 3 mg/dm$^2$ in terms of silver. Sixth layer: Intermediate layer As an ultraviolet absorbent, the sixth layer was coated with 2 -(2'-hydroxy-3',5'-di-t-amylphenyl)-benzotriazol to a build-up of 2 mg/dm$^2$, 2-(2'-hydroxy-3',5'-di-t-butylphenyl)benzotriazol to a build-up of 2 mg/dm$^2$, dioctylphthalate to a build-up of 2 mg/dm$^2$ and gelatin to a build-up of 5 mg/dm$^2$. Seventh layer: Protective layer The seventh laye aws coated with gelatin to a build-up of 9 mg/dm$^2$.

The sample thus prepared is named sample 29. Then a magenta coupler, metal complex and compound represented by formula [a-1] or [a-2] (the amount of the metal comlex and the compound represented by formula [a-1] or [a-2] was 0.5 mol for one mol of coupler) were added in the combination shown in Table 2. Following that, samples 30 thru 56 similar to sample 29 but not subjected to such addition were prepared.

The samples were subjected to the same exposure test as conducted with Example 1. Each of the samples then underwent light resistance measurements as with Example 1.

In addition, each of the samples was tested for an increase in the time-dependent fogging value during storage in the following manner:

<Time-dependent fogging vlaue increase test>

Each coated sample was stored in a thermostatic oven which was maintianed at 77 degrees C. without humidifying for six days. Following that, the sample was checked for green light reflection density of the white portion. The increased density of fogging value was assumed to be equal to the difference of green light reflection density of the white portion before storage in the thermostatic oven from that after storage in the oven. The result is shown in Table 2.

TABLE 2

| Sample No. | Magenta Coupler | Metal-Complex | Singlet Oxygen Q.R.C. | Compound of [a-1] or [a-2] | Fastness Fading Ratio (%) | Fog Density of Unexposed Sample |
|---|---|---|---|---|---|---|
| 29 (Comp.) | 44 | None | — | None | 80 | 0.04 |
| 30 (Comp.) | 44 | 16 | $2 \times 10^8$ | None | 45 | 0.11 |
| 31 (Comp.) | 44 | None | — | a-1-47 | 58 | 0.04 |
| 32 (Comp.) | 44 | None | — | a-2-1 | 55 | 0.05 |
| 33 (Inv.) | 44 | 16 | $2 \times 10^8$ | a-1-47 | 30 | 0.06 |
| 34 (Inv.) | 44 | 16 | $2 \times 10^8$ | a-2-51 | 30 | 0.04 |
| 35 (Inv.) | 44 | 20 | $2 \times 10^8$ | a-1-47 | 32 | 0.06 |
| 36 (Inv.) | 44 | 20 | $2 \times 10^8$ | a-2-51 | 33 | 0.04 |
| 37 (Inv.) | 44 | 22 | $2 \times 10^8$ | a-1-47 | 32 | 0.06 |
| 38 (Inv.) | 44 | 22 | $2 \times 10^8$ | a-2-51 | 33 | 0.05 |
| 39 (Inv.) | 44 | 35 | $3 \times 10^9$ | a-1-47 | 34 | 0.06 |
| 40 (Inv.) | 44 | 35 | $3 \times 10^9$ | a-2-51 | 32 | 0.04 |
| 41 (Inv.) | 44 | 57 | $3 \times 10^9$ | a-1-47 | 33 | 0.06 |
| 42 (Inv.) | 44 | 57 | $3 \times 10^9$ | a-2-51 | 33 | 0.04 |
| 43 (Inv.) | 44 | 105 | $3 \times 10^9$ | a-1-47 | 31 | 0.07 |
| 44 (Inv.) | 44 | 105 | $3 \times 10^9$ | a-2-51 | 31 | 0.05 |
| 45 (Inv.) | 44 | 127 | $3 \times 10^9$ | a-1-47 | 34 | 0.06 |
| 46 (Inv.) | 44 | 127 | $3 \times 10^9$ | a-2-51 | 33 | 0.04 |
| 47 (Inv.) | 44 | 16 | $2 \times 10^8$ | a-1-19 | 35 | 0.05 |
| 48 (Inv.) | 44 | 16 | $2 \times 10^8$ | a-2-1 | 37 | 0.04 |
| 49 (Inv.) | 44 | 16 | $2 \times 10^8$ | a-1-49 | 35 | 0.06 |
| 50 (Inv.) | 44 | 16 | $2 \times 10^8$ | a-2-2 | 35 | 0.04 |
| 51 (Inv.) | 44 | 16 | $2 \times 10^8$ | a-1-58 | 34 | 0.06 |
| 52 (Inv.) | 44 | 16 | $2 \times 10^8$ | a-2-8 | 32 | 0.05 |
| 53 (Inv.) | 44 | 16 | $2 \times 10^8$ | a-1-65 | 33 | 0.06 |
| 54 (Inv.) | 44 | 16 | $2 \times 10^8$ | a-2-22 | 33 | 0.04 |
| 55 (Inv.) | 44 | 16 | $2 \times 10^8$ | a-1-75 | 33 | 0.06 |
| 56 (Inv.) | 44 | 16 | $2 \times 10^8$ | a-2-33 | 30 | 0.04 |

(Note) Q.R.C refers to Quenching Rate Constant.

From the data listed in Table 2, it is apparent that, if a metal complex is added to the magenta coupler layer (sample 30), increased light resistance is achieved but the increase in the fogging value of the sample during raw storage becomes significantly high. It is also found that, if a compound represented by formula [a-1] or [a-2] is added to the magenta coupler layer (Sample 31 and 32), the increase in the fogging value during raw storage becomes negligible but lower light resistance results. By contrast, samples 33 thru 56 as implemented according to the subject invention provide significantly high light resistance while giving a very low increase in the fogging value during raw storage.

EXAMPLE 3

Sampels 57 thru 73 similar to Samples 33 and 34 of Example 2 were prepared. The differences are that the new samples had the metal complex and organic solvent listed in Table 3 added to the magenta coupler layer, and that an anti-oxidant (0.5 mol for one mol of coupler) or a compound represented by formula [a-1] and [a-2] were added in combination. Each of the samples thus prepared was subjected to light resistance tests and fogging value measurements as with Example 2. The result is shown in Table 3.

TABLE 3

| Sample No. | Metal-Complex | Anti-Oxidant | Organic Solvent | Compound of [a-1] or [a-2] | Fastness Fading Ratio (%) | Fog in Unexposed Sample |
|---|---|---|---|---|---|---|
| 33 (Inv.) | 16 | — | DOP | a-1-47 | 30 | 0.06 |
| 34 (Inv.) | 16 | — | DOP | a-2-51 | 30 | 0.04 |
| 57 (Inv.) | 16 | — | DNP | a-1-47 | 29 | 0.06 |
| 58 (Inv.) | 16 | — | DNP | a-2-51 | 31 | 0.05 |
| 59 (Inv.) | 16 | — | TNP | a-1-47 | 30 | 0.06 |
| 60 (Inv.) | 16 | — | TNP | a-2-51 | 31 | 0.04 |
| 61 (Inv.) | 16 | — | DELA | a-1-47 | 37 | 0.07 |
| 62 (Inv.) | 16 | — | DELA | a-2-51 | 37 | 0.05 |
| 63 (Inv.) | 16 | — | DMP | a-1-47 | 38 | 0.07 |
| 64 (Inv.) | 16 | — | DMP | a-2-51 | 39 | 0.05 |
| 65 (Inv.) | 16 | A-8 | DOP | a-1-47 | 24 | 0.06 |
| 66 (Inv.) | 16 | A-8 | DOP | a-2-51 | 23 | 0.04 |
| 67 (Inv.) | 16 | A-13 | DOP | a-1-47 | 24 | 0.06 |
| 68 (Inv.) | 16 | A-13 | DOP | a-2-51 | 22 | 0.04 |
| 69 (Inv.) | 16 | B-35 | DOP | a-1-47 | 25 | 0.06 |
| 70 (Inv.) | 16 | B-35 | DOP | a-2-51 | 24 | 0.04 |
| 71 (Comp.) | Comp. | — | DOP | a-1-47 | 55 | 0.07 |
| 72 (Comp.) | Comp. | — | DOP | a-2-51 | 55 | 0.05 |
| 73 (Inv.) | 16 | — | DOP | a-1-47<br>a-2-51 | 20 | 0.04 |

(Notes)
1. Chemical Structure of Comparative Metal Complex is:

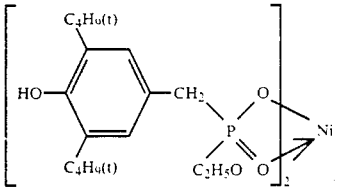

(Singlet Oxygen Quenching Rate Constant: 2.2 × $10^7$ $M^{-1}$ $sec^{-1}$)
2. In Table 3, as the organic solvent DOP refers to dioctyl phthalate, DNP to dinonyl phthalate, TNP to trinonyl phosphate, DELA to diethyllauric acid amide and DM to dimethyl phthalate, respectively.

(Singlet Oxygen Quenching Rate Constant: $2.2\times10^7$ $M^{-1}$ $sec^{-1}$)

2. In Table 3, as the organic solvent DOP refers to dioctyl phthalate, DNP to dinonyl phthalate, TNP to trinonyl phosphate, DELA to diethyllauric acid amide and DM to dimethyl phthalate, respectively.

As is apparente from the result listed in Table 3, Samples 57 thru 70 and 73 described under the subject invention has significantly high light resistance and a very little increase in the fogging value of raw samples during storage.

Samples 57 thru 70 using an anti-oxidant as another additive and sample 73 using compound represented by formula [a-1] and [a-2] in combination provides synergistically improved light resistance.

A comparison among smaples 33, 34 and 57 thru 64 teaches that higher light resistance is obtained where an organic solvent having a lower dielectric constant is employed.

What is claimed is:

1. A light-sensitive silver halide photographic material comprising a support having provided thereon at least one silver halide emulsion layer, wherein at least one layer of said silver halide emulsion layer contains a compound represented by General Formula [I],

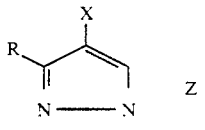

[I]

(wherein Z represents a group of non-metallic atoms necessary to complete a nitrogen-containing heterocyclic ring which may have a substituent; X represents a hydrogen atom or a substitutent capable of being split off upon reaction with an oxidation product of a color developing agent; and R represents a hydrogen atom or a substituent), said silver halide emulsion layer containing the compound of Formula [I] further containing a metal complex having a quenching rate constant of singlet oxygen more than $3\times10^7$ $M^{-1}sec^{-1}$, and a compound having the General Formula

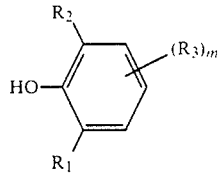

[a-1]

(wherein $R^1$ and $R^2$ are independently selected from an alkyl group; $R^3$ is selected from the group consisting of an alkyl group, a —NR'R" group, a —SR' group and a —COOR" group, in which R' is a monovalent organic group and R" is a hydrogen atom or a monovalent organic group; and m is an integer of 0 to 3); or

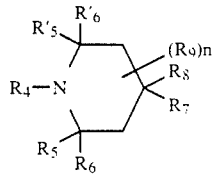

[a-2]

(where $R^4$ is selected from the group consisting of a hydrogen atom, a hydroxyl group, an oxy radical group, —SOR' group, in which R' is a monovalent organic group, a $—SO_2R''$ group, in which R'' is a hydrogen atom or a monovalent organic group; $R^5$, $R^6$, $R^{5'}$, $R^{6'}$, and $R^9$ are independently selected from an alkyl group; $R^7$ and $R^8$ are independently selected from the group consisting of a hydrogen atom and a $—O-COR^{10}$ group, in which $R^{10}$ is a monovalent organic group, provided that $R^7$ and $R^8$ may be combined with each other to form a heterocyclic group; and n is an integer of 0 to 4).

2. The light-sensitive silver halide photographic material of claim 1, wherein said substituent for R in formula [I] is selected from the group consisting of a halogen atom, an alkyl group, a cycloalkyl group, an alkenyl group, a cycloalkenyl group, an alkynyl group, an aryl group, a heterocyclic group, an acyl group, a sulfonyl group, a sulfiny group, a phosphonyl group, a carbamoyl group, a sulfamoyl group, a cyano group, a spiro compound residua group, a bridged hydrocarbon compound residual group, an alkoxy group, an aryloxy group, a heterocyclic oxy group, a siloxy group, an acyloxy group, a carbamoyloxy group, an amino group, an acylamino group, a sulfonamide group, an imide group, a ureido group, a sulfamoylamino group, an alkoxycarbonylamino group, an aryloxycarbonylamino group, an akoxycarbonyl group, an aryloxycarbonyl group, an alkylthio group, an arylthio group and a heterocyclic thio group.

3. The light-sensitive silver halide photographic material of claim 1, wherein X in formula [I] is selected from the group consisting of a hydrogen atom, a halogen atom and an organic group having a carbon atom, an oxygen atom, a sulfur atom, a nitrogen atom or phosphorus atom through which said organic group is connected with the remainder of the compound.

4. The light-sensitive silver halide photographic material of claim 1, wherein X in formula [I] is selected from the group consisting of a halogen atom, an alkoxy group, an aryloxy group, a heterocyclic oxy group, an acyloxy group, a sulfonyloxy group, an alkoxycarbonyloxy group, an aryloxycarbonyloxy group, an alkyloxalyloxy group, an alkoxyoxalyloxy group, an alkylthio group, an arylthio group, a heterocyclicthio group, an alkyloxythiocarbonylthio group, a group represented by the formula

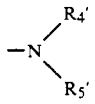

(wherein $R_3'$ and $R_5'$ independently represent a hydrogen atom, an alkyl group, an aryl group, a heterocyclic group, a sulfamoyl group, a carbamoyl group, an acyl group, a sulfonyl group, an aryloxycarbonyl group and an alkoxycarbonyl group provided that $R_4'$ and $R_5'$ are not simultaneously hydrogen atoms and $R_4'$ and $R_5'$ may combine with each other to form a nitrogen-containing heterocyclic group), a carboxyl group, a hydroxymethyl group, a triphenylmethyl group and a group represented by the following formula,

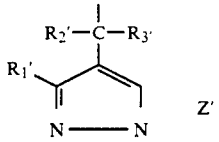

(wherein $R^{1'}$ is defined to be the same as R, Z' is the same as defined for as Z, and $R^{2'}$ and $R^{3'}$ are independently selected from the group consisting of a hydrogen atom, an aryl group, an alkyl group and a heterocyclic group.).

5. The light-sensitive silver halide photographic material of claim 1, wherein said nitrogen-containing heterocyclic ring in formula [I] is selected from the group consisting of a pyrazole ring, an imidazole ring, a triazole ring and a tetrazole ring provided that the above groups may have the same substituent as defined for R in formula [I].

6. The light-sensitive silver halide photographic material of claim 1, wherein said compound represented by general formula [I] is a magenta dye-forming coupler.

7. The light-sensitive silver halide photographic material of claim 6, wherein said magenta dye forming coupler is selected from a compound represented by formula [VII]:

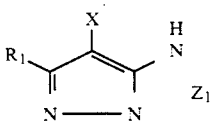

(where R', X and Z' have the same meaning as R, X and Z in formula [I].

8. The light-sensitive silver halide photographic material of claim 6, wherein said magenta dye forming coupler is selected from a compound represented by formulas [II] to [VII]:

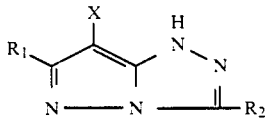

[II]

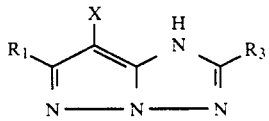

[III]

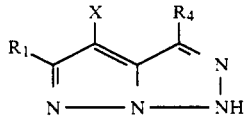

[IV]

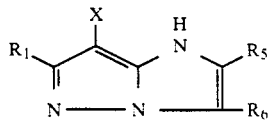

[V]

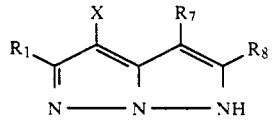

[VI]

-continued

[VII]

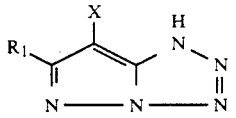

(in the above formulas R′ to $R^8$ have the same meaning as R in formula [I] and X has the same meaning as in formula [I]).

9. The light-sensitive silver halide photographic material of claim 6, wherein said magenta dye forming coupler is selected from a compound represented by formula [XI]:

[XI]

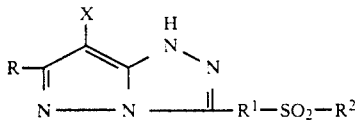

(wherein R and X respectively have the same meaning as in formula [I], R′ is an alkylene group and $R^2$ is selected from the group consisting of an alkyl group, a cyclo alkyl group and an aryl group).

10. The light-sensitive silver halide photographic material of claim 1, wherein said metal complex has a quenching rate constant of singlet oxygen more than $1\times10^8\ M^{-1}.\ sec^{-1}$.

11. The light-sensitive silver halide photographic material of claim 1, wherein said metal complex is selected from a compound represented by formulas [XII] to [XV]:

[XII]

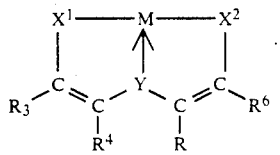

[XIII]

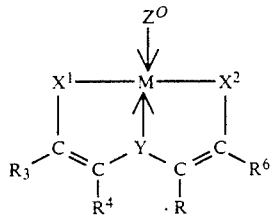

-continued

[XIV]

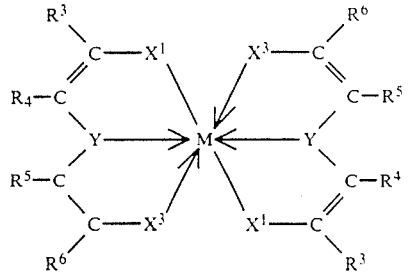

[XV]

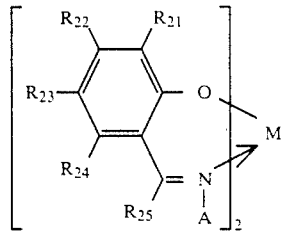

(in formulas [XII] to [XV], M represents a metal atom; $X^1$ and $X^2$ are independently selected from oxygen atom, sulfur atom and a —$NR^7$—group, in which $R^7$ is selected from the group consisting of hydrogen atom, an alkyl group, an aryl group and a hydroxyl group; $X^3$ is selected from the group consisting of a hydroxyl group and a mercapto group; Y is selected from oxygen atom and sulfur atom; $R^3$, $R^4$, $R^5$ and $R^6$ are independently selected from the group consisting of hydrogen atom, a halogen atom, a cyano group, an alkyl group an aryl group, a cycloalkyl group, a heterocyclic group, an alkyl group which connects with the carbon atom of the formulas through a divalent group, an aryl group which connects with the carbon atom of the formulas through a divalent group, a cycloalkyl group which connects with the carbon atom of the formulas through a divalent group and a heterocyclic group which connects with the carbon atom of the formulas through a divalent group provided that either $R^3$ and $R^4$ or $R^5$ and $R^6$ may be combined with each other to form a 5-membered or 6-membered ring together with the carbon atom to which $R^3$ and $R^4$ or $R^5$ and $R^6$ are commonly connected; $Z^0$ is a compound which is capable of being a ligand to M or a residual group thereof; $R^{21}$, $R^{22}$, $R^{23}$ and $R^{24}$ are independently selected from the group consisting of a hydrogen atom, a halogen atom, a hydroxyl group, a cyano group, an alkyl group which connects with the carbon atom of the formulas through a divalent group, an aryl group which connects with the carbon atom of the formulas through a divalent group, a cycloalkyl group which connects with the carbon atom of the formulas through a divalent group and a heterocyclic group which connects with the carbon atom of the formulas through a divalent group provided that either $R^{21}$ and $R^{22}$, $R^{23}$ and $R^{24}$ or $R^{25}$ and $R^{26}$ may be combined with each other to form a 6-membered ring; $R^{25}$ is selected from the group consisting of a hydrogen atom, an alkyl group and an aryl group; and A is selected from a hydrogen atom, an alkyl group, an aryl group and a hydroxyl group).

12. The light-sensitive silver halide photographic material of claim 11, wherein M is a transition metal atom.

13. The light-sensitive silver halide photographic material of claim 11, wherein M is selected from nickel, copper, iron, cobalt, palladium and platinum.

14. The light-sensitive silver halide photographic material of claim 11, wherein M is nickel.

* * * * *